US005578405A

United States Patent [19]

Ikegami et al.

[11] Patent Number: 5,578,405

[45] Date of Patent: Nov. 26, 1996

[54] ELECTROPHOTOGRAPHIC PHOTOCONDUCTOR CONTAINING DISAZO AND TRISAZO PIGMENTS

[75] Inventors: Takaaki Ikegami; Eiji Kurimoto; Takashi Rokutanzono, all of Numazu; Katsuichi Ohta, Mishima; Masaomi Sasaki, Susono; Yasuo Suzuki, Fuji; Kaoru Tadokoro, Yamato; Megumi Kawahara, Yokohama; Masayuki Koyano, Sagamihara, all of Japan

[73] Assignee: Ricoh Company, Tokyo, Japan

[21] Appl. No.: 323,347

[22] Filed: Oct. 14, 1994

[30] Foreign Application Priority Data

| | | | |
|---|---|---|---|
| Oct. 14, 1993 | [JP] | Japan | 5-280543 |
| Dec. 11, 1993 | [JP] | Japan | 5-341779 |
| Dec. 30, 1993 | [JP] | Japan | 5-354295 |
| Dec. 30, 1993 | [JP] | Japan | 5-354296 |
| Jul. 26, 1994 | [JP] | Japan | 6-193563 |

[51] Int. Cl.[6] ..... G03G 5/06

[52] U.S. Cl. ..... 430/59; 430/76; 430/78; 430/83

[58] Field of Search ..... 430/73, 76, 78, 430/59

[56] References Cited

U.S. PATENT DOCUMENTS

| | | | |
|---|---|---|---|
| 4,810,607 | 3/1989 | Matsumoto et al. | 430/73 |
| 4,957,838 | 9/1990 | Aruga et al. | 430/59 |
| 4,959,290 | 9/1990 | Aruga et al. | 430/73 |
| 4,965,157 | 10/1990 | Hashimoto et al. | 430/80 |
| 4,992,350 | 2/1991 | Sasaki et al. | 430/74 |
| 4,995,362 | 2/1991 | Sasaki et al. | 564/315 |
| 5,047,590 | 9/1991 | Shimada et al. | 564/309 |
| 5,072,061 | 12/1991 | Sasaki et al. | 568/931 |
| 5,077,164 | 12/1991 | Ueda et al. | 430/73 |
| 5,097,022 | 3/1992 | Sasaki et al. | 534/759 |
| 5,098,807 | 3/1992 | Shimada et al. | 430/59 |
| 5,162,181 | 11/1992 | Fujimoto et al. | 430/73 |
| 5,166,438 | 11/1992 | Hashimoto et al. | 564/374 |
| 5,219,692 | 6/1993 | Shimada et al. | 430/59 |
| 5,233,090 | 8/1993 | Shimada et al. | 564/426 |
| 5,260,156 | 11/1993 | Hashimoto et al. | 430/59 |
| 5,334,470 | 8/1994 | Shimada et al. | 430/59 |
| 5,344,985 | 9/1994 | Tanaka et al. | 564/426 |
| 5,350,653 | 9/1994 | Shoshi et al. | 430/58 |

*Primary Examiner*—John Goodrow

*Attorney, Agent, or Firm*—Oblon, Spivak, Mcclelland, Maier, & Neustadt, P.C.

[57] ABSTRACT

An electrophotographic photoconductor includes an electroconductive support and a single-layered photoconductive layer formed thereon, containing a charge transporting material, a binder resin, and a simultaneously pulverized mixture including at least one disazo pigment of formula (1) and at least one trisazo pigment of formula (2), which is obtained by simultaneously pulverizing those azo pigments:

(1)

(2)

wherein $R^1$ and $R^2$ each is hydrogen, a halogen atom, trifluoromethyl group, nitro group or cyano group; $R^3$ is hydrogen, chlorine, fluorine, iodine, bromine, nitro group or cyano group; and $Ar^1$, $Ar^2$ and $Ar^3$ each is a coupler radical, which may be the same or different.

55 Claims, 4 Drawing Sheets

ELECTROPHOTOGRAPHIC PHOTOCONDUCTOR CONTAINING DISAZO AND TRISAZO PIGMENTS

BACKGROUND OF THE INVENTION

1. Field of the Invention

The present invention relates to an electrophotographic photoconductor and, more particularly to a single-layered organic electrophotographic photoconductor for use in electrophotographic copying machines and printers.

2. Discussion of Background

Inorganic photoconductive materials such as selenium, zinc oxide and cadmium sulfide; organic photoconductive materials such as azo pigments; and amorphous silicon, are conventionally known as photoconductive materials for use in electrophotographic photoconductors. However, the inorganic photoconductive materials have the drawbacks in photosensitivity, thermal stability, durability, impact resistance, and toxicity. For instance, selenium easily tends to crystallize, for example, when inappropriately heated, so that the characteristics readily deteriorate. A photoconductor employing cadmium sulfide or zinc oxide as a photoconductive material has humidity resistance and durability. The organic photoconductive materials can easily be made into a film with much more design freedom than the inorganic photoconductive materials because of the superior film-forming properties of the organic photoconductive materials.

In addition, the organic photoconductive materials are cheaper and cause no environmental pollution problems, so that electrophotographic photoconductors using the organic photoconductive materials have been actively developed in recent years.

Photoconductors comprising such organic photoconductive materials may be classified into two types, that is, a function-separated type photoconductor comprising a charge generation layer and a charge transport layer which are laminated, and a single-layered photoconductor comprising a photoconductive layer in which a charge generating material is dispersed in a binder resin.

In particular, many function-separated type photoconductors are put to practical use because of their superiority in photosensitivity.

For example, a function-separated laminated photoconductor comprising Chloro Diane Blue and a hydrazone compound in combination is proposed in Japanese Patent Publication 55-42380. Charge generating materials for use in such a function-separated laminated photoconductor are disclosed in Japanese Laid-Open Patent Applications 53-133445, 54-21728 and 54-22834; and charge transporting materials are disclosed in Japanese Laid-Open Patent Applications 58-198043 and 58-199352.

When preparing a laminated photoconductor, however, it is necessary to severely control the thickness of a charge generation layer within a range of 0.1 to 1.0 μm for obtaining high photosensitivity. Such thickness control of the charge generation layer is susceptible to the surface conditions of an electroconductive support on which the charge generation layer is provided, and to the ambient conditions while a charge generation coating liquid is applied onto the support. Furthermore, for the preparation of such a laminated photoconductor comprising the charge generation layer and the charge transport layer, at least two coating steps are required. These factors largely affect the yield and manufacturing cost of the photoconductor.

For obtaining a laminated photoconductor with high photosensitivity, a charge transporting material with high electric charge mobility is demanded for use in the charge transport layer. Charge transporting materials with high electric charge mobility are almost limited to compounds which exhibit positive hole transporting characteristics. Therefore, photoconductors for use in practice are necessarily limited to photoconductors of a negative charging type, which are referred to as negatively-chargeable photoconductors.

Most of negatively-chargeable photoconductors are charged by use of corona charge with a negative polarity, so that a large amount of ozone is generated. The thus generated ozone is harmful to the human body, and impairs the photoconductor itself by the reaction with ozone, thereby shortening the life thereof. To prevent the generation of ozone, there are proposed a charging system capable of hindering the generation of ozone, a special system for decomposing the ozone discharged from a charging unit, and a special ozone exhaust system for removing ozone built up in an electrophotographic copying machine. Although some of these systems have been put to practical use, such systems have the shortcomings that they will make electrophotographic process complicated.

On the other hand, the single-layered electrophotographic photoconductors are generally known as positively-chargeable photoconductors. For example, there are proposed a photoconductor comprising polyvinyl carbazole and 2,4,7-trinitro-9-fluorenone in Japanese Patent Publication 50-10496; a photoconductor comprising a polyvinyl carbazole which is sensitized with a pyrylium salt-based pigment in Japanese Patent Publication 48-25658; a photoconductor comprising as a main component a eutectic complex; a photoconductor comprising a charge generating material and a charge transporting material in Japanese Laid-Open Patent Application 47-30330; photoconductors comprising a perylene pigment and a charge transporting material in Japanese Laid-Open Patent Applications 63-271461, 1-118143 and 3-65961; and a photoconductor comprising a phthalocyanine compound and a binder resin in Japanese Laid-Open Patent Application 3-65961.

However, the above-mentioned conventional single-layered photoconductors are still inferior in photosensitivity to the laminated photoconductors and the photosensitivity thereof is insufficient for use in practice.

In line with the recent trend of function-composition and improvement of copying machine, photoconductors capable of coping with a copying machine provided with both analog and digital functions have been developed. More specifically, to cope with the digital function of copying machine, it is desired that the photoconductor be highly photosensitive in a region with a wavelength of light from LD laser power source, namely, in the near infrared region; and to cope with the analog function of copying machine, it is required that the photoconductor be highly photosensitive in a region with the wavelength of white light, namely, in the visible region.

Function-separated laminated photoconductors which have a broad spectral sensitivity ranging from the visible region through the near infrared region are disclosed in Japanese Laid-Open Patent Applications 63-236047, 63-243950, 63-243951 and 1-315752, each of which comprises a mixture of a pigment having photosensitivity in the visible region and a pigment having photosensitivity in the near infrared region.

However, the charge transport layer is generally provided on the charge generation layer comprising the above-mentioned pigments and the charge transporting material contained in the charge transport layer absorbs light, so that the photosensitivity to light with a short wavelength of the function-separated laminated photoconductor is low. Thus, the spectral sensitivities of the conventional laminated photoconductors from the visible region to the near infrared region are not always sufficient for use in practice.

In addition, the laminated photoconductor has the optical problem of generation of interference light because of the presence of an interface between the charge generation layer and the charge transport layer.

SUMMARY OF THE INVENTION

It is therefore an object of the present invention to provide a single-layered electrophotographic photoconductor having high photosensitivities in a broad wave range including a visible region through a near infrared region, and having excellent performance stability and improved charging characteristics even when used repeatedly in electrophotographic image formation, which can be manufactured at a low cost.

The above object of the present invention can be attained by an electrophotographic photoconductor comprising an electroconductive support and a single-layered photoconductive layer formed thereon, comprising a charge transporting material, a binder resin, and a simultaneously pulverized mixture comprising at least one disazo pigment of formula (1) and at least one trisazo pigment of formula (2), which is obtained by simultaneously pulverizing the disazo pigment and the trisazo pigment:

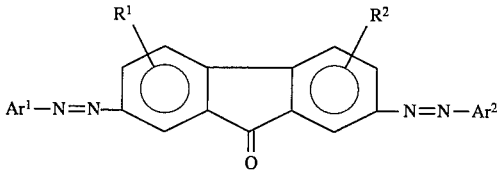

(1)

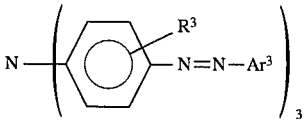

(2)

wherein $R^1$ and $R^2$ each is hydrogen, a halogen atom, trifluoromethyl group, nitro group or cyano group; $R^3$ is hydrogen, chlorine, fluorine, iodine, bromine, nitro group or cyano group; and $Ar^1$, $Ar^2$ and $Ar^3$ each is a coupler radical, which may be the same or different, and is selected from the group consisting of coupler radicals of formulas (3) to (10):

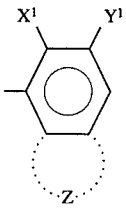

(3)

wherein $X^1$ is —OH, —$N(R^4)(R^5)$, or —$NHSO_2R^6$, in which $R^4$ and $R^5$ each is hydrogen, an acyl group or an alkyl group which may have a substituent, and $R^6$ is an aryl group which may have a substituent; $Y^1$ is hydrogen, a halogen atom, an alkyl group which may have a substituent, an alkoxyl group, a carboxyl group, a sulfone group, a benzimidazolyl group, a sulfamoyl group which may have a substituent, or —$CON(R^7)(Y^2)$, in which $R^7$ is hydrogen, an alkyl group which may have a substituent, or a phenyl group which may have a substituent, and $Y^2$ is a cyclic hydrocarbon group which may have a substituent, a heterocyclic group which may have a substituent, or —$N{=}C(R^8)(R^9)$, in which $R^8$ is a cyclic hydrocarbon group which may have a substituent, a heterocyclic group which may have a substituent, or a styryl group which may have a substituent, $R^9$ is hydrogen, an alkyl group which may have a substituent, or a phenyl group which may have a substituent, and $R^8$ and $R^9$ may form a ring in combination with a carbon atom to which $R^8$ and $R^9$ are bonded; and Z is a cyclic hydrocarbon group which may have a substituent, or a heterocyclic group which may have a substituent;

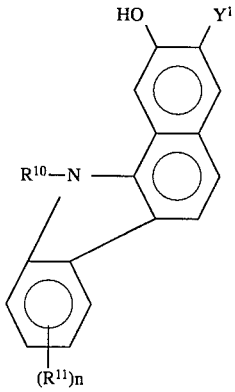

(4)

wherein n is an integer of 1 to 4; $R^{10}$ is hydrogen, an alkyl group which may have a substituent, or an aryl group which may have a substituent; $R^{11}$ is hydrogen, an alkyl group which may have a substituent, an alkoxyl group which may have a substituent, an alkylsulfonyl group which may have a substituent, an alkylmercapto group which may have a substituent, a halogen atom, an aryl group which may have a substituent, an acyl group which may have a substituent, cyano group, nitro group, or an amino group which may have a substituent, and when n is 2, 3 or 4, $R^{11}$ may be the same or different; and $Y^1$ is the same as defined in formula (3);

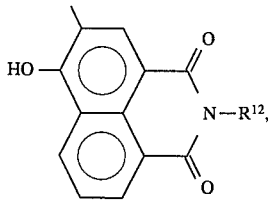

(5)

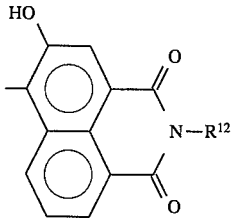

(6)

wherein $R^{12}$ in formulas (5) and (6) is a hydrocarbon group which may have a substituent;

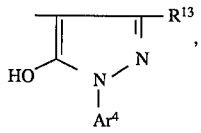

(7)

-continued

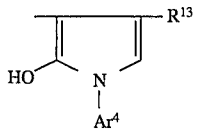

(8)

wherein $R^{13}$ in formulas (7) and (8) is an alkyl group, a carbamoyl group, a carboxyl group or an ester group thereof; and $Ar^4$ is an aromatic hydrocarbon group which may have a substituent;

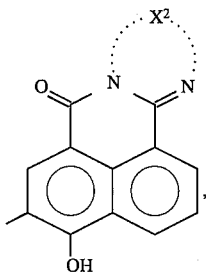

(9)

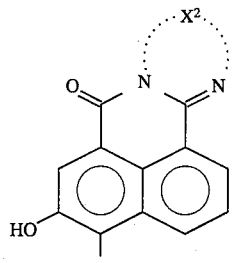

(10)

wherein $X^2$ in formulas (9) and (10) is a bivalent aromatic hydrocarbon group or a bivalent heterocyclic group.

In the first mentioned electrophotographic photoconductor, the charge transporting material may be an organic positive hole transporting material, or may comprise an organic positive hole transporting material and an organic acceptor compound.

When the electrophotographic photoconductor comprise an organic positive hole transporting material and an organic acceptor compound, the organic acceptor compound may have a reduction potential in a range of −0.2 to −1.2 v (vs SCE).

In the first mentioned electrophotographic photoconductor, the single-layered photoconductive layer may further comprise an antioxidant.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DETAILED DESCRIPTION OF THE PREFERRED EMBODIMENTS

Figure 1:
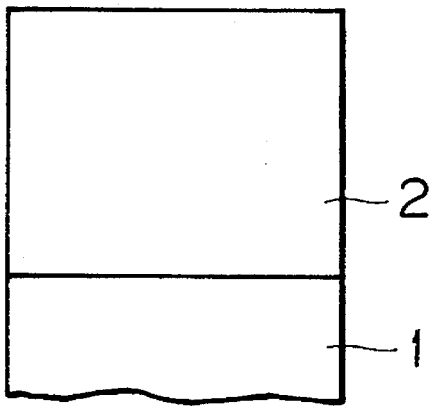
FIG. 1 is a schematic cross-sectional view of a first embodiment of an electrophotographic photoconductor according to the present invention, which comprises an electroconductive layer and a photoconductive layer formed on the electroconductive layer.

In the electrophotographic photoconductor according to the present invention, a disazo pigment having the sensitivity to the visible region, and a trisazo pigment having the sensitivity to the light with a wavelength of 700 nm or more, namely, to the near infrared rays, are simultaneously mixed and pulverized, and the thus simultaneously pulverized mixture is contained in a single-layered photoconductive layer.

The thus formed photoconductor exhibits high photosensitivities in a broad region, from the visible region to the near infrared region.

The photosensitivities of the disazo pigment and the trisazo pigment can be remarkably increased by simultaneously pulverizing and mixing these pigments together with the application of some mechanical energy thereto, as compared with the case where the abovementioned two kinds of pigments are merely contained in the photoconductive layer. Such a sensitizing effect can be proved by examples to be described later.

The mixing ratio of the disazo pigment to the trisazo pigment for use in the present invention can be determined depending upon the kinds of disazo pigment and trisazo pigment employed, and upon the characteristics required for the obtained photoconductor, such as photosensitivity, charging characteristics, and resistance to gases.

Generally, however, it is preferable that the mixing ratio of the disazo pigment to the trisazo pigment in terms of (Disazo Pigment)/(Disazo Pigment+Trisazo Pigment) be in a range of 0.01 to 0.99, namely $0.01 \leqq$(Disazo Pigment)/(Disazo Pigment+Trisazo Pigment)$\leqq 0.99$.

A sufficiently high sensitizing effect can be obtained effectively when the above ratio is 0.01 or more, while the sensitizing effect and the resistance to gases can be improved when the ratio is 0.99 or less.

When uniform spectral photosensitivity in the visible region range through the near infrared region is taken into consideration, it is desirable that the above ratio be in the range of 0.1 to 0.9, namely, $0.1 \leqq$(Disazo Pigment)/(Disazo Pigment+Trisazo Pigment)$\leqq 0.9$.

To mix and pulverize the disazo pigment and the trisazo pigment, any pulverizing and mixing methods can be employed as long as mechanical energy, such as compression, shearing, grinding, friction, stretching, shock and vibration may be applied to the pigments. For example, a ball mill, a vibration mill, a disk-vibration mill, an attritor, a sand mill, a paint shaker, a jet mil, and an ultrasonic dispersion mixer are usable. It is recommendable that desired amounts of the disazo pigment and the trisazo pigment be placed in the same container, and simultaneously pulverized and dispersed with the application of the above-mentioned mechanical energy thereto in the presence of a dispersing solvent.

A mixture of the disazo pigment and the trisazo pigment is used as a charge generating material in the electrophotographic photoconductor of the present invention. In particular, a disazo pigment of formula (1), which can efficiently generate electric charges when exposed to light in the visible range of 400 to 700 nm, and a trisazo pigment of formula (2), which has high sensitivity to light with a wavelength of 700 nm or more are employed in the present invention:

[Disazo pigment]

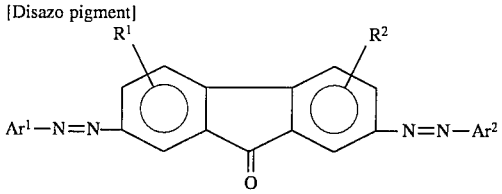

(1)

[Trisazo pigment]

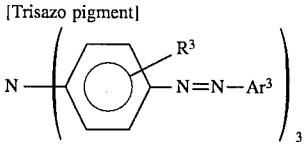

(2)

wherein $Ar^1$, $Ar^2$ and $Ar^3$ each is a coupler radical, which may be the same or different; $R^1$ and $R^2$ each is hydrogen, a halogen, trifluoromethyl group, nitro group or cyano group; and $R^3$ is hydrogen, chlorine, fluorine, iodine, bromine, nitro group or cyano group.

The coupler radical represented by $Ar^1$, $Ar^2$ or $Ar^3$ is selected from the group consisting of coupler radicals of formulas (3) to (10):

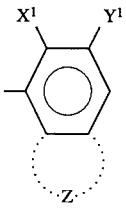

(3)

wherein $X^1$ is —OH, —$N(R^4)(R^5)$, or —$NHSO_2R^6$, in which $R^4$ and $R^5$ each is hydrogen, an acyl group or an alkyl group which may have a substituent, and $R^6$ is an aryl group which may have a substituent; $Y^1$ is hydrogen, a halogen atom, an alkyl group which may have a substituent, an alkoxyl group, a carboxyl group, a sulfone group, a benzimidazolyl group, a sulfamoyl group which may have a substituent, or —$CON(R^7)(Y^2)$, in which $R^7$ is hydrogen, an alkyl group which may have a substituent, or a phenyl group which may have a substituent, and $Y^2$ is a cyclic hydrocarbon group which may have a substituent, a heterocyclic group which may have a substituent, or —$N{=}C(R^8)(R^9)$, in which $R^8$ is a cyclic hydrocarbon group which may have a substituent, a heterocyclic group which may have a substituent, or a styryl group which may have a substituent, $R^9$ is hydrogen, an alkyl group which may have a substituent, or a phenyl group which may have a substituent, and $R^8$ and $R^9$ may form a ring in combination with a carbon atom to which $R^8$ and $R^9$ are bonded; and Z is a cyclic hydrocarbon group which may have a substituent, or a heterocyclic group which may have a substituent;

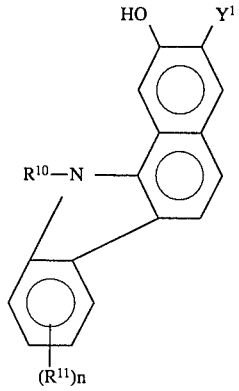

(4)

wherein n is an integer of 1 to 4; $R^{10}$ is hydrogen, an alkyl group which may have a substituent, or an aryl group which may have a substituent; $R^{11}$ is hydrogen, an alkyl group which may have a substituent, an alkoxyl group which may have a substituent, an alkylsulfonyl group which may have a substituent, an alkylmercapto group which may have a substituent, a halogen atom, an aryl group which may have a substituent, an acyl group which may have a substituent, cyano group, nitro group, or an amino group which may have a substituent, and when n is 2, 3 or 4, $R^{11}$ may be the same or different; and $Y^1$ is the same as defined in formula (3);

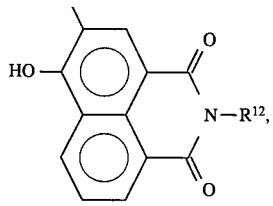

(5)

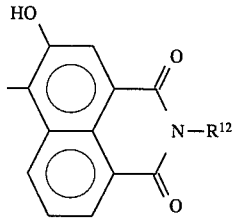

(6)

wherein $R^{12}$ in formulas (5) and (6) is a hydrocarbon group which may have a substituent;

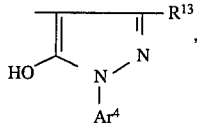

(7)

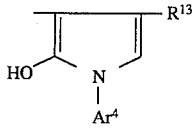

(8)

wherein $R^{13}$ in formulas (7) and (8) is an alkyl group, a carbamoyl group, a carboxyl group or an ester group thereof; and $Ar^4$ is an aromatic hydrocarbon group which may have a substituent;

(9)

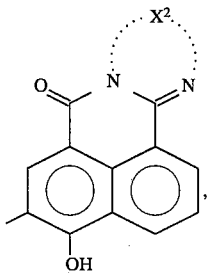

(10)

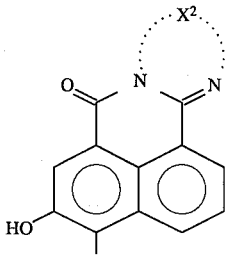

wherein $X^2$ in formulas (9) and (10) is a bivalent aromatic hydrocarbon group or a bivalent heterocyclic group.

Specific examples of the coupler which can be represented by $Ar^1$—H, $Ar^2$—H or $Ar^3$—H for preparation of the disazo pigment of formula (1) and the trisazo pigment of formula (2) are as shown in Table 1 to Table 16.

TABLE 1

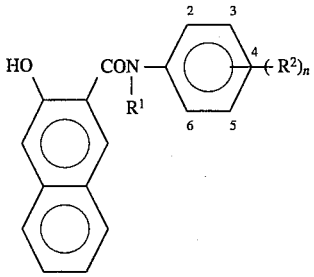

| Coupler No. | $R^1$ | $(R^2)_n$ | Melting Point (°C.) |
|---|---|---|---|
| 1 | H | H | 243–244 |
| 2 | H | 2-$NO_2$ | 194–196 |
| 3 | H | 3-$NO_2$ | 246–247 |
| 4 | H | 4-$NO_2$ | 266–267.5 |
| 5 | H | 2-$CF_3$ | 178–179 |
| 6 | H | 3-$CF_3$ | 237.5-238.5 |
| 7 | H | 4-$CF_3$ | 279–281 |
| 8 | H | 2-CN | 221-222.5 |
| 9 | H | 3-CN | 256.5–258.5 |
| 10 | H | 4-CN | 274.5–277 |
| 11 | H | 2-I | 199–199.5 |
| 12 | H | 3-I | 258.5–259.5 |
| 13 | H | 4-I | 261.5–262 |
| 14 | H | 2-Br | 217–218 |
| 15 | H | 3-Br | 254–255 |
| 16 | H | 4-Br | 265–268 |
| 17 | H | 2-Cl | 228–230 |
| 18 | H | 3-Cl | 256.5–257 |

TABLE 1-continued

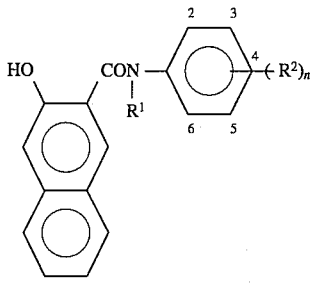

| Coupler No. | $R^1$ | $(R^2)_n$ | Melting Point (°C.) |
|---|---|---|---|
| 19 | H | 4-Cl | 264–266 |
| 20 | H | 2-F | 223.0–224.0 |
| 21 | H | 3-F | 250.0–251.0 |
| 22 | H | 4-F | 265.0–267.0 |
| 23 | H | 2-$CH_3$ | 195.5–198.0 |
| 24 | H | 3-$CH_3$ | 214.5–216.5 |
| 25 | H | 4-$CH_3$ | 227.0–229.0 |
| 26 | H | 2-$C_2H_5$ | 168.5–169.5 |
| 27 | H | 4-$C_2H_5$ | 203.0–204.5 |
| 28 | H | 2-$OCH_3$ | 167–168 |
| 29 | H | 3-$OCH_3$ | 195.5–198.0 |
| 30 | H | 4-$OCH_3$ | 229–230 |
| 31 | H | 2-$OC_2H_5$ | 157–158 |
| 32 | H | 3-$OC_2H_5$ | 188.5–189.0 |
| 33 | H | 4-$OC_2H_5$ | 225.0–225.5 |
| 34 | H | 4-$N(CH_3)_2$ | 232.0–233.5 |
| 35 | $-CH_3$ | H | 189.5–190.5 |
| 36 | 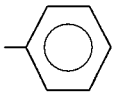 | H | 182.0–183.0 |
| 37 | H | 2-$OCH_3$, 5-$OCH_3$ | 186.0–188.0 |
| 38 | H | 2-$OC_2H_5$, 5-$OC_2H_5$ | 173.0–173.5 |
| 39 | H | 2-$CH_3$, 5-$CH_3$ | 207.0–208.5 |
| 40 | H | 2-Cl, 5-Cl | 253.5–254.5 |
| 41 | H | 2-$CH_3$, 5-Cl | 245–247 |
| 42 | H | 2-$OCH_3$, 4-$OCH_3$ | 151.0–152.0 |
| 43 | H | 2-$CH_3$, 4-$CH_3$ | 226–228 |
| 44 | H | 2-$CH_3$, 4-Cl | 244–245 |
| 45 | H | 2-$NO_2$, 4-$OCH_3$ | 179.5–181.0 |
| 46 | H | 3-$OCH_3$, 5-$OCH_3$ | 180.5–182.0 |
| 47 | H | 2-$OCH_3$, 5-Cl | 219.0–220.0 |
| 48 | H | 2-$OCH_3$, 5-$OCH_3$, 4-Cl | 193.5–195.5 |
| 49 | H | 2-$OCH_3$, 4-$OCH_3$, 5-Cl | 193–194 |
| 50 | H | 3-Cl, 4-Cl | 272.5–273.5 |
| 51 | H | 2-Cl, 4-Cl, 5-Cl | 257.5–258.5 |
| 52 | H | 2-$CH_3$, 3-Cl | 227.5–228.5 |
| 53 | H | 3-Cl, 4-$CH_3$ | 259.5–260.5 |
| 54 | H | 2-F, 4-F | 246.0–246.5 |
| 55 | H | 2-F, 5-F | 259.0–260.0 |
| 56 | H | 2-Cl, 4-$NO_2$ | 283.0–284.0 |
| 57 | H | 2-$NO_2$, 4-Cl | 216.5–227.5 |
| 58 | H | 2-Cl, 3-Cl, 4-Cl, 5-Cl | 280.0–281.5 |
| 59 | H | 4-OH | 268 |

TABLE 2

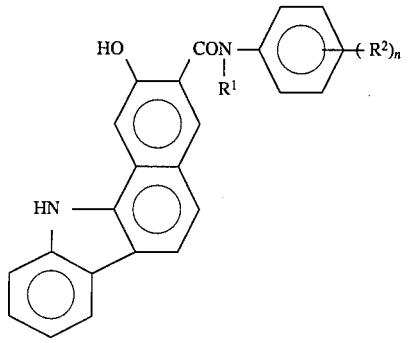

| Coupler No. | $R^1$ | $(R^2)_n$ | Melting Point (°C.) |
|---|---|---|---|
| 60 | H | H | >300 |
| 61 | H | 2-$NO_2$ | 283–284 |
| 62 | H | 3-$NO_2$ | >300 |
| 63 | H | 4-$NO_2$ | >300 |
| 64 | H | 2-Cl | >300 |
| 65 | H | 3-Cl | >300 |
| 66 | H | 4-Cl | >300 |
| 67 | H | 2-$CH_3$ | >300 |
| 68 | H | 3-$CH_3$ | >300 |
| 69 | H | 4-$CH_3$ | >300 |
| 70 | H | 2-$C_2H_5$ | 271–273 |
| 71 | H | 4-$C_2H_5$ | >300 |
| 72 | H | 2-$OCH_3$ | 276–278 |
| 73 | H | 3-$OCH_3$ | >300 |
| 74 | H | 4-$OCH_3$ | >300 |
| 75 | H | 2-$OC_2H_5$ | 273.5–275.0 |
| 76 | H | 4-$OC_2H_5$ | >300 |
| 77 | H | 2-$CH_2$, 4-$OCH_3$ | 296 |

TABLE 2-continued

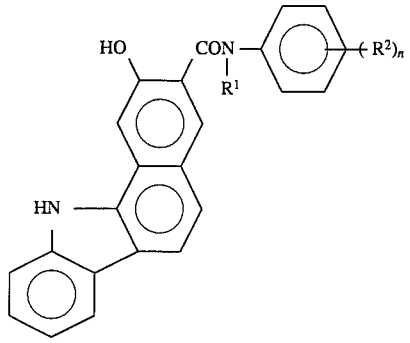

| Coupler No. | $R^1$ | $(R^2)_n$ | Melting Point (°C.) |
|---|---|---|---|
| 78 | H | 2-$CH_3$, 4-$CH_3$ | >300 |
| 79 | H | 2-$CH_3$, 5-$CH_3$ | 274.0–276.0 |
| 80 | H | 2-$CH_3$, 6-$CH_3$ | >300 |
| 81 | H | 2-$OCH_3$, 4-$OCH_3$ | 296.5–298.5 |
| 82 | H | 2-$OCH_3$, 5-$OCH_3$ | 284.5–286.5 |
| 83 | H | 3-$OCH_2$, 5-$OCH_3$ | 300.5–302.0 |
| 84 | H | 2-$CH_3$, 3-Cl | 296.0–297.5 |
| 85 | H | 2-$CH_3$, 4-Cl | >300 |
| 86 | H | 2-$CH_3$, 5-Cl | 290.5–292.0 |
| 87 | H | 4-NH 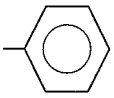 | 304 |
| 88 | H | 2-$CH(CH_3)_2$ | 239.0–240.0 |

TABLE 3

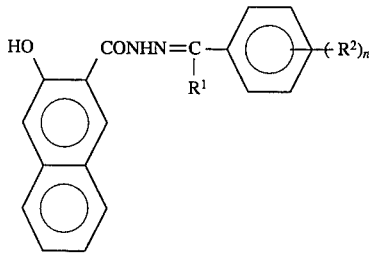

| Coupler No. | $R^1$ | $(R^2)_n$ | Melting Point (°C.) |
|---|---|---|---|
| 89 | H | H | 228.0–230.0 |
| 90 | H | 4-$N(CH_3)_2$ | 238.5–240.0 |
| 91 | H | 2-$OCH_3$ | 218.0–222.0 |
| 92 | H | 3-$OCH_3$ | 186.5–188.5 |
| 93 | H | 4-$OCH_3$ | 224.5–225.0 |
| 94 | H | 4-$OC_2H_5$ | 236.0–237.5 |
| 95 | H | 2-$CH_3$ | 227.0–228.0 |
| 96 | H | 3-$CH_3$ | 212.5–214.0 |
| 97 | H | 4-$CH_3$ | 233.0–236.0 |
| 98 | H | 2-F | 233.0–233.5 |
| 99 | H | 3-F | 248.5 |
| 100 | H | 4-F | 239.5–240.0 |
| 101 | H | 2-Cl | 254.0–255.0 |
| 102 | H | 3-Cl | 226.5–230.0 |
| 103 | H | 4-Cl | 265.5–269.0 |
| 104 | H | 2-Br | 243.0 |
| 105 | H | 3-Br | 231.0–231.5 |
| 106 | H | 4-Br | 259.0 |
| 107 | H | 2-Cl, 4-Cl | 251.5–252.0 |
| 108 | H | 3-Cl, 4-Cl | 260.0–261.0 |

TABLE 3-continued
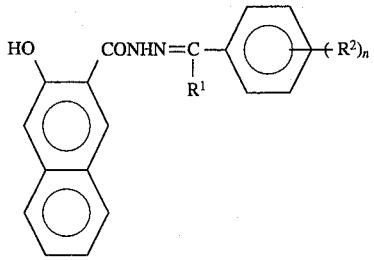
| Coupler No. | $R^1$ | $(R^2)_n$ | Melting Point (°C.) |
|---|---|---|---|
| 109 | H | 2-CN | 175.0–176.5 |
| 110 | H | 4-CN | 267.5–268.0 |
| 111 | H | 2-$NO_2$ | 240.0 |
| 112 | H | 3-$NO_2$ | 255.5–257.0 |
| 113 | H | 4-$NO_2$ | 260.0–261.0 |
| 114 | H | 2-$CH_3$, 4-$CH_3$ | 234.5–236.5 |
| 115 | H | 2-$OCH_3$, 5-$OCH_3$ | 221.5–222.0 |
| 116 | H | 2-$OCH_3$, 3-$OCH_3$ 4-$OCH_3$ | 191.0–192.0 |
| 117 | $-CH_3$ | H | 248.5–250.0 |
| 118 | 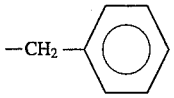 | H | 182.5–185.0 |
| 119 | 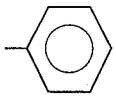 | H | 213.0–214.5 |
| 120 | H | 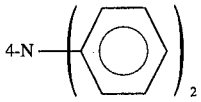 | 237.0–237.5 |
TABLE 4
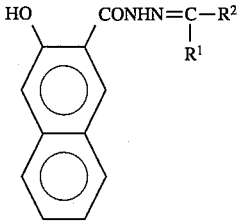
| Coupler No. | $R^1$ | $R^2$ | Melting Point (°C.) |
|---|---|---|---|
| 121 | $-CH_3$ | $-CH_3$ | 232.5–233.0 |
| 122 | H | 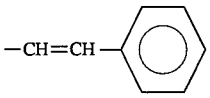 | 208.5–209.0 |
| 123 | H | 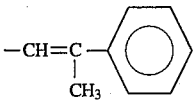 | 224.0–224.5 |
| 124 | H | 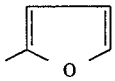 | 197.5–199.0 |
TABLE 4-continued
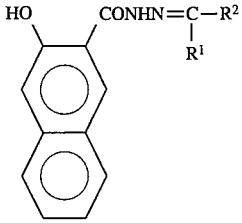
| Coupler No. | $R^1$ | $R^2$ | Melting Point (°C.) |
|---|---|---|---|
| 125 | H | 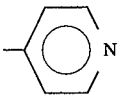 | 188.0–188.5 |
| 126 | H | 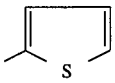 | 227.0–228.0 |
| 127 | $-CH_3$ | 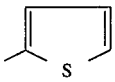 | 225.5–226.0 |

TABLE 4-continued
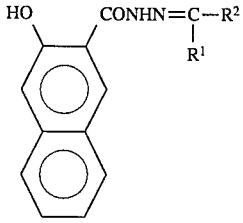
| Coupler No. | $R^1$ | $R^2$ | Melting Point (°C.) |
|---|---|---|---|
| 128 | H | 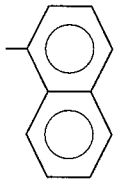 | 212.5–214.0 |
| 129 | H | 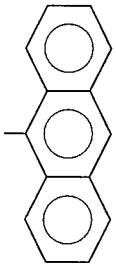 | 257 |
| 130 | H | 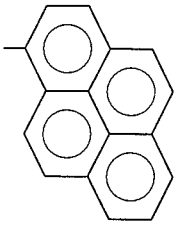 | 250 |
| 131 | H | 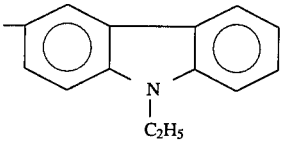  | 232.5–236.0 |
| 132 | H | 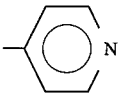  | 240.5–241.5 |
TABLE 5
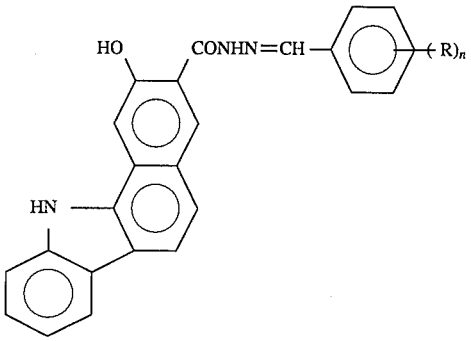
| Coupler No. | $(R)_n$ | Melting Point (°C.) |
|---|---|---|
| 133 | H | >300 |
| 134 | 2-$OCH_3$ | 268 |
| 135 | 3-$OCH_3$ | 281.0–283.0 |
| 136 | 4-$OCH_3$ | 293 |
| 137 | 2-$CH_3$ | 297 |
| 138 | 3-$CH_3$ | 296 |
| 139 | 4-$CH_3$ | >300 |
| 140 | 4-Cl | >300 |
| 141 | 2-$NO_2$ | >300 |
| 142 | 4-$NO_2$ | >300 |
| 143 | 2-OH | >300 |
| 144 | 2-OH, 3-$NO_2$ | >300 |
| 145 | 2-OH, 5-$NO_2$ | >300 |
| 146 | 2-OH, 3-$OCH_3$ | >300 |
TABLE 6
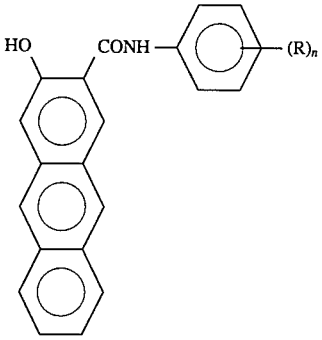
| Coupler No. | $(R)_n$ | Melting Point (°C.) |
|---|---|---|
| 147 | 4-Cl | >300 |
| 148 | 2-$NO_2$ | 268–274 |
| 149 | 3-$NO_2$ | >300 |
| 150 | 4-$NO_2$ | >300 |
| 151 | 4-NH 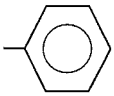 | 296 |
| 152 | H | 300–307 |
| 153 | 2-$OCH_3$ | 242–248 |
| 154 | 3-$OCH_3$ | 269–275 |
| 155 | 4-$OCH_3$ | 312 |
| 156 | 2-$CH_3$ | 265–270 |
| 157 | 3-$CH_3$ | 270–278 |
| 158 | 4-$CH_3$ | 304 |
| 159 | 2-Cl | 283–288 |
| 160 | 3-Cl | 281–287 |

TABLE 7
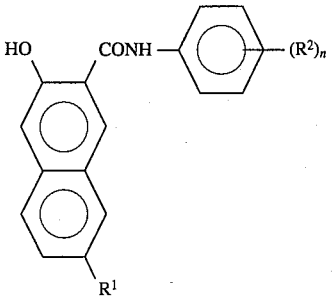
| Coupler No. | $R^1$ | $(R^2)_n$ | Melting Point (°C.) |
|---|---|---|---|
| 161 | H | 2-$OCH_3$, 4-Cl, 5-$CH_3$ | 208.0–208.5 |
| 162 | $-OCH_3$ | H | 230.5–231.5 |
| 163 | $-OCH_3$ | 2-$CH_3$ | 205.5–206.0 |
| 164 | $-OCH_3$ | 2-$OCH_3$, 5-$OCH_3$ 4-Cl | 245.5–246.0 |
TABLE 8
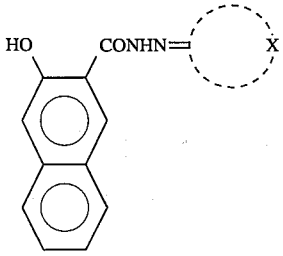
| Coupler No. | X | Melting Point (°C.) |
|---|---|---|
| 165 | 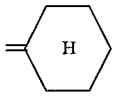 | 207.0–209.0 |
| 166 | 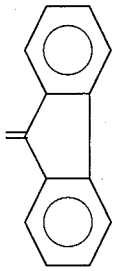 | 257.0–259.0 |
| 167 | 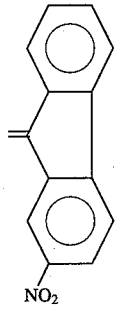 | 290 |
TABLE 9
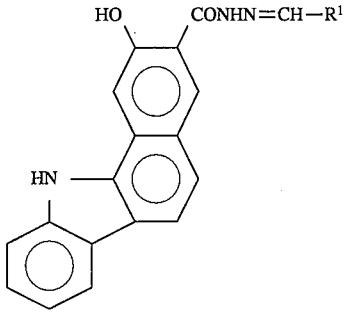
| Coupler No. | $R^1$ | Melting Point (°C.) |
|---|---|---|
| 168 | 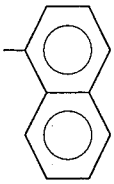 | >300 |
| 169 | 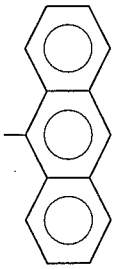 | >300 |
| 170 | 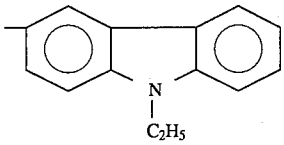 | >300 |
| 171 | 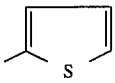 | 298 |

TABLE 10
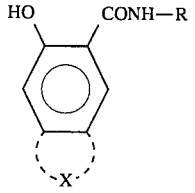
| Coupler No. | X | R | Melting Point (°C.) |
|---|---|---|---|
| 172 | 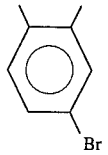 | 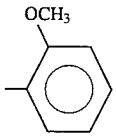 | 180–183 |
| 173 | 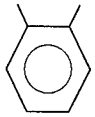 | 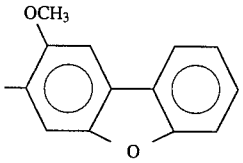 | 228.5–229.5 |
| 174 | 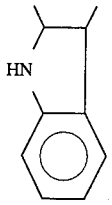 | 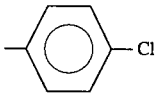 | >262 |
| 175 | 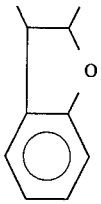 | 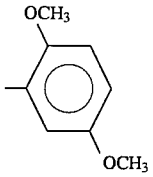 | 226.5–227.0 |
| 176 | 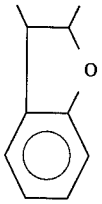 | 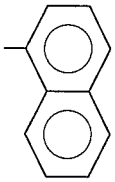 | 308–310 |
| 177 | 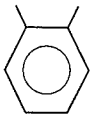 | 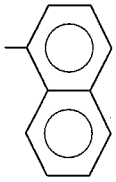 | 222–223 |

TABLE 11
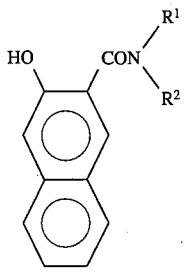
| Coupler No. | $R^1$ | $R^2$ | Melting Point (°C.) |
|---|---|---|---|
| 178 | H | H | 220.5–221.5 |
| 179 | $-CH_3$ | H | 190.5–192.5 |
| 180 | $-CH_3$ | $-CH_3$ | 196.0–198.0 |
| 181 | H | 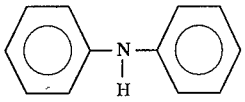 | 222.0–223.0 |
TABLE 12
| Coupler No. | Formula | Melting Point (°C.) |
|---|---|---|
| 182 | 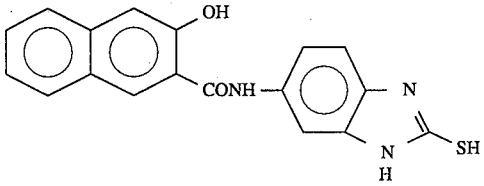 | >300 |
| 183 | 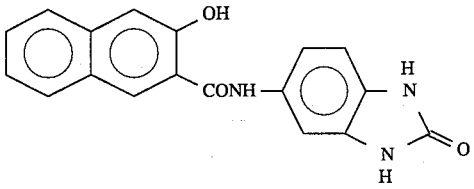 | >300 |
| 184 | 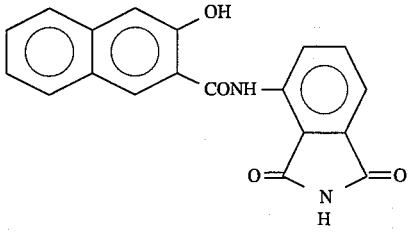 | >300 |
| 185 | 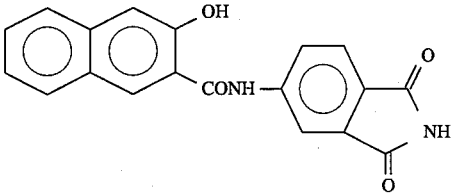 | >300 |

TABLE 12-continued
| Coupler No. | Formula | Melting Point (°C.) |
|---|---|---|
| 186 | 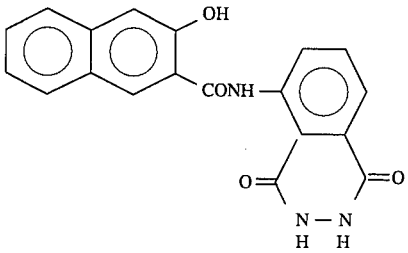 | >300 |
| 187 | 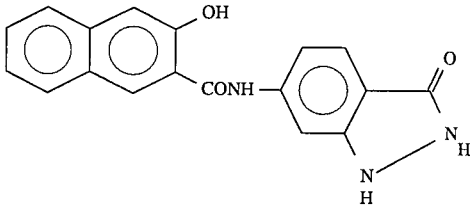 | >300 |
| 188 | 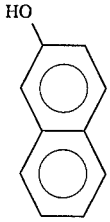 | 122.0–122.5 |
| 189 | 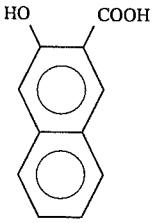 | 222.5–224.0 |
| 190 | 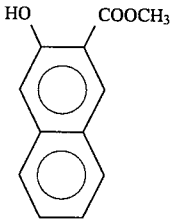 | 74.5–75.5 |
| 191 | 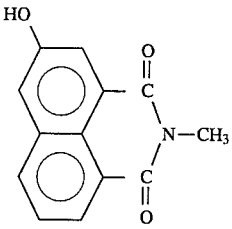 | 275.5–276.5 |

TABLE 12-continued
| Coupler No. | Formula | Melting Point (°C.) |
|---|---|---|
| 192 | 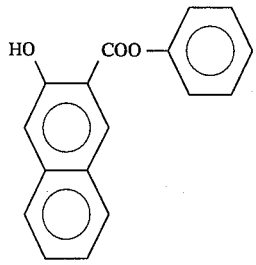 | 130.5–131.5 |
| 193 | 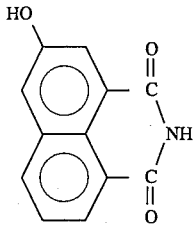 | >300 |
| 194 | 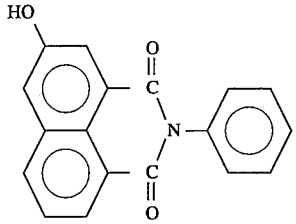 | >300 |
| 195 | 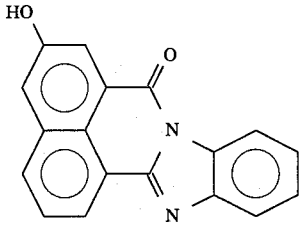 | >300 |
| 196 | 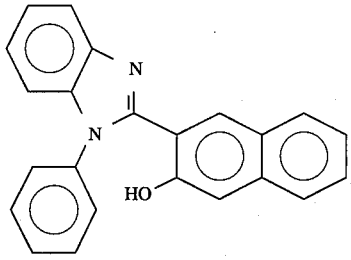 | 172.5–173.5 |
| 197 | 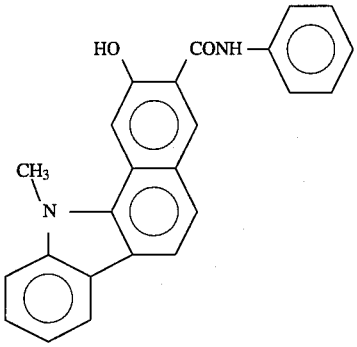 | 262.5–265.5 |

TABLE 12-continued
| Coupler No. | Formula | Melting Point (°C.) |
|---|---|---|
| 198 | 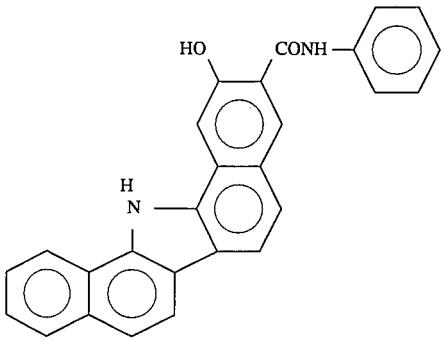 | >300 |
| 199 | 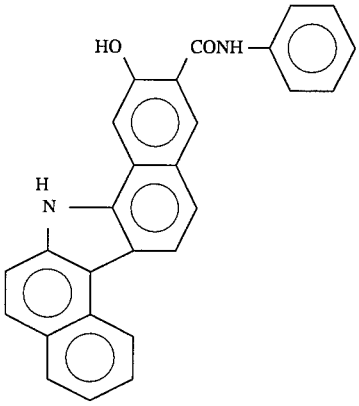 | >300 |
| 200 | 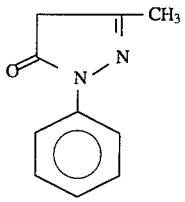 | 128.0–129.0 |
TABLE 13
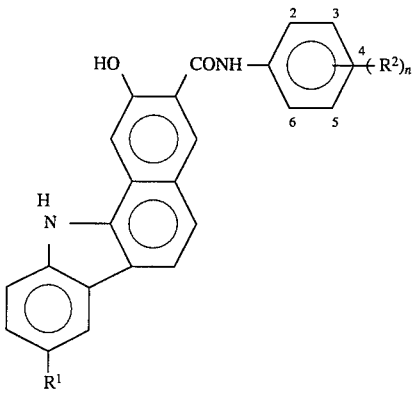
| Coupler No. | $R^1$ | $(R^2)_n$ | Melting Point (°C.) |
|---|---|---|---|
| 201 | Cl | H | >300 |
| 202 | Cl | 2-$OCH_3$ | >300 |
| 203 | Cl | 3-$OCH_3$ | >300 |
TABLE 13-continued
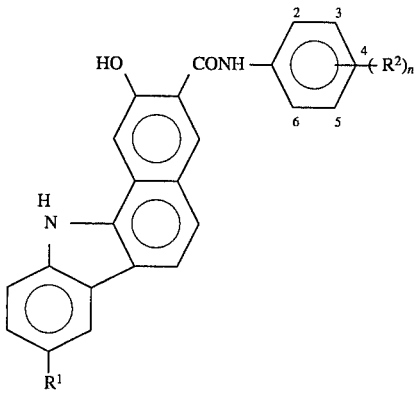
| Coupler No. | $R^1$ | $(R^2)_n$ | Melting Point (°C.) |
|---|---|---|---|
| 204 | Cl | 4-$OCH_3$ | >300 |
| 205 | Cl | 2-$CH_3$ | >300 |
| 206 | Cl | 3-$CH_3$ | >300 |

TABLE 13-continued

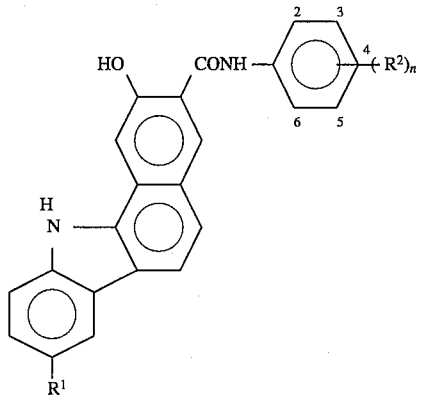

| Coupler No. | $R^1$ | $(R^2)_n$ | Melting Point (°C.) |
|---|---|---|---|
| 207 | Cl | 4-$CH_3$ | >300 |
| 208 | Cl | 2-Cl | >300 |
| 209 | Cl | 3-Cl | >300 |
| 210 | Cl | 4-Cl | >300 |
| 211 | Cl | 2-$NO_2$ | >300 |
| 212 | Cl | 3-$NO_2$ | >300 |
| 213 | Cl | 4-$NO_2$ | >300 |
| 214 | Cl | 2-$CH_3$, 4-Cl | >300 |
| 215 | Cl | 2-$CH_3$, 4-$CH_3$ | >300 |
| 216 | Cl | 2-$C_2H_5$ | 299.0–301.0 |
| 217 | $CH_3$ | H | >300 |
| 218 | $CH_3$ | 2-$OCH_3$ | 297 |
| 219 | $CH_3$ | 3-$OCH_3$ | >300 |
| 220 | $CH_3$ | 4-$OCH_3$ | >300 |
| 221 | $CH_3$ | 2-$CH_3$ | >300 |
| 222 | $CH_3$ | 3-$CH_3$ | >300 |
| 223 | $CH_3$ | 4-$CH_3$ | >300 |
| 224 | $CH_3$ | 2-Cl | >300 |
| 225 | $CH_3$ | 3-Cl | >300 |
| 226 | $CH_3$ | 4-Cl | >300 |
| 227 | $CH_3$ | 2-$NO_2$ | >300 |
| 228 | $CH_3$ | 3-$NO_2$ | >300 |
| 229 | $CH_3$ | 4-$NO_2$ | >300 |
| 230 | $CH_3$ | 2-$CH_3$, 4-Cl | >300 |
| 231 | $CH_3$ | 2-$CH_3$, 4-$CH_3$ | >300 |
| 232 | $CH_3$ | 2-$C_2H_5$ | 268.5–270.0 |
| 233 | $OCH_3$ | H | 289.0 |
| 234 | $OCH_3$ | 2-$OCH_3$ | 268.0–270.0 |
| 235 | $OCH_3$ | 3-$OCH_3$ | >300 |
| 236 | $OCH_3$ | 4-$OCH_3$ | >300 |
| 237 | $OCH_3$ | 2-$CH_3$ | 284.5–285.5 |
| 238 | $OCH_3$ | 3-$CH_3$ | >300 |
| 239 | $OCH_3$ | 4-$CH_3$ | >300 |
| 240 | $OCH_3$ | 3-Cl | >300 |
| 242 | $OCH_3$ | 4-Cl | >300 |
| 243 | $OCH_3$ | 2-$NO_2$ | >300 |
| 244 | $OCH_3$ | 3-$NO_2$ | >300 |
| 245 | $OCH_3$ | 4-$NO_2$ | >300 |
| 246 | $OCH_3$ | 2-$C_2H_5$ | 264.5–266.5 |

TABLE 14

| Coupler No. | Formula |
|---|---|
| 247 | 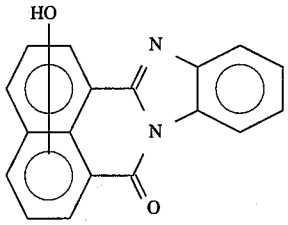 |

TABLE 14-continued

| Coupler No. | Formula |
|---|---|
| 248 | 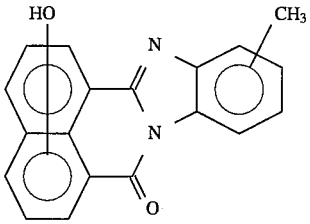 |
| 249 | 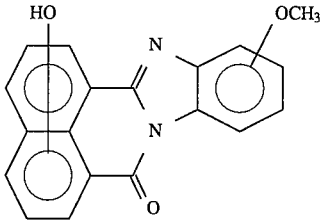 |
| 250 | 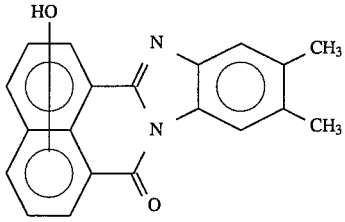 |
| 251 | 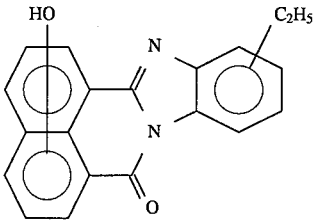 |
| 252 | 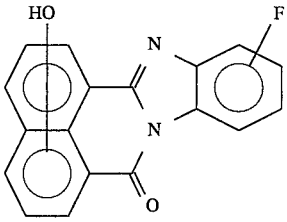 |
| 253 | 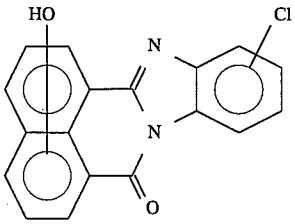 |
| 254 | 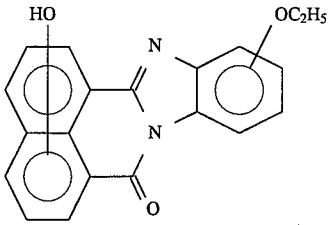 |

TABLE 14-continued
| Coupler No. | Formula |
|---|---|
| 255 | 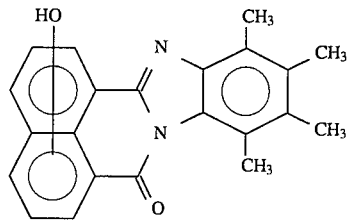 |
| 256 | 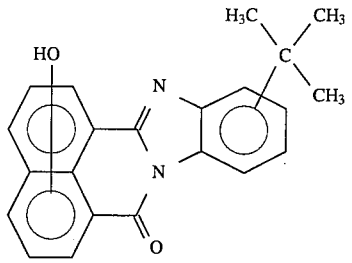 |
| 257 | 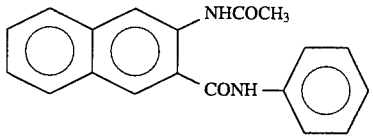 |
| 258 | 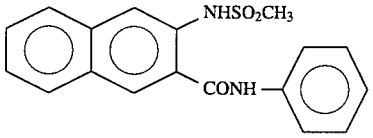 |
TABLE 15
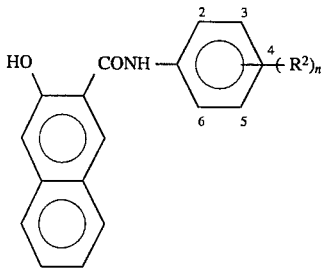
| Coupler No. | $(R^2)_n$ |
|---|---|
| 259 | 2-Cl, 3-Cl |
| 260 | 2-Cl, 4-Cl |
| 261 | 3-Cl, 5-Cl |
TABLE 16
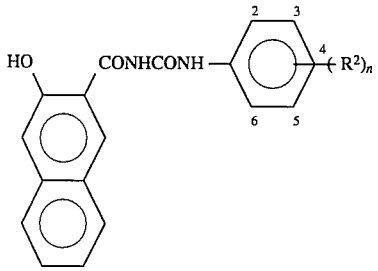
| Coupler No. | $(R^2)_n$ |
|---|---|
| 262 | 4-$CH_2$ |
| 263 | 3-$NO_2$ |
| 264 | 2-Cl |
| 265 | 3-Cl |
| 266 | 4-Cl |
| 267 | 2-Cl, 3-Cl |
| 268 | 2-Cl, 4-Cl, |
| 269 | 3-Cl, 5-Cl |
| 270 | 2-Cl, 5-Cl |
| 271 | 3-Cl, 4-Cl |
In the electrophotographic photoconductor of the present invention, disazo pigments of formula (11) and formula (12) are particularly preferable because of their high sensitivities in the visible light range:

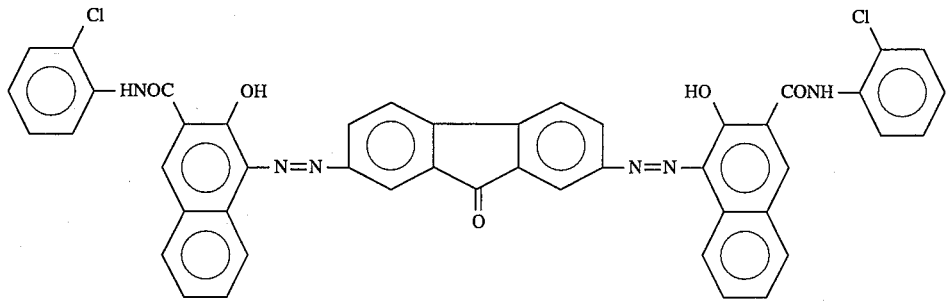

(11)

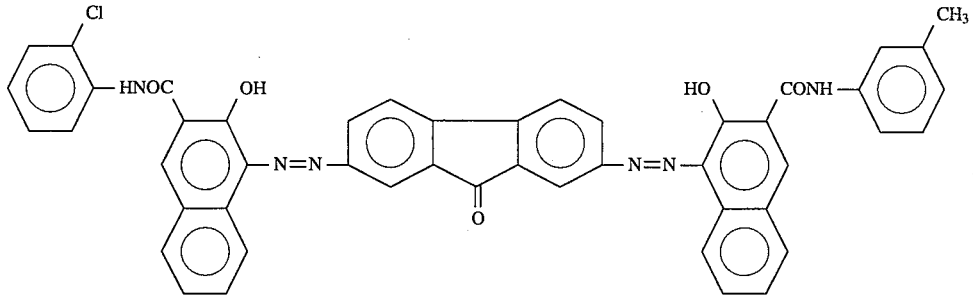

(12)

When any of these disazo pigments of formulas (11) and (12) and the trisazo pigment of the previously mentioned formula (2) are mixed and pulverized simultaneously, a pigment dispersion coating liquid with excellent stability can be obtained. Therefore, a photoconductive layer with an increased sensitizing effect can be formed by coating the above pigment dispersion coating liquid.

As the trisazo pigment of formula (2), the following compound of formula (13) is preferably employed in the present invention:

(13)

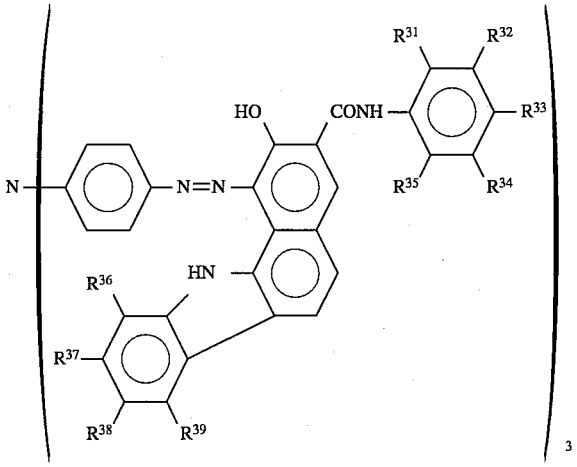

wherein $R^{31}$ to $R^{39}$ each is hydrogen, $—CH_3$, $—C_2H_5$, $—C_3H_7$, chlorine, fluorine, iodine, bromine, $CH_3—$, $C_2H_5O—$, $C_3H_7O—$, $—NO_2$, —CN, $—CF_3$ or —OH.

The trisazo compound of formula (13) can generate electric charges very efficiently, particularly by the application of light with a wavelength of 700 nm or more in the near infrared region. When the trisazo compound of formula (13) is simultaneously pulverized with the above-mentioned disazo pigments of formulas (11) or (12) and the thus obtained mixture is contained in a single-layered photoconductive layer, the photosensitivity of the obtained photoconductor becomes sufficiently high in a broad range from the visible light range to the near infrared range.

In particular, to prepare a photoconductor with a high sensitivity to the LD light of 780 to 850 nm, the following trisazo pigments of formulas (13-a) and (13-b) are advantageous because they have high sensitivities in a board wave range up to 850 nm:

(13-a)

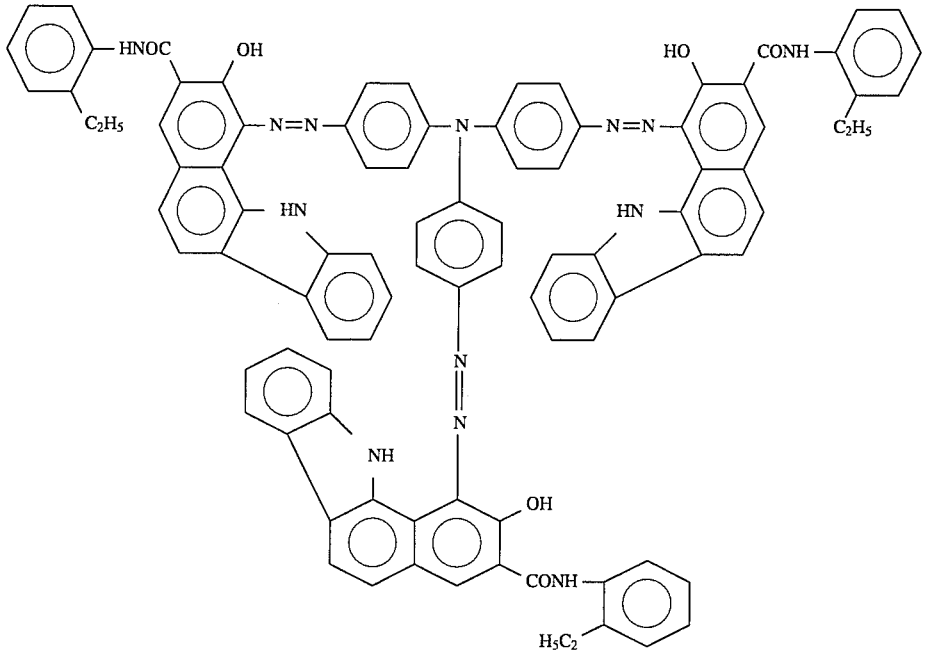

(13-b)

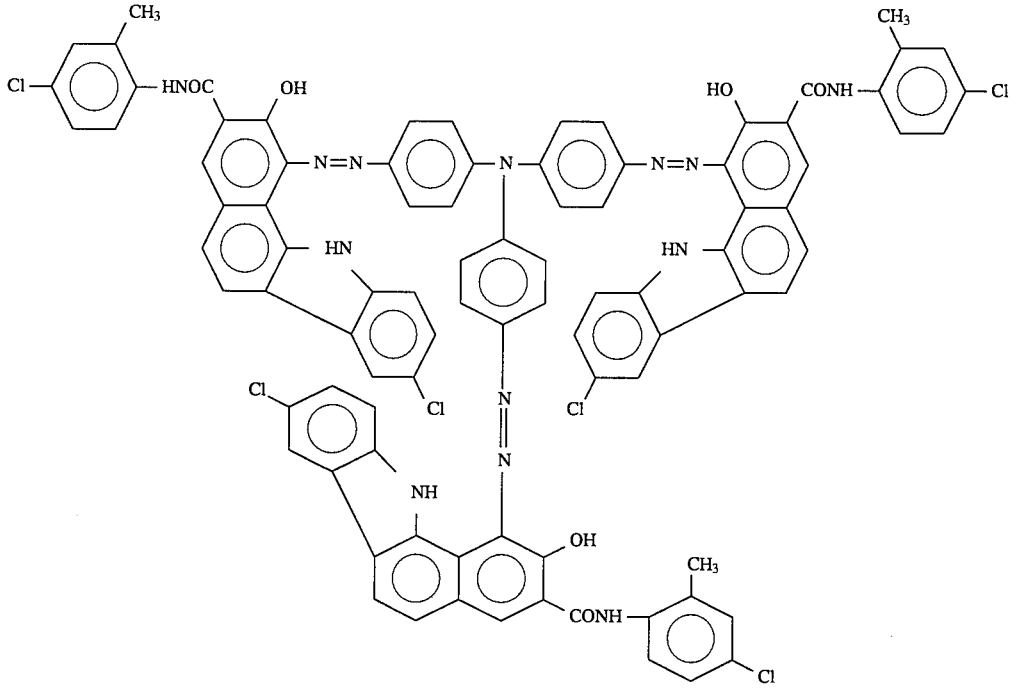

In the electrophotographic photoconductor of the present invention, oxazole derivatives, imidazole derivatives and triphenylamine derivatives can be used as charge transporting materials.

Further, it is preferable that the charge transporting material for use in the present invention be a positive hole transporting material which is selected from the group consisting of the following compounds of formulas (14) to (32):

(14)

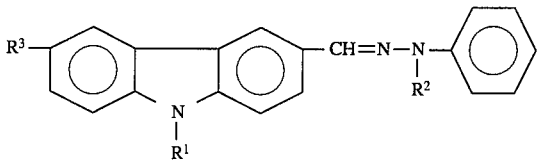

wherein $R^1$ is methyl group, ethyl group, 2-hydroxyethyl group or 2-chloroethyl group; $R^2$ is methyl group, ethyl group, benzyl group or phenyl group; and $R^3$ is hydrogen, chlorine, bromine, an alkyl group having 1 to 4 carbon atoms, an alkoxyl group having 1 to 4 carbon atoms, a dialkylamino group, or nitro group;

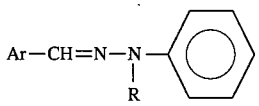

(15)

wherein Ar is naphthalene ring, anthracene ring, styryl ring, each of which may have a substituent, pyridyl ring, furan ring, or thiophene ring; and R is an alkyl group or benzyl group;

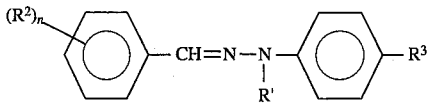

(16)

wherein $R^1$ is an alkyl group, benzyl group, phenyl group, or naphthyl group; $R^2$ is hydrogen, an alkyl group having 1 to 3 carbon atoms, an alkoxyl group having 1 to 3 carbon atoms, a dialkylamino group, a diaralkylamino group or a diarylamino group; n is an integer of 1 to 4; when n is 2 or more, $R^2$ may be the same or different; and $R^3$ is hydrogen or methoxy group;

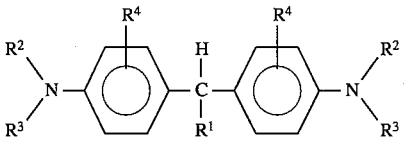

(17)

wherein $R^1$ is an alkyl group having 1 to 11 carbon atoms, a substituted or unsubstituted phenyl group, or a heterocyclic ring; $R^2$ and $R^3$ may be the same or different and each is hydrogen, an alkyl group having 1 to 4 carbon atoms, a hydroxyalkyl group, a chloroalkyl group, or a substituted or unsubstituted aralkyl group, and $R^2$ and $R^3$ may form a nitrogen-containing heterocyclic ring in combination; and $R^4$ is hydrogen, an alkyl group having 1 to 4 carbon atoms, an alkoxyl group, or a halogen atom, and may be the same or different;

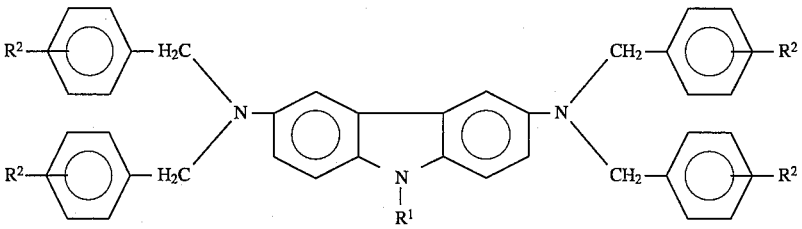

(18)

wherein $R^1$ is hydrogen, a substituted or unsubstituted alkyl group, or phenyl group; $R^2$ is hydrogen, a substituted or unsubstituted alkyl group, an alkoxyl group or a halogen atom;

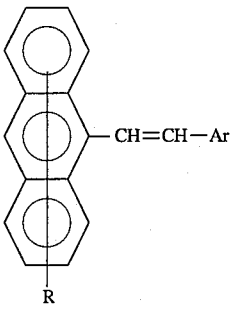

(19)

wherein R is hydrogen or a halogen atom; Ar is phenyl group, naphthyl group, anthryl group or carbazolyl group, each of which may have a substituent;

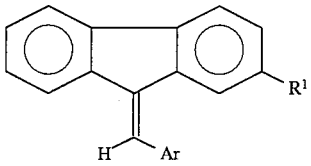

(20)

wherein $R^1$ is hydrogen, a halogen atom, cyano group, an alkoxyl group having 1 to 4 carbon atoms, or an alkyl group having 1 to 4 carbon atoms; and Ar is

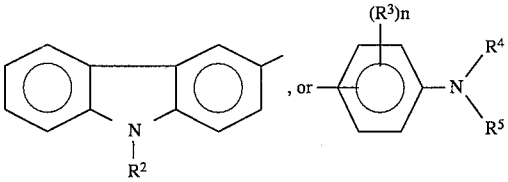

wherein $R^2$ is an alkyl group having 1 to 4 carbon atoms; $R^3$ is hydrogen, a halogen atom, an alkyl group having 1 to 4 carbon atoms, an alkoxyl group having 1 to 4 carbon atoms, or a dialkylamino group; n is an integer of 1 or 2; when n is 2, $R^3$ may be the same or different; and $R^4$ and $R^5$ each is hydrogen, a substituted or unsubstituted alkyl group having 1 to 4 carbon atoms or a substituted or unsubstituted benzyl group;

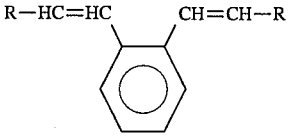

(21)

wherein R is carbazolyl group, pyridyl group, thienyl group, indolyl group, furyl group, a substituted or unsubstituted phenyl group, styryl group, naphthyl group, or anthryl group, each of which may have a substituent selected from the group consisting of a dialkylamino group, an alkyl group, an alkoxyl group, carboxyl group or an ester group thereof, a halogen atom, cyano group, an aralkylamino group, an N-alkyl-N-aralkylamino group, amino group, nitro group and acetylamino group;

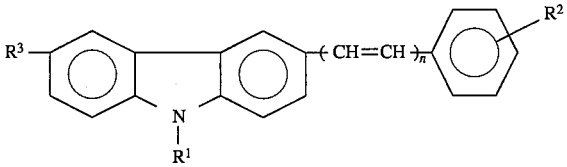

(22)

wherein $R^1$ is a lower alkyl group, a substituted or unsubstituted phenyl group, or benzyl group; $R^2$ and $R^3$ each is hydrogen, a lower alkyl group, a lower alkoxyl group, a halogen atom, nitro group, or an amino group which may have as a substituent a lower alkyl group or benzyl group; and n is an integer of 1 or 2;

(23)

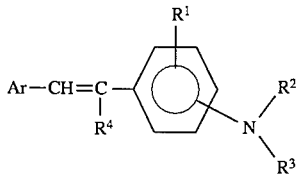

wherein $R^1$ is hydrogen, an alkyl group, an alkoxyl group or a halogen atom; $R^2$ and $R^3$ each is an alkyl group, a substituted or unsubstituted aralkyl group, or a substituted or unsubstituted aryl group; $R^4$ is hydrogen, a lower alkyl group, or a substituted or unsubstituted phenyl group; and Ar is a substituted or unsubstituted phenyl group or naphthyl group;

(24)

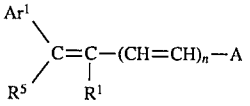

wherein n is an integer of 0 or 1; $R^1$ is hydrogen, an alkyl group or a substituted or unsubstituted phenyl group; $Ar^1$ is a substituted or unsubstituted aryl group; $R^5$ is a substituted or unsubstituted alkyl group, or a substituted or unsubstituted aryl group; and A is

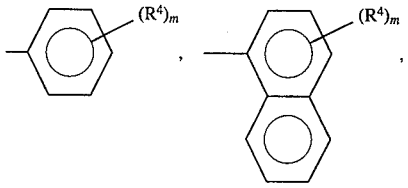

9-anthryl group or a substituted or unsubstituted N-alkylcarbazolyl group, in which $R^2$ is hydrogen, an alkyl group, an alkoxyl group, a halogen atom, or

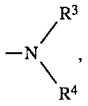

in which $R^3$ and $R^4$ each is an alkyl group, a substituted or unsubstituted aralkyl group, or a substituted or unsubstituted aryl group, and $R^3$ and $R^4$ may be the same or different and may form a ring in combination; m is an integer of 0 to 3; and when m is 2 or more, $R^2$ may be the same or different; and when n is 0, A and $R^1$ may form a ring in combination;

(25)

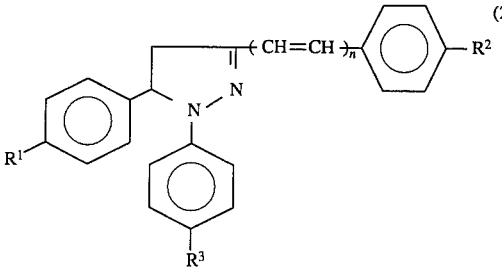

wherein $R^1$, $R^2$ and $R^3$ each is hydrogen, a lower alkyl group, a lower alkoxyl group, a dialkylamino group or a halogen atom; and n is an integer of 0 or 1;

(26)

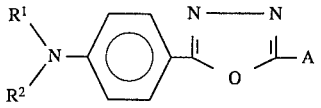

wherein $R^1$ and $R^2$ each is a substituted or unsubstituted alkyl group, or a substituted or unsubstituted aryl group; and A is a substituted amino group, a substituted or unsubstituted aryl group, or an allyl group;

(27)

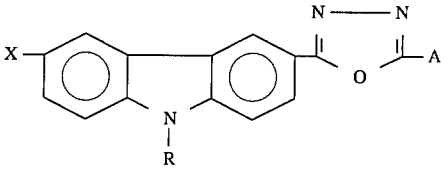

wherein X is hydrogen, a lower alkyl group, or a halogen atom; R is a substituted or unsubstituted alkyl group, or a substituted or unsubstituted aryl group; and A is a substituted amino group, or a substituted or unsubstituted aryl group;

(28)

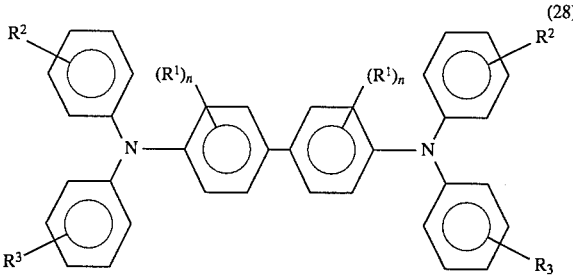

wherein $R^1$ is a lower alkyl group, a lower alkoxyl group, or a halogen atom; n is an integer of 0 to 4; and $R^2$ and $R^3$ may be the same or different, and each is hydrogen, a lower alkyl group, a lower alkoxyl group, or a halogen atom;

(29)

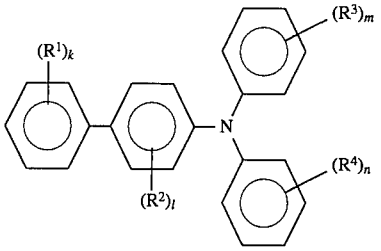

wherein $R^1$, $R^3$ and $R^4$ each is hydrogen, an amino group, a thioalkoxyl group, an aryloxy group, methylenedioxy group, a substituted or unsubstituted alkyl group, a halogen atom, or a substituted or unsubstituted aryl group; $R^2$ is hydrogen, an alkoxyl group, a substituted or unsubstituted alkyl group, or a halogen atom, provided that not all of $R^1$, $R^2$, $R^3$, and $R^4$ are hydrogen at the same time; k, l, m and n each is an integer of 1 to 4, and when each of k, l, m and n is 2, 3 or 4, $R^1$, $R^2$, $R^3$, and $R^4$ may be the same or different;

(30)

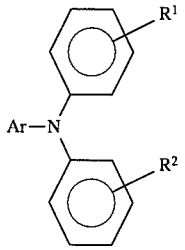

wherein Ar is a condensed polycyclic hydrocarbon group having 18 or less carbon atoms; $R^1$ and $R^2$ may be the same or different, and each is hydrogen, a halogen atom, a substituted or unsubstituted alkyl group, an alkoxyl group, or a substituted or unsubstituted phenyl group;

$$A—CH=CH—Ar—CH=CH—A \quad (31)$$

wherein Ar is a substituted or unsubstituted aromatic hydrocarbon group; and A is

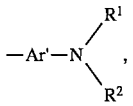

in which Ar' is a substituted or unsubstituted aromatic hydrocarbon group; and $R^1$ and $R^2$ each is a substituted or unsubstituted alkyl group, or a substituted or unsubstituted aryl group; and

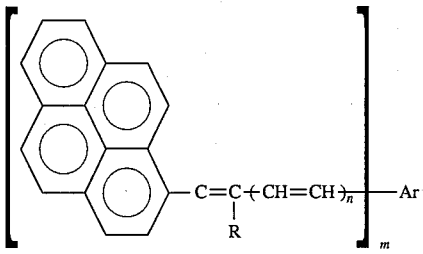

(32)

wherein Ar is an aromatic hydrocarbon group; R is hydrogen, a substituted or unsubstituted alkyl group, or a substituted or unsubstituted aryl group; and n is an integer of 0 or 1, and m is an integer of 1 or 2, and when n=0 and m=1, Ar and R may form a ring in combination.

Specific examples of the compound of formula (14) are 9-ethylcarbazole-3-aldehyde-1-methyl-1-phenylhydrazone, 9-ethylcarbazole-3-aldehyde-1-benzyl-1-phenylhydrazone, and 9-ethylcarbazole-3-aldehyde-1,1-diphenylhydrazone.

Specific examples of the compound of formula (15) are 4-diethylaminostyryl-β-aldehyde-1-methyl-1-phenylhydrazone, and 4-methyoxynaphthalene-1-aldehyde-1-benzyl-1-phenylhydrazone.

Specific examples of the compound of formula (16) are 4-methoxybenzaldehyde-1-methyl-1-phenylhydrazone, 2,4-dimethoxybenzaldehyde-1-benzyl-1-phenylhydrazone, 4-diethylaminobenzaldehyde-1,1-diphenylhydrazone, 4-methoxybenzaldehyde-1-benzyl-1-(4-methoxy)phenylhydrazone, 4-diphenylaminobenzaldehyde-1-benzyl-1-phenylhydrazone, and 4-dibenzylaminobenzaldehyde-1,1-diphenylhydrazone.

Specific examples of the compound of formula (17) are 1,1-bis(4-dibenzylaminophenyl)propane, tris(4-diethylaminophenyl)methane, 1,1-bis(4-dibenzylaminophenyl)propane, and 2,2'-dimethyl-4,4'-bis(diethylamino)triphenylmethane.

As the compound of formula (18), N-ethyl-3,6-tetrabenzylaminocarbazole can be employed.

Specific examples of the compound of formula (19) are 9-(4-diethylaminostyryl)anthracene, and 9-bromo-10-(4-diethylaminostyryl)anthracene.

Specific examples of the compound of formula (20) are 9-(4-dimethylaminobenzylidene)fluorene, and 3-(9-fluorenylidene)-9-ethylcarbazole.

Specific examples of the compound of formula (21) are 1,2-bis(4-diethylaminostyryl)benzene, and 1,2-bis(2,4-dimethoxystyryl)benzene.

Specific examples of the compound of formula (22) are 3-styryl-9-ethylcarbazole, and 3-(4-methoxystyryl)-9-ethylcarbazole.

Specific examples of the compound of formula (23) are 4-diphenylaminostilbene, 4-dibenzylaminostilbene, 4-ditolyllaminostilbene, 1-(4-diphenylaminostyryl)naphthalene, and 1-(4-diethylaminostyryl)naphthalene.

Specific examples of the compound of formula (24) are 4'-diphenylamino-α-phenylstilbene, and 4'-bis(methylphenyl)amino-α-phenylstilbene.

Specific examples of the compound of formula (25) are 1-phenyl-3-(4-diethylaminostyryl)-5-(4-diethylaminophenyl)pyrazoline, and 1-phenyl-3-(4-dimethylaminostyryl)-5-(4-dimethylaminophenyl)pyrazoline.

Specific examples of the compound of formula (26) are 2,5-bis(4-diethylaminophenyl)-1,3,4-oxadiazole, 2-N,N-diphenylamino-5-(4-diethylaminophenyl)-1,3,4-oxadiazole, and 2-(4-dimethylaminophenyl)-5-(4-diethylaminophenyl)-1,3,4-oxadiazole.

Specific examples of the compound of formula (27) are 2-N,N-diphenylamino-5-(N-ethylcarbazole-3-yl)-1,3,4-oxadiazole, and 2-(4-diethylaminophenyl)-5-(N-ethylcarbazole-3-yl)-1,3,4-oxadiazole.

Specific examples of the compound of formula (28) are N,N'-diphenyl-N,N'-bis(3-methylphenyl)-[1,1'-bisphenyl]-4,4'-diamine, and 3,3'-dimethyl-N,N,N',N'-tetrakis(4-methylphenyl)-[1,1'-biphenyl]-diamine.

Specific examples of the biphenylamine compound of formula (29) are 4'-methoxy-N,N-diphenyl-[1,1'-biphenyl]-4-amine, 4'-methyl-N,N'-bis(4-methylphenyl)-[1,1'-biphenyl]-4-amine, and 4'-methoxy-N,N'-bis(4-methylphenyl)-[1,1'-biphenyl]-4-amine.

Specific examples of the triarylamine compound of formula (30) are 1-phenylaminopyrene, and 1-di(p-tolylamino)pyrene.

Specific examples of the diolefin aromatic compound of formula (31) are 1,4-bis(4-diphenylaminostyryl)benzene, and 1,4-bis[4-di(p-tolyl)aminostyryl]benzene.

Specific examples of the styrylpyrene compound of formula (32) are 1-(4-diphenylaminostyryl)pyrene, and 1-[4-di(p-tolyl)aminostyryl]pyrene.

These charge transporting materials may be used alone or in combination.

It is preferable that the charge transporting material for use in the present invention have an oxidation potential of +0.5 V (vs SCE) or more. In particular, the charge transporting materials of formulas (14), (15), (17), (19), (22), (23), (24), (28), (29), (30) and (31) are preferable from the viewpoints of charging characteristics and photosensitivity of the obtained photoconductor. In particular, an electrophotographic photoconductor employing the positive hole transporting compound of formula (17) is superior to others in the charging stability when repeatedly used in electrophotographic process.

The oxidation potential of the charge transporting material for use in the present invention means a half-wave potential obtained by conventionally known cyclic voltametry, using acetonitrile as a solvent, 0.1 MTEAP as an electrolyte, and a saturated calomel electrode (SCE) as a reference electrode.

The charge transporting material for use in the electrophotographic photoconductor of the present invention may comprise the above-mentioned organic positive hole transporting material and an organic acceptor compound.

Any conventional organic acceptor compounds can be employed in the present invention. Particularly, it is preferable to use organic acceptor compounds of formulas (1) to (14) in combination:

[Organic Acceptor Compound of Formula (1)]

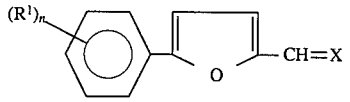

(1)

wherein $R^1$ is hydrogen, a halogen atom, a substituted or unsubstituted alkyl group, a substituted or unsubstituted phenyl group, an alkoxycarbonyl group, an N-alkylcarbamoyl group, cyano group or nitro group; n is an integer of 1 to 3; X is $$C(CN)_2,\quad \overset{\overset{\displaystyle CN}{|}}{C}COOR^2,\quad \text{or}\quad C(COOR^3)_2,$$

in which $R^2$ and $R^3$ each is an alkyl group, and $R^3$ may be bonded to each other.

[Organic Acceptor Compound of Formula (2)]

$$Ar-CH=\overset{\overset{\displaystyle CN}{|}}{C}-X \qquad (2)$$

wherein Ar is a substituted or unsubstituted aromatic group; and X is cyano group or an alkoxycarbonyl group.

[Organic Acceptor Compound of Formula (3)]

$$Ar-CH=C(COOR)_2 \qquad (3)$$

wherein Ar is a substituted or unsubstituted aromatic group; and R is an alkyl group, and R may be bonded to each other to form a ring.

[Organic Acceptor Compound of Formula (4)]

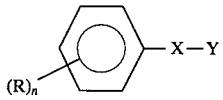

(4)

wherein X is sulfur or selenium; Y is a substituted or unsubstituted alkyl group, an aryl group, or cyano group; R is a substituted or unsubstituted alkyl group, a substituted or unsubstituted aryl group, cyano group, nitro group, a halogen atom, or hydrogen; and n is an integer of 1 to 3.

[Organic Acceptor Compound of Formula (5)]

$$Ar-CH=CHNO_2 \qquad (5)$$

wherein Ar is a substituted or unsubstituted aromatic group.

[Organic Acceptor Compound of Formula (6)]

$$R^1-\underset{\underset{\displaystyle O}{\|}}{C}-CH=CH-R^2 \qquad (6)$$

wherein $R^1$ and $R^2$ each is a substituted or unsubstituted phenyl group, a substituted or unsubstituted naphthyl group, or a heterocyclic aromatic group.

[Organic Acceptor Compound of Formula (7)]

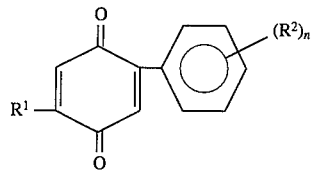

(7)

wherein $R^1$ is hydrogen, a halogen atom, an alkyl group, or a substituted or unsubstituted phenyl group; $R^2$ is hydrogen, a substituted or unsubstituted alkyl group, a substituted or unsubstituted phenyl group, a halogen atom, an alkoxycarbonyl group, an N-alkylcarbamoyl group, cyano group, or nitro group; and n is an integer of 1 to 3.

[Organic Acceptor Compound of Formula (8)]

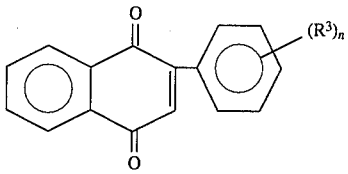

(8)

wherein $R^3$ is hydrogen, a substituted or unsubstituted alkyl group, a substituted or unsubstituted phenyl group, a halogen atom, an alkoxycarbonyl group, an N-alkylcarbamoyl group, cyano group, or nitro group; and n is an integer of 1 to 3.

[Organic Acceptor Compound of Formula (9)]

$$R^1-\overset{\overset{\displaystyle CN}{|}}{C}=CH-R^2 \qquad (9)$$

wherein $R^1$ and $R^2$ each is a substituted or unsubstituted phenyl group, a substituted or unsubstituted polycyclic aromatic group, or a substituted or unsubstituted heterocyclic group.

[Organic Acceptor Compound (10)]

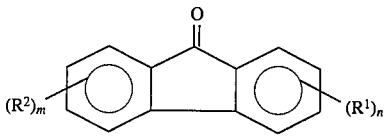

(10)

wherein $R^1$ and $R^2$ each is hydrogen, a halogen atom, a substituted or unsubstituted alkyl group, a substituted or unsubstituted aryl group, a substituted or unsubstituted heterocyclic group, an alkoxycarbonyl group, an aryloxycarbonyl group, an N-alkylcarbamoyl group, an alkylcarbonyl group, an arylcarbonyl group, cyano group, nitro group, an alkoxyl group, an aryloxy group, an amino group, or a vinyl group of $$-\overset{\overset{\displaystyle X}{|}}{C}=\overset{\overset{\displaystyle Y}{|}}{C}-Z,$$

in which X is hydrogen or an alkyl group, and at least one of Y or Z is a substituted or unsubstituted phenyl group and the other is hydrogen; and n and m each is an integer of 1 to 3.

[Organic Acceptor Compound of Formula (11)]

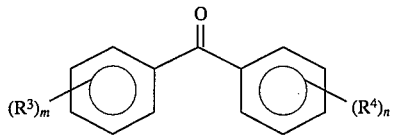

(11)

wherein $R^3$ and $R^4$ each is hydrogen, a halogen atom, a substituted or unsubstituted alkyl group, a substituted or unsubstituted aryl group, a substituted or unsubstituted heterocyclic group, an alkoxycarbonyl group, an aryloxycarbonyl group, an N-alkylcarbamoyl group, an alkylcarbonyl group, an arylcarbonyl group, cyano group, nitro group, an alkoxyl group, an aryloxy group, an amino group, or a vinyl group of

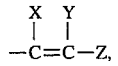

in which X is hydrogen or an alkyl group, and at least one of Y or Z is a substituted or unsubstituted phenyl group and the other is hydrogen; and n and m each is an integer of 1 to 3.

[Organic Acceptor Compound of Formula (12)]

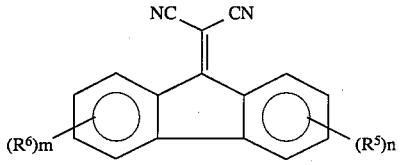

(12)

wherein $R^5$ and $R^6$ each is hydrogen, a halogen atom, a substituted or unsubstituted alkyl group, a substituted or unsubstituted aryl group, a substituted or unsubstituted heterocyclic group, an alkoxycarbonyl group, an aryloxycarbonyl group, an N-alkylcarbamoyl group, an alkylcarbonyl group, an arylcarbonyl group, cyano group, nitro group, an alkoxyl group, an aryloxy group an amino group, or a vinyl group of

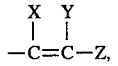

in which X is hydrogen or an alkyl group, and at least one of Y or Z is a substituted or unsubstituted phenyl group and the other is hydrogen; and n and m each is an integer of 1 to 3.

[Organic Acceptor Compound of Formula (13)]

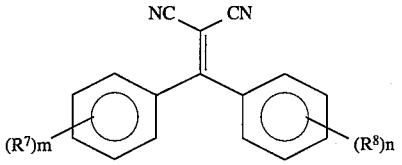

(13)

wherein $R^7$ and $R^8$ each is hydrogen, a halogen atom, a substituted or unsubstituted alkyl group, a substituted or unsubstituted aryl group, a substituted or unsubstituted heterocyclic group, an alkoxycarbonyl group, an aryloxycarbonyl group, an N-alkylcarbamoyl group, an alkylcarbonyl group, an arylcarbonyl group, cyano group, nitro group, an alkoxyl group, an aryloxy group, an amino group, or a vinyl group of

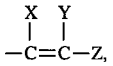

in which X is hydrogen or an alkyl group, and at least one of Y or Z is a substituted or unsubstituted phenyl group and the other is hydrogen; and n and m each is an integer of 1 to 3.

[Organic Acceptor Compound of Formula (14)]

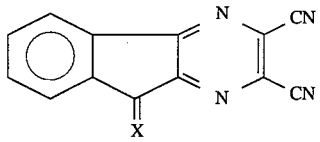

(14)

wherein X is O or N—R, in which R is a substituted or unsubstituted phenyl group, or a substituted or unsubstituted naphthyl group.

TABLES 17–30 respectively show specific examples of the organic acceptor compound of formulae (1) to (14).

TABLE 17

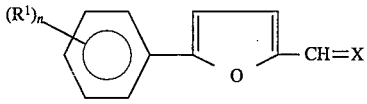

(1)

| Compound No. | X | $R^1$ |
|---|---|---|
| 1 | $C(CN)_2$ | 4'-$NO_2$ |
| 2 | $C(CN)_2$ | 3'-$NO_2$ |
| 3 | $C(CN)_2$ | 3'-$NO_2$-4'-Cl |
| 4 | $C(CN)_2$ | 4'-CN |
| 5 | $C(CN)_2$ | 4'-Cl |
| 6 | $C(CN)_2$ | 4'-$COOC_2H_5$ |
| 7 | $C(CN)_2$ | 4'-$COOC_4H_9$ |
| 8 | $C(CN)_2$ | 4'-$CF_3$ |
| 9 | $C(CN)_2$ | 4'-$C_4H_9$ |
| 10 | CN \| C—$COOC_2H_5$ | 4'-$NO_2$ |
| 11 | CN \| C—$COOC_2H_5$ | 3'-$NO_2$-4'-Cl |
| 12 | CN \| C—$COOC_2H_5$ | 3'-$NO_2$-4'-$CH_3$ |
| 13 | CN \| C—$COOC_2H_5$ | 4'-CN |
| 14 | CN \| C—$COOC_2H_5$ | 4'-Cl |
| 15 | CN \| C—$COOC_2H_5$ | 4'-$COOCH_2H_5$ |
| 16 | CN \| C—$COOC_2H_5$ | 4'-$CF_3$ |
| 17 | CN \| C—$COOC_2H_5$ | 4'-$C_4H_9$ |

TABLE 17-continued

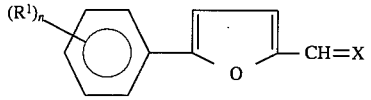

(1)

| Compound No. | X | $R^1$ |
|---|---|---|
| 18 | CN<br>\|<br>C—$COOC_4H_9$ | 4'-$NO_2$ |
| 19 | CN<br>\|<br>C—$COOC_4H_9$ | 3'-$NO_2$ |
| 20 | CN<br>\|<br>C—$COOC_4H_9$ | 3'-$NO_2$, 4'-Cl |
| 21 | CN<br>\|<br>C—$COOC_4H_9$ | 3'-$NO_2$, 4'-$CH_3$ |
| 22 | CN<br>\|<br>C—$COOC_4H_9$ | 4'-CN |
| 23 | CN<br>\|<br>C—$COOC_4H_9$ | 3'-$CF_3$, 4'-CN |
| 24 | CN<br>\|<br>C—$COOC_4H_9$ | 4'-Cl |
| 25 | CN<br>\|<br>C—$COOC_4H_9$ | 4'-$COOC_2H_5$ |
| 26 | CN<br>\|<br>C—$COOC_4H_9$ | 4'-$COOC_4H_9$ |
| 27 | CN<br>\|<br>C—$COOC_4H_9$ | 4'-$CON(C_4H_9)_2$ |
| 28 | CN<br>\|<br>C—$COOC_4H_9$ | 4'-$CF_3$ |
| 29 | CN<br>\|<br>C—$COOC_4H_9$ | 4'-$C_2H_5$ |
| 30 | CN<br>\|<br>C—$COOC_4H_9$ | 4'-$C_4H_9$ |
| 31 | $C(COOCH_3)_2$ | 4'-$NO_2$ |
| 32 | $C(COOCH_3)_2$ | 4'-Cl |
| 33 | $C(COOCH_3)_2$ | 4'-$COOC_4H_9$ |
| 34 | $C(COOCH_3)_2$ | 4'-$CF_3$ |
| 35 | $C(COOCH_3)_2$ | 4'-$C_4H_9$ |
| 36 | $C(COOC_4H_9)_2$ | 4'-$NO_2$ |
| 37 | $C(COOC_4H_9)_2$ | 2'-$CH_3$, 4'-$NO_2$ |
| 38 | $C(COOC_4H_9)_2$ | 3'-$NO_2$, 4'-Cl |
| 39 | $C(COOC_4H_9)_2$ | 3'-$NO_2$, 4'-$CH_3$ |
| 40 | $C(COOC_4H_9)_2$ | 4'-CN |

TABLE 17-continued

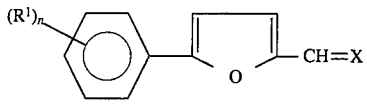

(1)

| Compound No. | X | $R^1$ |
|---|---|---|
| 41 | $C(COOC_4H_9)_2$ | 4'-Cl |
| 42 | $C(COOC_4H_9)_2$ | 4'-$COOC_4H_9$ |
| 43 | $C(COOC_4H_9)_2$ | 4'-$CF_3$ |
| 44 | $C(COOC_4H_9)_2$ | 4'-$C_4H_9$ |
| 45 | 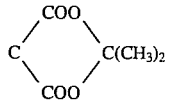 | 4'-$NO_2$ |
| 46 | 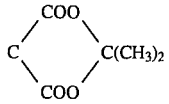 | 2'-$CH_3$-4'-$NO_2$ |
| 47 | 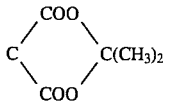 | 4'-CN |
| 48 | 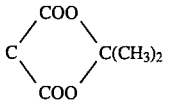 | 4'-Cl |
| 49 | 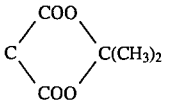 | 4'-$COOC_2H_5$ |
| 50 | 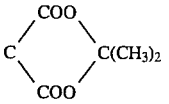 | 4'-$COOC_4H_9$ |
| 51 | 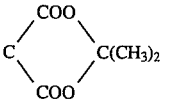 | 4'-$CF_3$ |
| 52 | 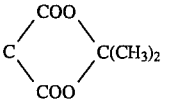 | 4'-$C_2H_5$ |
| 53 | 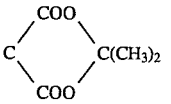 | 4'-$C_4H_9$ |

TABLE 18
$$Ar-CH=\overset{\overset{\displaystyle CN}{|}}{C}-X \qquad (2)$$
| Compound No. | X | Ar |
|---|---|---|
| 1 | −CN | 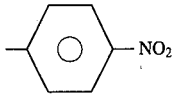 |
| 2 | −CN | 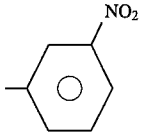 |
| 3 | −CN | 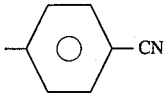 |
| 4 | −CN | 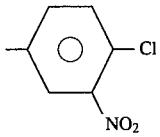 |
| 5 | −CN | 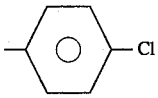 |
| 6 | −CN | 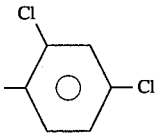 |
| 7 | −CN | 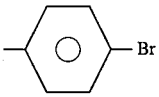 |
| 8 | −CN | 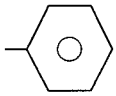 |
| 9 | −CN | 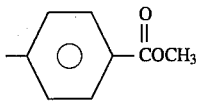 |
| 10 | −CN | 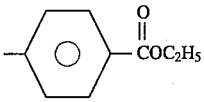 |
| 11 | −CN | 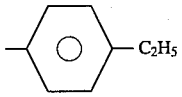 |
| 12 | −CN | 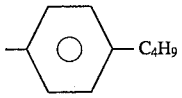 |
| 13 | −CN | 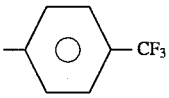 |

TABLE 18-continued
| Compound No. | X | Ar |
|---|---|---|
| | $Ar-CH=C(CN)-X$ | (2) |
| 14 | −CN | 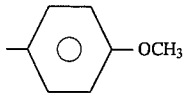 |
| 15 | −CN | 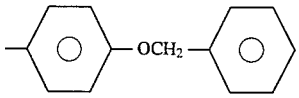 |
| 16 | −CN | 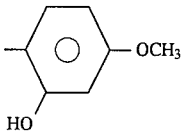 |
| 17 | −CN | 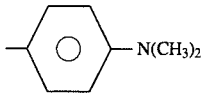 |
| 18 | −CN | 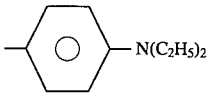 |
| 19 | −CN | 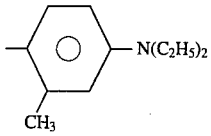 |
| 20 | −CN | 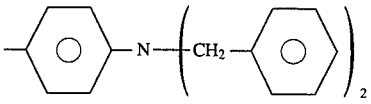 |
| 21 | −CN | 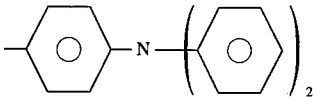 |
| 22 | −CN | 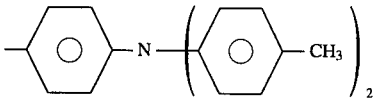 |
| 23 | −CN | 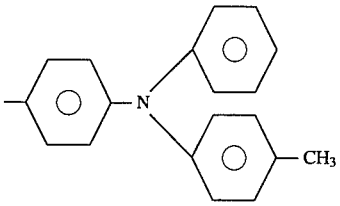 |
| 24 | −CN | 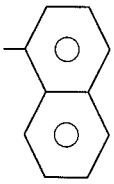 |

TABLE 18-continued
$$Ar-CH=\overset{\overset{\displaystyle CN}{|}}{C}-X \qquad (2)$$
| Compound No. | X | Ar |
|---|---|---|
| 25 | −CN | 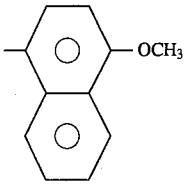 |
| 26 | −CN | 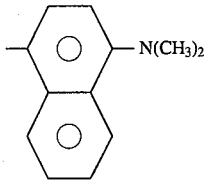 |
| 27 | −CN | 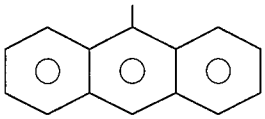 |
| 28 | −CN | 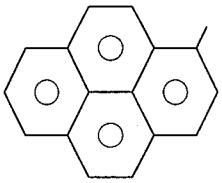 |
| 29 | −CN | 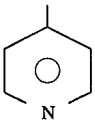 |
| 30 | −CN | 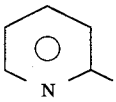 |
| 31 | −CN | 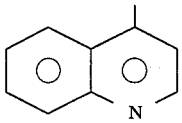 |
| 32 | −CN | 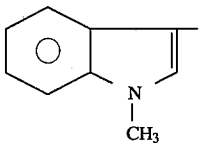 |
| 33 | −CN | 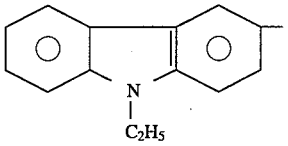 |
| 34 | −CN | 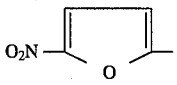 |

TABLE 18-continued
$$Ar-CH=\overset{\overset{\displaystyle CN}{|}}{C}-X \qquad (2)$$
| Compound No. | X | Ar |
|---|---|---|
| 35 | $-CN$ | 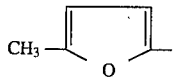 |
| 36 | $-CN$ | 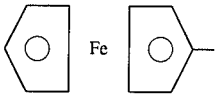 |
| 37 | $-COOC_2H_5$ | 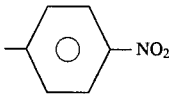 |
| 38 | $-COOC_2H_5$ | 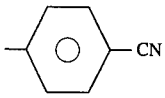 |
| 39 | $-COOC_2H_5$ | 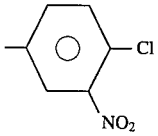 |
| 40 | $-COOC_2H_5$ | 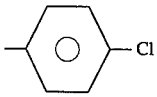 |
| 41 | $-COOC_2H_5$ | 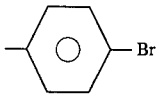 |
| 42 | $-COOC_2H_5$ | 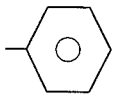 |
| 43 | $-COOC_2H_5$ | 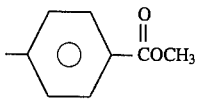 |
| 44 | $-COOC_2H_5$ | 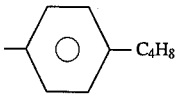 |
| 45 | $-COOC_2H_5$ | 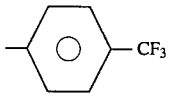 |
| 46 | $-COOC_2H_5$ | 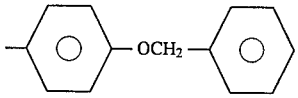 |
| 47 | $-COOC_2H_5$ | 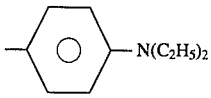 |

TABLE 18-continued
| Compound No. | X | Ar |
|---|---|---|
| | $Ar-CH=\overset{\overset{CN}{\vert}}{C}-X$ (2) | |
| 48 | $-COOC_2H_5$ | 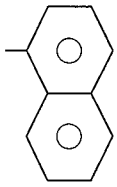 |
| 49 | $-COOC_2H_5$ | 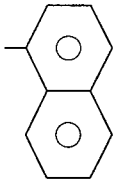 |
| 50 | $-COOC_2H_5$ | 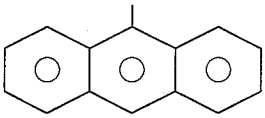 |
| 51 | $-COOC_2H_5$ | 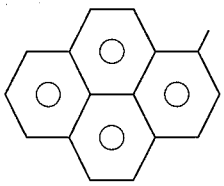 |
| 52 | $-COOC_2H_5$ | 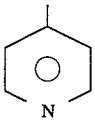 |
| 53 | $-COOC_2H_5$ | 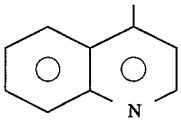 |
| 54 | $-COOC_4H_9$ | 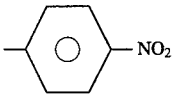 |
| 55 | $-COOC_4H_9$ | 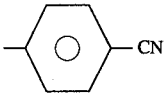 |
| 56 | $-COOC_4H_9$ | 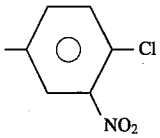 |
| 57 | $-COOC_4H_9$ | 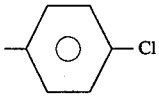 |

TABLE 18-continued
$$Ar-CH=\overset{\overset{\displaystyle CN}{|}}{C}-X \qquad (2)$$
| Compound No. | X | Ar |
|---|---|---|
| 58 | $-COOC_4H_9$ | 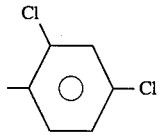 |
| 59 | $-COOC_4H_9$ | 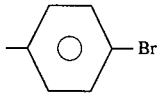 |
| 60 | $-COOC_4H_9$ | 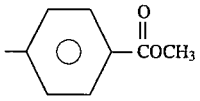 |
| 61 | $-COOC_4H_9$ | 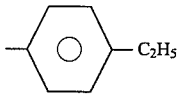 |
| 62 | $-COOC_4H_9$ | 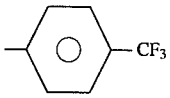 |
| 63 | $-COOC_4H_9$ | 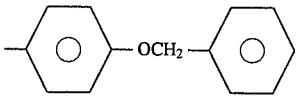 |
| 64 | $-COOC_4H_9$ | 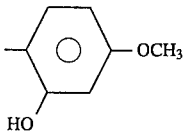 |
| 65 | $-COOC_4H_9$ | 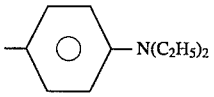 |
| 66 | $-COOC_4H_9$ | 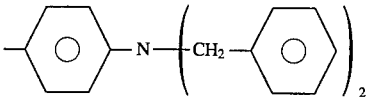 |
| 67 | $-COOC_4H_9$ | 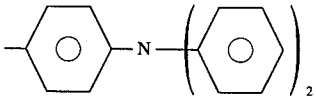 |
| 68 | $-COOC_4H_9$ | 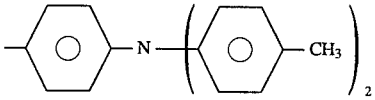 |
| 69 | $-COOC_4H_9$ | 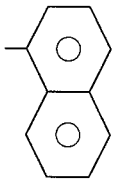 |

TABLE 18-continued
| | $Ar-CH=C(CN)-X$ (2) | |
|---|---|---|
| Compound No. | X | Ar |
| 70 | $-COOC_4H_9$ | 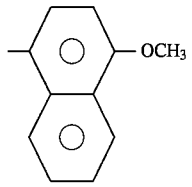 |
| 71 | $-COOC_4H_9$ | 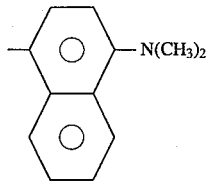 |
| 72 | $-COOC_4H_9$ | 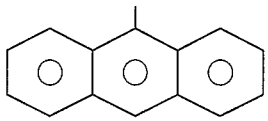 |
| 73 | $-COOC_4H_9$ | 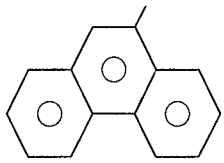 |
| 74 | $-COOC_4H_9$ | 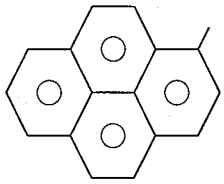 |
| 75 | $-COOC_4H_9$ | 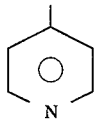 |
| 76 | $-COOC_4H_9$ | 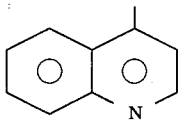 |
| 77 | $-COOC_4H_9$ | 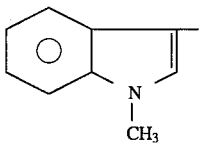 |
| 78 | $-COOC_4H_9$ | 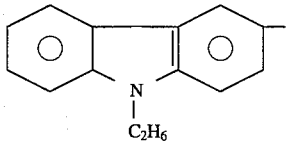 |
| 79 | $-COOC_4H_9$ | 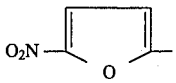 |

TABLE 18-continued
| Compound No. | X | Ar |
|---|---|---|
| | $Ar-CH=C(CN)-X$ | (2) |
| 80 | $-COOC_4H_9$ | 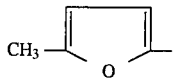 |
| 81 | $-COOC_4H_9$ | 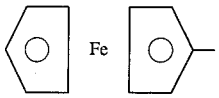 |
| 82 | $-COOCH_2CH(CH_3)_2$ | 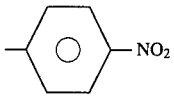 |
| 83 | $-COOCH_2CH(CH_3)_2$ | 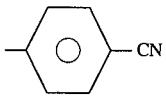 |
| 84 | $-COOCH_2CH(CH_3)_2$ | 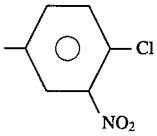 |
| 85 | $-COOCH_2CH(CH_3)_2$ | 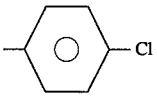 |
| 86 | $-COOCH_2CH(CH_3)_2$ | 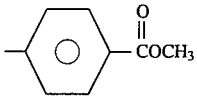 |
| 87 | $-COOCH_2CH(CH_3)_2$ | 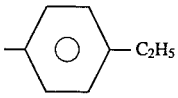 |
| 88 | $-COOCH_2CH(CH_3)_2$ | 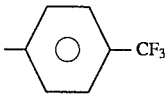 |
| 89 | $-COOCH_2CH(CH_3)_2$ | 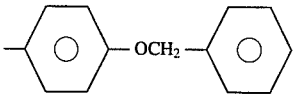 |
| 90 | $-COOCH_2CH(CH_3)_2$ | 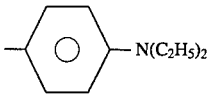 |
| 91 | $-COOCH_2CH(CH_3)_2$ | 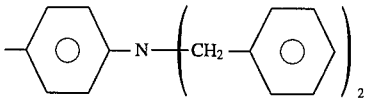 |
| 92 | $-COOCH_2CH(CH_3)_2$ | 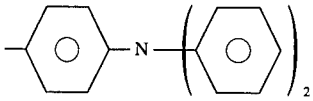 |

TABLE 18-continued
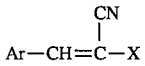
(2)
| Compound No. | X | Ar |
|---|---|---|
| 93 | $-COOCH_2CH(CH_3)_2$ | |
| 94 | $-COOCH_2CH(CH_3)_2$ | $N(CH_3)_2$ |
| 95 | $-COOCH_2CH(CH_3)_2$ | |
| 96 | $-COOCH_2CH(CH_3)_2$ | |
| 97 | $-COOCH_2CH(CH_3)_2$ | |
| 98 | $-COOCH_2CH(CH_3)_2$ | N |
| 99 | $-COOCH_2CH(CH_3)_2$ | N, $CH_3$ |
| 100 | $-COOCH_2CH(CH_3)_2$ | N, $C_2H_5$ |
| 101 | $-COOCH_2CH(CH_3)_2$ | $O_2N$, O |
| 102 | $-COOCH_2CH(CH_3)_2$ | Fe |

TABLE 18-continued
| Compound No. | X | Ar |
|---|---|---|
| | $Ar-CH=\overset{\overset{CN}{\vert}}{C}-X$ (2) | |
| 103 | $-COOC_3H_7$ | 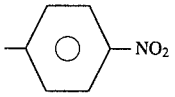 |
| 104 | $-COOC_3H_7$ | 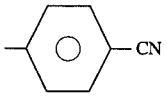 |
| 105 | $-COOC_3H_7$ | 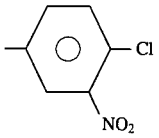 |
| 106 | $-COOC_3H_7$ | 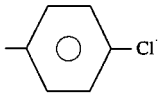 |
| 107 | $-COOC_3H_7$ | 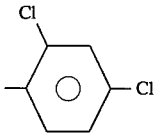 |
| 108 | $-COOC_3H_7$ | 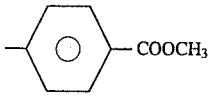 |
| 109 | $-COOC_3H_7$ | 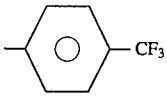 |
| 110 | $-COOC_3H_7$ | 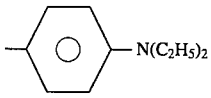 |
| 111 | $-COOC_3H_7$ | 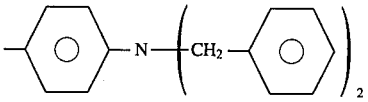 |
| 112 | $-COOC_3H_7$ | 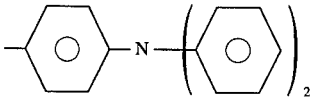 |
| 113 | $-COOC_3H_7$ | 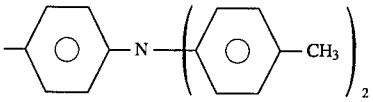 |
| 114 | $-COOC_3H_7$ | 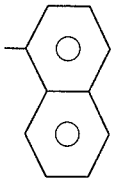 |

TABLE 18-continued
| | $Ar-CH=C(CN)-X$ | (2) |
|---|---|---|
| Compound No. | X | Ar |
| 115 | $-COOC_3H_7$ | 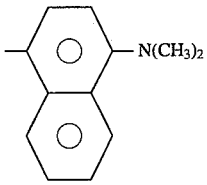 |
| 116 | $-COOC_3H_7$ | 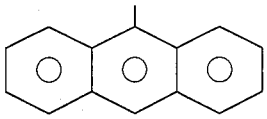 |
| 117 | $-COOC_3H_7$ | 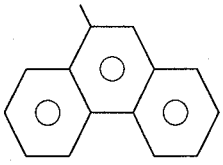 |
| 118 | $-COOC_3H_7$ | 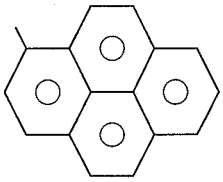 |
| 119 | $-COOC_3H_7$ | 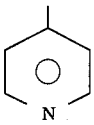 |
| 120 | $-COOC_3H_7$ | 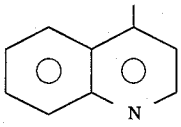 |
| 121 | $-COOC_3H_7$ | 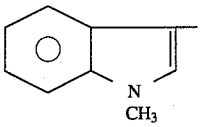 |
| 122 | $-COOC_3H_7$ | 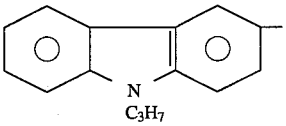 |
| 123 | $-COOC_3H_7$ | 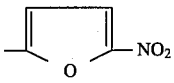 |
| 124 | $-COOC_3H_7$ | 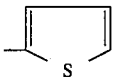 |
| 125 | $-COOC_3H_7$ | 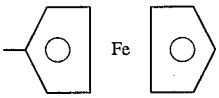 |

TABLE 18-continued
$$Ar-CH=\overset{\overset{\displaystyle CN}{|}}{C}-X \qquad (2)$$
| Compound No. | X | Ar |
|---|---|---|
| 126 | $-COOCH(CH_3)_2$ | 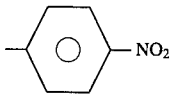 |
| 127 | $-COOCH(CH_3)_2$ | 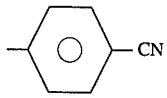 |
| 128 | $-COOCH(CH_3)_2$ | 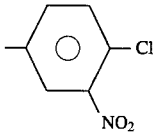 |
| 129 | $-COOCH(CH_3)_2$ | 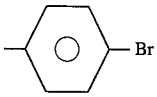 |
| 130 | $-COOCH(CH_3)_2$ | 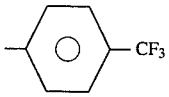 |
| 131 | $-COOCH(CH_3)_2$ | 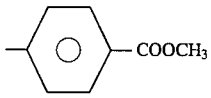 |
| 132 | $-COOCH(CH_3)_2$ | 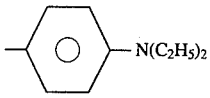 |
| 133 | $-COOCH(CH_3)_2$ | 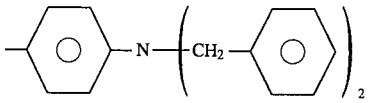 |
| 134 | $-COOCH(CH_3)_2$ | 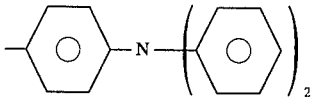 |
| 135 | $-COOCH(CH_3)_2$ | 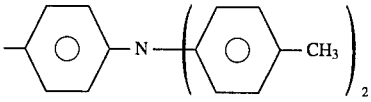 |
| 136 | $-COOCH(CH_3)_2$ | 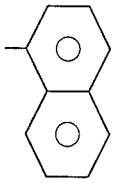 |
| 137 | $-COOCH(CH_3)_2$ | 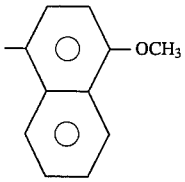 |

TABLE 18-continued
$$Ar-CH=\overset{\overset{\displaystyle CN}{|}}{C}-X \qquad (2)$$
| Compound No. | X | Ar |
|---|---|---|
| 138 | $-COOCH(CH_3)_2$ | 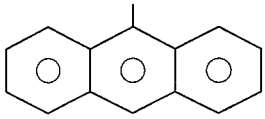 |
| 139 | $-COOCH(CH_3)_2$ | 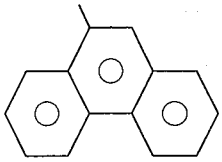 |
| 140 | $-COOCH(CH_3)_2$ | 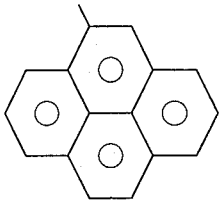 |
| 141 | $-COOCH(CH_3)_2$ | 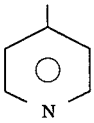 |
| 142 | $-COOCH(CH_3)_2$ | 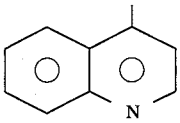 |
| 143 | $-COOCH(CH_3)_2$ | 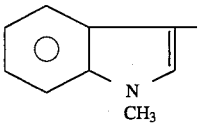 |
| 144 | $-COOCH(CH_3)_2$ | 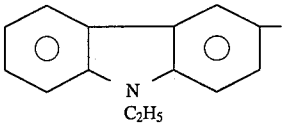 |
| 145 | $-COOCH(CH_3)_2$ | 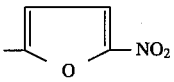 |
| 146 | $-COOCH(CH_3)_2$ | 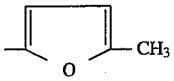 |
| 147 | $-COOCH(CH_3)_2$ | 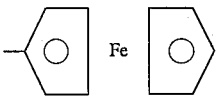 |

TABLE 19
$Ar-CH=C(COOR)_2$ (3)
| Compound No. | R | Ar |
|---|---|---|
| 148 | $-CH_3$ | 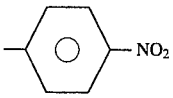 |
| 149 | $-CH_3$ | 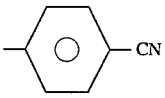 |
| 150 | $-CH_3$ | 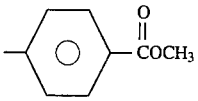 |
| 151 | $-CH_3$ | 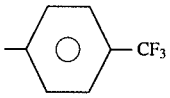 |
| 152 | $-CH_3$ | 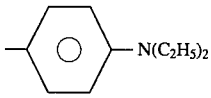 |
| 153 | $-CH_3$ | 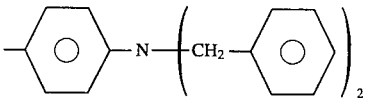 |
| 154 | $-CH_3$ | 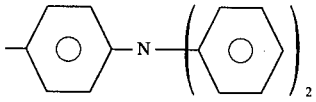 |
| 155 | $-CH_3$ | 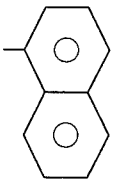 |
| 156 | $-CH_3$ | 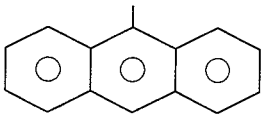 |
| 157 | $-CH_3$ | 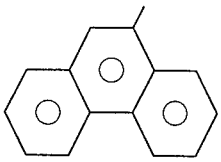 |
| 158 | $-CH_3$ | 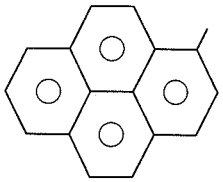 |

TABLE 19-continued
| Compound No. | R | Ar—CH=C(COOR)$_2$ (3) Ar |
|---|---|---|
| 159 | $-CH_3$ | 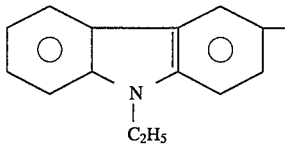 |
| 160 | $-CH_3$ | 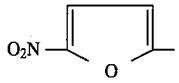 |
| 161 | $-C_4H_9$ | 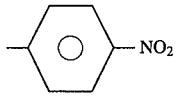 |
| 162 | $-C_4H_9$ | 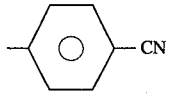 |
| 163 | $-C_4H_9$ | 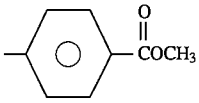 |
| 164 | $-C_4H_9$ | 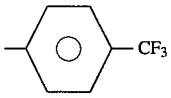 |
| 165 | $-C_4H_9$ | 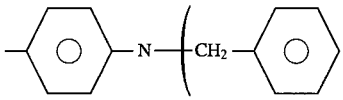 |
| 166 | $-C_4H_9$ | 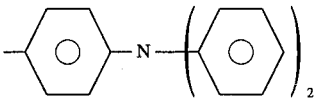 |
| 167 | $-C_4H_9$ | 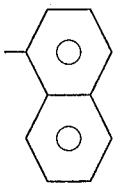 |
| 168 | $-C_4H_9$ | 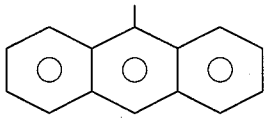 |
| 169 | $-C_4H_9$ | 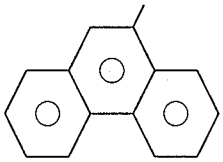 |
| 170 | $-C_4H_9$ | 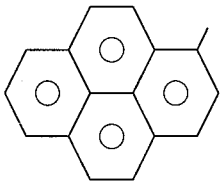 |

TABLE 19-continued
| Compound No. | R | $Ar-CH=C(COOR)_2$ (3) Ar |
|---|---|---|
| 171 | $-C_4H_9$ | 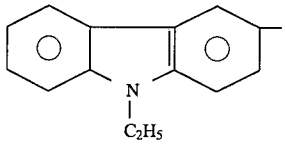 |
| 172 | $-C_4H_9$ | 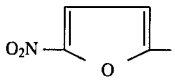 |
| 173 | $-\overset{\vert}{C}(CH_3)_2$ | 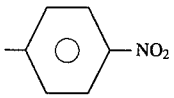 |
| 174 | $-\overset{\vert}{C}(CH_3)_2$ | 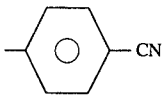 |
| 175 | $-\overset{\vert}{C}(CH_3)_2$ | 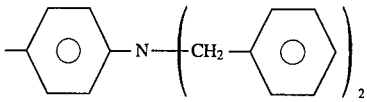 |
| 176 | $-\overset{\vert}{C}(CH_3)_2$ | 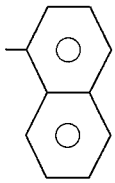 |
| 177 | $-\overset{\vert}{C}(CH_3)_2$ | 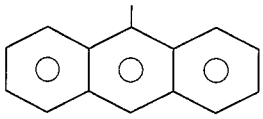 |
| 178 | $-\overset{\vert}{C}(CH_3)_2$ | 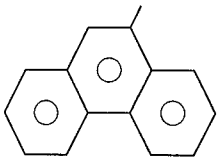 |
| 179 | $-\overset{\vert}{C}(CH_3)_2$ | 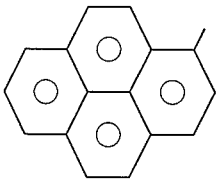 |
| 180 | $-\overset{\vert}{C}(CH_3)_2$ | 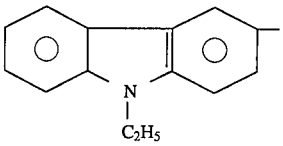 |
| 181 | $-\overset{\vert}{C}(CH_3)_2$ | 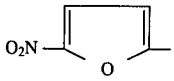 |

TABLE 20
(4)
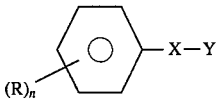
| Compound No. | Formula |
|---|---|
| 1 | 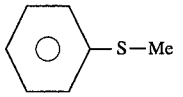  |
| 2 | 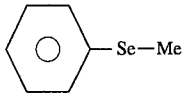  |
| 3 | 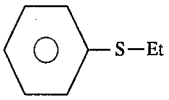  |
| 4 | 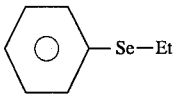  |
| 5 | 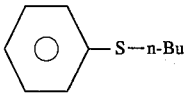  |
| 6 | 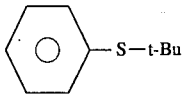  |
| 7 | 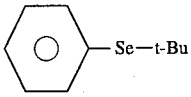  |
| 8 | 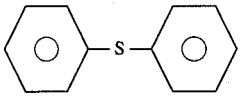  |
| 9 | 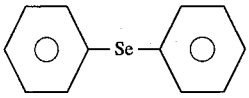  |
| 10 | 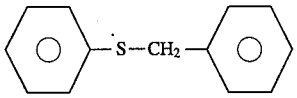  |
| 11 | 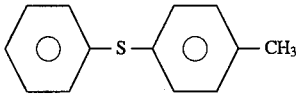  |
| 12 | 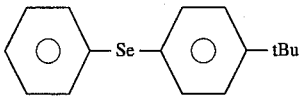  |
| 13 | 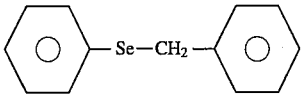  |
TABLE 20-continued
(4)
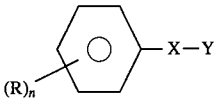
| Compound No. | Formula |
|---|---|
| 14 | 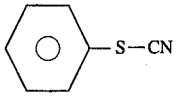  |
| 15 | 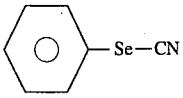  |
| 16 | 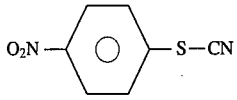  |
| 17 | 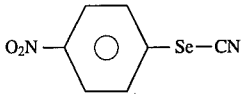  |
| 18 | 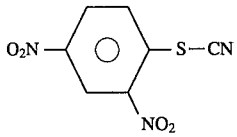  |
| 19 | 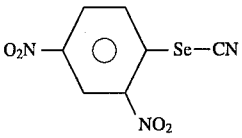  |
| 20 | 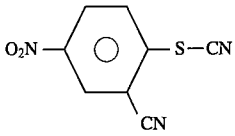  |
| 21 | 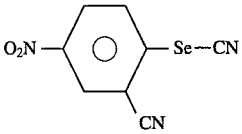  |
| 22 | 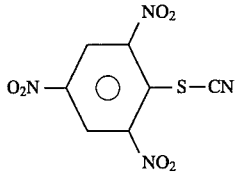  |
| 23 | 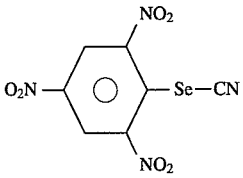  |

TABLE 20-continued
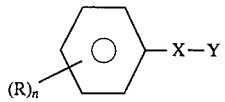
(4)
| Compound No. | Formula |
|---|---|
| 24 | 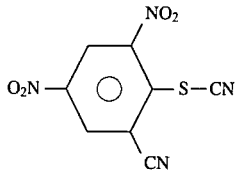  |
| 25 | 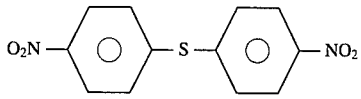  |
| 26 | 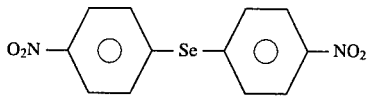  |
| 27 | 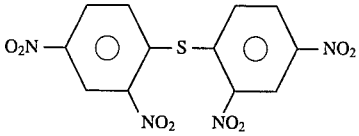  |
| 28 | 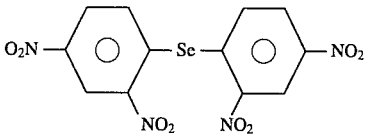  |
| 29 | 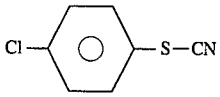  |
| 30 | 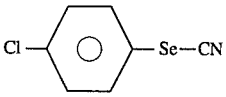  |
| 31 | 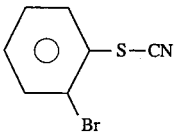  |
| 32 | 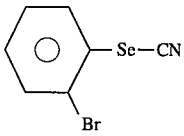  |
| 33 | 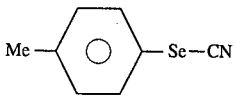  |
| 34 | 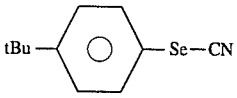  |
TABLE 20-continued
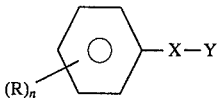
(4)
| Compound No. | Formula |
|---|---|
| 35 | 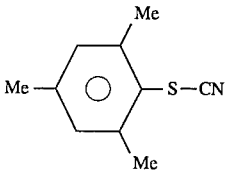  |
| 36 | 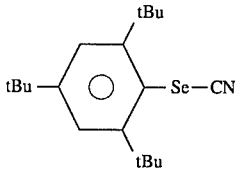  |
TABLE 21
$Ar-CH=CHNO_2$ (5)
| Compound No. | Ar |
|---|---|
| 1 | 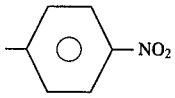  |
| 2 | 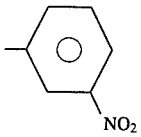  |
| 3 | 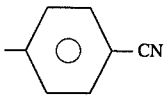  |
| 4 | 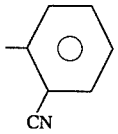  |
| 5 | 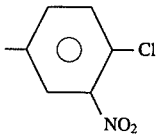  |
| 6 | 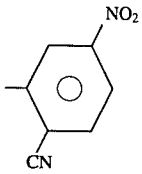  |
| 7 | 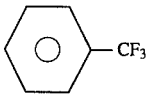  |

TABLE 21-continued
$Ar-CH=CHNO_2$ (5)
| Compound No. | Ar |
|---|---|
| 8 | 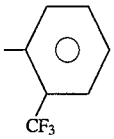 |
| 9 | 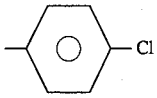 |
| 10 | 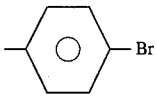 |
| 11 | 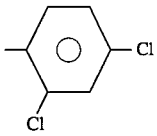 |
| 12 | 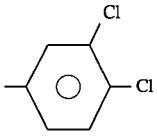 |
| 13 | 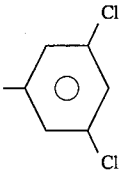 |
| 14 | 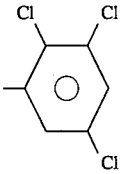 |
| 15 | 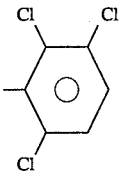 |
| 16 | 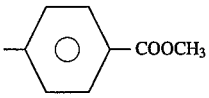 |
| 17 | 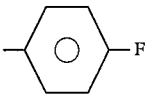 |
| 18 | 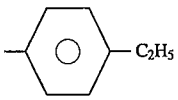 |
TABLE 21-continued
$Ar-CH=CHNO_2$ (5)
| Compound No. | Ar |
|---|---|
| 19 | 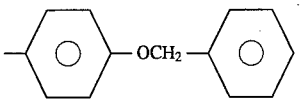 |
| 20 | 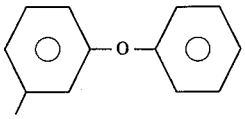 |
| 21 | 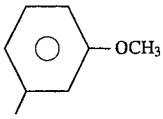 |
| 22 | 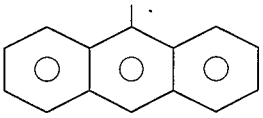 |
| 23 | 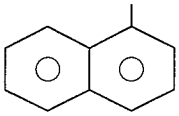 |
| 24 | 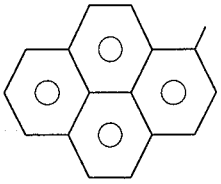 |
| 25 | 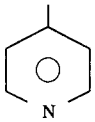 |
| 26 | 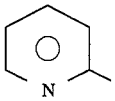 |
| 27 | 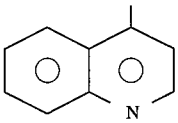 |
| 28 | 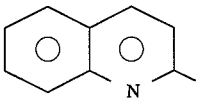 |
| 29 | 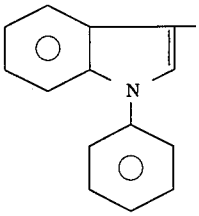 |

TABLE 21-continued
$Ar-CH=CHNO_2$ (5)
| Compound No. | Ar |
|---|---|
| 30 | 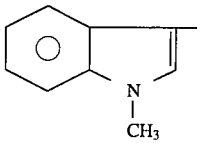 |
| 31 | 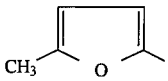 |
| 32 | 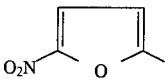 |
TABLE 21-continued
$Ar-CH=CHNO_2$ (5)
| Compound No. | Ar |
|---|---|
| 33 | 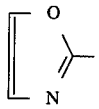 |
| 34 | 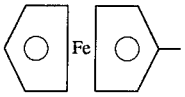 |
TABLE 22
$R^1-C(=O)-CH=CH-R^2$ (6)
| Compound No. | $R^1$ | $R^2$ |
|---|---|---|
| 1 | 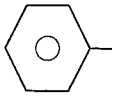 | 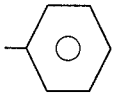 |
| 2 | 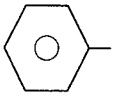 | 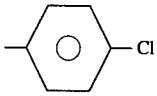 |
| 3 | 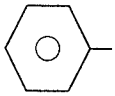 | 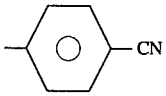 |
| 4 | 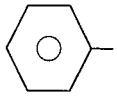 | 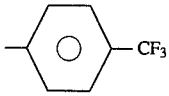 |
| 5 | 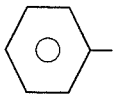 | 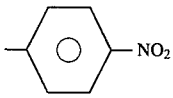 |
| 6 | 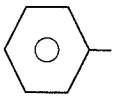 | 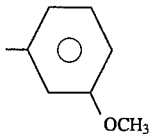 |
| 7 | 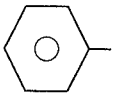 | 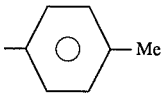 |
| 8 | 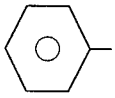 | 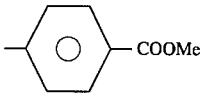 |
| 9 | 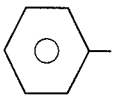 | 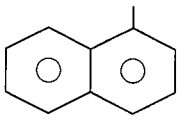 |

TABLE 22-continued
$$R^1-\underset{\underset{O}{\|}}{C}-CH=CH-R^2 \quad (6)$$
| Compound No. | $R^1$ | $R^2$ |
|---|---|---|
| 10 | 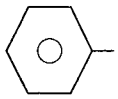 | 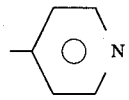 |
| 11 | 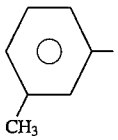 | 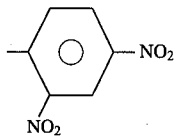 |
| 12 | 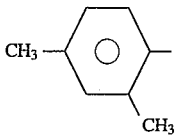 | 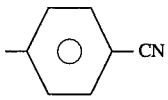 |
| 13 | 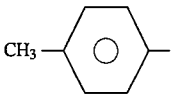 | 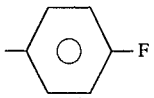 |
| 14 | 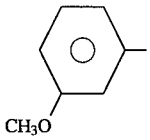 | 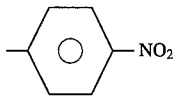 |
| 15 | 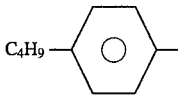 | 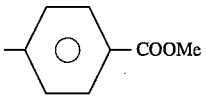 |
| 16 | 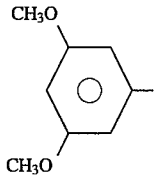 | 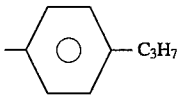 |
| 17 | 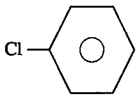 | 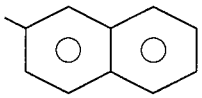 |
| 18 | 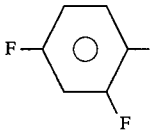 | 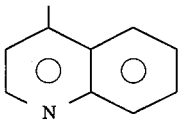 |
| 19 | 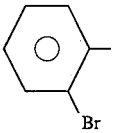 | 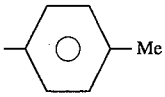 |
| 20 | 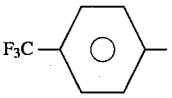 | 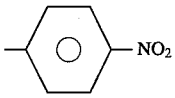 |

TABLE 22-continued
$R^1-\underset{\underset{O}{\|}}{C}-CH=CH-R^2$ (6)
| Compound No. | $R^1$ | $R^2$ |
|---|---|---|
| 21 | 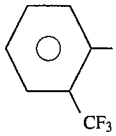 | 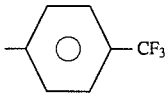 |
| 22 | 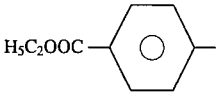 | 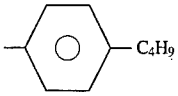 |
| 23 | 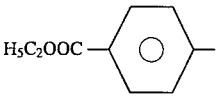 | 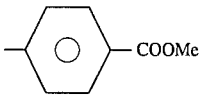 |
| 24 | 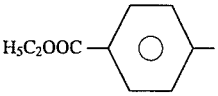 | 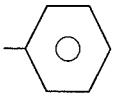 |
| 25 | 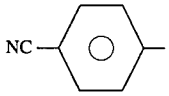 | 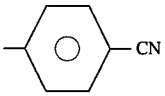 |
| 26 | 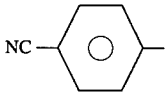 | 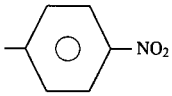 |
| 27 | 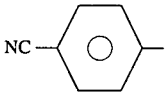 | 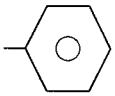 |
| 28 | 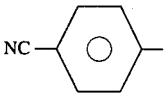 | 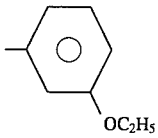 |
| 29 | 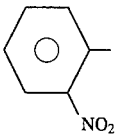 | 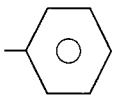 |
| 30 | 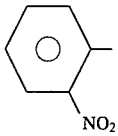 | 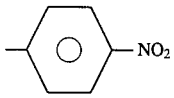 |
| 31 | 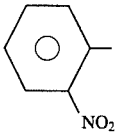 | 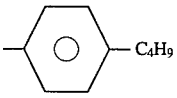 |
| 32 | 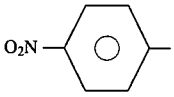 | 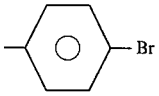 |

TABLE 22-continued
$$R^1-\underset{\underset{O}{\|}}{C}-CH=CH-R^2 \quad (6)$$
| Compound No. | $R^1$ | $R^2$ |
|---|---|---|
| 33 | 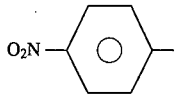 | 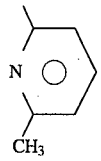 |
| 34 | 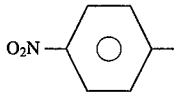 | 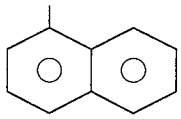 |
| 35 | 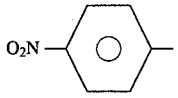 | 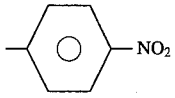 |
| 36 | 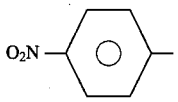 | 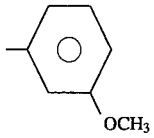 |
| 37 | 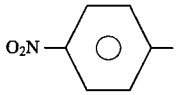 | 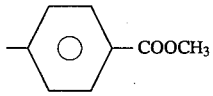 |
| 38 | 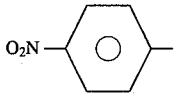 | 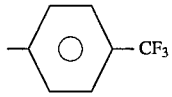 |
| 39 | 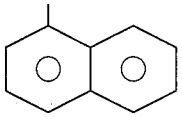 | 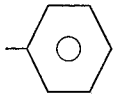 |
| 40 | 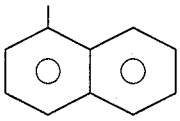 | 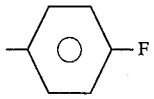 |
| 41 | 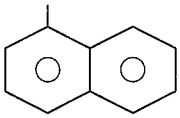 | 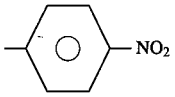 |
| 42 | 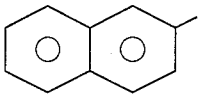 | 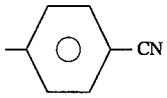 |
| 43 | 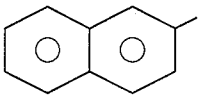 | 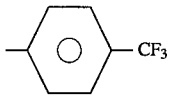 |
| 44 | 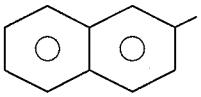 | 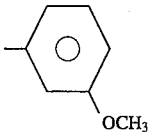 |

TABLE 22-continued
$R^1-\underset{\underset{O}{\|}}{C}-CH=CH-R^2$ (6)
| Compound No. | $R^1$ | $R^2$ |
|---|---|---|
| 45 | 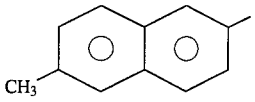 | 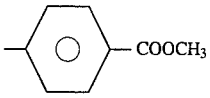 |
| 46 | 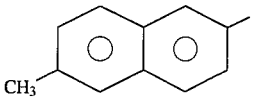 | 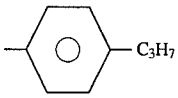 |
| 47 | 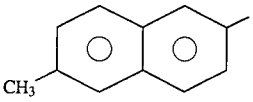 | 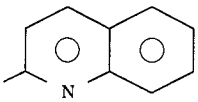 |
| 48 | 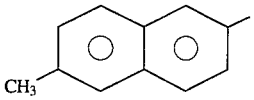 | 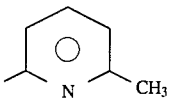 |
| 49 | 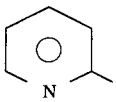 | 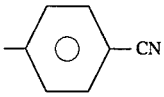 |
| 50 | 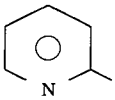 | 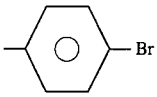 |
| 51 | 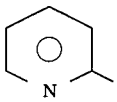 | 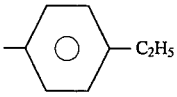 |
| 52 | 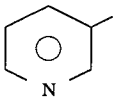 | 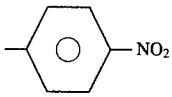 |
| 53 | 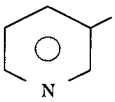 | 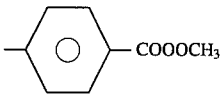 |
| 54 | 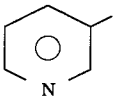 | 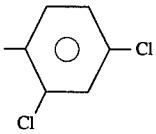 |
| 55 | 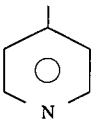 | 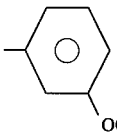 |
| 56 | 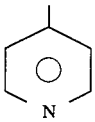 | 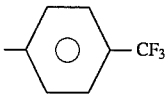 |

TABLE 22-continued
$$R^1-\underset{\underset{O}{\|}}{C}-CH=CH-R^2 \quad (6)$$
| Compound No. | $R^1$ | $R^2$ |
|---|---|---|
| 57 | 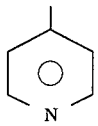 | 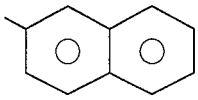 |
| 58 | 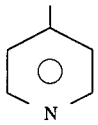 | 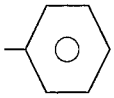 |
| 59 | 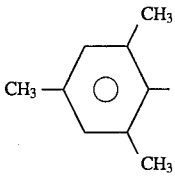 | 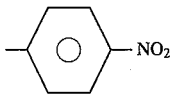 |
| 60 | 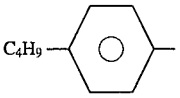 | 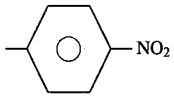 |
| 61 | 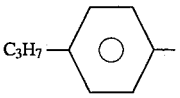 | 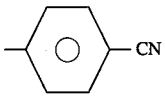 |
| 62 | 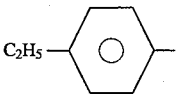 | 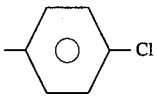 |
| 63 | 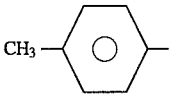 | 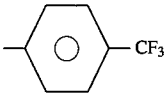 |
| 64 | 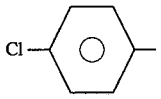 | 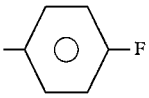 |
| 65 | 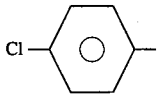 | 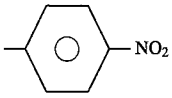 |
| 66 | 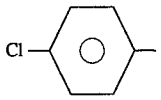 | 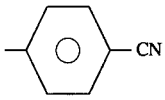 |

TABLE 23

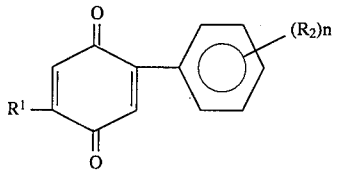

(7)

| Compound No. | $R^1$ | $R^2$ |
|---|---|---|
| 1 | H | 4'-$NO_2$ |
| 2 | H | 3'-$NO_2$ |
| 3 | H | 3'-$COOC_2H_5$-4'-$NO_2$ |
| 4 | H | 3'-$NO_2$-4'-F |
| 5 | H | 3'-$NO_2$-4'-Cl |
| 6 | H | 3'-$NO_2$-4'-$CH_3$ |
| 7 | H | 4'-CN |
| 8 | H | 3'-CN |
| 9 | H | 3'-$CF_3$-4'-CN |
| 10 | H | 4'-Cl |
| 11 | H | 3'-Cl |
| 12 | H | 4'-Br |
| 13 | H | 3'-Br |
| 14 | H | 3'-Cl-4'-$CH_3$ |
| 15 | H | 3'-$CF_3$-4'-F |
| 16 | H | 3'-$CF_3$-4'-Cl |
| 17 | H | 3'-Cl-4'-F |
| 18 | H | 3',4'-diF |
| 19 | H | 3',4'-diCl |
| 20 | H | 3',5'-diCl |
| 21 | H | 2',4',5'-triCl |
| 22 | H | 4'-$COOC_2H_5$ |
| 23 | H | 4'-$COOC_4H_9$ |
| 24 | H | 4'-$CONHC_4H_9$ |
| 25 | H | 4'-$CON(C_4H_9)_2$ |
| 26 | H | 3'-$CF_3$ |
| 27 | H | 4'-$CF_3$ |
| 28 | H | 4'-$CH_3$ |
| 29 | H | 4'-$C_2H_5$ |
| 30 | H | 4'-$C_4H_9$ |
| 31 | H | 4'-$C_6H_{13}$ |
| 32 | H | 3'- 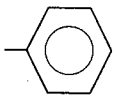 |
| 33 | H | 3',4'-di$CH_3$ |
| 34 | H | H |
| 35 | Cl | 4'-$NO_2$ |
| 36 | Cl | 3'-$NO_2$ |
| 37 | Cl | 3'-$NO_2$-4'-$CH_3$ |
| 38 | Cl | 4'-CN |
| 39 | Cl | 4'-Cl |
| 40 | Cl | 3'-$CF_3$-4'-F |
| 41 | Cl | 3',4'-diCl |
| 42 | Cl | 4'-$COOC_2H_5$ |
| 43 | Cl | 4'-$CF_3$ |
| 44 | Cl | 4'-$C_4H_9$ |
| 45 | Br | 4'-$NO_2$ |
| 46 | Br | 4'-CN |
| 47 | Br | 4'-$COOC_2H_5$ |
| 48 | Br | 4'-$CF_3$ |
| 49 | 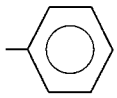 | 4'-$NO_2$ |
| 50 | 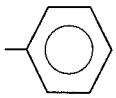 | 3'-$NO_2$ |

TABLE 23-continued

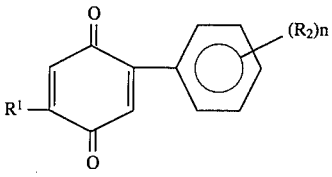

(7)

| Compound No. | $R^1$ | $R^2$ |
|---|---|---|
| 51 | 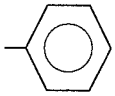 | 3'-$NO_2$-4'-$CH_3$ |
| 52 | 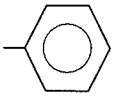 | 4'-CN |
| 53 | 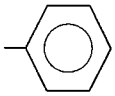 | 4'-Cl |
| 54 | 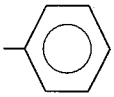 | 3',4'-diCl |
| 55 | 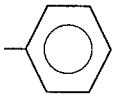 | 4'-$COOC_2H_5$ |
| 56 | 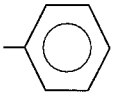 | 4'-$COOC_4H_9$ |
| 57 | 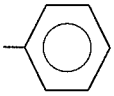 | 4'-$COON(C_4H_9)_2$ |
| 58 | 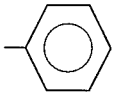 | 4'-$CF_3$ |
| 59 | 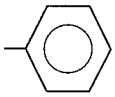 | 4'-$C_2H_5$ |
| 60 | 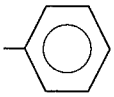 | 4'-$C_4H_9$ |
| 61 | 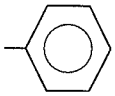 | H |
| 62 | 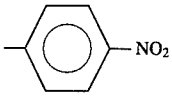 | 4'-$NO_2$ |
| 63 | 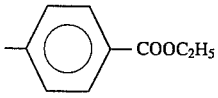 | 4'-$COOC_2H_5$ |

TABLE 23-continued
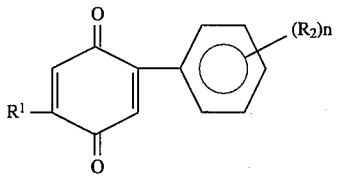
(7)
| Compound No. | $R^1$ | $R^2$ |
|---|---|---|
| 64 | 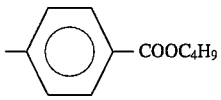 | 4'-$COOC_4H_9$ |
| 65 | 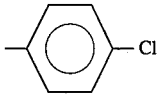 | 4'-Cl |
| 66 | 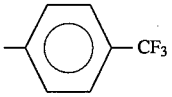 | 4'-$CF_3$ |
| 67 | 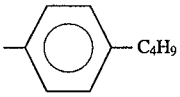 | 4'-$C_4H_9$ |
| 68 | $-CH_3$ | 4'-$NO_2$ |
| 69 | $-CH_3$ | 4'-CN |
| 70 | $-CH_3$ | 4'-Cl |
| 71 | $-CH_3$ | 4'-$COOC_2H_5$ |
| 72 | $-CH_3$ | 4'-$COOC_4H_9$ |
| 73 | $-CH_3$ | 4'-$CF_3$ |
| 74 | $-CH_3$ | 4'-$C_2H_5$ |
| 75 | $-CH_3$ | 4'-$C_4H_9$ |
TABLE 24
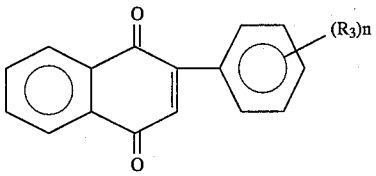
(8)
| Compound No. | $R^3$ |
|---|---|
| 76 | 4'-$NO_2$ |
| 77 | 3'-$NO_2$ |
| 78 | 4'-CN |
| 79 | 4'-Cl |
| 80 | 3'-Cl |
| 81 | 4'-$COOC_2H_5$ |
| 82 | 4'-$COOC_4H_9$ |
| 83 | 4'-$CF_3$ |
| 84 | 4'-$C_2H_5$ |
| 85 | 4'-$C_4H_9$ |
| 86 | 4'-$C_6H_{13}$ |
| 87 | H |
TABLE 25
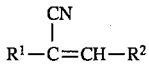
(9)
| Compound No. | $R^1$ | $R^2$ |
|---|---|---|
| 1 | 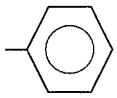 | 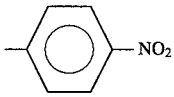 |
| 2 | 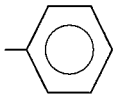 | 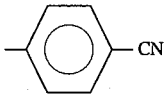 |
| 3 | 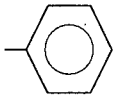 | 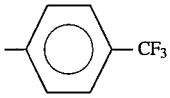 |
| 4 | 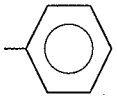 | 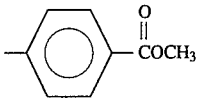 |
| 5 | 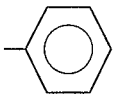 | 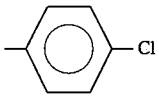 |
| 6 | 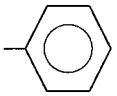 | 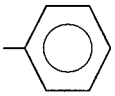 |
| 7 | 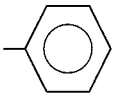 | 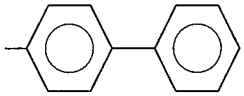 |
| 8 | 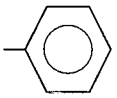 | 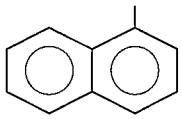 |
| 9 | 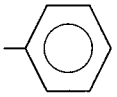 | 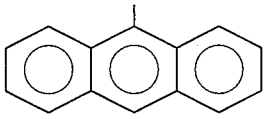 |
| 10 | 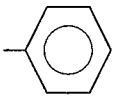 | 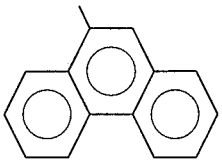 |
| 11 | 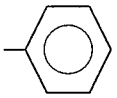 | 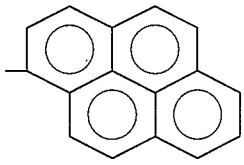 |
| 12 | 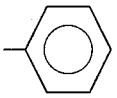 | 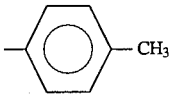 |

TABLE 25-continued
$$R^1-\overset{\overset{\displaystyle CN}{|}}{C}=CH-R^2 \quad (9)$$
| Compound No. | $R^1$ | $R^2$ |
|---|---|---|
| 13 | 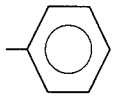 | 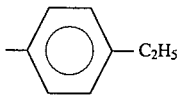 |
| 14 | 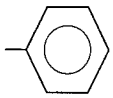 | 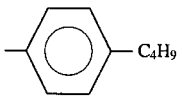 |
| 15 | 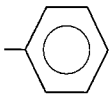 | 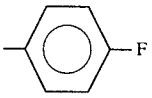 |
| 16 | 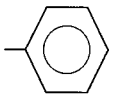 | 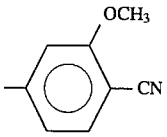 |
| 17 | 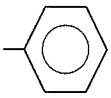 | 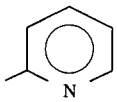 |
| 18 | 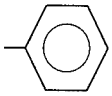 | 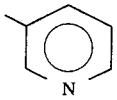 |
| 19 | 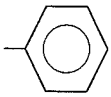 | 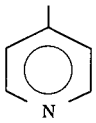 |
| 20 | 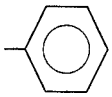 | 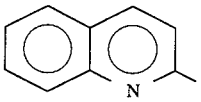 |
| 21 | 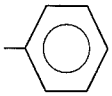 | 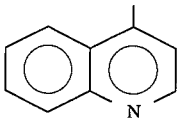 |
| 22 | 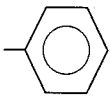 | 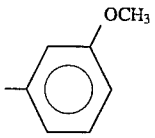 |
| 23 | 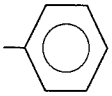 | 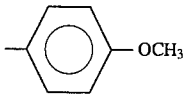 |
| 24 | 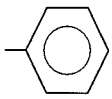 | 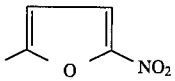 |
TABLE 25-continued
$$R^1-\overset{\overset{\displaystyle CN}{|}}{C}=CH-R^2 \quad (9)$$
| Compound No. | $R^1$ | $R^2$ |
|---|---|---|
| 25 | 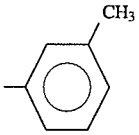 | 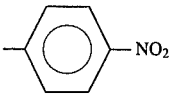 |
| 26 | 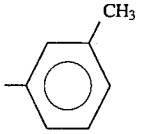 | 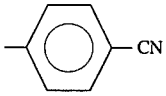 |
| 27 | 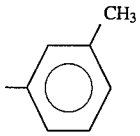 | 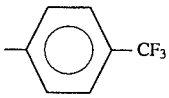 |
| 28 | 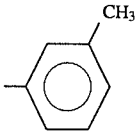 | 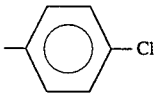 |
| 29 | 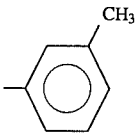 | 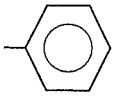 |
| 30 | 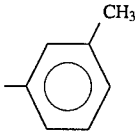 | 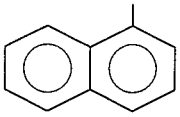 |
| 31 | 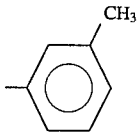 | 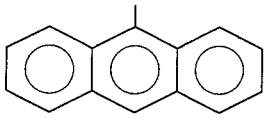 |
| 32 | 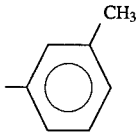 | 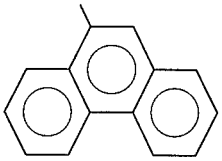 |
| 33 | 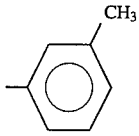 | 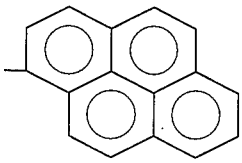 |

TABLE 25-continued
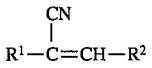
(9)
| Compound No. | $R^1$ | $R^2$ |
|---|---|---|
| 34 | 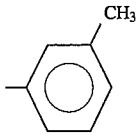 | 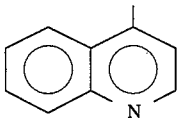 |
| 35 | 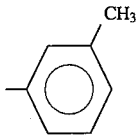 | 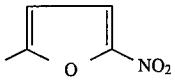 |
| 36 | 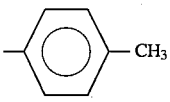 | 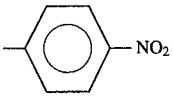 |
| 37 | 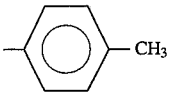 | 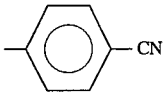 |
| 38 | 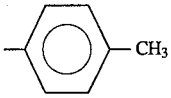 | 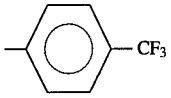 |
| 39 | 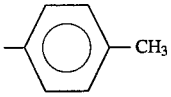 | 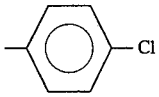 |
| 40 | 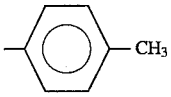 | 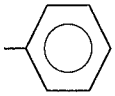 |
| 41 | 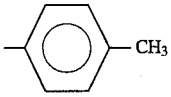 | 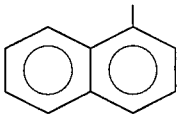 |
| 42 | 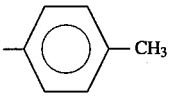 | 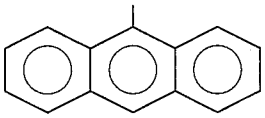 |
| 43 | 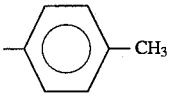 | 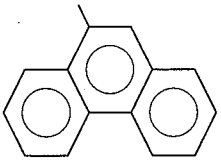 |
TABLE 25-continued
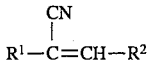
(9)
| Compound No. | $R^1$ | $R^2$ |
|---|---|---|
| 44 | 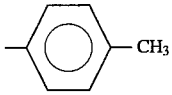 | 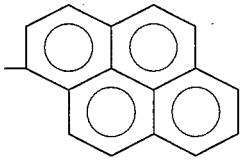 |
| 45 | 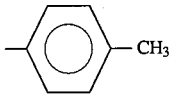 | 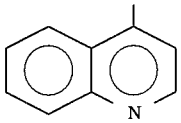 |
| 46 | 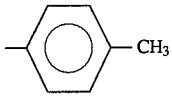 | 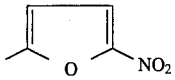 |
| 47 | 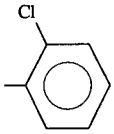 | 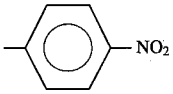 |
| 48 | 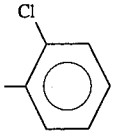 | 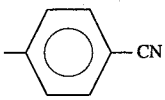 |
| 49 | 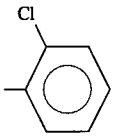 | 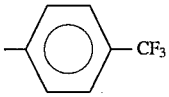 |
| 50 | 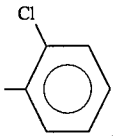 | 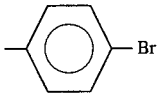 |
| 51 | 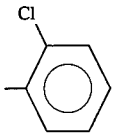 | 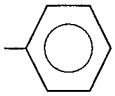 |
| 52 | 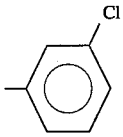 | 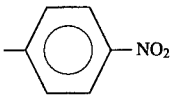 |

TABLE 25-continued
$$R^1-\overset{\overset{\displaystyle CN}{|}}{C}=CH-R^2 \quad (9)$$
| Compound No. | $R^1$ | $R^2$ |
|---|---|---|
| 53 | 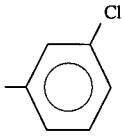 | 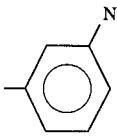 |
| 54 | 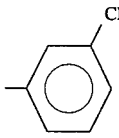 | 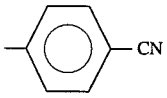 |
| 55 | 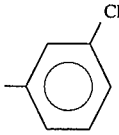 | 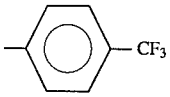 |
| 56 | 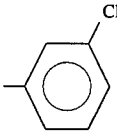 | 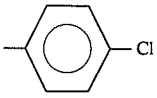 |
| 57 | 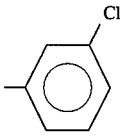 | 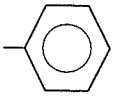 |
| 58 | 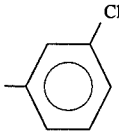 | 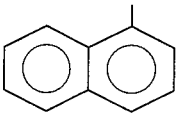 |
| 59 | 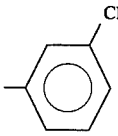 | 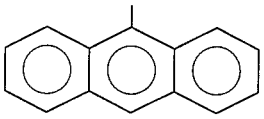 |
| 60 | 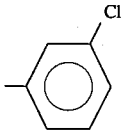 | 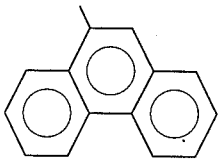 |
| 61 | 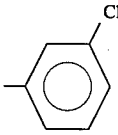 | 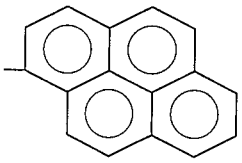 |
TABLE 25-continued
$$R^1-\overset{\overset{\displaystyle CN}{|}}{C}=CH-R^2 \quad (9)$$
| Compound No. | $R^1$ | $R^2$ |
|---|---|---|
| 62 | 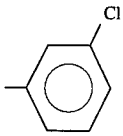 | 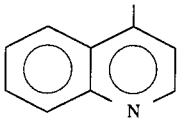 |
| 63 | 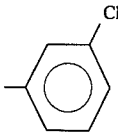 | 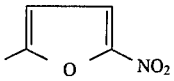 |
| 64 | 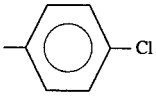 | 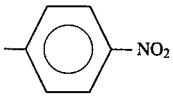 |
| 65 | 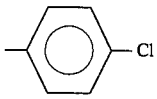 | 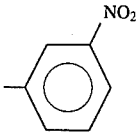 |
| 66 | 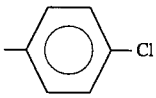 | 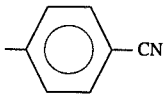 |
| 67 | 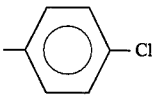 | 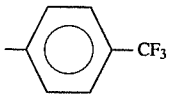 |
| 68 | 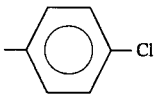 | 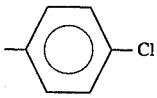 |
| 69 | 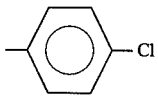 | 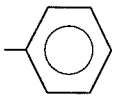 |
| 70 | 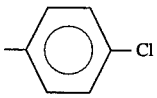 | 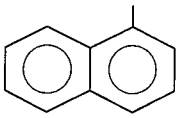 |
| 71 | 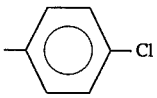 | 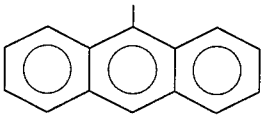 |
| 72 | 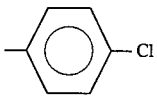 | 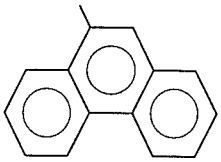 |

TABLE 25-continued
$$R^1-\overset{\overset{\displaystyle CN}{|}}{C}=CH-R^2 \quad (9)$$
| Compound No. | $R^1$ | $R^2$ |
|---|---|---|
| 73 | 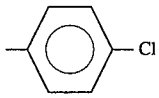 | 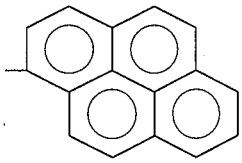 |
| 74 | 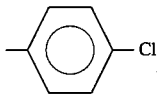 | 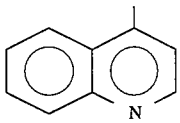 |
| 75 | 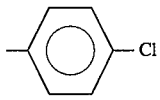 | 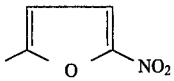 |
| 76 | 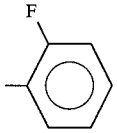 | 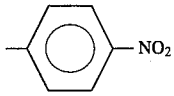 |
| 77 | 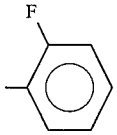 | 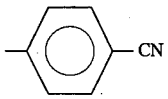 |
| 78 | 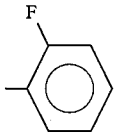 | 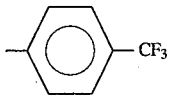 |
| 79 | 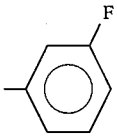 | 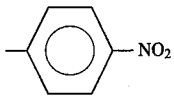 |
| 80 | 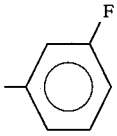 | 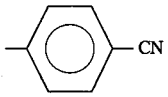 |
| 81 | 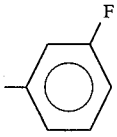 | 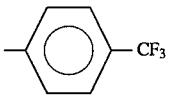 |
| 82 | 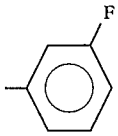 | 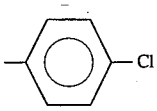 |
TABLE 25-continued
$$R^1-\overset{\overset{\displaystyle CN}{|}}{C}=CH-R^2 \quad (9)$$
| Compound No. | $R^1$ | $R^2$ |
|---|---|---|
| 83 | 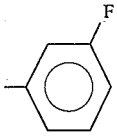 | 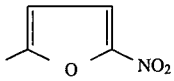 |
| 84 | 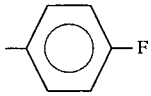 | 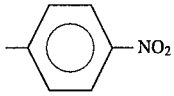 |
| 85 | 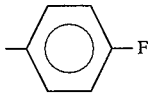 | 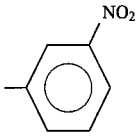 |
| 86 | 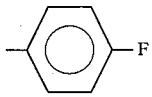 | 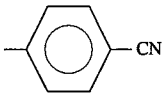 |
| 87 | 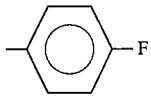 | 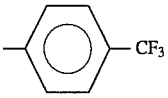 |
| 88 | 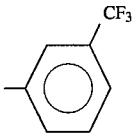 | 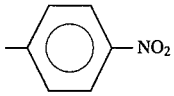 |
| 89 | 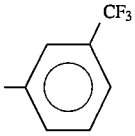 | 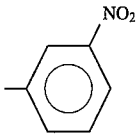 |
| 90 | 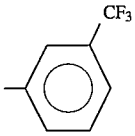 | 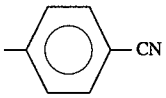 |
| 91 | 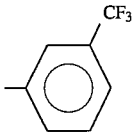 | 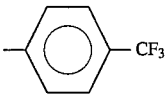 |
| 92 | 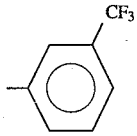 | 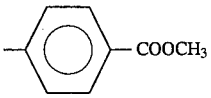 |
| 93 | 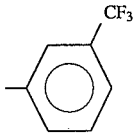 | 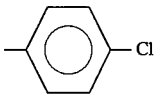 |

TABLE 25-continued
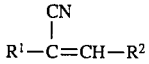
(9)
| Compound No. | $R^1$ | $R^2$ |
|---|---|---|
| 94 | 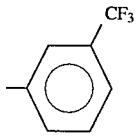 | 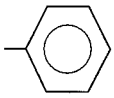 |
| 95 | 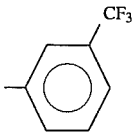 | 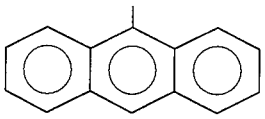 |
| 96 | 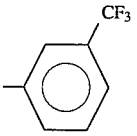 | 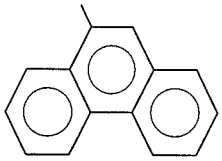 |
| 97 | 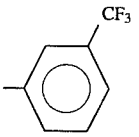 | 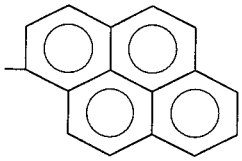 |
| 98 | 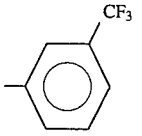 | 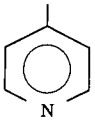 |
| 99 | 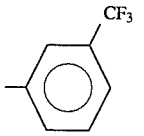 | 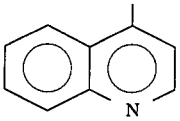 |
| 100 | 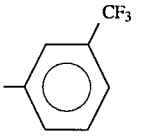 | 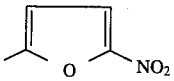 |
| 101 | 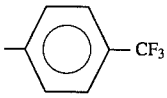 | 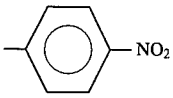 |
| 102 | 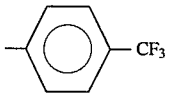 | 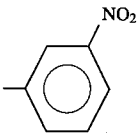 |
| 103 | 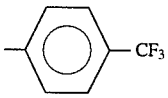 | 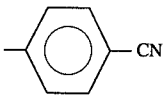 |
TABLE 25-continued
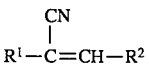
(9)
| Compound No. | $R^1$ | $R^2$ |
|---|---|---|
| 104 | 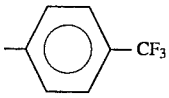 | 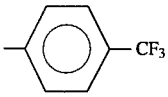 |
| 105 | 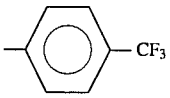 | 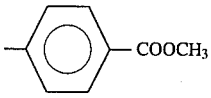 |
| 106 | 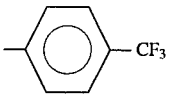 | 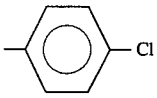 |
| 107 | 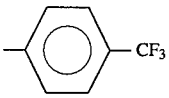 | 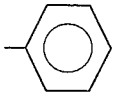 |
| 108 | 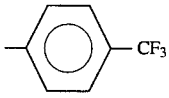 | 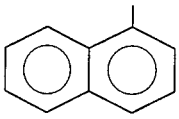 |
| 109 | 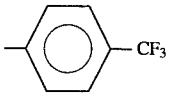 | 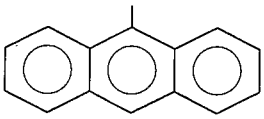 |
| 110 | 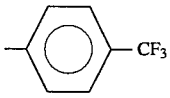 | 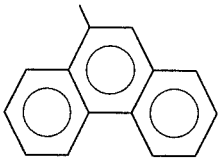 |
| 111 | 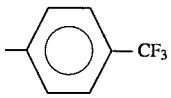 | 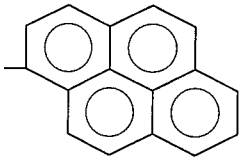 |
| 112 | 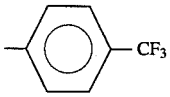 | 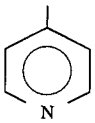 |
| 113 | 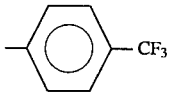 | 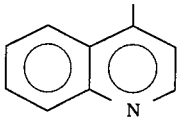 |
| 114 | 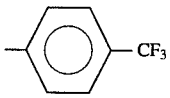 | 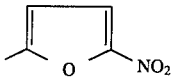 |

TABLE 25-continued
$$R^1-\overset{\overset{\displaystyle CN}{|}}{C}=CH-R^2 \quad (9)$$
| Compound No. | $R^1$ | $R^2$ |
|---|---|---|
| 115 | 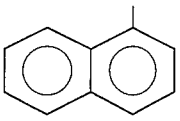 | 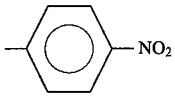 |
| 116 | 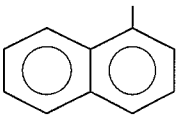 | 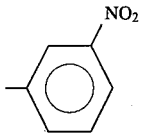 |
| 117 | 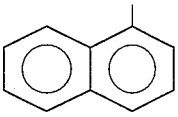 | 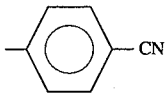 |
| 118 | 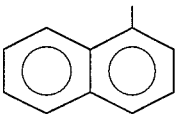 | 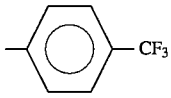 |
| 119 | 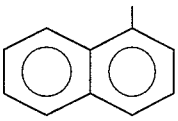 | 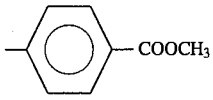 |
| 120 | 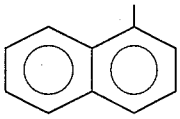 | 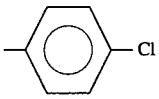 |
| 121 | 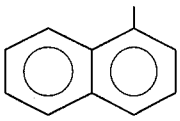 | 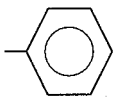 |
| 122 | 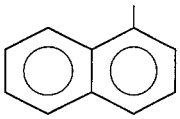 | 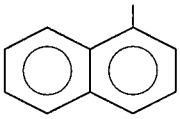 |
| 123 | 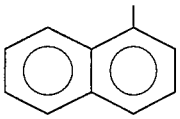 | 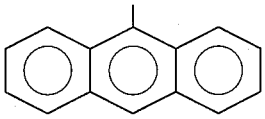 |
| 124 | 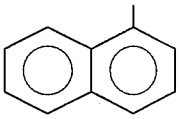 | 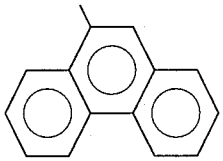 |
TABLE 25-continued
$$R^1-\overset{\overset{\displaystyle CN}{|}}{C}=CH-R^2 \quad (9)$$
| Compound No. | $R^1$ | $R^2$ |
|---|---|---|
| 125 | 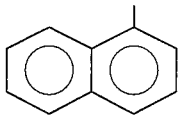 | 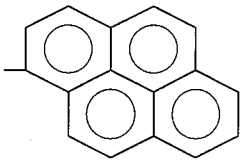 |
| 126 | 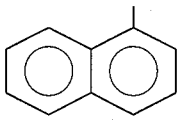 | 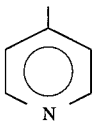 |
| 127 | 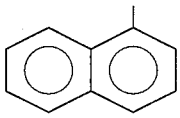 | 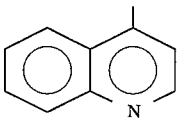 |
| 128 | 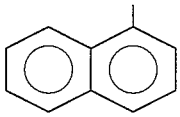 | 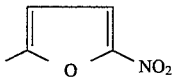 |
| 129 | 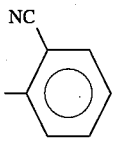 | 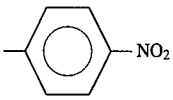 |
| 130 | 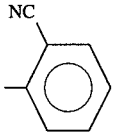 | 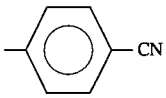 |
| 131 | 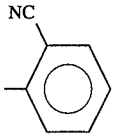 | 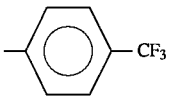 |
| 132 | 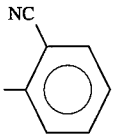 | 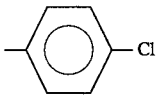 |
| 133 | 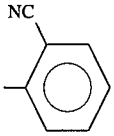 | 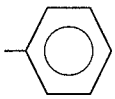 |
| 134 | 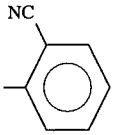 | 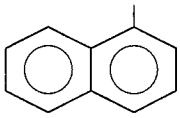 |

TABLE 25-continued
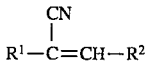
(9)
| Compound No. | $R^1$ | $R^2$ |
|---|---|---|
| 135 | 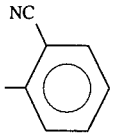 | 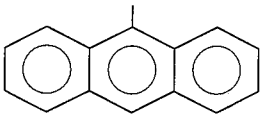 |
| 136 | 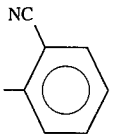 | 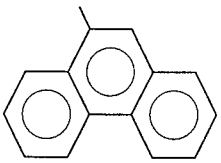 |
| 137 | 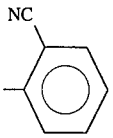 | 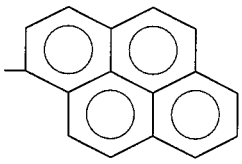 |
| 138 | 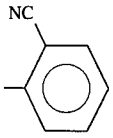 | 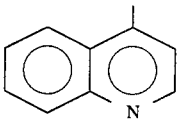 |
| 139 | 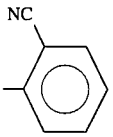 | 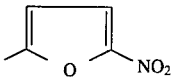 |
| 140 | 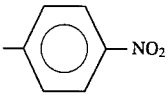 | 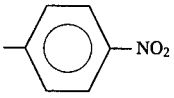 |
| 141 | 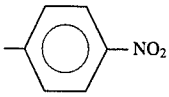 | 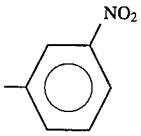 |
| 142 | 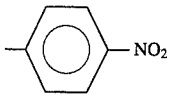 | 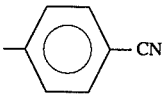 |
| 143 | 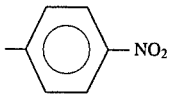 | 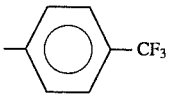 |
| 144 | 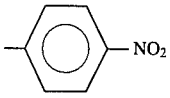 | 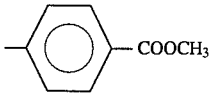 |
| 145 | 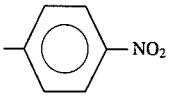 | 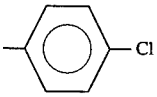 |
TABLE 25-continued
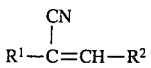
(9)
| Compound No. | $R^1$ | $R^2$ |
|---|---|---|
| 146 | 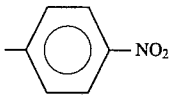 | 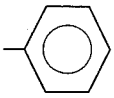 |
| 147 | 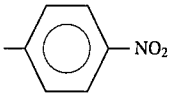 | 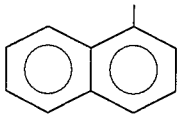 |
| 148 | 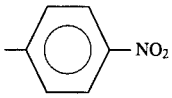 | 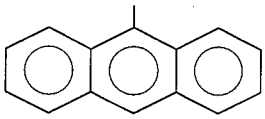 |
| 149 | 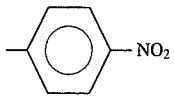 | 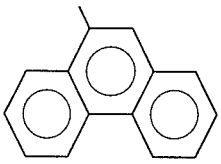 |
| 150 | 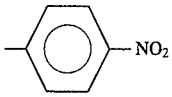 | 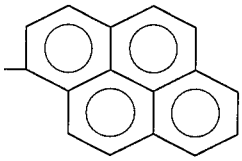 |
| 151 | 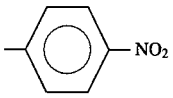 | 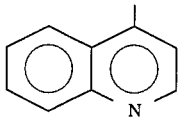 |
| 152 | 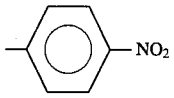 | 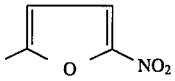 |
| 153 | 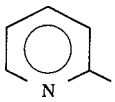 | 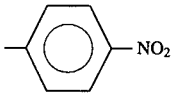 |
| 154 | 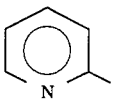 | 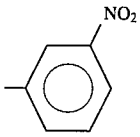 |
| 155 | 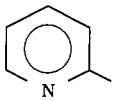 | 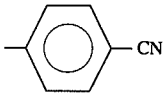 |
| 156 | 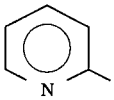 | 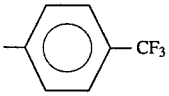 |

TABLE 25-continued
$$R^1-\overset{\overset{\displaystyle CN}{|}}{C}=CH-R^2 \quad (9)$$
| Compound No. | $R^1$ | $R^2$ |
|---|---|---|
| 157 | 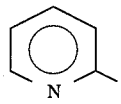 | 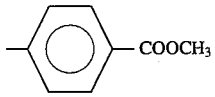 |
| 158 | 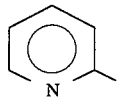 | 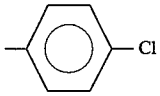 |
| 159 | 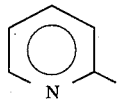 | 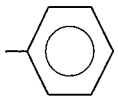 |
| 160 | 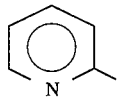 | 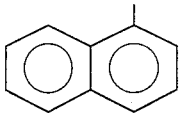 |
| 161 | 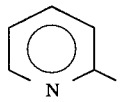 | 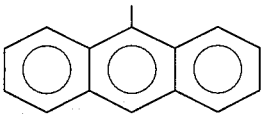 |
| 162 | 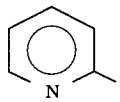 | 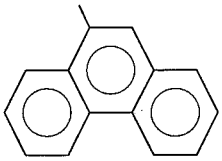 |
| 163 | 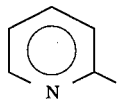 | 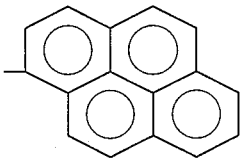 |
| 164 | 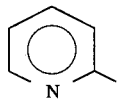 | 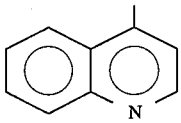 |
| 165 | 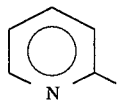 | 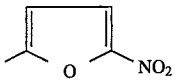 |
| 166 | 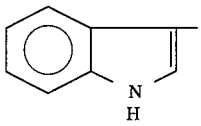 | 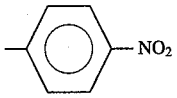 |
| 167 | 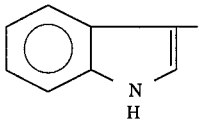 | 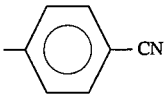 |
TABLE 25-continued
$$R^1-\overset{\overset{\displaystyle CN}{|}}{C}=CH-R^2 \quad (9)$$
| Compound No. | $R^1$ | $R^2$ |
|---|---|---|
| 168 | 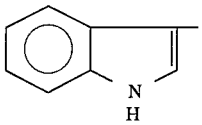 | 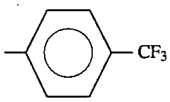 |
| 169 | 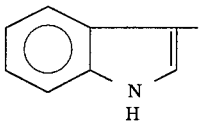 | 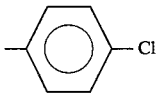 |
| 170 | 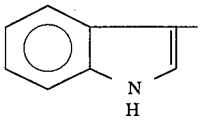 | 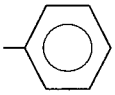 |
| 171 | 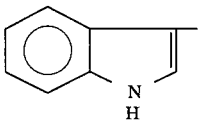 | 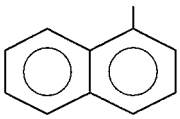 |
| 172 | 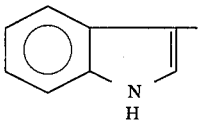 | 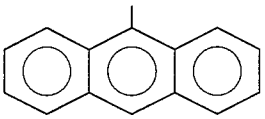 |
| 173 | 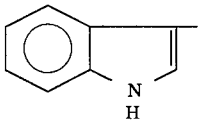 | 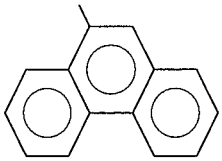 |
| 174 | 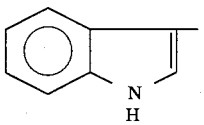 | 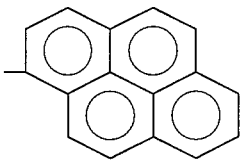 |
| 175 | 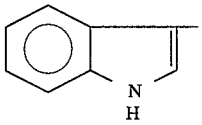 | 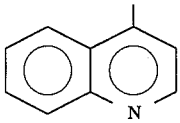 |
| 176 | 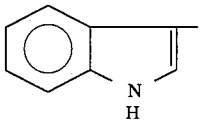 | 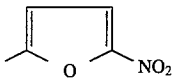 |

TABLE 26
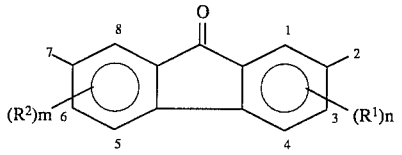
| Compound No. | $R^1$ | $R^2$ |
|---|---|---|
| 1 | 4-$COOCH_3$ | H |
| 2 | 4-$COOCH_3$ | 7-$NO_2$ |
| 3 | 2-$C(CH_3)_3$-4-$NO_2$ | 5-$NO_2$-7-$NO_2$ |
| 4 | 4-$COOC_2H_5$ | H |
| 5 | 2-$COOC_4H_9$ | H |
| 6 | 4-$COOC_4H_9$ | H |
| 7 | 4-$COOC_8H_{17}$ | H |
| 8 | 2-$C(CH_3)_3$-4-$COOC_4H_9$ | 7-$C(CH_3)_3$ |
| 9 | 4-CO 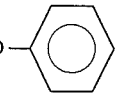 | H |
| 10 | 4-CO 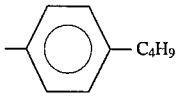 $C_4H_9$ | H |
| 11 | 2,4-di-$NO_2$ | 7-$NO_2$ |
| 12 | 2-CH= 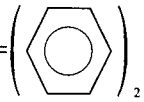 | H |
| 13 | 2-$C(CH_3)_3$-4-C=C 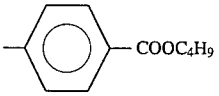 $COOC_4H_9$ | H |
| 14 | 4-CO 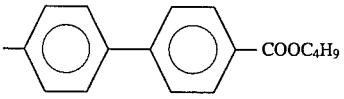 $COOC_4H_9$ | H |
| 15 | 2-$CH_3$ | 7-$CH_3$ |
TABLE 27
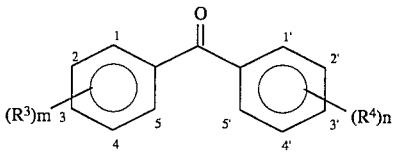
| Compound No. | $R^3$ | $R^4$ |
|---|---|---|
| 1 | H | H |
| 2 | 4-$NO_2$ | H |
| 3 | 3-$NO_2$ | H |
| 4 | 4-$NO_2$ | 4'-$CH_3$ |
| 5 | H | 2'-$CH_3$ |
| 6 | 4-$NO_2$ | 4'-$OCH_3$ |
| 7 | 4-$NO_2$ | 4' 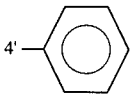 |
TABLE 27-continued
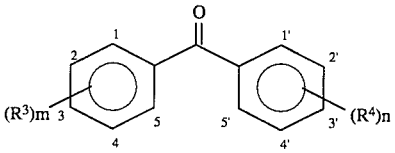
| Compound No. | $R^3$ | $R^4$ |
|---|---|---|
| 8 | 4-$NO_2$ | 4' 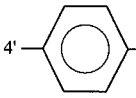 $C_2H_5$ |
| 9 | 4-$CH_3$ | 4'-$CH_3$ |
| 10 | 2,4-di-$NO_2$ | H |
| 11 | H | 4' 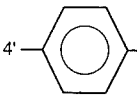 $COOCH_3$ |

TABLE 27-continued
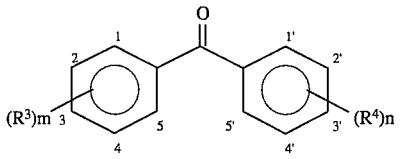
| Compound No. | $R^3$ | $R^4$ |
|---|---|---|
| 12 | 4-Cl | 4'-Cl |
| 13 | H | 3'-$COOC_4H_9$ |
| 14 | 3-$NO_2$ | 4'-$COOC_4H_9$ |
| 15 | 4-$NO_2$ | 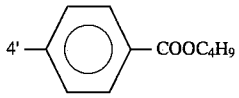 |
| 16 | 4-$NO_2$ | 4'-I |
| 17 | 4-CN | 4'-$NO_2$ |
| 18 | 4-CN | 4'-$COOC_4H_9$ |
| 19 | 4,5-di-$COOC_2H_5$ | 3',4'-di-$COOC_2H_5$ |
| 20 | 3-$NO_2$-4-$C_4H_9$ | 3'-$NO_2$-4'-$C_4H_9$ |
TABLE 27-continued
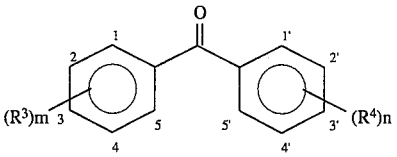
| Compound No. | $R^3$ | $R^4$ |
|---|---|---|
| 21 | 4-$NO_2$ | 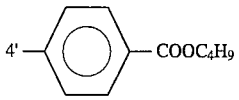 |
| 22 | H | 3',4'- 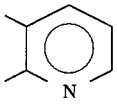 |
| 23 | 4-$NO_2$ | H |
TABLE 28
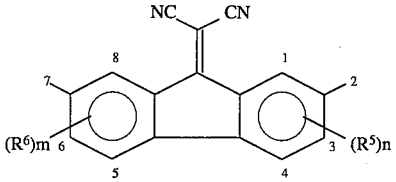
| Compound No. | $R^5$ | $R^6$ |
|---|---|---|
| 1 | 4-$COOCH_3$ | H |
| 2 | 4-$COOCH_3$ | 7-$NO_2$ |
| 3 | 2-$C(CH_3)_3$-4-$NO_2$ | 5-$NO_2$-7-$NO_2$ |
| 4 | 4-$COOC_2H_5$ | H |
| 5 | 2-$COOC_4H_9$ | H |
| 6 | 4-$COOC_4H_9$ | H |
| 7 | 4-$COOC_8H_{17}$ | H |
| 8 | 2-$C(CH_3)_3$-4-$COOC_4H_9$ | 7-$C(CH_3)_3$ |
| 9 | 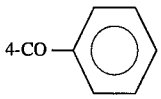 | H |
| 10 | 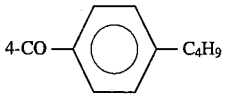 | H |
| 11 | 2,4-di-$NO_2$ | 7-$NO_2$ |
| 12 | 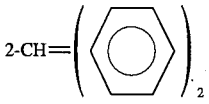 | H |
| 13 | 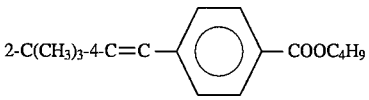 | H |
| 14 | 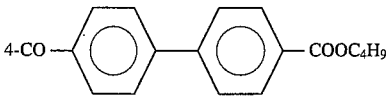 | H |

TABLE 28-continued
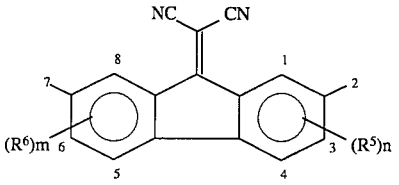
| Compound No. | $R^5$ | $R^6$ |
|---|---|---|
| 15 | 2-$CH_3$ | 7-$CH_3$ |
TABLE 29
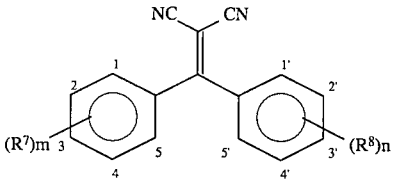
| Compound No. | $R^7$ | $R^8$ |
|---|---|---|
| 1 | H | H |
| 2 | 4-$NO_2$ | H |
| 3 | 3-$NO_2$ | H |
| 4 | 4-$NO_2$ | 4'-$CH_3$ |
| 5 | H | 2'-$CH_3$ |
| 6 | 4-$NO_2$ | 4'-$OCH_3$ |
| 7 | 4-$NO_2$ | 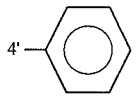 |
| 8 | 4-$NO_2$ | 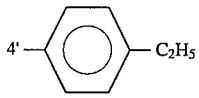 |
| 9 | 4-$CH_3$ | 4'-$CH_3$ |
| 10 | 2,4-di-$NO_2$ | H |
| 11 | H | 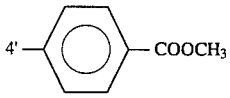 |
| 12 | 4-Cl | 4'-Cl |
| 13 | H | 3'-$COOC_4H_9$ |
| 14 | 3-$NO_2$ | 4'-$COOC_4H_9$ |
| 15 | 4-$NO_2$ | 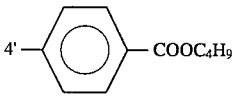 |
| 16 | 4-$NO_2$ | 4'-I |
| 17 | 4-CN | 4'-$NO_2$ |
| 18 | 4-CN | 4'-$COOC_4H_9$ |
| 19 | 4,5-di-$COOC_2H_5$ | 3',4'-di-$COOC_2H_5$ |
| 20 | 3-$NO_2$-4-$C_4H_9$ | 3'-$NO_2$-4'-$C_4H_9$ |
| 21 | 4-$NO_2$ | 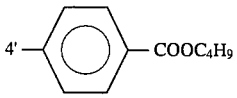 |
TABLE 29-continued
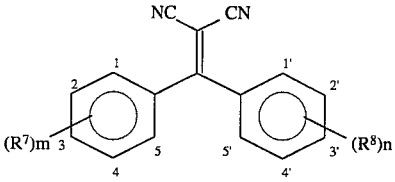
| Compound No. | $R^7$ | $R^8$ |
|---|---|---|
| 22 | H | 3',4'- 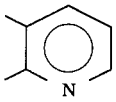 |
| 23 | 4-$NO_2$ | H |
TABLE 30
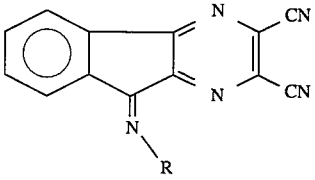
| Compound No. | R |
|---|---|
| 1 | 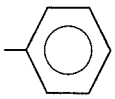 |
| 2 | 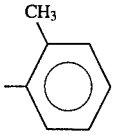 |
| 3 | 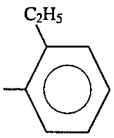 |

TABLE 30-continued
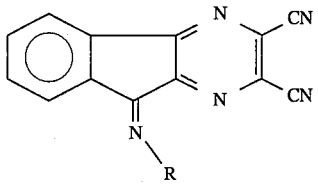
| Compound No. | R |
|---|---|
| 4 | 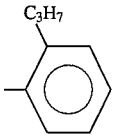 |
| 5 | 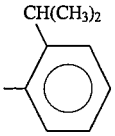 |
| 6 | 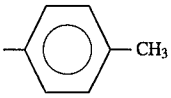 |
| 7 | 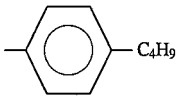 |
| 8 | 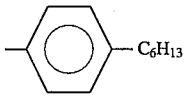 |
| 9 | 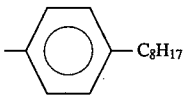 |
| 10 | 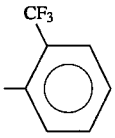 |
| 11 | 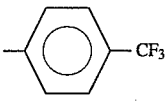 |
| 12 | 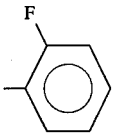 |
| 13 | 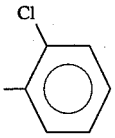 |
TABLE 30-continued
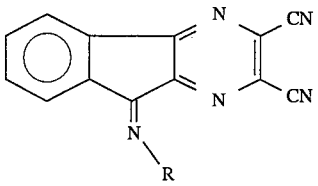
| Compound No. | R |
|---|---|
| 14 | 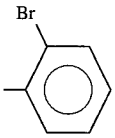 |
| 15 | 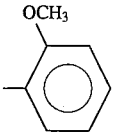 |
| 16 | 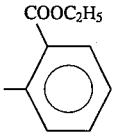 |
| 17 | 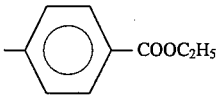 |
| 18 | 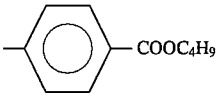 |
| 19 | 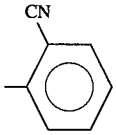 |
| 20 | 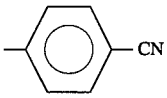 |
| 21 | 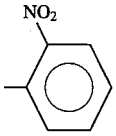 |
| 22 | 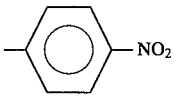 |
| 23 | 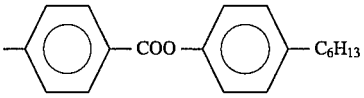 |

TABLE 30-continued
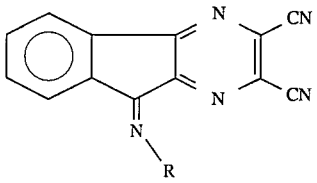
| Compound No. | R |
|---|---|
| 24 | 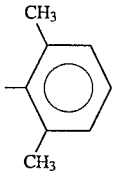 |
| 25 | 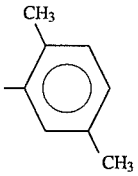 |
| 26 | 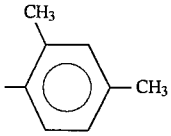 |
| 27 | 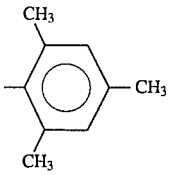 |
| 28 | 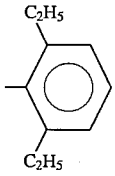 |
| 29 | 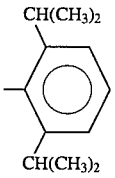 |
| 30 | 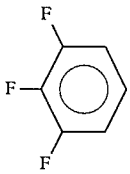 |
TABLE 30-continued
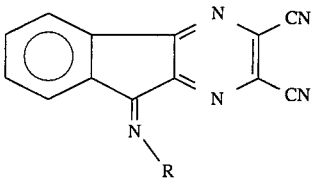
| Compound No. | R |
|---|---|
| 31 | 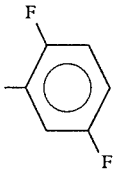 |
| 32 | 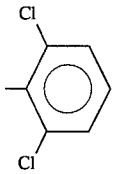 |
| 33 | 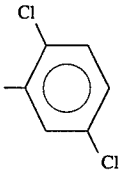 |
| 34 | 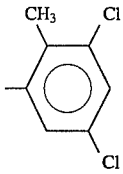 |
| 35 | 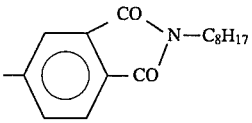 |
| 36 | 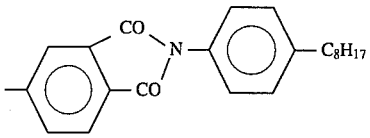 |
| 37 | 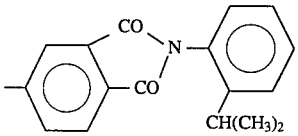 |
| 38 | 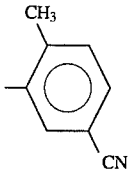 |

TABLE 30-continued

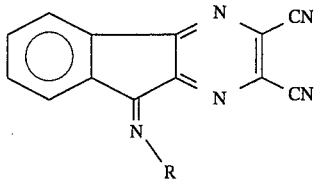

| Compound No. | R |
|---|---|
| 39 | 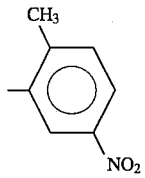 |
| 40 | 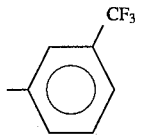 |
| 41 | 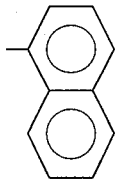 |
| 42 | 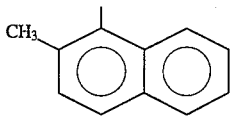 |
| 43 | 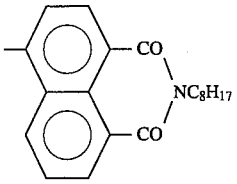 |
| 44 | 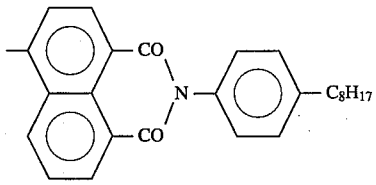 |
| 45 | 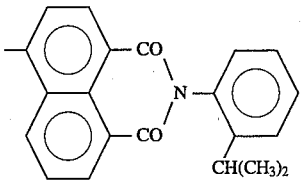 |

TABLE 30-continued

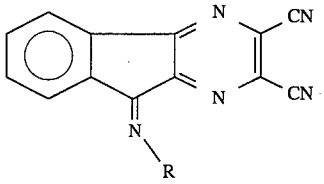

| Compound No. | R |
|---|---|
| 46 | 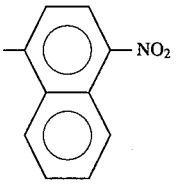 |

Furthermore, when at least one organic acceptor compound of formula (A), (B) or (C) is employed in the single-layered photoconductive layer, not only the sensitizing effect is improved, but also the decrease of the charging characteristics can be prevented during the repeated operations and the charging stability is remarkably improved.

[Organic Acceptor Compound of Formula (A)]

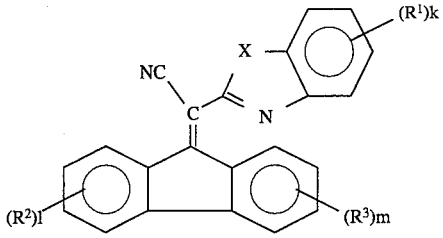

(A)

wherein $R^1$, $R^2$, and $R^3$ each is hydrogen, a substituted or unsubstituted alkyl group, an alkoxyl group, a substituted or unsubstituted alkoxycarbonyl group, a substituted or unsubstituted acyl group, a substituted or unsubstituted sulfonyl group, a substituted or unsubstituted sulfonamide group, a substituted or unsubstituted carbamoyl group, a halogen atom, cyano group, or nitro group, and $R^1$ may form a ring in combination with other atoms; k, l and m each is an integer of 1 to 4; and X is oxygen, sulfur or selenium.

[Organic Acceptor Compound of Formula (B)]

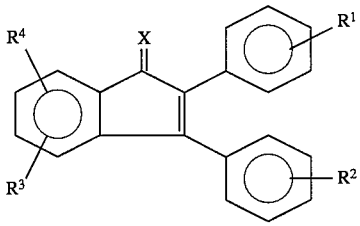

(B)

wherein $R^1$, $R^2$, $R^3$ and $R^4$ may be the same or different, and each is hydrogen, a halogen atom, a substituted or unsubstituted alkyl group, cyano group, or nitro group; and X is

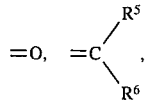

in which $R^5$ and $R^6$ may be the same or different and each is hydrogen, a halogen atom, cyano group, a substituted or unsubstituted aromatic group, or —$COOR^7$ in which $R^7$ is a substituted or unsubstituted alkyl group, or a substituted or unsubstituted aromatic group; or N—$R^8$, in which $R^8$ is a substituted or unsubstituted alkyl group, a substituted or unsubstituted aromatic group, or cyano group.

[Organic Acceptor Compound of Formula (C)]

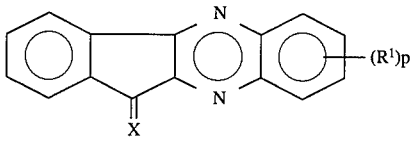

(C)

wherein $R^1$ may be the same or different, and is a halogen atom, nitro group, or a substituted or unsubstituted alkyl group; X is =O, N—$R^2$, in which $R^2$ is a substituted or unsubstituted phenyl group, or a substituted or unsubstituted naphthyl group, or

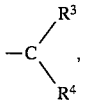

in which $R^3$ and $R^4$ may be the same or different and each is hydrogen, cyano group, a substituted or unsubstituted alkoxycarbonyl group, a substituted or unsubstituted phenoxycarbonyl group, a substituted or unsubstituted phenyl group, or a substituted or unsubstituted naphthyl group; and p is an integer of 0 to 4, provided that when X is oxygen, p is an integer of 1 to 4.

TABLES 31–32 show specific examples of the organic acceptor compound of formulae (A) and (B), and TABLES 33–35 show specific examples of the organic acceptor compounds of formula (C).

TABLE 31

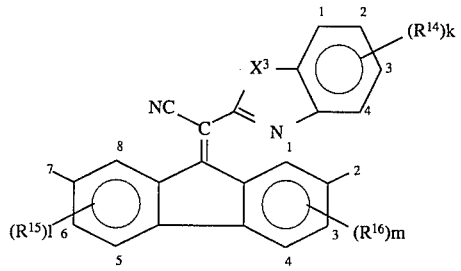

| Compound No. | k | l | m | $X^3$ | $R^{14}$ | $R^{15}$ | $R^{16}$ |
|---|---|---|---|---|---|---|---|
| A-1 | 0 | 0 | 1 | S | H | H | 2-$COOC_4H_9$ |
| A-2 | 0 | 0 | 1 | S | H | H | 4-$COOC_4H_9$ |
| A-3 | 0 | 0 | 1 | S | H | H | 1-$COOC_4H_9$ |
| A-4 | 0 | 0 | 1 | S | H | H | 3-$COOC_4H_9$ |
| A-5 | 0 | 0 | 1 | S | H | H | 1-$COOCH_3$ |
| A-6 | 0 | 0 | 1 | S | H | H | 2-$COOC_5H_{11}$ |
| A-7 | 0 | 0 | 1 | S | H | H | 3-$COOC_5H_{11}$ |
| A-8 | 0 | 0 | 1 | S | H | H | 4-$COOC_5H_{11}$ |
| A-9 | 0 | 0 | 1 | S | H | H | 1-$COOC_6H_{13}$ |
| A-10 | 0 | 0 | 1 | S | H | H | 2-$COOC_6H_{13}$ |
| A-11 | 0 | 0 | 1 | S | H | H | 3-$COOC_6H_{13}$ |
| A-12 | 0 | 0 | 1 | S | H | H | 4-$COOC_6H_{13}$ |
| A-13 | 0 | 0 | 1 | S | H | H | 1-$COOC_7H_{15}$ |
| A-14 | 0 | 0 | 1 | S | H | H | 2-$COOC_7H_{15}$ |
| A-15 | 0 | 0 | 1 | S | H | H | 3-$COOC_7H_{15}$ |
| A-16 | 0 | 0 | 1 | S | H | H | 4-$COOC_7H_{15}$ |
| A-17 | 0 | 0 | 1 | S | H | H | 1-$COOC_8H_{17}$ |
| A-18 | 0 | 0 | 1 | S | H | H | 2-$COOC_8H_{17}$ |
| A-19 | 0 | 0 | 1 | S | H | H | 3-$COOC_8H_{17}$ |
| A-20 | 0 | 0 | 1 | S | H | H | 4-$COOC_8H_{17}$ |
| A-21 | 0 | 0 | 1 | O | H | H | 2-$COOC_4H_9$ |
| A-22 | 0 | 0 | 1 | O | H | H | 4-$COOC_4H_9$ |
| A-23 | 0 | 0 | 1 | O | H | H | 1-$COOC_4H_9$ |
| A-24 | 0 | 0 | 1 | O | H | H | 3-$COOC_4H_9$ |
| A-25 | 0 | 0 | 1 | O | H | H | 1-$COOCH_3$ |
| A-26 | 0 | 0 | 1 | O | H | H | 2-$COOCH_3$ |
| A-27 | 0 | 0 | 1 | O | H | H | 3-$COOCH_3$ |
| A-28 | 0 | 0 | 1 | O | H | H | 4-$COOCH_3$ |
| A-29 | 0 | 0 | 1 | O | H | H | 1-$COOC_2H_5$ |
| A-30 | 1 | 0 | 1 | O | 2-$NO_2$ | H | 2-$COOC_7H_{15}$ |
| A-31 | 1 | 0 | 1 | O | 2-$NO_2$ | H | 3-$COOC_7H_{15}$ |
| A-32 | 1 | 0 | 1 | O | 2-$NO_2$ | H | 4-$COOC_7H_{15}$ |
| A-33 | 1 | 0 | 1 | O | 2-$NO_2$ | H | 1-$COOC_8H_{17}$ |
| A-34 | 1 | 0 | 1 | O | 2-$NO_2$ | H | 2-$COOC_8H_{17}$ |
| A-35 | 1 | 0 | 1 | O | 2-$NO_2$ | H | 3-$COOC_8H_{17}$ |
| A-36 | 1 | 0 | 1 | O | 2-$NO_2$ | H | 4-$COOC_8H_{17}$ |
| A-37 | 1 | 0 | 1 | O | 3-$C(CH_3)_3$ | H | 2-$COOC_4H_9$ |
| A-38 | 1 | 0 | 1 | O | 3-$C(CH_3)_3$ | H | 4-$COOC_4H_9$ |
| A-39 | 1 | 0 | 1 | O | 3-$C(CH_3)_3$ | H | 1-$COOC_4H_9$ |
| A-40 | 1 | 0 | 1 | O | 3-$C(CH_3)_3$ | H | 3-$COOC_4H_9$ |
| A-41 | 1 | 0 | 1 | O | 3-$C(CH_3)_3$ | H | 1-$COOCH_3$ |
| A-42 | 0 | 1 | 1 | S | H | 6-$CF_3$ | 3-$CF_3$ |
| A-43 | 0 | 1 | 2 | S | H | 7-$CF_3$ | 2-$CF_3$<br>4-$C_4H_9$ |
| A-44 | 0 | 1 | 2 | S | H | 7-$CF_3$ | 2-$NO_2$<br>4-$C_8H_{17}$ |
| A-45 | 0 | 1 | 2 | S | H | 7-$NO_2$ | 2-$NO_2$<br>4-$NO_2$ |
| A-46 | 0 | 2 | 2 | S | H | 7-$NO_2$<br>5-$NO_2$ | 2-$NO_2$<br>4-$NO_2$ |
| A-47 | 0 | 0 | 1 | S | H | H | 2-$NO_2$ |
| A-48 | 0 | 1 | 1 | S | H | 7-$NO_2$ | 2-$NO_2$ |
| A-49 | 0 | 1 | 1 | O | H | 7-CN | 4-$COC_8H_{17}$ |
| A-50 | 0 | 1 | 1 | O | H | 7-CN | 4-$COOC_4H_9$ |
| A-51 | 0 | 1 | 1 | O | H | 7-CN | 4-$OC_4H_9$ |

TABLE 32
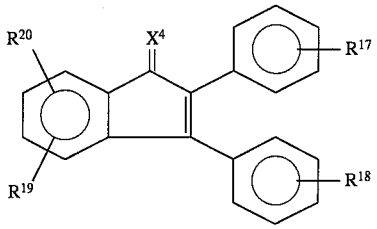
| Compound No. | $X^4$ | $R^{17}$ | $R^{18}$ | $R^{19}$ | $R^{20}$ |
|---|---|---|---|---|---|
| B-1 | =O | H | H | H | H |
| B-2 | =C(CN)(CN) | H | H | H | H |
| B-3 | =C(CN)(COOCH$_3$) | H | H | H | H |
| B-4 | =C(CN)(COOC$_2$H$_5$) | H | H | H | H |
| B-5 | =C(CN)(COOC$_3$H$_7$) | H | H | H | H |
| B-6 | =C(CN)(COOC$_4$H$_9$) | H | H | H | H |
| B-7 | =C(CN)(COOC$_6$H$_{13}$) | H | H | H | H |
| B-8 | =C(CN)(COOC$_8$H$_{17}$) | H | H | H | H |
| B-9 | =C(COOCH$_3$)(COOCH$_3$) | H | H | H | H |
| B-10 | =C(COOC$_2$H$_5$)(COOC$_2$H$_5$) | H | H | H | H |
| B-11 | =C(COOC$_4$H$_9$)(COOC$_4$H$_9$) | H | H | H | H |
| B-12 | =C(CN)(C$_6$H$_4$-CH$_3$) | H | H | H | H |

TABLE 32-continued
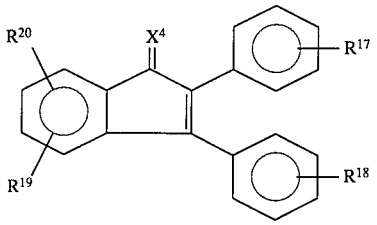
| Compound No. | $X^4$ | $R^{17}$ | $R^{18}$ | $R^{19}$ | $R^{20}$ |
|---|---|---|---|---|---|
| B-13 | 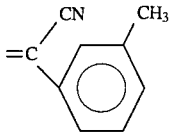 | H | H | H | H |
| B-14 | 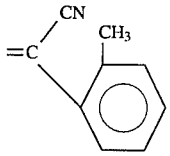 | H | H | H | H |
| B-15 | 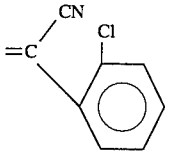 | H | H | H | H |
| B-16 | 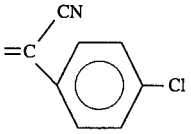 | H | H | H | H |
| B-17 | 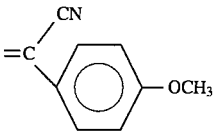 | H | H | H | H |
| B-18 | 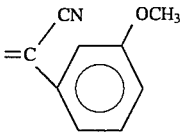 | H | H | H | H |
| B-19 | 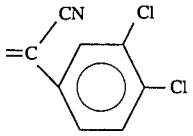 | H | H | H | H |
| B-20 | =N—CN | H | H | H | H |
| B-21 | 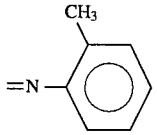 | H | H | H | H |

TABLE 32-continued
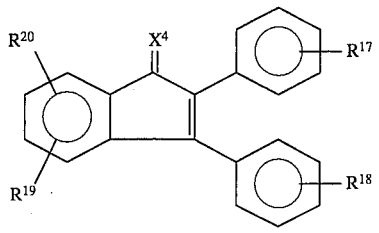
| Compound No. | $X^4$ | $R^{17}$ | $R^{18}$ | $R^{19}$ | $R^{20}$ |
|---|---|---|---|---|---|
| B-22 | 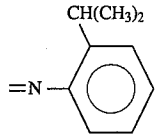 | H | H | H | H |
| B-23 | 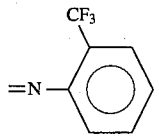 | H | H | H | H |
| B-24 | 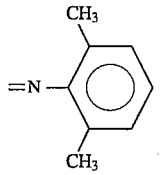 | H | H | H | H |
| B-25 | 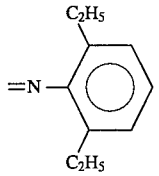 | H | H | H | H |
| B-26 | $=N-C_4H_9$ | H | H | H | H |
| B-27 | $=O$ | 4-$CH_3$ | H | 2-$CH_3$ | H |
| B-28 | 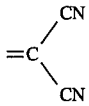 | 4-$CH_3$ | H | 2-$CH_3$ | H |
| B-29 | 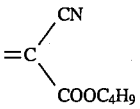 | 4-$CH_3$ | H | 2-$CH_3$ | H |
| B-30 | $=O$ | 4-$CH_3$ | 4-$CH_3$ | 2-$CH_3$ | H |
| B-31 | 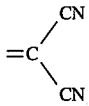 | 4-$CH_3$ | 4-$CH_3$ | 2-$CH_3$ | H |
| B-32 | 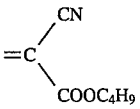 | 4-$CH_3$ | 4-$CH_3$ | 2-$CH_3$ | H |
| B-33 | 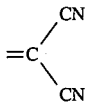 | 4-$C_4H_9$ | H | 2-$CH_3$ | H |

TABLE 32-continued
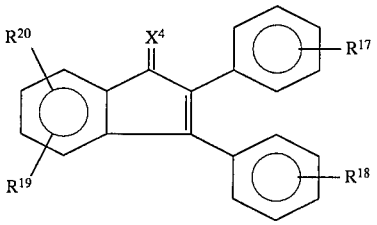
| Compound No. | $X^4$ | $R^{17}$ | $R^{18}$ | $R^{19}$ | $R^{20}$ |
|---|---|---|---|---|---|
| B-34 | 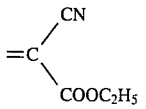 | 3-$CH_3$ | H | 3-$C_4H_9$ | H |
| B-35 | 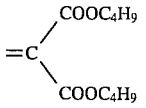 | 4-$CF_3$ | H | H | H |
| B-36 | 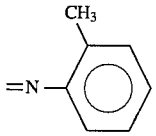 | 4-Br | H | 3-Br | 4-Br |
| B-37 | 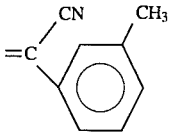 | 4-$NO_2$ | H | H | H |
| B-38 | 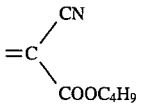 | 4-CN | H | H | H |
| B-39 | =O | H | H | 2-$NO_2$ | H |
| B-40 | 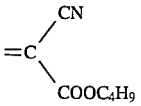 | 4-Br | H | 2-Br | H |
| B-41 | 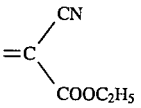 | 4-Cl | H | H | H |
| B-42 | 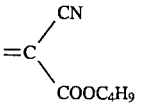 | H | H | 2-Br | H |

TABLE 33
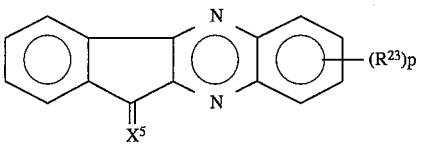
$X^5$: = O
| Compound No. | P | $R^{23}$ |
|---|---|---|
| CI-1 | 1 | $CH_3$ |
| CI-2 | 1 | $CF_3$ |
| CI-3 | 1 | $NO_2$ |
| CI-4 | 2 | Cl |
| CI-5 | 2 | $CH_3$ |
TABLE 34
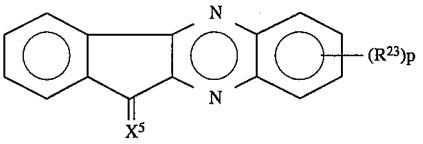
$X^5$: = N—$R^{24}$
| Compound No. | P | $R^{23}$ | $R^{24}$ |
|---|---|---|---|
| CII-1 | 0 | — | 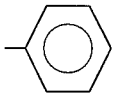 |
| CII-2 | 0 | — | $CH_3$ 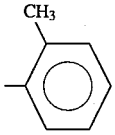 |
| CII-3 | 0 | — | $CH(CH_3)_2$ 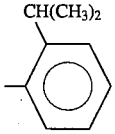 |
| CII-4 | 0 | — | $CH_3$ 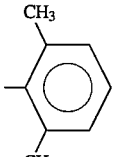 $CH_3$ |
| CII-5 | 0 | — | $C_2H_5$ 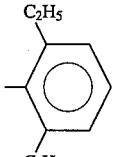 $C_2H_5$ |
| CII-6 | 0 | — | 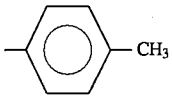 $CH_3$ |
| CII-7 | 0 | — | 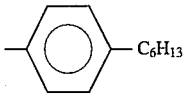 $C_6H_{13}$ |
TABLE 34-continued
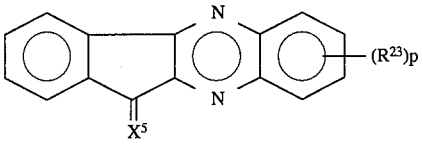
$X^5$: = N—$R^{24}$
| Compound No. | P | $R^{23}$ | $R^{24}$ |
|---|---|---|---|
| CII-8 | 0 | — | $CF_3$ 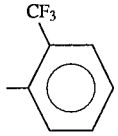 |
| CII-9 | 0 | — | 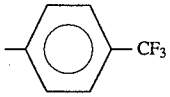 $CF_3$ |
| CII-10 | 0 | — | F 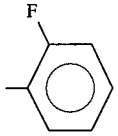 |
| CII-11 | 0 | — | Cl 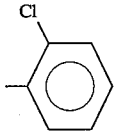 |
| CII-12 | 0 | — | Br 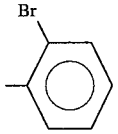 |
| CII-13 | 0 | — | $CH_2O$ 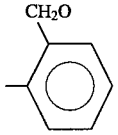 |
| CII-14 | 0 | — | $COOC_2H_5$ 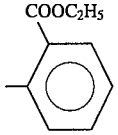 |
| CII-15 | 0 | — | $COOC_4H_9$ 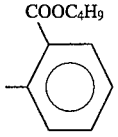 |
| CII-16 | 0 | — | 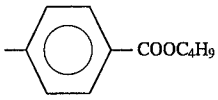 $COOC_4H_9$ |
| CII-17 | 0 | — | CN 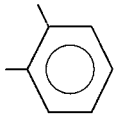 |

TABLE 34-continued
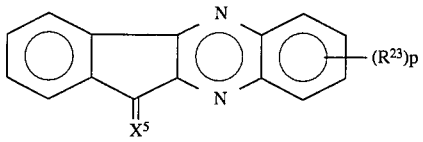
$X^5$: = N—$R^{24}$
| Compound No. | P | $R^{23}$ | $R^{24}$ |
|---|---|---|---|
| CII-18 | 0 | — | 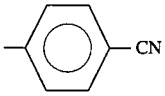 |
| CII-19 | 0 | — | 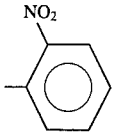 |
| CII-20 | 0 | — | 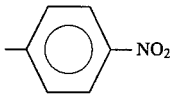 |
| CII-21 | 0 | — | 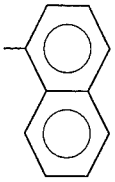 |
| CII-22 | 0 | — | 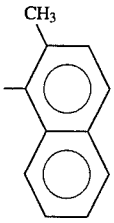 |
| CII-23 | 0 | — | 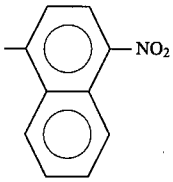 |
| CII-24 | 1 | $CF_3$ | 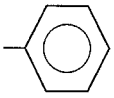 |
| CII-25 | 1 | $CF_3$ | 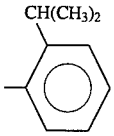 |
| CII-26 | 1 | $CF_3$ | 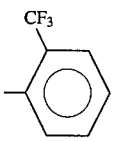 |
TABLE 34-continued
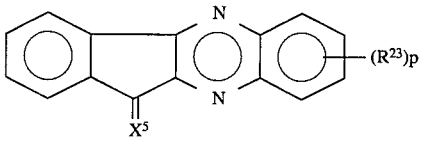
$X^5$: = N—$R^{24}$
| Compound No. | P | $R^{23}$ | $R^{24}$ |
|---|---|---|---|
| CII-27 | 1 | $CF_3$ | 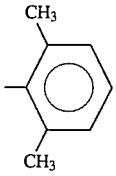 |
| CII-28 | 1 | $CF_3$ | 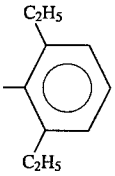 |
| CII-29 | 1 | $CF_3$ | 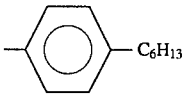 |
| CII-30 | 1 | $CF_3$ | 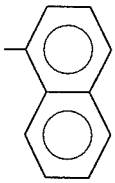 |
| CII-31 | 1 | $NO_2$ | 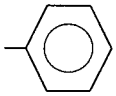 |
| CII-32 | 1 | $NO_2$ | 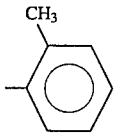 |
| CII-33 | 1 | $NO_2$ | 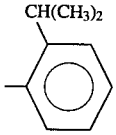 |
| CII-34 | 1 | $NO_2$ | 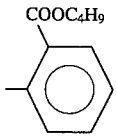 |
| CII-35 | 1 | $NO_2$ | 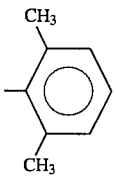 |

TABLE 34-continued
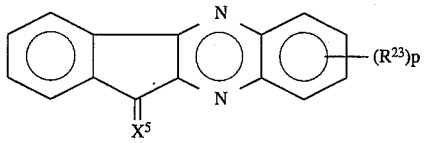
$X^5$: = N—$R^{24}$
| Compound No. | P | $R^{23}$ | $R^{24}$ |
|---|---|---|---|
| CII-36 | 1 | $NO_2$ | 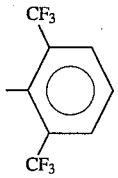 |
| CII-37 | 2 | $CH_3$ | 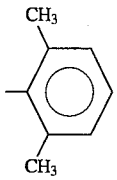 |
| CII-38 | 2 | $CH_3$ | 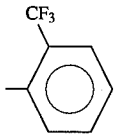 |
| CII-39 | 2 | $CH_3$ | 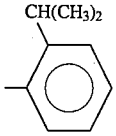 |
| CII-40 | 2 | $CH_3$ | 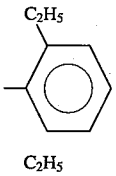 |
| CII-41 | 2 | $CH_3$ | 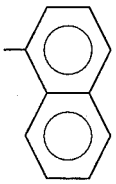 |
TABLE 34-continued
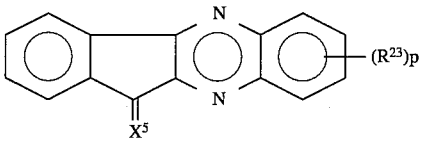
$X^5$: = N—$R^{24}$
| Compound No. | P | $R^{23}$ | $R^{24}$ |
|---|---|---|---|
| CII-42 | 2 | Cl | 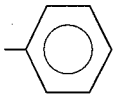 |
| CII-43 | 2 | Cl | 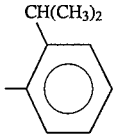 |
| CII-44 | 2 | Cl | 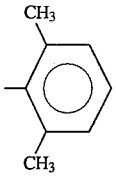 |
| CII-45 | 2 | Cl | 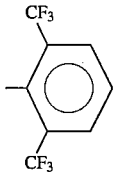 |

TABLE 35
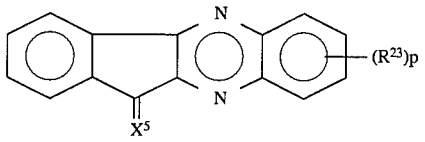
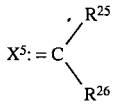
| Compound No. | P | $R^{23}$ | $R^{25}$ | $R^{26}$ |
|---|---|---|---|---|
| CIII-1 | 0 | — | H | CN |
| CIII-2 | 0 | — | H | $COOC_2H_5$ |
| CIII-3 | 0 | — | H | $COOC_4H_9$ |
| CIII-4 | 0 | — | H | 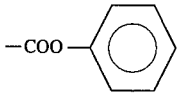 |
| CIII-5 | 0 | — | H | 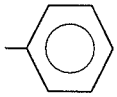 |
| CIII-6 | 0 | — | H | 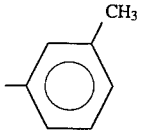 |
| CIII-7 | 0 | — | CN | CN |
| CIII-8 | 0 | — | CN | $COOCH_3$ |
| CIII-9 | 0 | — | CN | $COOC_2H_5$ |
| CIII-10 | 0 | — | CN | $COOC_3H_7$ |
| CIII-11 | 0 | — | CN | $COOC_4H_9$ |
| CIII-12 | 0 | — | CN | $COOC_5H_{11}$ |
| CIII-13 | 0 | — | CN | $COOC_6H_{13}$ |
| CIII-14 | 0 | — | CN | $COOC_7H_{15}$ |
| CIII-15 | 0 | — | CN | $COOC_8H_{17}$ |
| CIII-16 | 0 | — | CN | $COOCF_3$ |
| CIII-17 | 0 | — | CN | $COOCH(CF_3)_2$ |
| CIII-18 | 0 | — | CN | $COOCH_2OCH_3$ |
| CIII-19 | 0 | — | CN | $COOC_2H_4OCH_3$ |
| CIII-20 | 0 | — | CN | 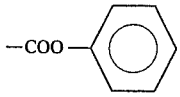 |
| CIII-21 | 0 | — | CN | 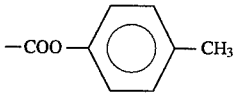 |
| CIII-22 | 0 | — | CN | 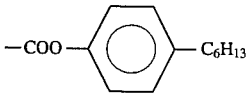 |
| CIII-23 | 0 | — | CN | 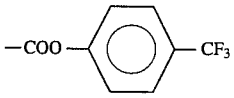 |
| CIII-24 | 0 | — | CN | 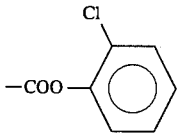 |

TABLE 35-continued
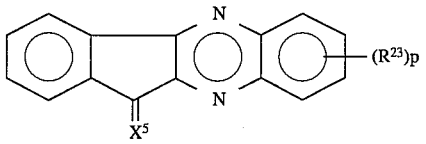
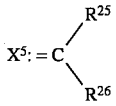
| Compound No. | P | $R^{23}$ | $R^{25}$ | $R^{26}$ |
|---|---|---|---|---|
| CIII-25 | 0 | — | CN | 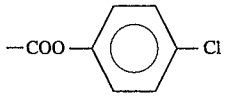 |
| CIII-26 | 0 | — | CN | 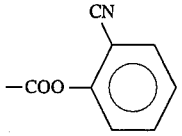 |
| CIII-27 | 0 | — | CN | 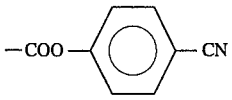 |
| CIII-28 | 0 | — | CN | 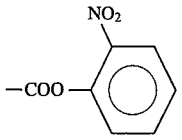 |
| CIII-29 | 0 | — | CN | 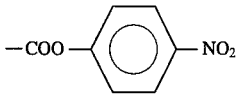 |
| CIII-30 | 0 | — | CN | 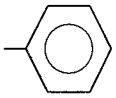 |
| CIII-31 | 0 | — | CN | 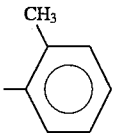 |
| CIII-32 | 0 | — | CN | 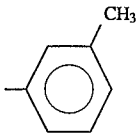 |
| CIII-33 | 0 | — | CN | 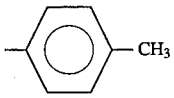 |
| CIII-34 | 0 | — | CN | 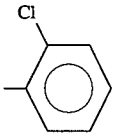 |

TABLE 35-continued
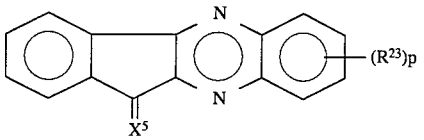
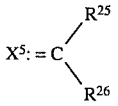
| Compound No. | P | $R^{23}$ | $R^{25}$ | $R^{26}$ |
|---|---|---|---|---|
| CIII-35 | 0 | — | CN | 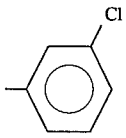 |
| CIII-36 | 0 | — | CN | 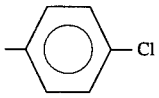 |
| CIII-37 | 0 | — | CN | 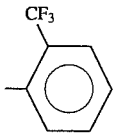 |
| CIII-38 | 0 | — | CN | 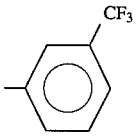 |
| CIII-39 | 0 | — | CN | 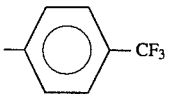 |
| CIII-40 | 0 | — | CN | 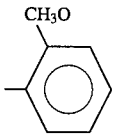 |
| CIII-41 | 0 | — | CN | 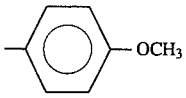 |
| CIII-42 | 0 | — | CN | 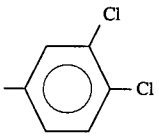 |
| CIII-43 | 0 | — | CN | 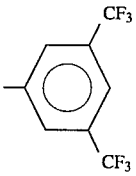 |

TABLE 35-continued

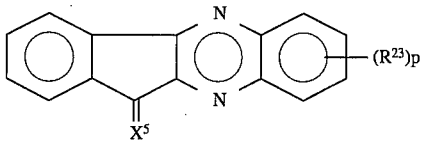

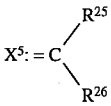

| Compound No. | P | $R^{23}$ | $R^{25}$ | $R^{26}$ |
|---|---|---|---|---|
| CIII-44 | 0 | — | CN | 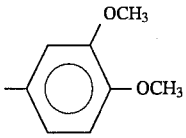 |
| CIII-45 | 0 | — | CN | 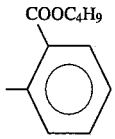 |
| CIII-46 | 0 | — | $COOCH_3$ | $COOCH_3$ |
| CIII-47 | 0 | — | $COOCH_3$ | 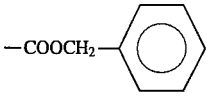 |
| CIII-48 | 0 | — | $COOC_2H_5$ | $COOC_2H_5$ |
| CIII-49 | 0 | — | $COOCH(CH_3)_2$ | $COOCH(CH_3)_2$ |
| CIII-50 | 0 | — | $COOC_4H_9$ | $COOC_4H_9$ |
| CIII-51 | 0 | — | 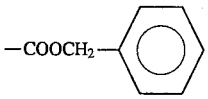 | 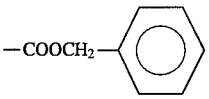 |
| CIII-52 | 1 | $CF_3$ | H | CN |
| CIII-53 | 1 | $CF_3$ | H | $COOC_4H_9$ |
| CIII-54 | 1 | $CF_3$ | H | 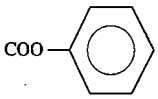 |
| CIII-55 | 1 | $CF_3$ | CN | CN |
| CIII-56 | 1 | $CF_3$ | CN | $COOC_2H_5$ |
| CIII-57 | 1 | $CF_3$ | CN | $COOC_4H_9$ |
| CIII-58 | 1 | $CF_3$ | CN | $COOC_6H_{13}$ |
| CIII-59 | 1 | $CF_3$ | CN | $COOC_8H_{17}$ |
| CIII-60 | 1 | $CF_3$ | CN | 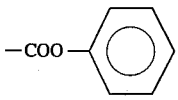 |
| CIII-61 | 1 | $CF_3$ | CN | 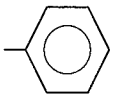 |
| CIII-62 | 1 | $CF_3$ | CN | 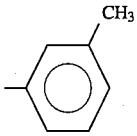 |
| CIII-63 | 1 | $CF_3$ | $COOC_2H_5$ | $COOC_2H_5$ |
| CIII-64 | 1 | $CF_3$ | $COOC_4H_9$ | $COOC_4H_9$ |

TABLE 35-continued

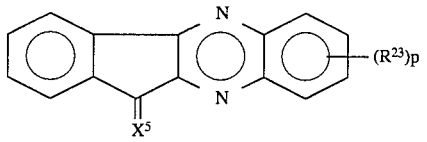

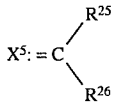

| Compound No. | P | $R^{23}$ | $R^{25}$ | $R^{26}$ |
|---|---|---|---|---|
| CIII-65 | 1 | $NO_2$ | CN | CN |
| CIII-66 | 1 | $NO_2$ | CN | $COOC_4H_9$ |
| CIII-67 | 1 | $NO_2$ | CN | $COOC_6H_{13}$ |
| CIII-68 | 1 | $NO_2$ | CN | $COOC_8H_{17}$ |
| CIII-69 | 1 | $NO_2$ | CN | 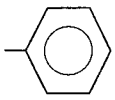 |
| CIII-70 | I | $NO_2$ | CN | 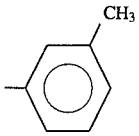 |
| CIII-71 | 1 | $NO_2$ | $COOC_2H_5$ | $COOC_2H_5$ |
| CIII-72 | 1 | $NO_2$ | $COOC_4H_9$ | $COOC_4H_9$ |
| CIII-73 | 2 | $CH_3$ | CN | CN |
| CIII-74 | 2 | $CH_3$ | CN | $COOC_4H_9$ |
| CIII-75 | 2 | $CH_3$ | CN | $COOC_6H_{13}$ |
| CIII-76 | 2 | $CH_3$ | CN | $COOC_8H_{17}$ |
| CIII-77 | 2 | $CH_3$ | CN | 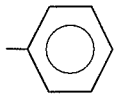 |
| CIII-78 | 2 | $CH_3$ | CN | 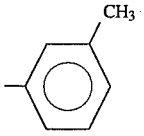 |
| CIII-79 | 2 | $CH_3$ | $COOC_2H_5$ | $COOC_2H_5$ |
| CIII-80 | 2 | $CH_3$ | $COOC_4H_9$ | $COOC_4H_9$ |
| CIII-81 | 2 | Cl | CN | CN |
| CIII-82 | 2 | Cl | CN | $COOC_4H_9$ |
| CIII-83 | 2 | Cl | CN | $COOC_6H_{13}$ |
| CIII-84 | 2 | Cl | CN | $COOC_8H_{17}$ |
| CIII-85 | 2 | Cl | CN | 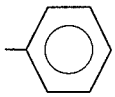 |
| CIII-86 | 2 | Cl | CN | 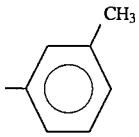 |
| CIII-87 | 2 | Cl | $COOC_2H_5$ | $COOC_2H_5$ |
| CIII-88 | 2 | Cl | $COOC_4H_9$ | $COOC_4H_9$ |

It is also preferable that the organic acceptor compound for use in the present invention have a reduction potential in a range of −0.2 to −1.2 V (vs SCE).

As organic acceptor compounds having a reduction potential in the above-mentioned range, derivatives of benzoquinone, naphthoquinone, anthraquinone, diphenoquinone;

anhydrides; and aliphatic compounds, aromatic compound, and heterocyclic compounds, which have an electron attractive group such as nitro group, nitroso group, or cyano group, can be given.

The reduction potential of such organic acceptor compounds for use in the present invention is a half-wave potential obtained by conventionally known cyclic voltametry, using acetonitrile as a solvent, 0.1 MTEAP as an electrolyte, and a saturated calomel electrode (SCE) as a reference electrode.

The reasons why it is preferable that the organic acceptor compound for use in the present invention have a reduction potential in a range of −0.2 to −1.2 V (vs SCE) are that the reduction potential corresponds to the affinity for electrons, and that organic acceptor compounds with a reduction potential in the above-mentioned range have excellent electron transporting performance, so that when the organic acceptor compounds with a reduction potential in the above-mentioned range are employed in combination with the disazo compound and trisazo compound having the previously mentioned respective chemical structures, which are used as charge generating materials, excellent electrophotographic characteristics are exhibited.

The above-mentioned organic acceptor compounds can be used alone or in combination.

Furthermore in the present invention, to improve the charging stability of the single-layered photoconductive layer during the repeated use thereof, the photoconductive layer may further comprise an antioxidant.

More specifically, any conventional antioxidants can be employed. Specific examples of such antioxidants include antioxidants for plastics, rubber, petroleum, and fats and oils; ultraviolet absorbers; and light stabilizers such as phenol and phenol derivatives, paraphenylenediamines, hydroquinone and derivatives thereof, organic sulfur-containing compounds, organic phosphorus-containing compounds, hydroxy anisoles, piperidine and oxopiperidine, carotenes, amines, tocophenols, Ni(II) complexes, and sulfides, as disclosed in Japanese Laid-Open Patent Applications 57-122444, 60-188956, 63-18355, and 63-18356.

In particular, It is preferable that such an antioxidant for use in the present invention comprise at least one compound selected from the group consisting of compounds of formulae (I) to (XII):

[Compound of Formula (I)]

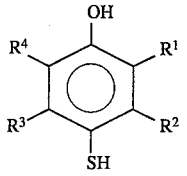

(I)

wherein $R^1$, $R^2$, $R^3$ and $R^4$ each is hydrogen, a halogen atom, hydroxyl group, a substituted or unsubstituted alkyl group, a substituted or unsubstituted alkenyl group, a substituted or unsubstituted aryl group, a substituted or unsubstituted cycloalkyl group, a substituted or unsubstituted alkoxyl group, a substituted or unsubstituted aryloxy group, a substituted or unsubstituted alkylthio group, a substituted or unsubstituted arylthio group, a substituted amino group, imino group, a heterocyclic group, a sulfoxide group, a sulfonyl group, an acyl group, or an azo group.

[Compound of Formula (II)]

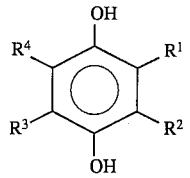

(II)

wherein $R^1$, $R^2$, $R^3$ and $R^4$ each is hydrogen, a halogen atom, a substituted or unsubstituted alkyl group, a substituted or unsubstituted alkenyl group, a substituted or unsubstituted cycloalkyl group, a substituted or unsubstituted alkoxyl group, a substituted or unsubstituted aryloxy group, an alkylthio group, an arylthio group, an alkylamino group, an arylamino group, an acyl group, an alkylacylamino group, an arylacylamino group, an alkylcarbamoyl group, an arylcarbamoyl group, an alkylsulfonamide group, an arylsulfonamide group, an alkylsulfamoyl group, an arylsulfamoyl group, an alkylsulfonyl group, an arylsulfonyl group, an alkyloxycarbonyl group, an aryloxycarbonyl group, an alkylacyloxy group, an arylacyloxy group, a silyl group, or a heterocyclic group, provided that at least one of $R^1$, $R^2$, $R^3$ or $R^4$ is a group having 4 or more carbon atoms.

[Compound of Formula (III)]

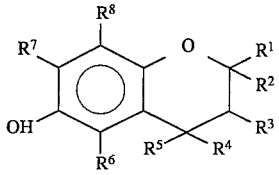

(III)

wherein $R^1$ to $R^8$ each is hydrogen, a hydroxyl group, a halogen atom, a substituted or unsubstituted alkyl group, a substituted or unsubstituted alkenyl group, a substituted or unsubstituted aryl group, a substituted or unsubstituted cycloalkyl group, a substituted or unsubstituted alkoxyl group, a substituted or unsubstituted aryloxy group, a substituted or unsubstituted amino group, a substituted or unsubstituted imino group, a substituted or unsubstituted heterocyclic group, a substituted or unsubstituted alkylthio group, a substituted or unsubstituted arylthio group, a substituted or unsubstituted acyl group, a substituted or unsubstituted sulfonyl group, a substituted or unsubstituted phosphonyl group, or a substituted or unsubstituted carbamoyl group.

[Compound of Formula (IV)]

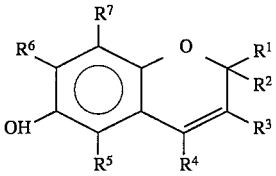

(IV)

wherein $R^1$ to $R^7$ each is hydrogen, a hydroxyl group, a halogen atom, a substituted or unsubstituted alkyl group, a substituted or unsubstituted alkenyl group, a substituted or unsubstituted aryl group, a substituted or unsubstituted cycloalkyl group, a substituted or unsubstituted alkoxyl group, a substituted or unsubstituted aryloxy group, a substituted or unsubstituted amino group, a substituted or unsubstituted imino group, a substituted or unsubstituted heterocyclic group, a substituted or unsubstituted alkylthio group, a substituted or unsubstituted arylthio group, a substituted or unsubstituted acyl group, a substituted or unsubstituted sulfonyl group, a substituted or unsubstituted phosphonyl group, or a substituted or unsubstituted carbamoyl group.

[Compound of Formula (V)]

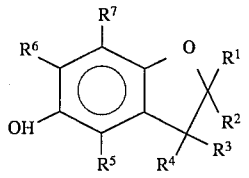

(V)

wherein $R^1$ to $R^7$ each is hydrogen, a hydroxyl group, a halogen atom, a substituted or unsubstituted alkyl group, a substituted or unsubstituted alkenyl group, a substituted or unsubstituted aryl group, a substituted or unsubstituted cycloalkyl group, a substituted or unsubstituted alkoxyl group, a substituted or unsubstituted aryloxy group, a substituted or unsubstituted amino group, a substituted or unsubstituted imino group, a substituted or unsubstituted heterocyclic group, a substituted or unsubstituted alkylthio group, a substituted or unsubstituted arylthio group, a substituted or unsubstituted acyl group, a substituted or unsubstituted sulfonyl group, a substituted or unsubstituted phosphonyl group, or a substituted or unsubstituted carbamoyl group.

[Compound of Formula (VI)]

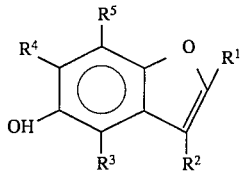

(VI)

wherein $R^1$ to $R^6$ each is hydrogen, a hydroxyl group, a halogen atom, a substituted or unsubstituted alkyl group, a substituted or unsubstituted alkenyl group, a substituted or unsubstituted aryl group, a substituted or unsubstituted cycloalkyl group, a substituted or unsubstituted alkoxyl group, a substituted or unsubstituted aryloxy group, a substituted or unsubstituted amino group, a substituted or unsubstituted imino group, a substituted or unsubstituted heterocyclic group, a substituted or unsubstituted alkylthio group, a substituted or unsubstituted arylthio group, a substituted or unsubstituted acyl group, a substituted or unsubstituted sulfonyl group, a substituted or unsubstituted phosphonyl group, or a substituted or unsubstituted carbamoyl group.

[Compound of Formula (VII)]

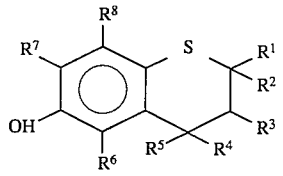

(VII)

wherein $R^1$ to $R^8$ each is hydrogen, a hydroxyl group, a halogen atom, a substituted or unsubstituted alkyl group, a substituted or unsubstituted alkenyl group, a substituted or unsubstituted aryl group, a substituted or unsubstituted cycloalkyl group, a substituted or unsubstituted alkoxyl group, a substituted or unsubstituted aryloxy group, a substituted or unsubstituted amino group, a substituted or unsubstituted imino group, a substituted or unsubstituted heterocyclic group, a substituted or unsubstituted alkylthio group, a substituted or unsubstituted arylthio group, a substituted or unsubstituted acyl group, a substituted or unsubstituted sulfonyl group, a substituted or unsubstituted phosphonyl group, or a substituted or unsubstituted carbamoyl group.

[Compound of Formula (VIII)]

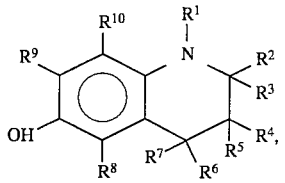

(VIII)

[Compound of Formula (IX)]

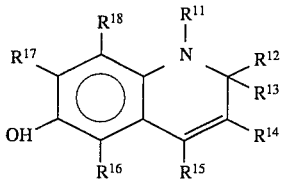

(IX)

wherein $R^1$ to $R^{10}$ and $R^{11}$ to $R^{18}$ each is hydrogen, a halogen atom, a hydroxyl group, a substituted or unsubstituted alkyl group, a substituted or unsubstituted alkenyl group, a substituted or unsubstituted aryl group, a substituted or unsubstituted cycloalkyl group, a substituted or unsubstituted alkoxyl group, a substituted or unsubstituted aryloxy group, a substituted amino group, an imino group, a heterocyclic group, a substituted or unsubstituted alkylthio group, a substituted or unsubstituted arylthio group, a sulfoxide group, a sulfonyl group, an acyl group, or an azo group.

[Compound of Formula (X)]

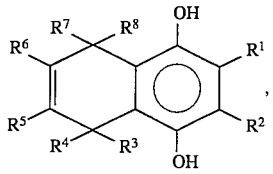

[Compound of Formula (XI)]

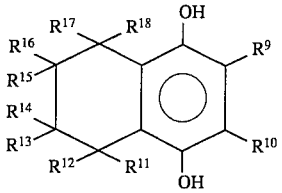

(XI)

wherein $R^1$ to $R^8$ and $R^9$ to $R^{18}$ each is hydrogen, a halogen atom, a hydroxyl group, a substituted or unsubstituted alkyl group, a substituted or unsubstituted alkenyl group, a substituted or unsubstituted aryl group, a substituted or unsubstituted cycloalkyl group, a substituted or unsubstituted alkoxyl group, a substituted or unsubstituted aryloxy group, a substituted amino group, an imino group, a heterocyclic group, a substituted or unsubstituted alkylthio group, a substituted or unsubstituted arylthio group, a sulfoxide group, a sulfonyl group, an acyl group, or an azo group.

[Compound of Formula (XII)]

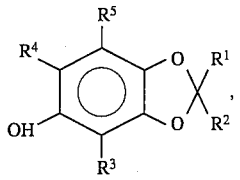

(XII)

wherein $R^1$ to $R^5$ each is hydrogen, a halogen atom, a hydroxyl group, a substituted or unsubstituted alkyl group, a substituted or unsubstituted alkenyl group, a substituted or unsubstituted aryl group, a substituted or unsubstituted cycloalkyl group, a substituted or unsubstituted alkoxyl group, a substituted or unsubstituted aryloxy group, a substituted amino group, an imino group, a heterocyclic group, a substituted or unsubstituted alkylthio group, a substituted or unsubstituted arylthio group, a sulfoxide group, a sulfonyl group, an acyl group, or an azo group.

These antioxidants can be obtained by the synthesis in accordance with the methods described in U.S. Pat. No. 1,968,906 and J. Am. Chem. Soc. 55. 1224 (1933).

It is preferable that the amount of the antioxidant in the photoconductive layer be in the range of 0.01 to 2 parts by weight to 10 parts by weight of the binder resin. When the amount of the antioxidant is within the above range, the charging stability is sufficiently improved, with the decrease of photosensitivity and the increase of the residual potential being prevented.

TABLES 36 to 47 respectively show specific examples of the compounds of formulae (I) to (XII) serving as antioxidant component for use in the present invention.

TABLE 36

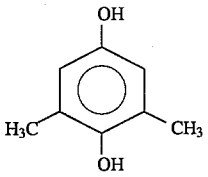

(I)-1

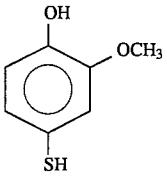

(I)-2

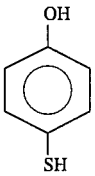

(I)-3

TABLE 36-continued

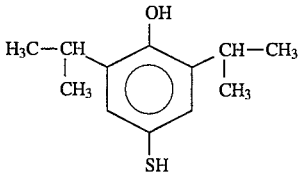

(I)-4

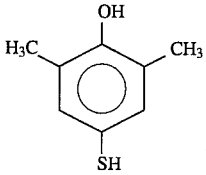

(I)-5

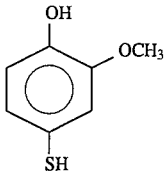

(I)-6

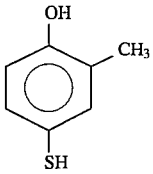

(I)-7

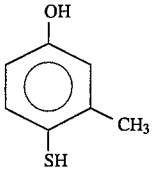

(I)-8

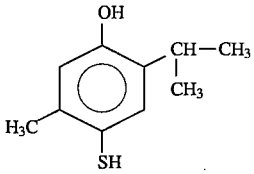

(I)-9

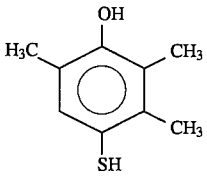

(I)-10

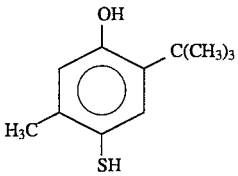

(I)-11

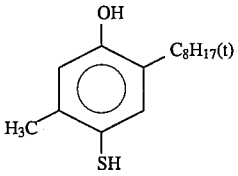

(I)-12

TABLE 36-continued
(I)-13
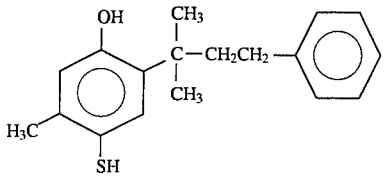
(I)-14
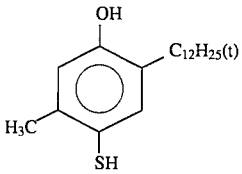
TABLE 36-continued
(I)-15
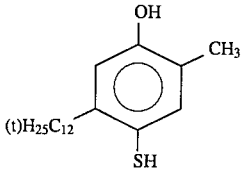
TABLE 37
(II)-1
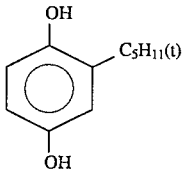
(II)-2
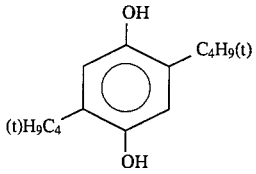
(II)-3
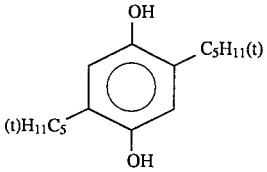
(II)-4
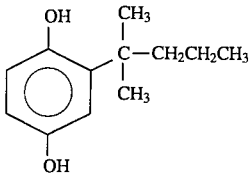
(II)-5
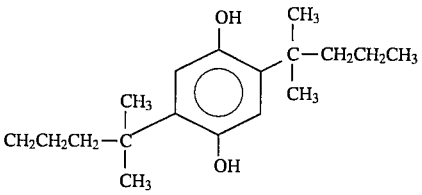
(II)-6
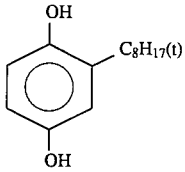
(II)-7
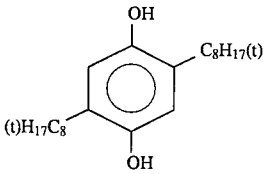
(II)-8
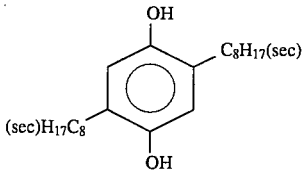
(II)-9
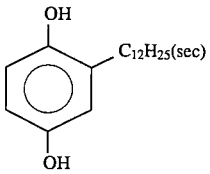
(II)-10
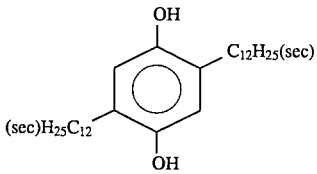
(II)-11
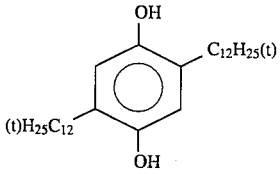
(II)-12
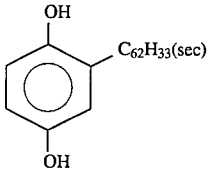

TABLE 37-continued
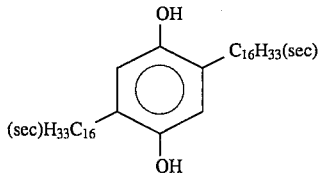
(II)-13
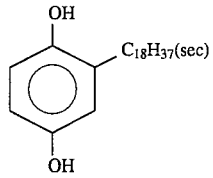
(II)-14
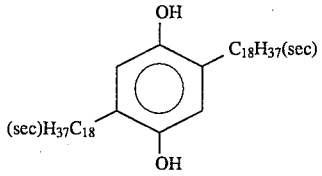
(II)-15
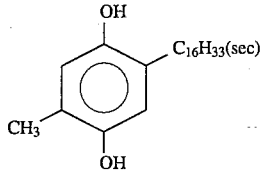
(II)-16
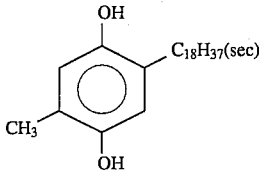
(II)-17
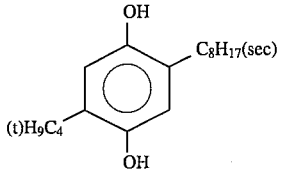
(II)-18
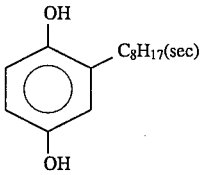
(II)-19
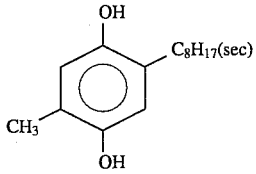
(II)-20
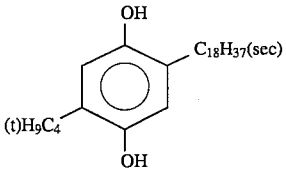
(II)-21
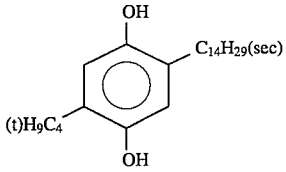
(II)-22
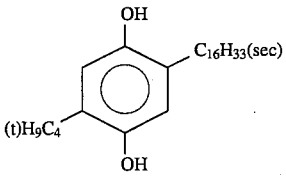
(II)-23
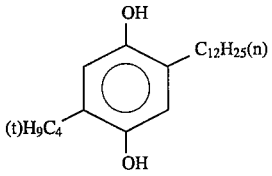
(II)-24
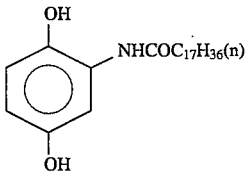
(II)-25
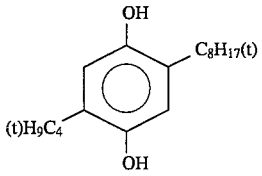
(II)-26
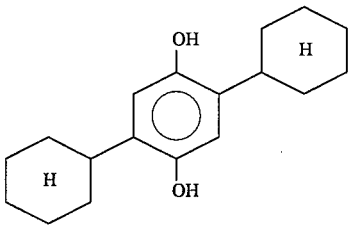
(II)-27
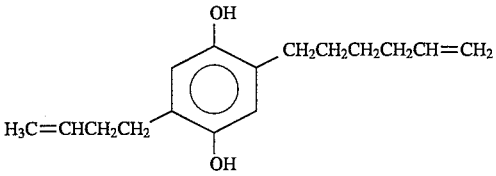
(II)-28

TABLE 37-continued
(II)-29
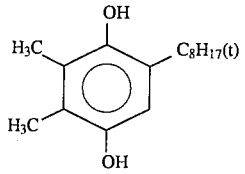
(II)-30
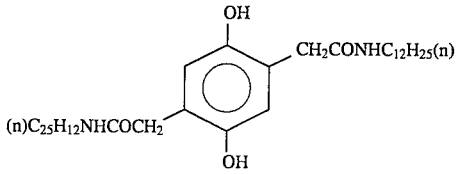
(II)-31
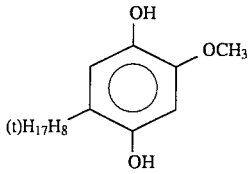
(II)-32
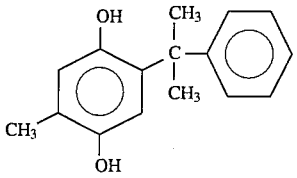
(II)-33
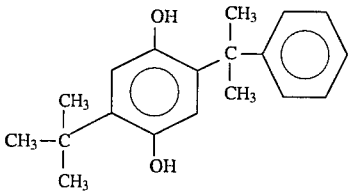
(II)-34
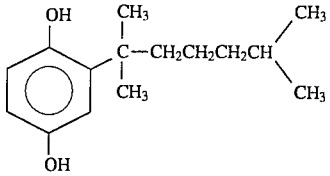
(II)-35
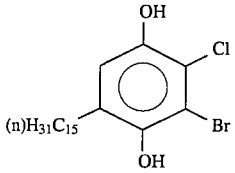
(II)-36
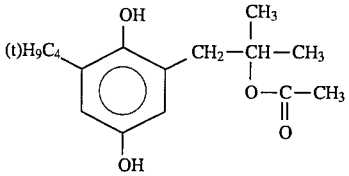
(II)-37
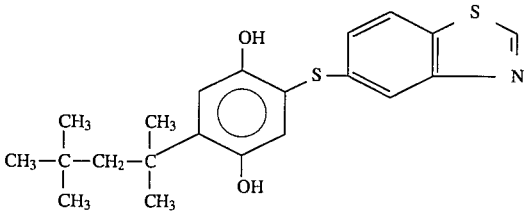
(II)-38
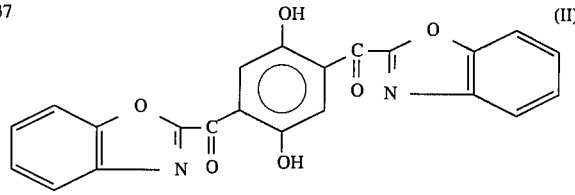
(II)-39
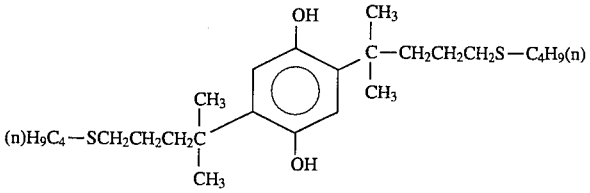
(II)-40
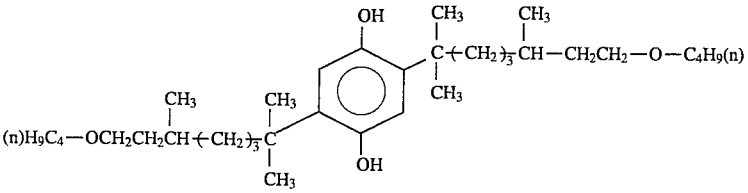

TABLE 37-continued
(II)-41
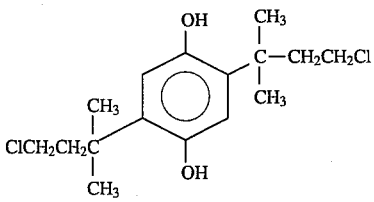
(II)-42
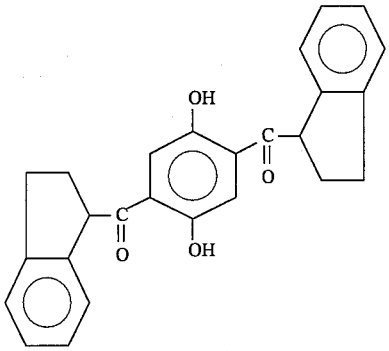
(II)-43
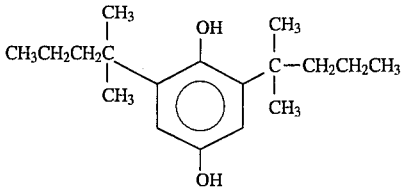
(II)-44
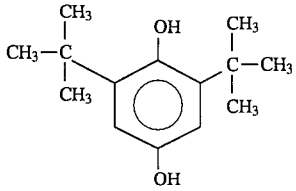
(II)-45
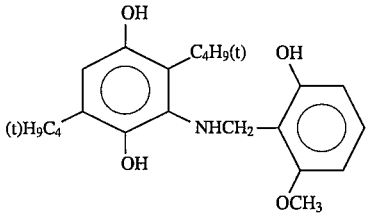
(II)-46
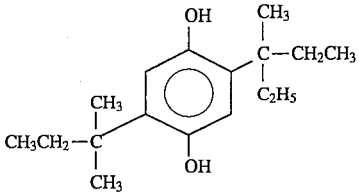
(II)-47
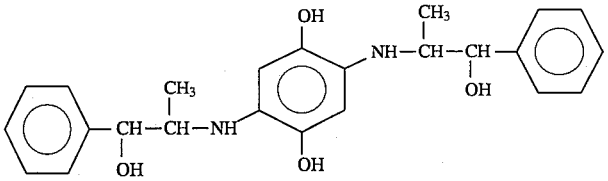
(II)-48
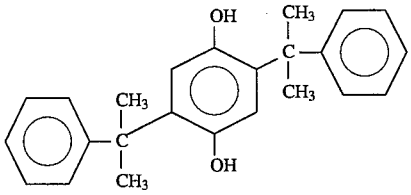
(II)-49
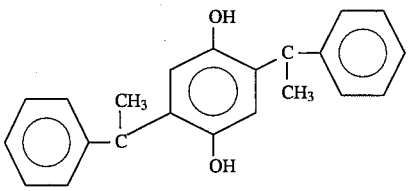
(II)-50
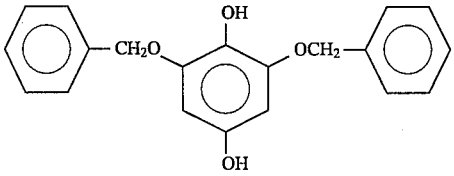
(II)-51
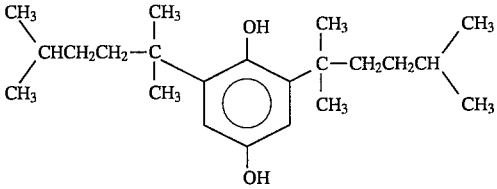
(II)-52
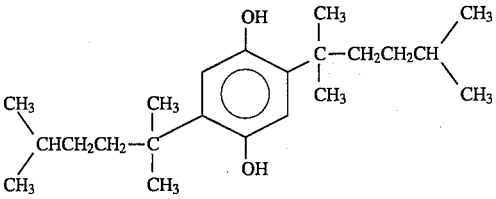
(II)-53
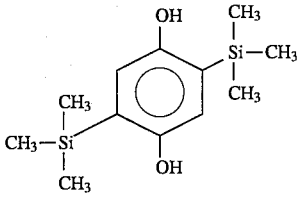

TABLE 37-continued
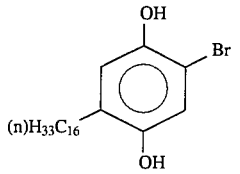
(II)-54
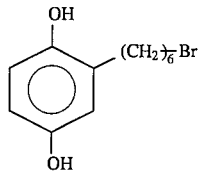
(II)-55
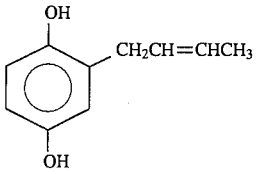
(II)-56
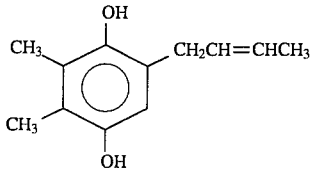
(II)-57
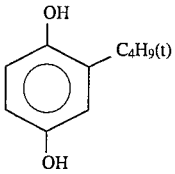
(II)-58
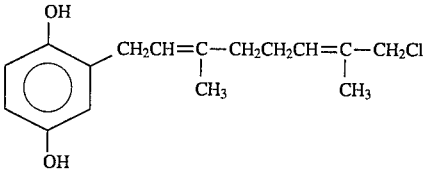
(II)-59
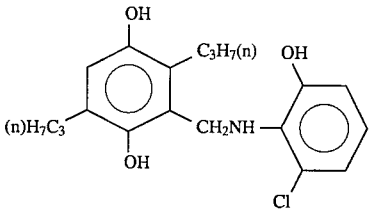
(II)-60
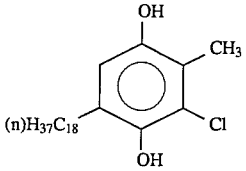
(II)-61
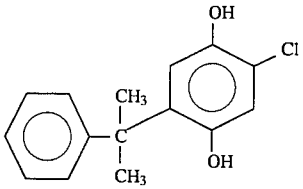
(II)-62
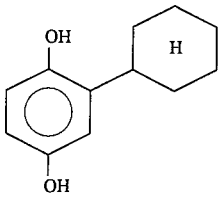
(II)-63
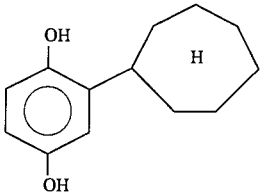
(II)-64
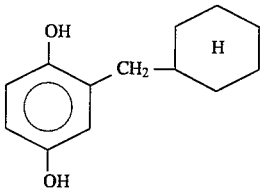
(II)-65
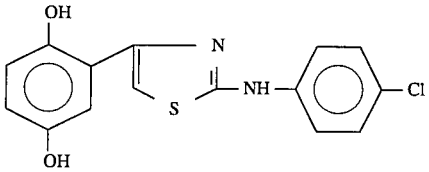
(II)-66
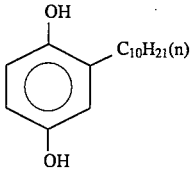
(II)-67
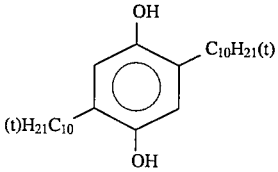
(II)-68
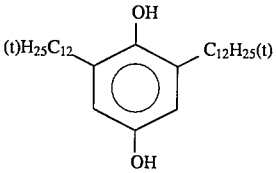
(II)-69

TABLE 37-continued
(II)-70
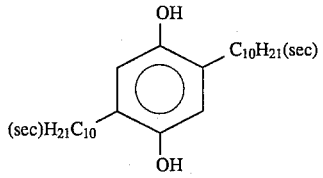
(II)-71
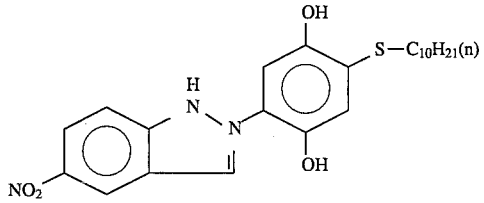
(II)-72
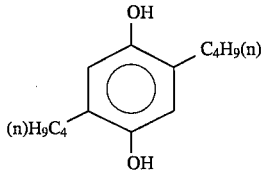
(II)-73
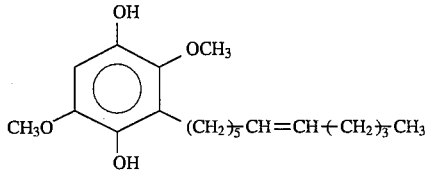
(II)-74
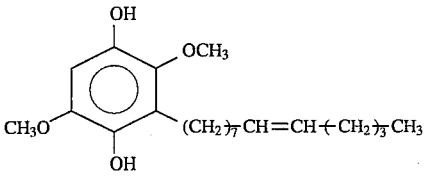
(II)-75
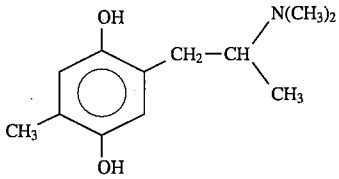
(II)-76
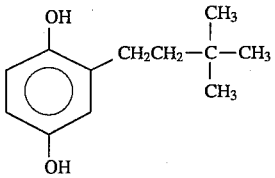
(II)-77
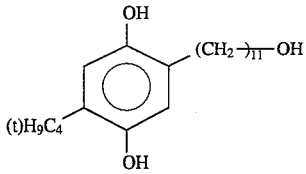
(II)-78
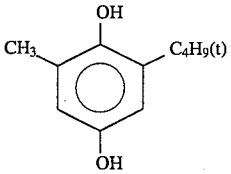
(II)-79
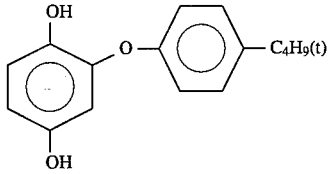
(II)-80
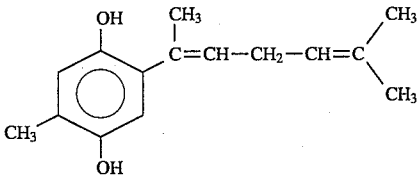
(II)-81
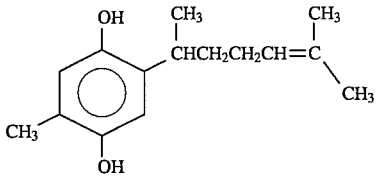
(II)-82
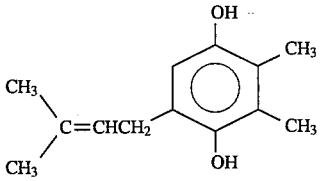
(II)-83
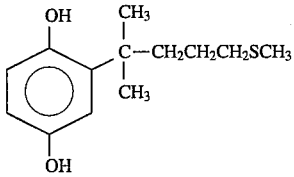
(II)-84
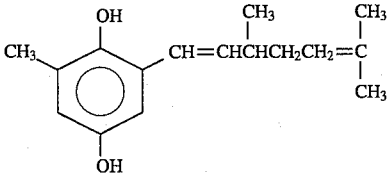
(II)-85
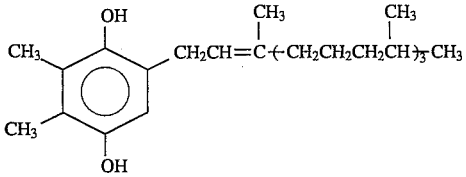

TABLE 37-continued
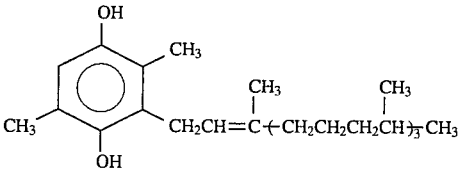
(II)-86
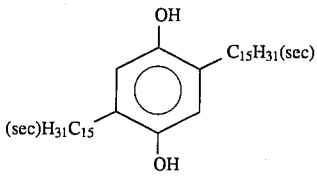
(II)-87
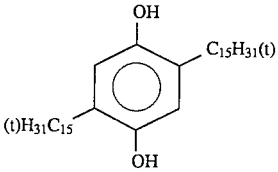
(II)-88
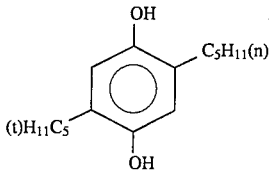
(II)-89
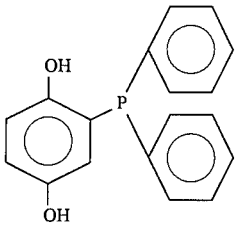
(II)-90
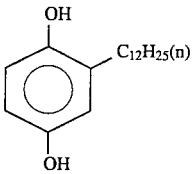
(II)-91
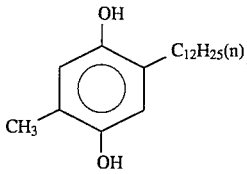
(II)-92
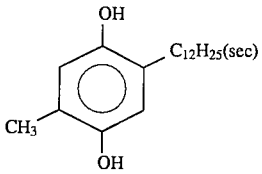
(II)-93
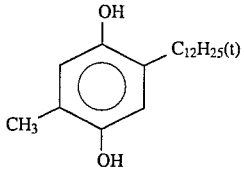
(II)-94
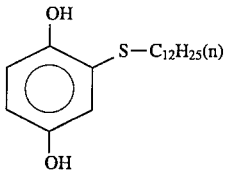
(II)-95
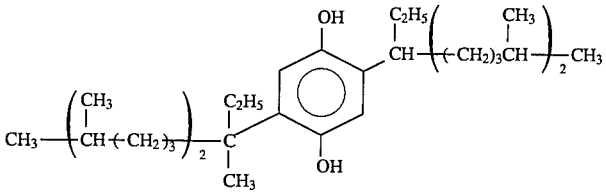
(II)-96
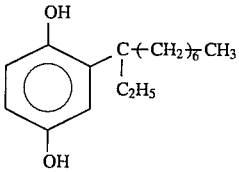
(II)-97
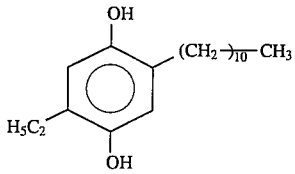
(II)-98
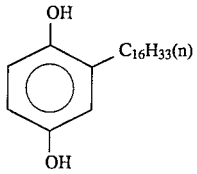
(II)-99
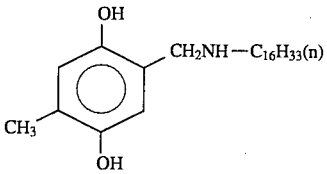
(II)-100

TABLE 37-continued
(II)-101
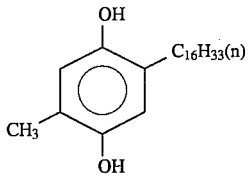
(II)-102
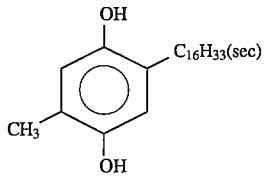
(II)-103
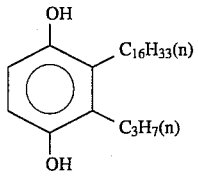
(II)-104
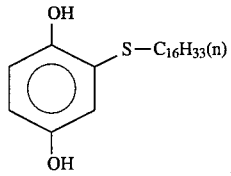
(II)-105
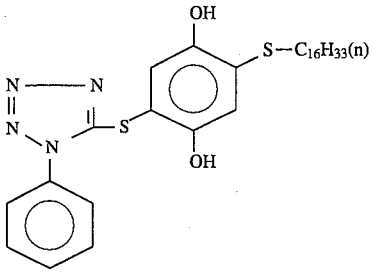
(II)-106
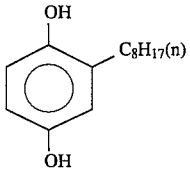
(II)-107
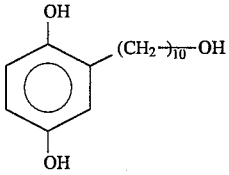
(II)-108
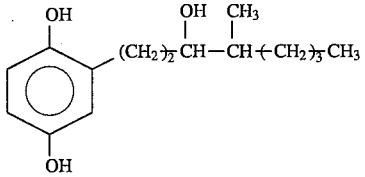
(II)-109
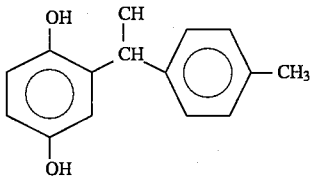
(II)-110
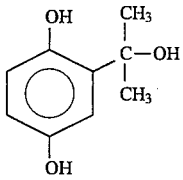
(II)-111
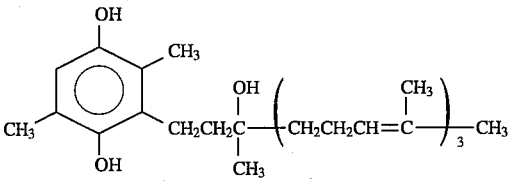
(II)-112
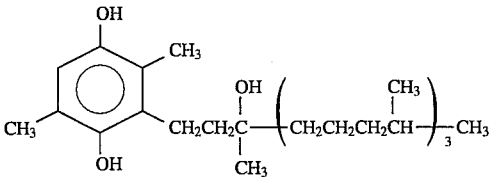
(II)-113
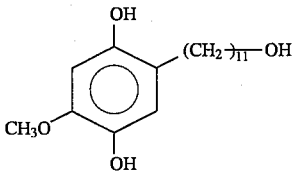
(II)-114
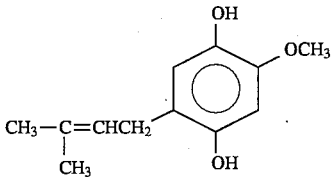
(II)-115
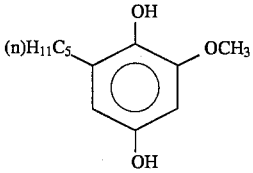
(II)-116
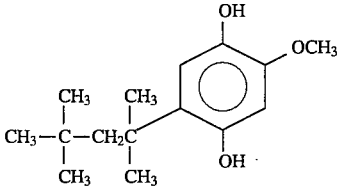

TABLE 37-continued
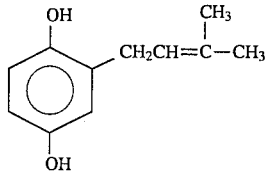
(II)-117
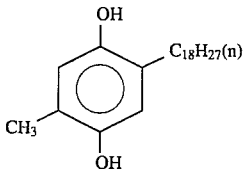
(II)-118
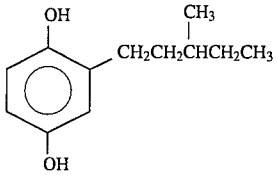
(II)-119
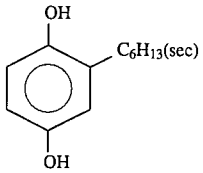
(II)-120
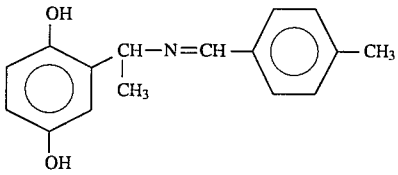
(II)-121
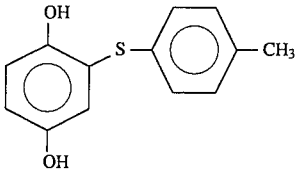
(II)-122
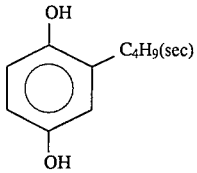
(II)-123
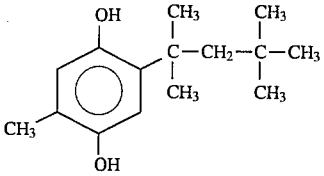
(II)-124
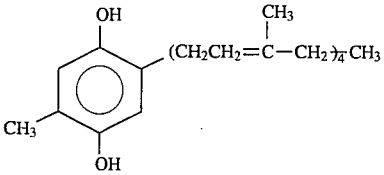
(II)-125
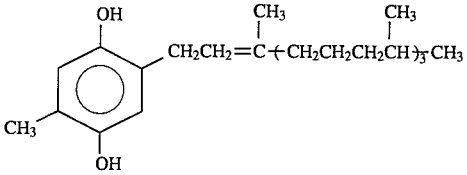
(II)-126
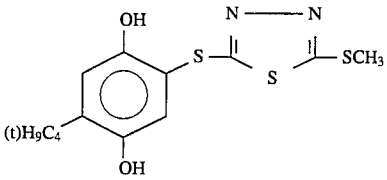
(II)-127
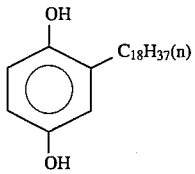
(II)-128
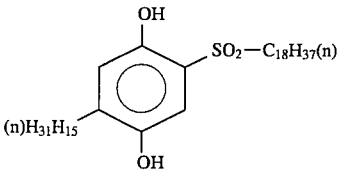
(II)-129
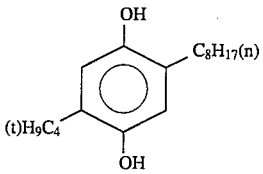
(II)-130
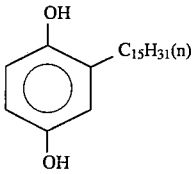
(II)-131
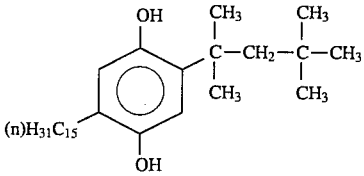
(II)-132

TABLE 37-continued
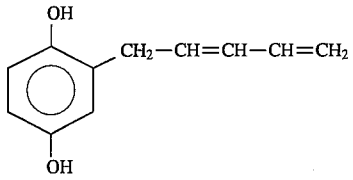
(II)-133
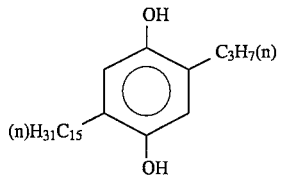
(II)-134
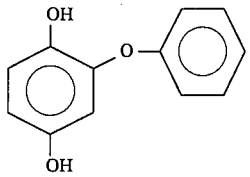
(II)-135
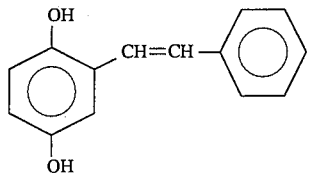
(II)-136
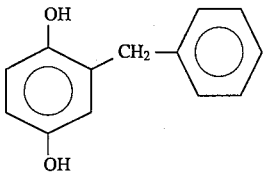
(II)-137
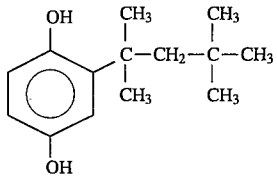
(II)-138
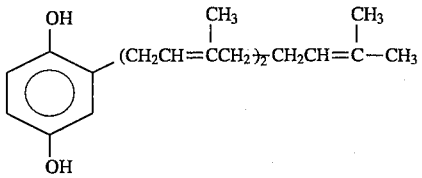
(II)-139
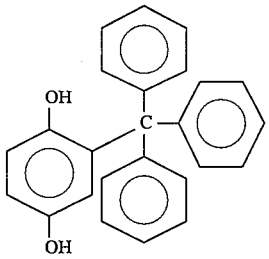
(II)-140
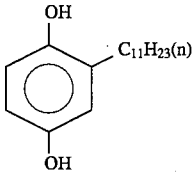
(II)-141
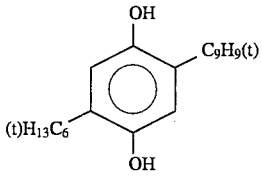
(II)-142
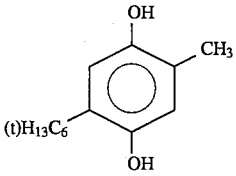
(II)-143
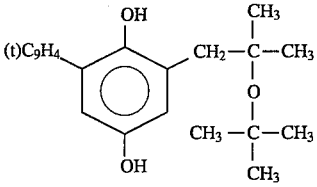
(II)-144
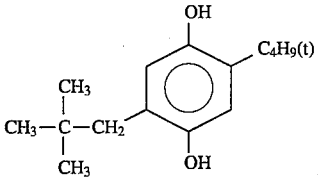
(II)-145
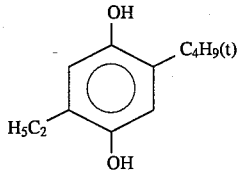
(II)-146
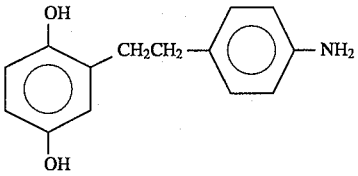
(II)-147
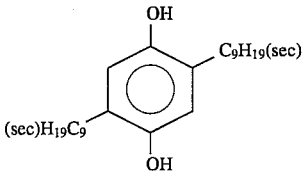
(II)-148

TABLE 37-continued
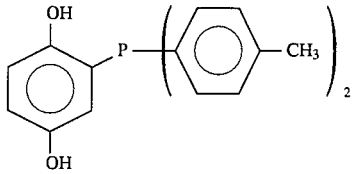
(II)-149
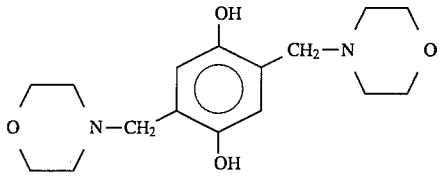
(II)-150
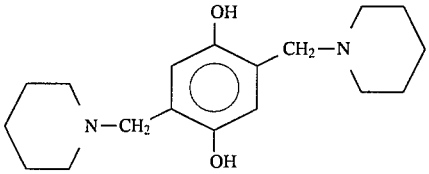
(II)-151
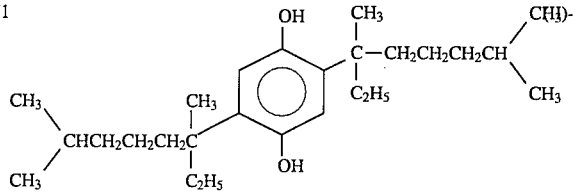
(II)-152
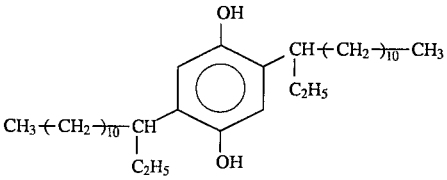
(II)-153
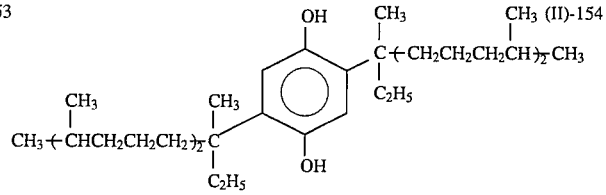
(II)-154
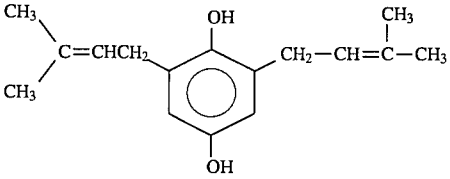
(II)-155
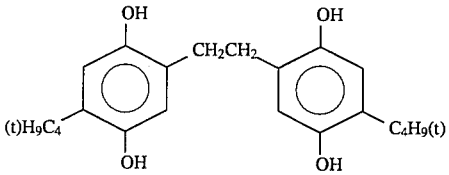
(II)-156
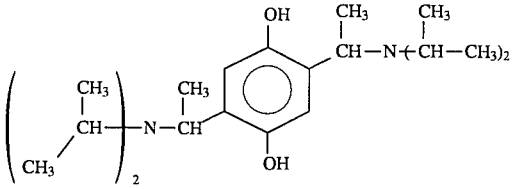
(II)-157
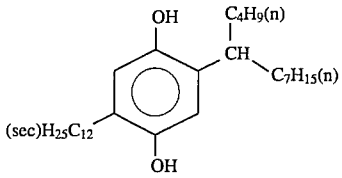
(II)-158
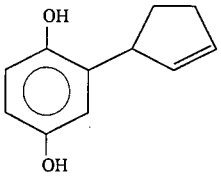
(II)-159
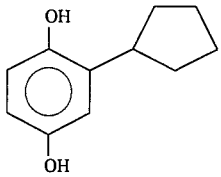
(II)-160
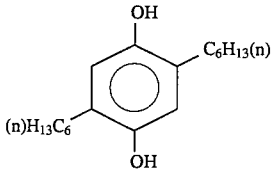
(II)-161
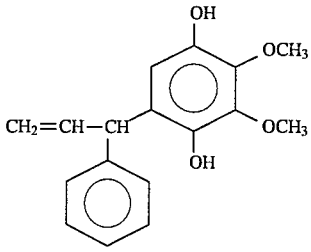
(II)-162
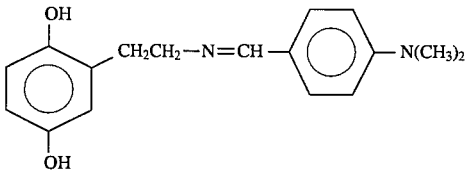
(II)-163
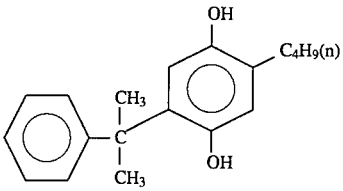
(II)-164

TABLE 37-continued
(II)-165
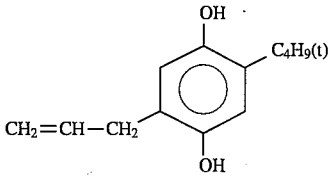
(II)-166
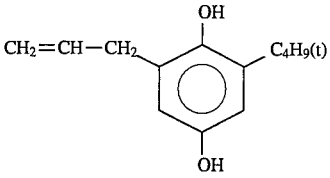
(II)-167
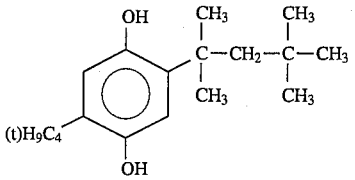
(II)-168
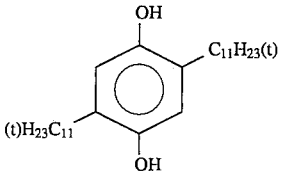
(II)-169
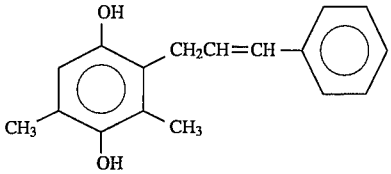
(II)-170
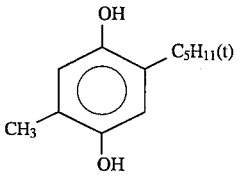
(II)-171
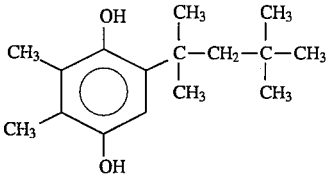
(II)-172
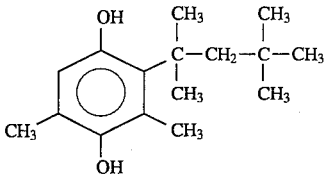
(II)-173
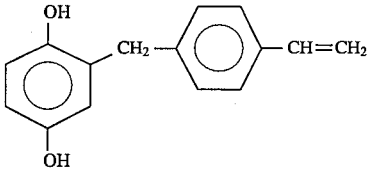
(II)-174
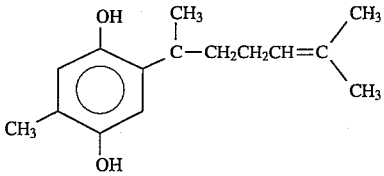
(II)-175
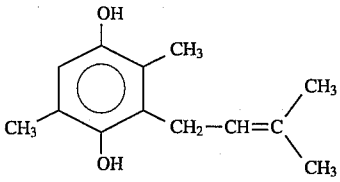
(II)-176
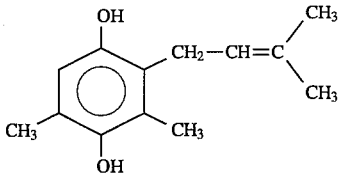
(II)-177
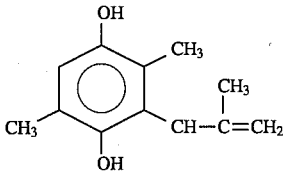
(II)-178
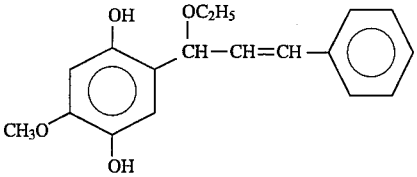
(II)-179
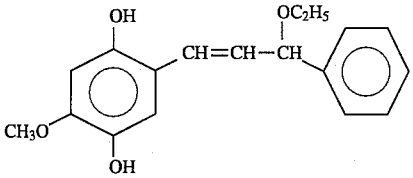
(II)-180
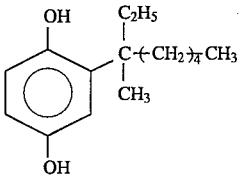

TABLE 37-continued
(II)-181
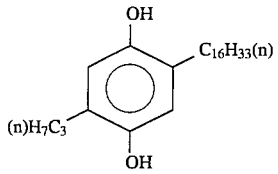
(II)-182
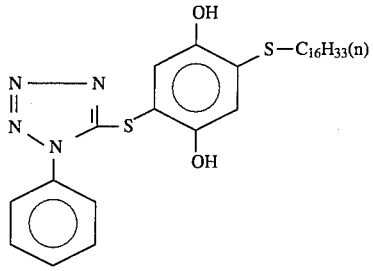
(II)-183
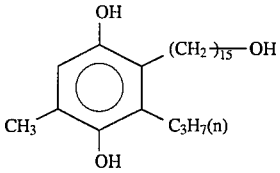
(II)-184
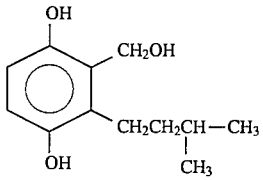
(II)-185
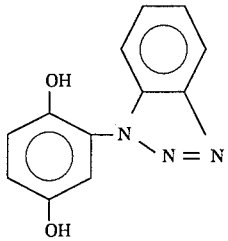
(II)-186
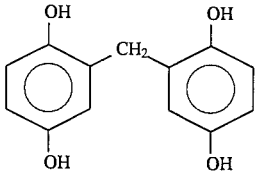
(II)-187
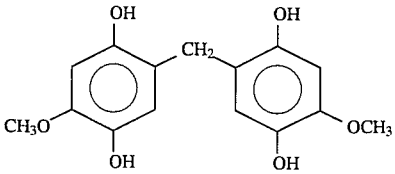
(II)-188
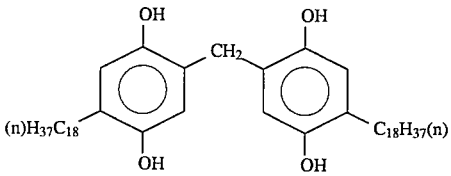
(II)-189
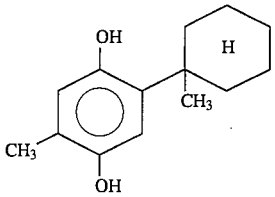
(II)-190
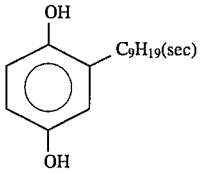
(II)-191
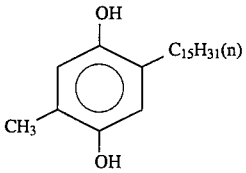
(II)-192
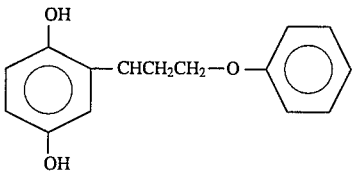
(II)-193
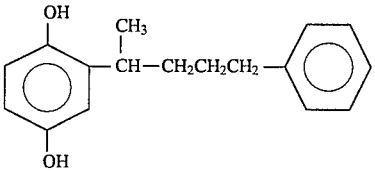
(II)-194
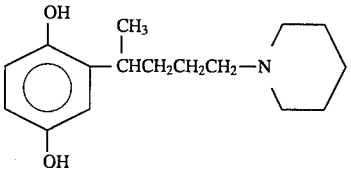

TABLE 37-continued
(II)-195
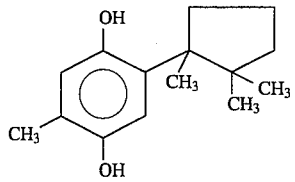
(II)-196
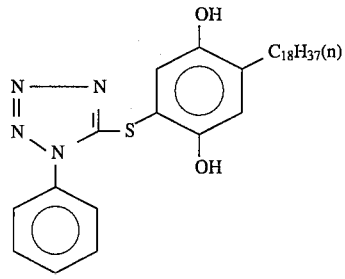
(II)-197
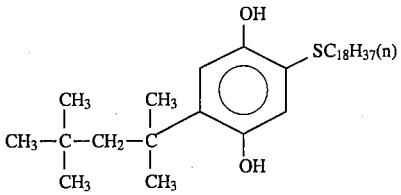
(II)-198
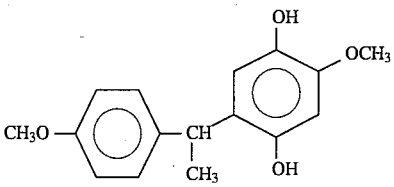
(II)-199
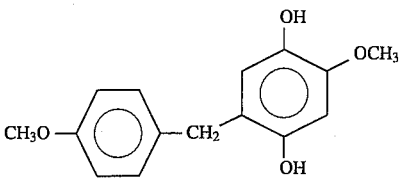
(II)-200
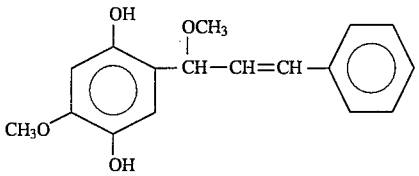
(II)-201
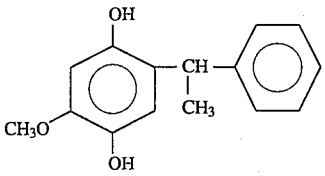
(II)-202
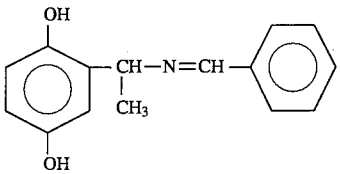
(II)-203
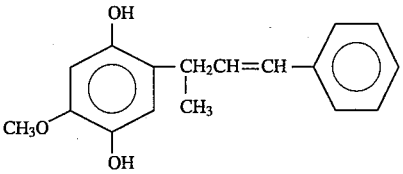
(II)-204
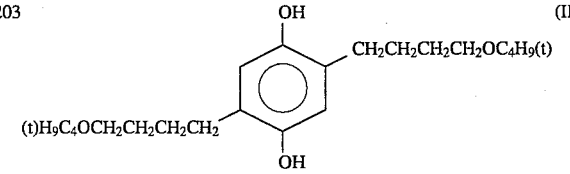
(II)-205
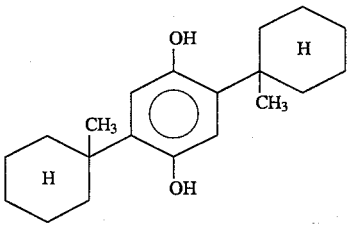
(II)-206
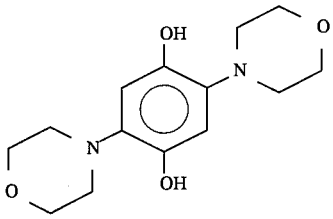
(II)-207
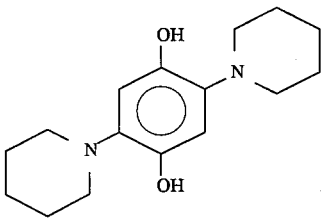
(II)-208
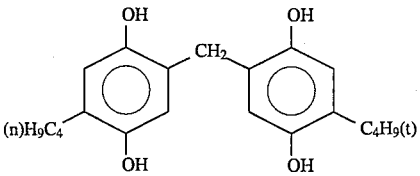

TABLE 37-continued
(II)-209
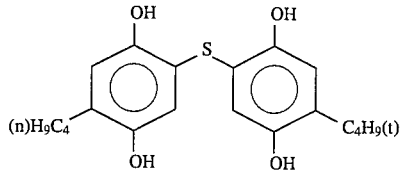
(II)-210
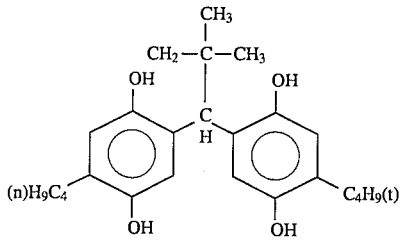
(II)-211
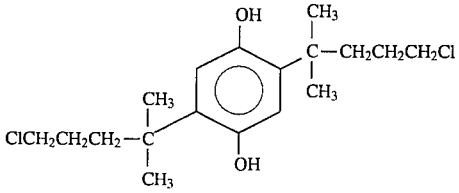
(II)-212
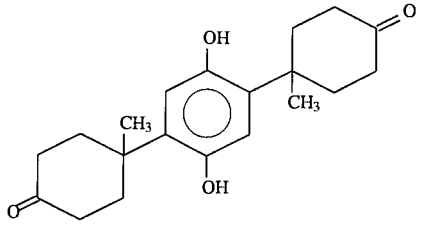
(II)-213
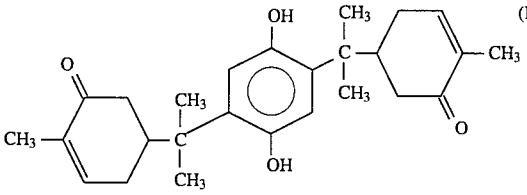
(II)-214
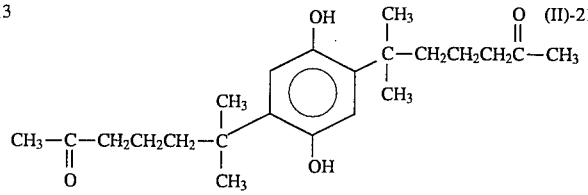
(II)-215
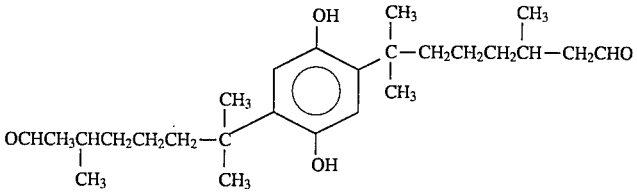
(II)-216
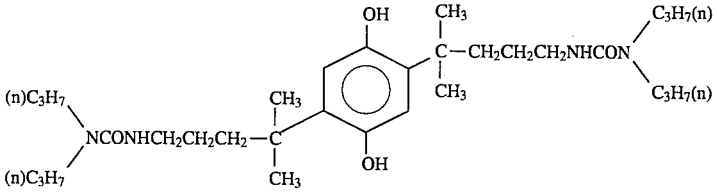
(II)-217
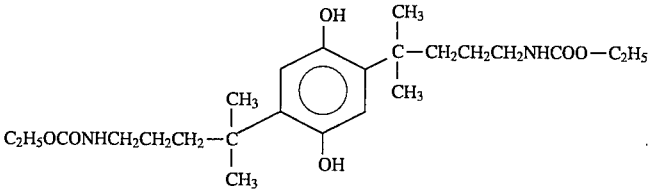
(II)-218
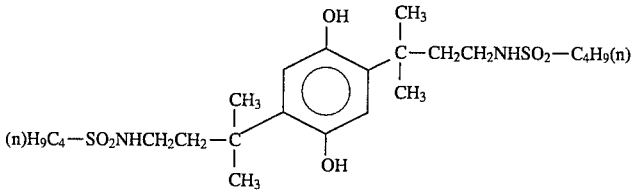

TABLE 37-continued
(II)-219
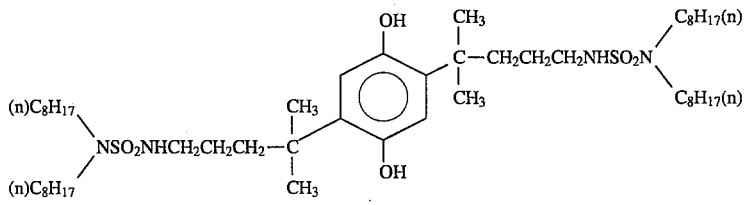
(II)-220
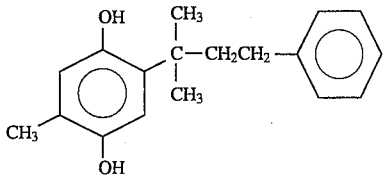
(II)-221
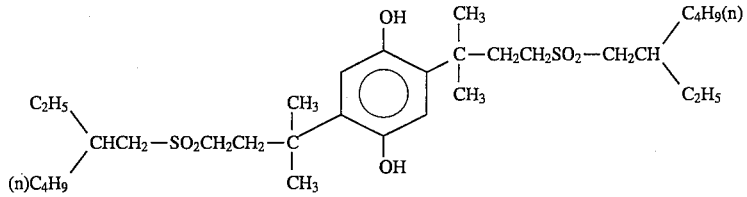
(II)-222
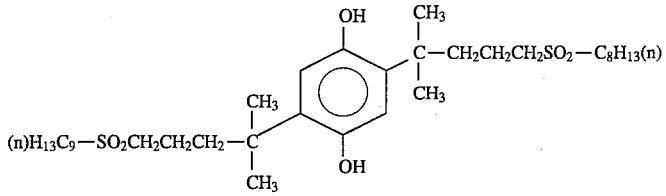
(II)-223
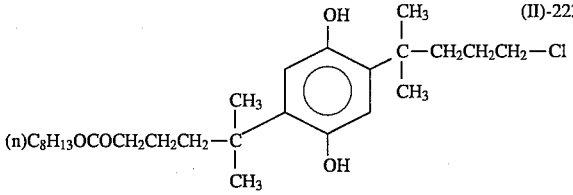
(II)-224
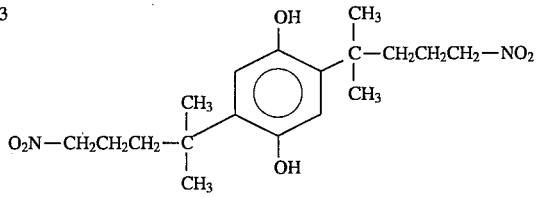
TABLE 38
(III)-1
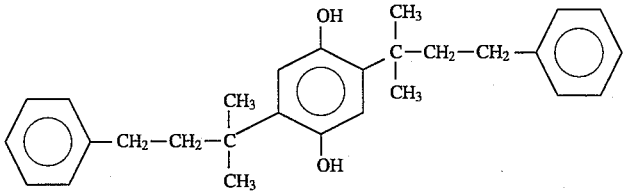
(III)-2
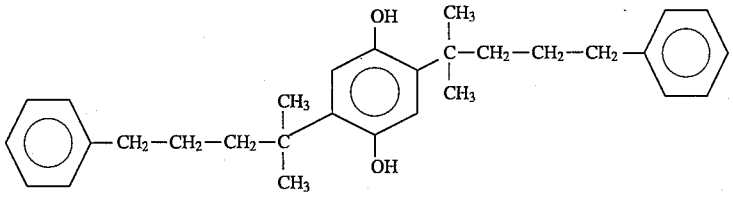

TABLE 38-continued
(III)-3
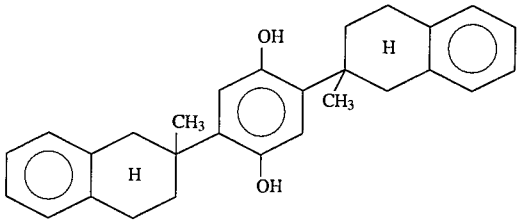
(III)-4
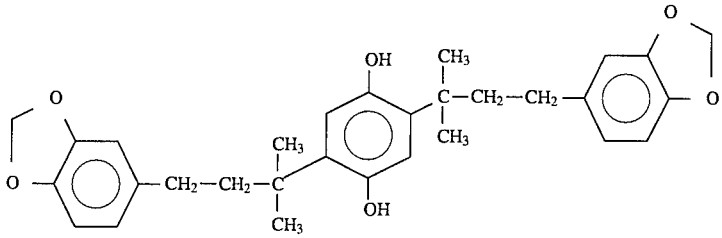
(III)-5
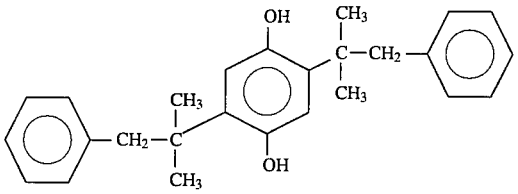
(III)-6
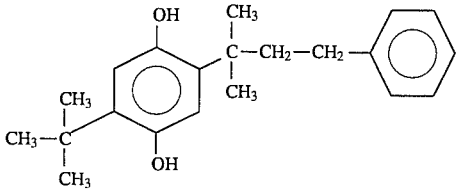
(III)-7
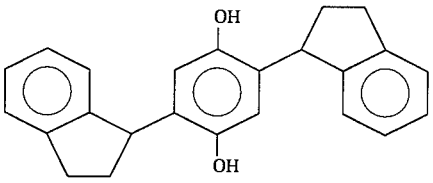
(III)-8
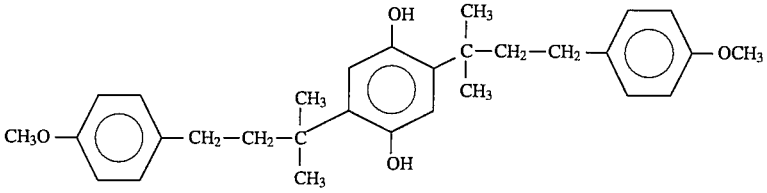
(III)-9
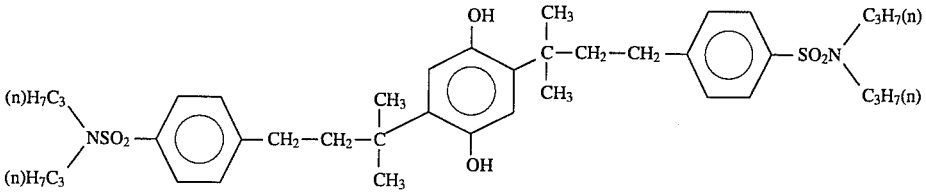

TABLE 38-continued
(III)-10
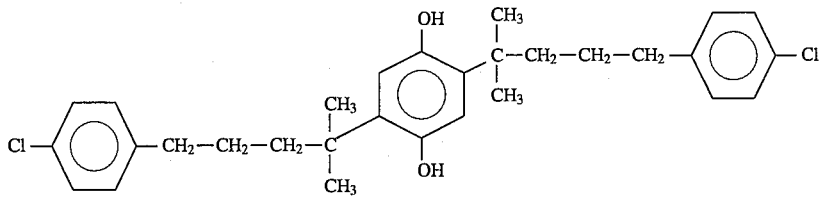
(III)-11
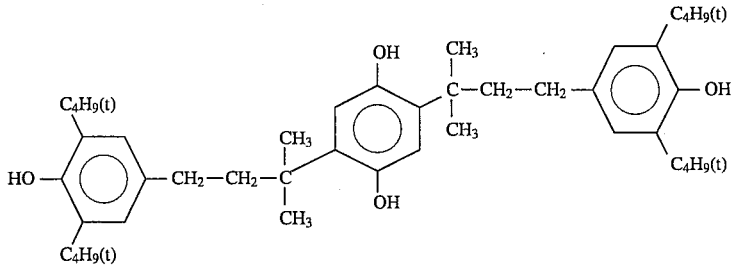
(III)-12
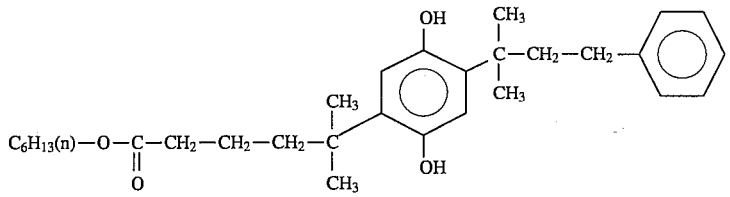
(III)-13
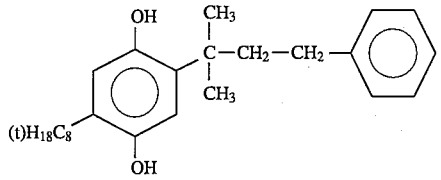
(III)-14
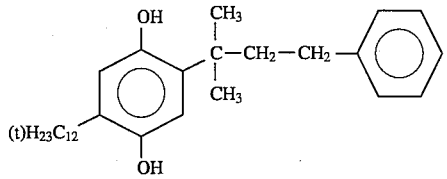
(III)-15
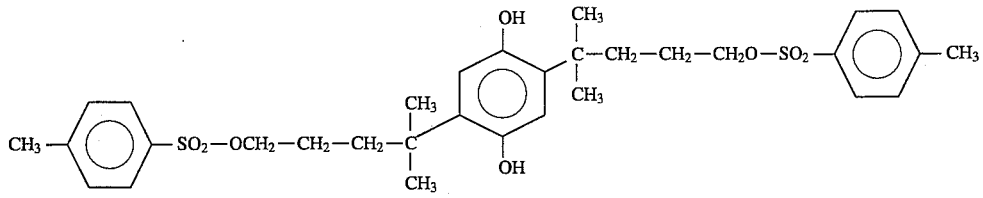
(III)-16
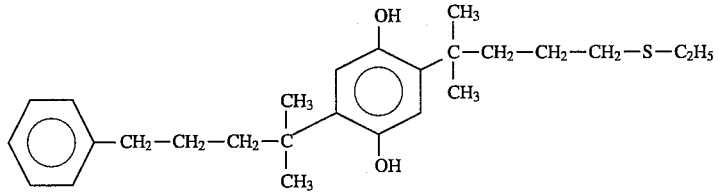
(III)-17
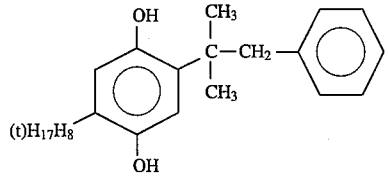

TABLE 38-continued
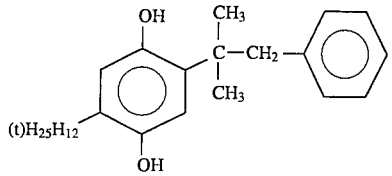
(III)-18
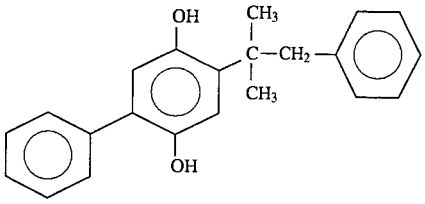
(III)-19
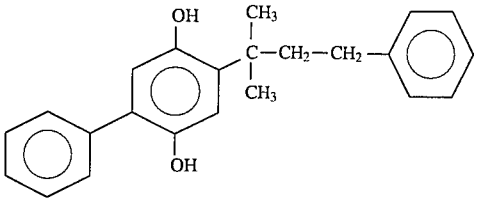
(III)-20
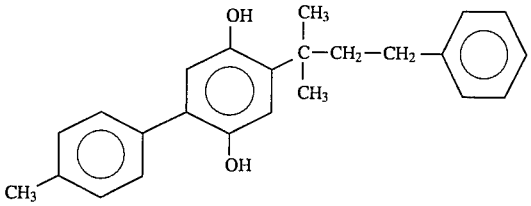
(III)-21
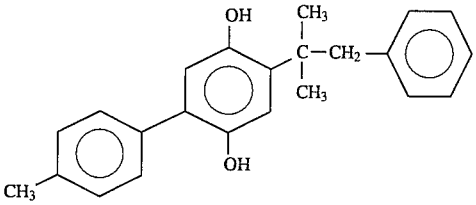
(III)-22
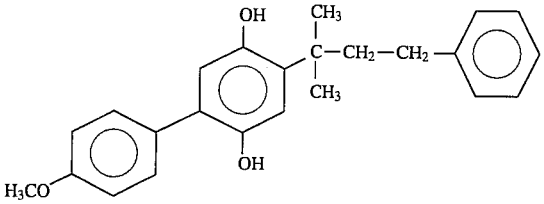
(III)-23
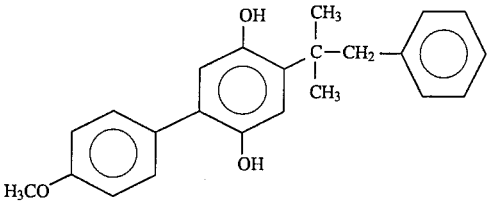
(III)-24

TABLE 38-continued
(III)-25
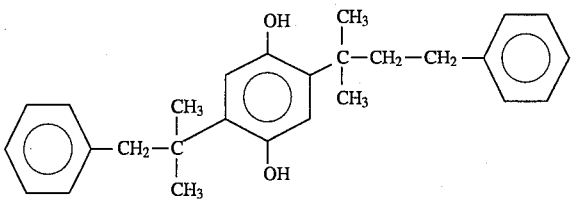
(III)-26
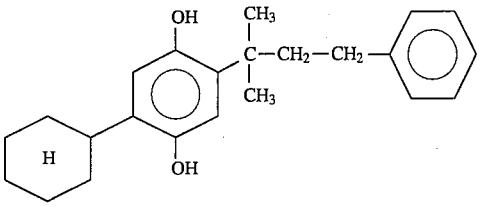
(III)-27
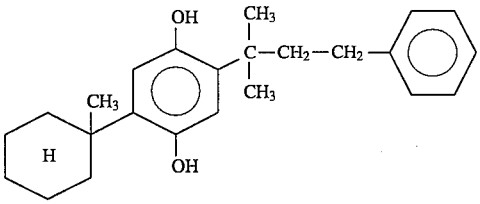
(III)-28
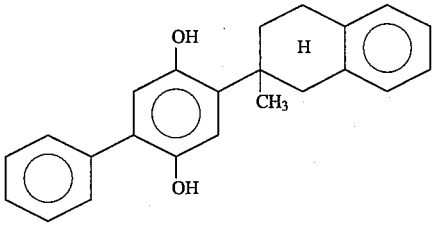
(III)-29
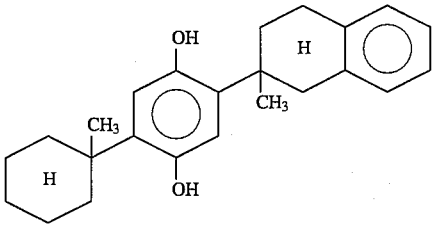
(III)-30
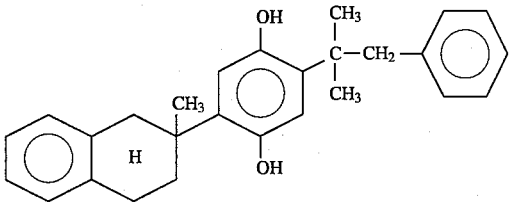
(III)-31
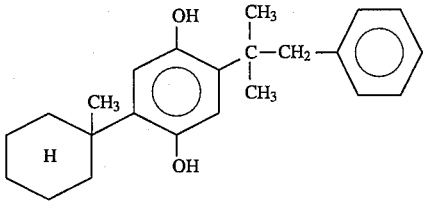

TABLE 38-continued
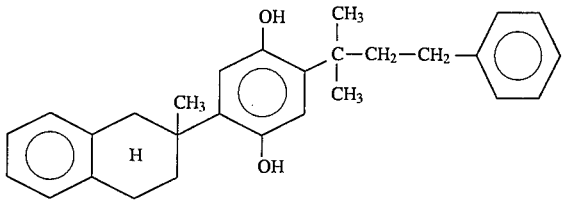
(III)-32
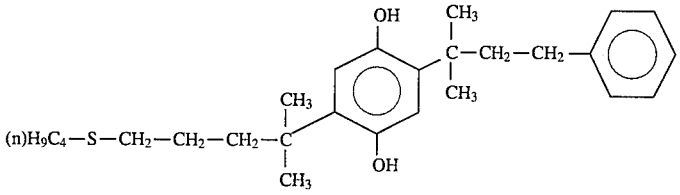
(III)-33
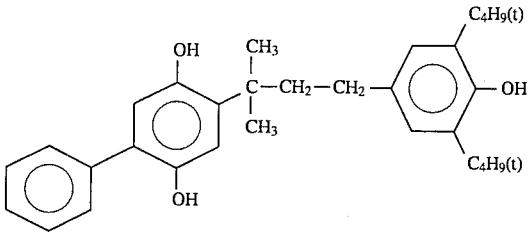
(III)-34
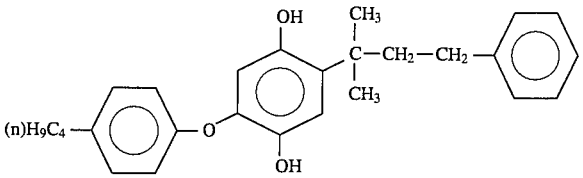
(III)-35
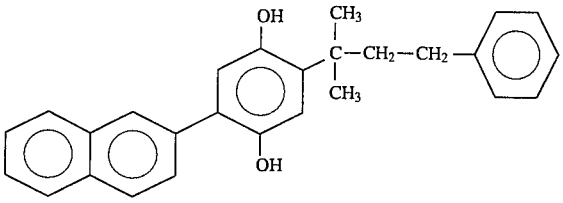
(III)-36
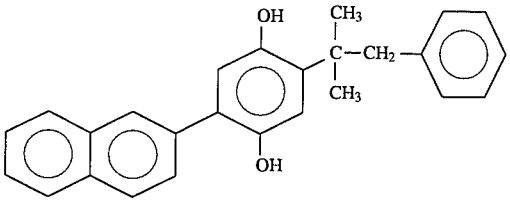
(III)-37
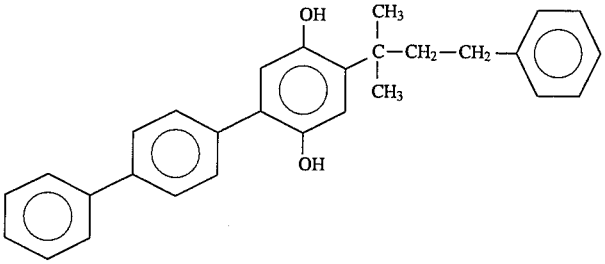
(III)-38

TABLE 38-continued
(III)-39
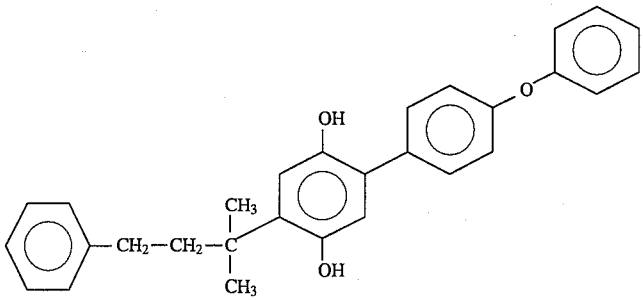
(III)-40
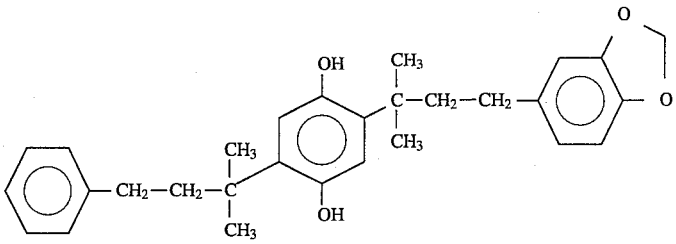
(III)-41
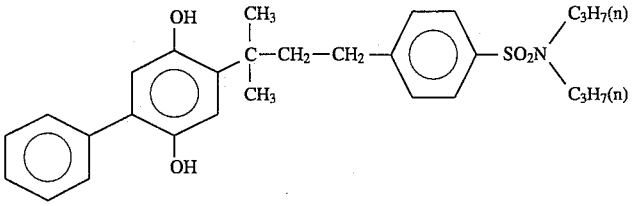
(III)-42
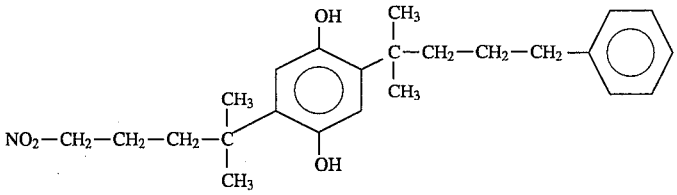
(III)-43
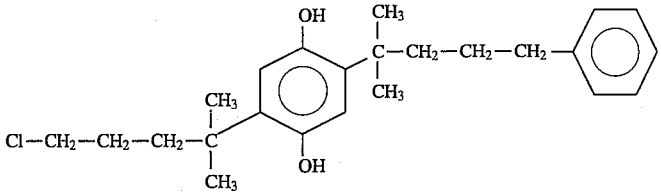
(III)-44
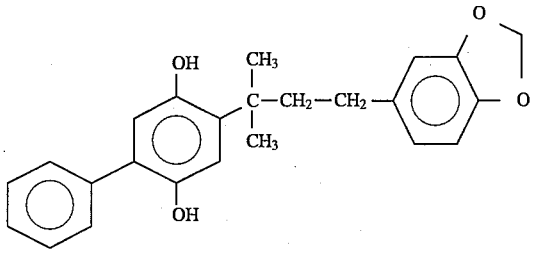
(III)-45
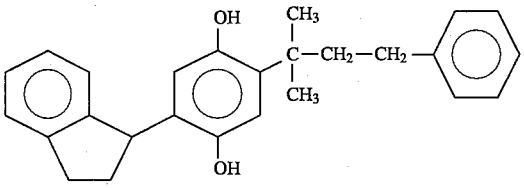

TABLE 38-continued
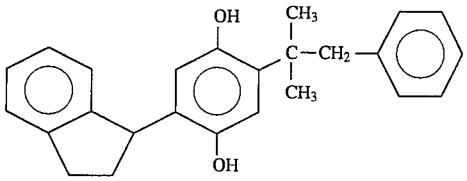
(III)-46
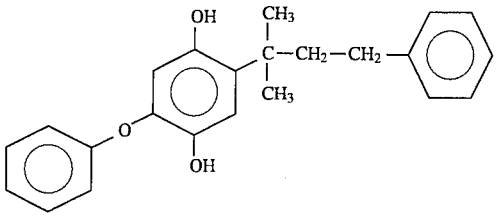
(III)-47
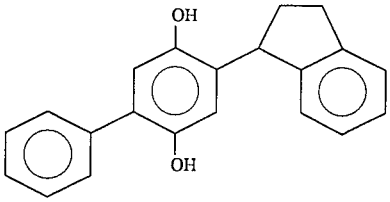
(III)-48
TABLE 39
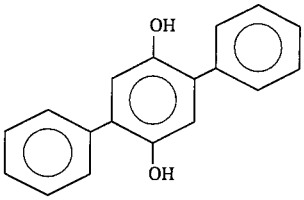
(IV)-1
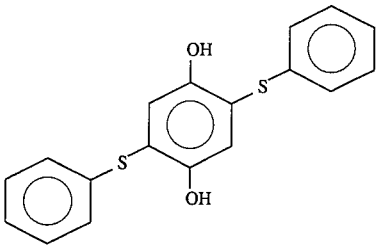
(IV)-2
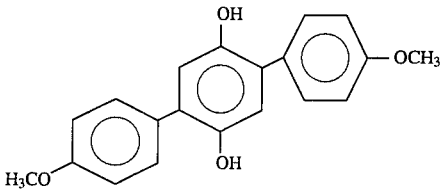
(IV)-3
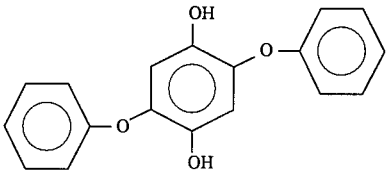
(IV)-4
TABLE 39-continued
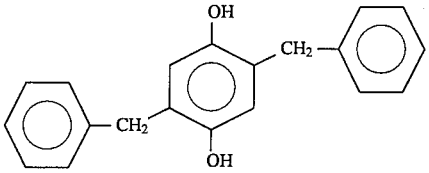
(IV)-5
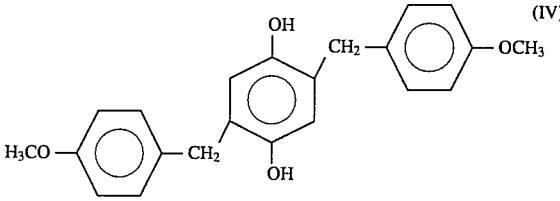
(IV)-6
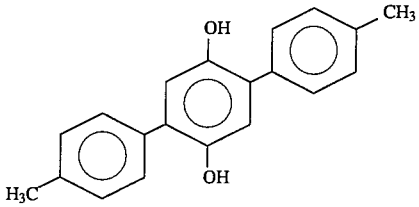
(IV)-7
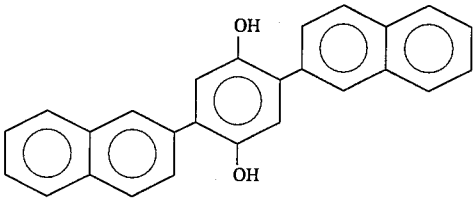
(IV)-8

TABLE 39-continued
(IV)-9
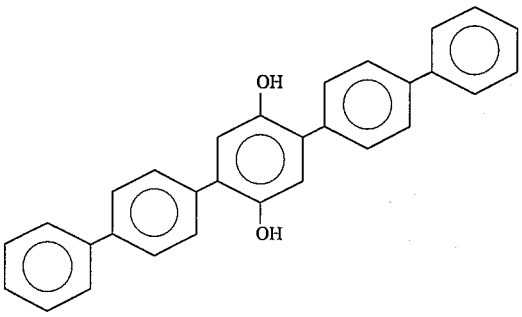
(IV)-10
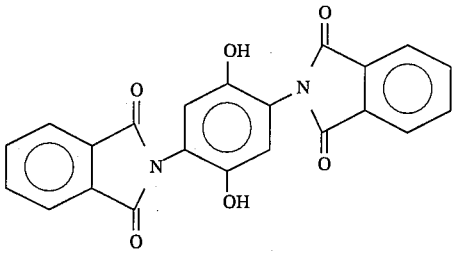
(IV)-11
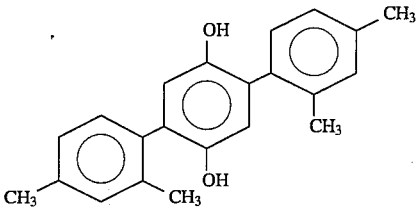
TABLE 39-continued
(IV)-12
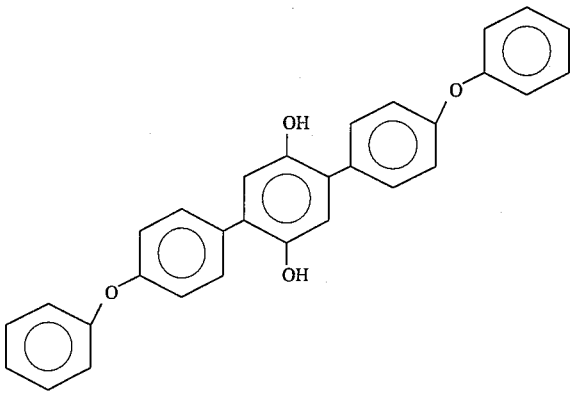
(IV)-13
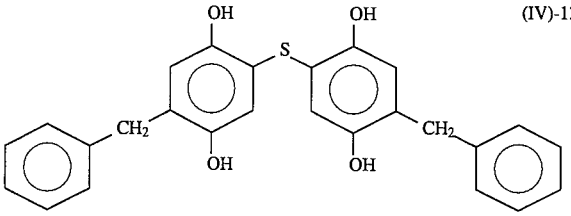
TABLE 40
| Compound No. | $R^1$ | $R^2$ | $R^3$ | $R^4$ |
|---|---|---|---|---|
| (V)-1 | H | H | 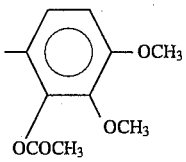 | H |
| (V)-2 | $-CH_2CH_2NH_2$ | $-CH_3$ | H | H |
| (V)-3 | $-(CH_2CH_2CH_2CH(CH_3))_3-CH_3$ | | $-CH_3$ | H |
| (V)-4 | H | H | H | H |
| (V)-5 | $-CH_2CH_2NH_2$ | $-CH_3$ | H | H |
| (V)-6 | $-(CH_2CH_2CH_2CH(CH_3))_3-CH_3$ | $-CH_3$ | H | H |
| (V)-7 | $-(CH_2CH_2CH_2CH(CH_3))_3-CH_3$ | $-CH_3$ | H | H |
| (V)-8 | $-(CH_2CH_2CH_2CH(CH_3))_3-CH_3$ | $-CH_3$ | H | H |
| (V)-9 | $-CH_2CH_2Br$ | $-CH_3$ | H | H |

TABLE 40-continued

| | | | | |
|---|---|---|---|---|
| (V)-10 | H | H | H | H |
| (V)-11 | H | H | H | H |
| (V)-12 | $-CH_3$ | $-CH_3$ | H | $-CH_3$ |
| (V)-13 | $-CH_2CH_2Cl$ | $-CH_3$ | H | H |
| (V)-14 | $-CH_2CH_2\underset{\underset{Cl}{\vert}}{CH}-\underset{\underset{CH_3}{\vert}}{C}=CH_2$ | $-CH_3$ | H | H |
| (V)-15 | H | H | H | H |
| (V)-16 | H | H | H | H |
| (V)-17 | H | H | H | H |
| (V)-18 | H | H | H | H |
| (V)-19 | $-CH_3$ | $-CH_3$ | H | H |
| (V)-20 | $-CH_3$ | $-CH_3$ | H | H |
| (V)-21 | $-CH_3$ | $-CH_3$ | H | H |
| (V)-22 | $-CH_3$ | $-CH_3$ | H | $-\underset{\underset{CH_3}{\vert}}{CH}-CH_3$ |
| (V)-23 | $-CH_3$ | $-CH_3$ | H | $-\underset{\underset{CH_3}{\vert}}{CH}-CH_3$ |
| (V)-24 | $-CH_3$ | $-CH_3$ | H | $-\underset{\underset{CH_3}{\vert}}{CH}-CH_3$ |
| (V)-25 | $-\left(CH_2CH_2CH=\underset{\underset{CH_3}{\vert}}{C}\right)_4-CH_3$ | $-CH_3$ | H | H |
| (V)-26 | $-\left(CH_2CH_2CH=\underset{\underset{CH_3}{\vert}}{C}\right)_4-CH_3$ | $-CH_3$ | H | H |
| (V)-27 | $-\left(CH_2CH_2CH=\underset{\underset{CH_3}{\vert}}{C}\right)_4-CH_3$ | $-CH_3$ | H | H |
| (V)-28 | $-\left(CH_2CH_2CH=\underset{\underset{CH_3}{\vert}}{C}\right)_4-CH_3$ | $-CH_3$ | H | H |
| (V)-29 | $-\left(CH_2CH_2CH=\underset{\underset{CH_3}{\vert}}{C}\right)_4-CH_3$ | $-CH_3$ | H | H |
| (V)-30 | $-\left(CH_2CH_2CH=\underset{\underset{CH_3}{\vert}}{C}\right)_3-CH_3$ | $-CH_3$ | H | H |
| (V)-31 | H | H | 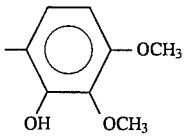 | H |
| (V)-32 | $-CH_2CH_2CH=\underset{\underset{CH_3}{\vert}}{C}-CH_2CH_3$ | $-CH_3$ | H | H |
| (V)-33 | H | H | H | H |
| (V)-34 | H | H | H | H |
| (V)-35 | H | H | H | H |
| (V)-36 | H | H | H | H |
| (V)-37 | H | H | H | H |
| (V)-38 | $-CH_3$ | $-CH_3$ | H | H |

TABLE 40-continued
| | | | | |
|---|---|---|---|---|
| (V)-39 | H | H | 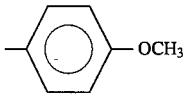 | H |
| (V)-40 | H | H | 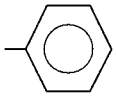 | H |
| (V)-41 | $-OCH_3$ | $-CH_3$ | H | H |
| (V)-42 | $-CH_2CH_2CH=C(CH_3)-CH_3$ | $-CH_3$ | H | H |
| (V)-43 | 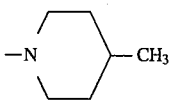 | $-CH_3$ | H | H |
| (V)-44 | 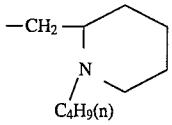 | $-CH_3$ | H | H |
| (V)-45 | $-(CH_2CH_2CH=C(CH_3))_5-CH_3$ | $-CH_3$ | H | H |
| (V)-46 | $-(CH_2CH_2CH=C(CH_3))_4-CH_3$ | $-CH_3$ | H | H |
| (V)-47 | $-(CH_2CH_2CH=C(CH_3))_3-CH_3$ | $-CH_3$ | H | H |
| (V)-48 | $-(CH_2CH_2CH_2CH(CH_3))_3-CH_3$ | $-CH_3$ | H | H |
| (V)-49 | $-CH_3$ | $-CH_3$ | H | H |
| (V)-50 | H | H | H | $-CH_3$ |
| (V)-51 | H | H | 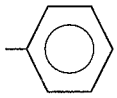 | H |
| (V)-52 | H | H | H | H |
| (V)-53 | H | H | H | H |
| (V)-54 | H | H | H | H |
| (V)-55 | H | H | H | H |
| (V)-56 | H | H | H | H |
| (V)-57 | H | H | H | H |
| (V)-58 | H | H | H | H |
| (V)-59 | H | H | H | 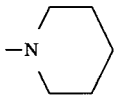 |
| (V)-60 | $-CH_3$ | $-CH_3$ | H | $-CH_3$ |
| (V)-61 | $-CH_3$ | $-CH_3$ | H | H |
| (V)-62 | $-CH_3$ | $-CH_3$ | H | H |
| (V)-63 | $-CH_3$ | $-CH_3$ | H | H |
| (V)-64 | $-CH_3$ | H | H | H |
| (V)-65 | $-(CH_2CH_2CH=C(CH_3))_6-CH_3$ | $-CH_3$ | H | H |

TABLE 40-continued

| | | | | |
|---|---|---|---|---|
| (V)-66 | $-\left(CH_2CH_2CH_2\underset{\underset{CH_3}{\vert}}{CH}\right)_5-CH_3$ | $-CH_3$ | H | H |
| (V)-67 | $-C_3H_7(n)$ | $-CH_3$ | H | H |
| (V)-68 | $-\left(CH_2CH_2CH{=}\underset{\underset{CH_3}{\vert}}{C}\right)_4-CH_3$ | $-CH_3$ | H | H |
| (V)-69 | $-\left(CH_2CH_2CH_2\underset{\underset{CH_3}{\vert}}{CH}\right)_4-CH_3$ | $-CH_3$ | H | H |
| (V)-70 | $-\left(CH_2CH_2CH_2\overset{\overset{Cl}{\vert}}{\underset{\underset{CH_3}{\vert}}{C}}\right)_3-CH_3$ | $-CH_3$ | H | H |
| (V)-71 | $-\left(CH_2CH_2CH{=}\underset{\underset{CH_3}{\vert}}{C}\right)_3-CH_3$ | $-CH_3$ | H | H |
| (V)-72 | $-\left(CH_2CH_2CH_2\underset{\underset{CH_3}{\vert}}{CH}\right)_3-CH_3$ | $-CH_3$ | H | H |
| (V)-73 | $-CH_2-\left(CH_2CH_2\underset{\underset{CH_3}{\vert}}{CH}\right)_3-CH_3$ | $-CH_3$ | H | H |
| (V)-74 | $-CH_3$ | $-CH_3$ | $-CH_3$ | H |
| (V)-75 | $-CH_3$ | H | H | H |
| (V)-76 | H | H | H | H |
| (V)-77 | $-CH_3$ | $-CH_3$ | H | $-CH_3$ |
| (V)-78 | $-\left(CH_2CH_2CH{=}\underset{\underset{CH_3}{\vert}}{C}\right)_4-CH_3$ | $-CH_3$ | H | H |
| (V)-79 | $-\left(CH_2CH_2CH_2\underset{\underset{CH_3}{\vert}}{CH}\right)_4-CH_3$ | $-CH_3$ | H | H |
| (V)-80 | $-\left(CH_2CH_2CH{=}\underset{\underset{CH_3}{\vert}}{C}\right)_3-CH_3$ | $-CH_3$ | H | H |
| (V)-81 | $-\left(CH_2CH_2CH{=}\underset{\underset{CH_3}{\vert}}{C}\right)_3-CH_3$ | $-CH_3$ | H | H |
| (V)-82 | $-\left(CH_2CH_2CH_2\underset{\underset{CH_3}{\vert}}{CH}\right)_3-CH_3$ | $-CH_3$ | H | H |
| (V)-83 | $-\left(CH_2CH_2CH_2\underset{\underset{CH_3}{\vert}}{CH}\right)_3-CH_3$ | $-CH_3$ | H | H |
| (V)-84 | $-\left(CH_2CH_2CH_2\underset{\underset{CH_3}{\vert}}{CH}\right)_3-CH_3$ | $-CH_3$ | H | H |
| (V)-85 | $-CH(OCH_3)_2$ | $-CH_3$ | H | H |
| (V)-86 | $-CH(OCH_3)_2$ | H | H | H |
| (V)-87 | $-CH_2CH_2CH_2N(CH_3)_2$ | $-CH_3$ | H | H |
| (V)-88 | $-CH_2CH_2CH_2N(CH_3)_2$ | 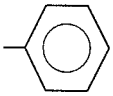 | H | H |

TABLE 40-continued

| | | | | |
|---|---|---|---|---|
| (V)-89 | $-CH_2CH_2OCH(CH_3)_2$ | $-CH_3$ | H | H |
| (V)-90 | $-CH_3$ | $-CH_3$ | H | H |
| (V)-91 | $-CH_3$ | $-CH_3$ | H | $-\underset{\underset{CH_3}{\vert}}{CH}-CH_3$ |
| (V)-92 | $-C_8H_{17}(n)$ | $-CH_3$ | H | $-\underset{\underset{CH_3}{\vert}}{CH}-CH_3$ |
| (V)-93 | $-C_8H_{17}(n)$ | $-CH_3$ | H | H |
| (V)-94 | $-CH_3$ | $-CH_3$ | H | $-CH_3$ |
| (V)-95 | $-CH_3$ | $-CH_3$ | H | H |
| (V)-96 | $-\left(CH_2CH_2CH=\underset{\underset{CH_3}{\vert}}{C}\right)_2-CH_3$ | $-CH_3$ | H | H |
| (V)-97 | $-\left(CH_2CH_2CH=\underset{\underset{CH_3}{\vert}}{C}\right)_2-CH_3$ | $-C_2H_5$ | H | H |
| (V)-98 | $-\left(CH_2CH_2CH_2\underset{\underset{CH_3}{\vert}}{CH}\right)_2-CH_3$ | $-C_2H_5$ | H | H |
| (V)-99 | $-CH=CH_2$ | $-CH_3$ | H | H |
| (V)-100 | $-C_2H_5$ | $-CH_3$ | H | H |
| (V)-101 | $-C_2H_5$ | H | H | H |
| (V)-102 | $-C_{16}H_{33}(n)$ | $-CH_3$ | H | H |
| (V)-103 | $-CH_3$ | $-CH_3$ | H | H |
| (V)-104 | | | | |
| (V)-105 | $-\left(CH_2CH_2CH_2\underset{\underset{CH_3}{\vert}}{CH}\right)_3-CH_3$ | $-CH_3$ | H | H |
| (V)-106 | $-CH_3$ | $-CH_3$ | H | H |
| (V)-107 | 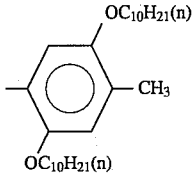 | $-CH_3$ | H | $-CH_3$ |
| (V)-108 | $-CH_3$ | $-CH_3$ | H | H |
| (V)-109 | 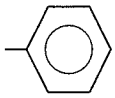 | H | $-CH_2CH=CH-$ 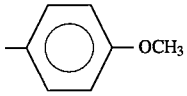 $-OCH_3$ | $-CH_3$ |
| (V)-110 | $-CH_3$ | $-CH_3$ | H | $-\underset{\underset{CH_3}{\vert}}{CH}-CH_3$ |
| (V)-111 | $-CH_3$ | $-CH_3$ | H | H |
| (V)-112 | $-\left(CH_2CH_2CH=\underset{\underset{CH_3}{\vert}}{C}\right)_3-CH_3$ | $-CH_3$ | H | H |
| (V)-113 | $-\left(CH_2CH_2CH_2\underset{\underset{CH_3}{\vert}}{CH}\right)_3-CH_3$ | $-CH_3$ | H | H |
| (V)-114 | $-CH_3$ | $-CH_3$ | H | H |
| (V)-115 | $-CH_3$ | $-CH_3$ | H | H |
| (V)-116 | $-CH_3$ | $-CH_3$ | H | H |
| (V)-117 | $-CH_3$ | $-CH_3$ | H | H |

TABLE 40-continued

| | | | | |
|---|---|---|---|---|
| (V)-118 | 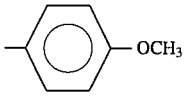 | H | H | H |
| (V)-119 | $-OCH_3$ | $-CH_3$ | H | H |
| (V)-120 | $-OCH_3$ | $-CH_3$ | H | H |
| (V)-121 | 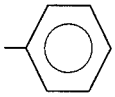 | H | H | H |
| (V)-122 | $-OCH_3$ | H | H | H |
| (V)-123 | $-CH_3$ | $-CH_3$ | H | H |
| (V)-124 | $-(CH_2CH_2CH_2\underset{\underset{CH_3}{\vert}}{CH})_3-CH_3$ | $-CH_3$ | H | H |
| (V)-125 | 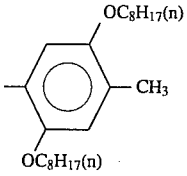 | $-CH_3$ | H | $-CH_3$ |
| (V)-126 | $-(CH_2)_3-\underset{\underset{CH_3}{\vert}}{CH}(CH_2)_4-CH_3$ | $-CH_3$ | H | H |
| (V)-127 | $-C_5H_{11}(n)$ | $-CH_3$ | H | H |
| (V)-128 | 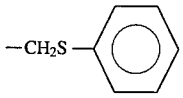 | $-CH_3$ | H | H |
| (V)-129 | $-C_{13}H_{27}(n)$ | $-CH_3$ | H | H |
| (V)-130 | $-(CH=CH-CH_2\underset{\underset{CH_3}{\vert}}{CH})_3-CH_3$ | $-CH_3$ | H | H |
| (V)-131 | $-CH_3$ | $-CH_3$ | H | H |
| (V)-132 | $-CH_3$ | $-CH_3$ | H | $-CH_3$ |
| (V)-133 | $-CH_3$ | $-CH_3$ | H | $-C_8H_{17}(n)$ |
| (V)-134 | $-CH_3$ | $-CH_3$ | H | $-CH_3$ |
| (V)-135 | 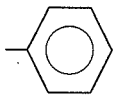 | H | H | H |
| (V)-136 | 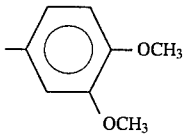 | H | 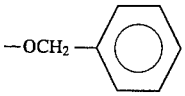 | H |
| (V)-137 | $-CH_3$ | $-CH_3$ | H | H |
| (V)-138 | $-OCH_3$ | $-CH_3$ | H | H |
| (V)-139 | $-\overset{\overset{CH_3}{\vert}}{\underset{\underset{CH_3}{\vert}}{C}}-CH_2-\overset{\overset{CH_3}{\vert}}{\underset{\underset{CH_3}{\vert}}{C}}-CH_3$ | $-CH_3$ | H | H |
| (V)-140 | $-CH_3$ | $-CH_3$ | H | H |
| (V)-141 | H | H | $-OC_2H_5$ | $-CH_3$ |
| (V)-142 | $-(CH_2CH_2CH=\underset{\underset{CH_3}{\vert}}{C})_2-CH_3$ | $-CH_3$ | H | H |

TABLE 40-continued

| | | | | |
|---|---|---|---|---|
| (V)-143 | $-CH_3$ | H | H | $-\left(CH_2CH_2CH_2\underset{\underset{CH_3}{\vert}}{CH}\right)_2-CH_3$ |
| (V)-144 | $-OC_2H_5$ | $-CH_3$ | H | H |
| (V)-145 | $-CH_3$ | $-CH_3$ | H | H |
| (V)-146 | $-OCH_3$ | $-C_2H_5$ | H | H |
| (V)-147 | H | H | 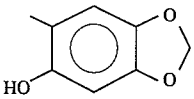 | $-OCH_3$ |
| (V)-148 | 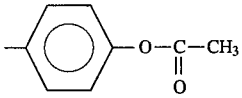 | H | 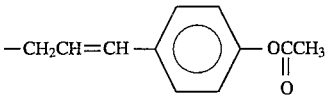 | H |
| (V)-149 | 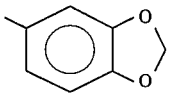 | H | $-C_3H_7(n)$ | H |
| (V)-150 | 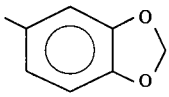 | H | $-OC_2H_5$ | H |
| (V)-151 | $-\left(CH_2CH_2CH_2\underset{\underset{CH_3}{\vert}}{CH}\right)_3-CH_3$ | $-CH_3$ | H | H |
| (V)-152 | $-CH_3$ | $-CH_3$ | H | H |
| (V)-153 | 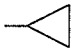 | $-CH_3$ | H | H |
| (V)-154 | $-\left(CH_2CH_2CH_2\underset{\underset{CH_3}{\vert}}{CH}\right)_3-CH_3$ | $-CH_3$ | H | H |
| (V)-155 | $-\left(CH_2CH_2CH_2\underset{\underset{CH_3}{\vert}}{CH}\right)_3-CH_3$ | $-CH_3$ | H | H |
| (V)-156 | $-CH_3$ | $-CH_3$ | H | H |
| (V)-157 | $-CH_2CH_2CH=\underset{\underset{CH_3}{\vert}}{C}-CH_3$ | $-CH_3$ | H | H |
| (V)-158 | $-\left(CH_2CH_2CH_2\underset{\underset{CH_3}{\vert}}{CH}\right)_3-CH_3$ | $-CH_3$ | H | H |
| (V)-159 | $-CH_3$ | $-CH_3$ | H | H |
| (V)-160 | $-CH_3$ | $-CH_3$ | H | H |
| (V)-161 | $-CH_3$ | $-CH_3$ | H | H |
| (V)-162 | $-CH_3$ | $-CH_3$ | H | H |
| (V)-163 | H | H | 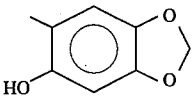 | H |
| (V)-164 | $-CH_3$ | $-CH_3$ | H | H |
| (V)-165 | $-C_3H_7(n)$ | $-CH_3$ | H | H |
| (V)-166 | 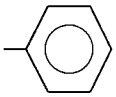 | $-CH_3$ | H | H |

TABLE 40-continued

| | | | | |
|---|---|---|---|---|
| (V)-167 | $-CH_3$ | $-CH_3$ | H | H |
| (V)-168 | $-C_3H_7(n)$ | $-CH_3$ | H | H |
| (V)-169 | $-OCH_3$ | H | H | $-CH_3$ |
| (V)-170 | $-CH_3$ | $-CH_3$ | H | H |
| (V)-171 | 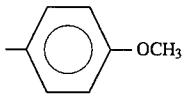 | H | $-CH(CH_3)-CH_3$ | H |
| (V)-172 | 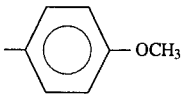 | H | $-C_3H_7(n)$ | H |
| (V)-173 | $-CH_3$ | $-OCH_3$ | H | H |
| (V)-174 | $-CH_3$ | H | H | H |
| (V)-175 | $-CH_2CH_2CH=C(CH_3)-CH_3$ | $-CH_3$ | H | H |
| (V)-176 | 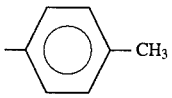 | $-CH_3$ | H | H |
| (V)-177 | 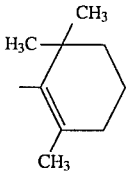 | $-CH_3$ | H | H |
| (V)-178 | $-CH_3$ | $-CH_3$ | H | H |
| (V)-179 | $-CH_3$ | $-CH_3$ | H | H |
| (V)-180 | $-(CH_2CH_2CH_2CH(CH_3))_3-CH_3$ | $-CH_3$ | H | H |
| (V)-181 | $-(CH_2CH_2CH_2CH(CH_3))_3-CH_3$ | $-CH_3$ | H | H |
| (V)-182 | $-CH_3$ | $-CH_3$ | H | H |
| (V)-183 | $-(CH_2CH_2CH_2CH(CH_3))_2-CH_3$ | $-CH_3$ | H | H |
| (V)-184 | $-(CH_2CH_2CH_2CH(CH_3))_3-CH_3$ | $-CH_3$ | H | H |
| (V)-185 | $-(CH_2CH_2CH_2CH(CH_3))_3-CH_3$ | $-CH_3$ | H | H |
| (V)-186 | $-C_8H_{17}(n)$ | $-CH_3$ | H | H |
| (V)-187 | $-CH_3$ | $-CH_3$ | H | H |
| (V)-188 | $-(CH_2CH_2CH=C(CH_3))_2-CH_3$ | $-CH_3$ | H | H |
| (V)-189 | $-(CH_2CH_2CH=C(CH_3))_2-CH_3$ | $-CH_3$ | H | H |
| (V)-190 | $-(CH_2CH_2CH=C(CH_3))_2-CH_3$ | $-CH_3$ | H | H |

TABLE 40-continued
| | | | | |
|---|---|---|---|---|
| (V)-191 | 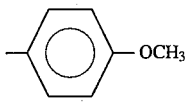 | $-OC_2H_5$ | $-OCH_3$ | H |
| (V)-192 | 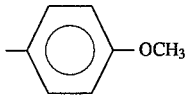 | $-OCH_3$ | $-OC_2H_5$ | H |
| (V)-193 | 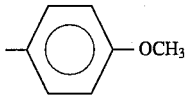 | H | $-OC_2H_5$ | H |
| (V)-194 | $-OC_2H_5$ | H | H | $-CH_3$ |
| (V)-195 | $-CH_3$ | $-CH_3$ | H | H |
| (V)-196 | $-C_2H_5$ | $-CH_3$ | H | H |
| (V)-197 | $-(CH_2CH_2CH_2CH(CH_3))_3-CH_3$ | $-CH_3$ | H | H |
| (V)-198 | $-(CH_2CH_2CH_2CH(CH_3))_3-CH_3$ | H | H | H |
| (V)-199 | $-CH(CH_3)-(CH_2)_4-CH_3$ | H | H | H |
| (V)-200 | $+CH_2)_8CH_3$ | H | $-CH_3$ | H |
| (V)-201 | $+CH_2)_{12}-CH_3$ | H | $-CH_3$ | H |
| (V)-202 | $+CH_2)_{14}-CH_3$ | H | $-CH_3$ | H |
| (V)-203 | $+CH_2)_{16}-CH_3$ | H | H | H |
| (V)-204 | 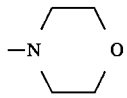 | H | $-CH_3$ | H |
| (V)-205 | $-CH(CH_3)-(CH_2)_3-CH(CH_3)-CH_3$ | $-CH_3$ | H | H |
| (V)-206 | $-CH_3$ | $-CH_3$ | 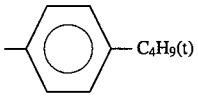 | H |
| (V)-207 | $-CH_3$ | $-CH_3$ | 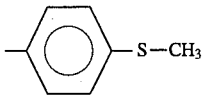 | H |
| (V)-208 | $-CH_3$ | $-CH_3$ | 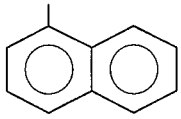 | H |
| (V)-209 | $-CH_3$ | $-CH_3$ | 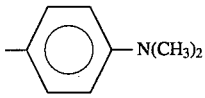 | H |

TABLE 40-continued
(V)-210
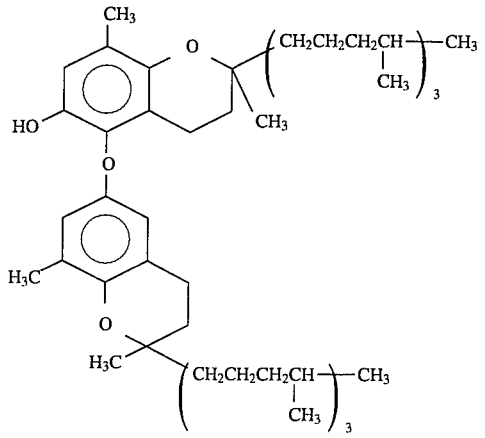
(V)-211
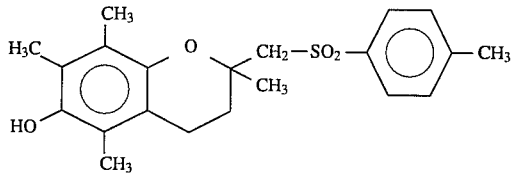
(V)-212
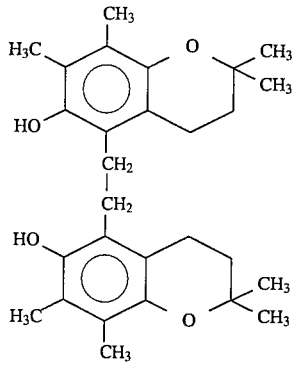
(V)-213
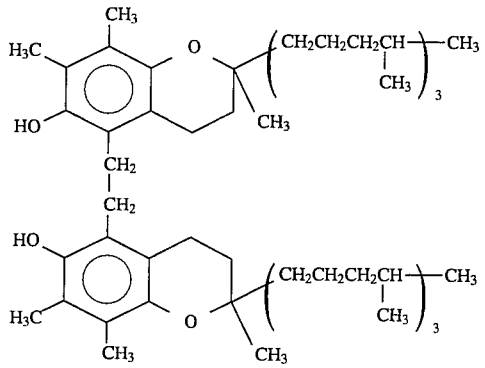

TABLE 40-continued
(V)-214
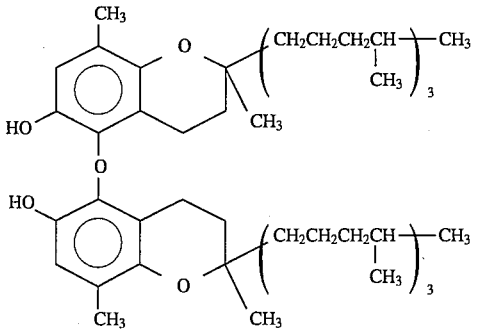
(V)-215
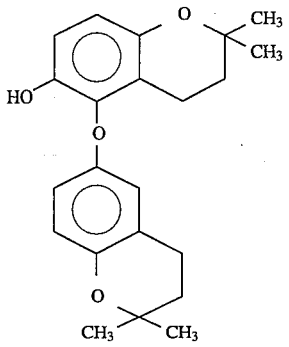
(V)-216
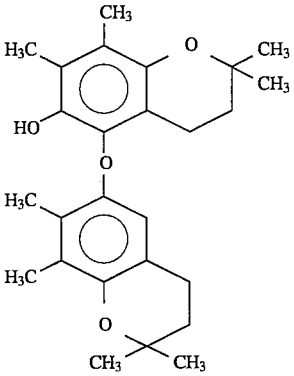
(V)-217
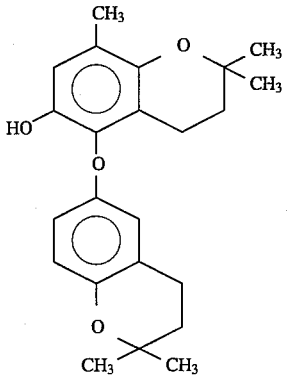

TABLE 40-continued
(V)-218
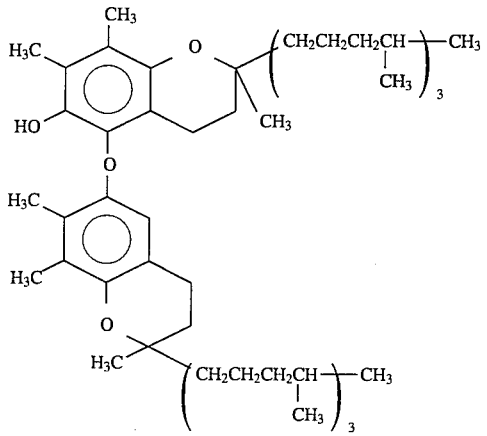
(V)-219
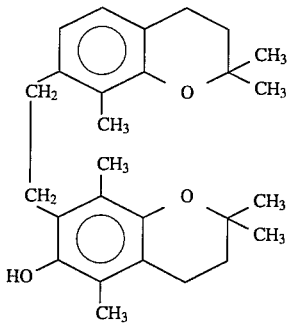
(V)-220
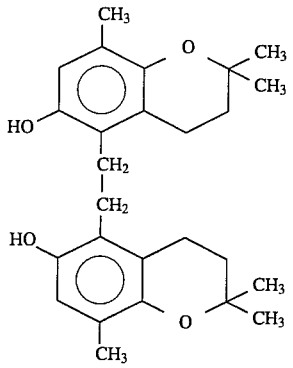
(V)-221
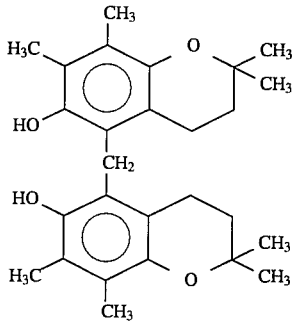
(V)-222
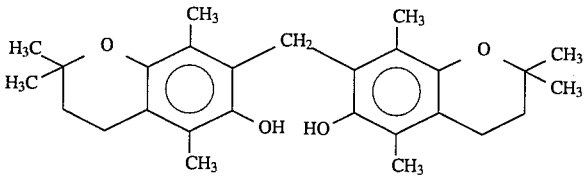

TABLE 40-continued
(V)-223
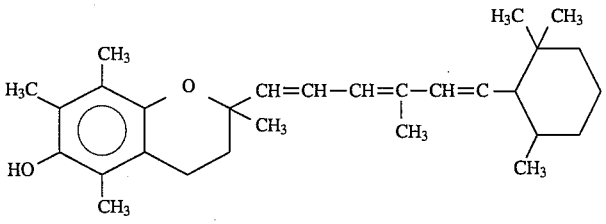
(V)-224
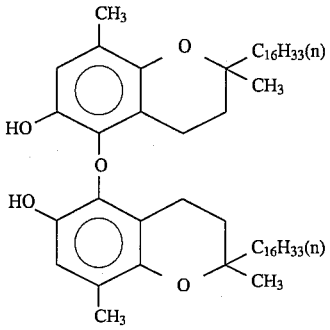
(V)-225
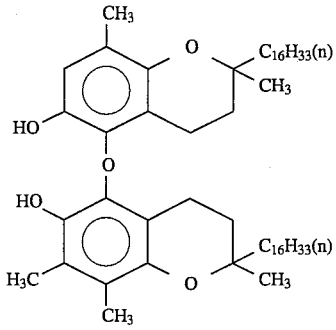
(V)-226
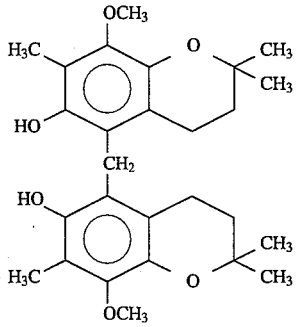
(V)-227
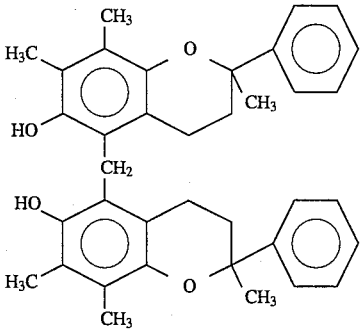

TABLE 40-continued
(V)-228
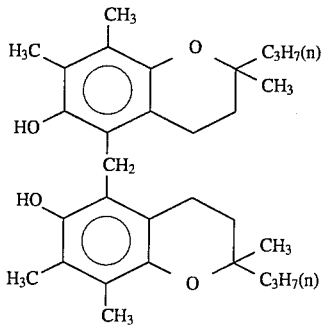
(V)-229
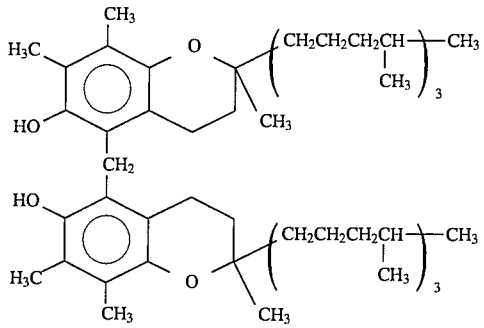
(V)-230
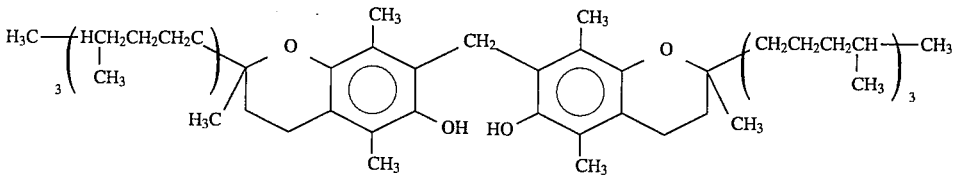
(V)-231
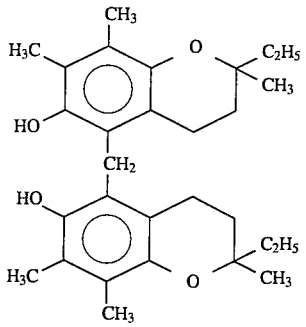
| Compound No. | $R^5$ | $R^6$ | $R^7$ | $R^8$ |
|---|---|---|---|---|
| (V)-1 | H | H | $-OCH_3$ | $-OCH_3$ |
| (V)-2 | H | $-CH_3$ | $-CH_3$ | $-CH_3$ |
| (V)-3 | H | H | $-CH_2CH_2NH_2$ | H |
| (V)-4 | H | H | $-CH_2CH_2NH_2$ | H |
| (V)-5 | H | $-CH_3$ | $-CH_3$ | $-CH_3$ |
| (V)-6 | H | $-CH_2CH_2NH_2$ | $-CH_3$ | $-CH_3$ |
| (V)-7 | H | $-CH_3$ | $-CH_2CH_2NH_2$ | $-CH_3$ |
| (V)-8 | H | $-CH_2CH_2NH_2$ | $-CH_2CH_2NH_2$ | $-CH_3$ |
| (V)-9 | H | $-CH_3$ | $-CH_3$ | $-CH_3$ |
| (V)-10 | H | 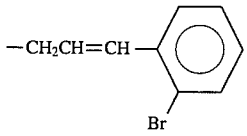 | H | H |

TABLE 40-continued
| | | | | |
|---|---|---|---|---|
| (V)-11 | H | H | 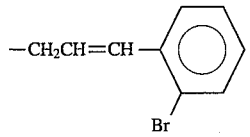 | H |
| (V)-12 | $-CH_3$ | H | $-C(CH_3)_2-CH_2-CH_2CH_2-S-C_4H_9(n)$ | H |
| (V)-13 | H | $-CH_3$ | $-CH_3$ | $-CH_3$ |
| (V)-14 | H | H | H | H |
| (V)-15 | H | 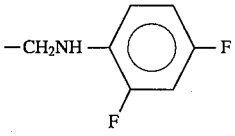 | H | H |
| (V)-16 | H | H | 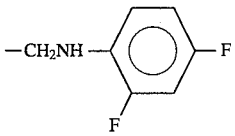 | H |
| (V)-17 | H | 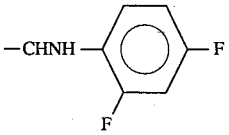 | H | H |
| (V)-18 | H | H | 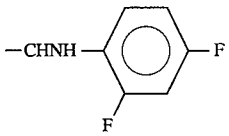 | H |
| (V)-19 | H | $-OCH_3$ | $-OCH_3$ | H |
| (V)-20 | H | H | H | H |
| (V)-21 | H | $-CH(CH_3)-CH_3$ | $-CH(CH_3)-CH_3$ | H |
| (V)-22 | H | H | H | H |
| (V)-23 | H | H | $-C_8H_{17}(n)$ | H |
| (V)-24 | H | H | $-C(CH_3)_2-CH_2-C(CH_3)_2-CH_3$ | H |
| (V)-25 | H | $-CH_3$ | H | H |
| (V)-26 | H | H | $-CH_3$ | H |
| (V)-27 | H | H | H | $-CH_3$ |
| (V)-28 | H | H | $-CH_3$ | H |
| (V)-29 | H | $-CH_3$ | H | H |
| (V)-30 | H | H | $-CH_3$ | H |
| (V)-31 | H | H | $-OCH_3$ | $-OCH_3$ |
| (V)-32 | H | $-CH_3$ | $-CH_3$ | $-CH_3$ |
| (V)-33 | H | 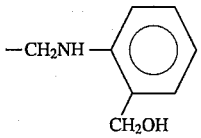 | H | H |

TABLE 40-continued
| | | | | |
|---|---|---|---|---|
| (V)-34 | H | H | 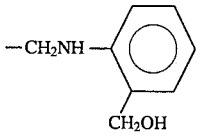 | H |
| (V)-35 | H | 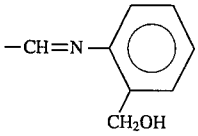 | H | H |
| (V)-36 | H | H | 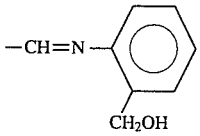 | H |
| (V)-37 | H | 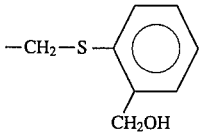 | H | H |
| (V)-38 | H | H | $-OCH_3$ | H |
| (V)-39 | H | H | $-OCH_3$ | H |
| (V)-40 | H | H | $-OCH_3$ | H |
| (V)-41 | H | $-CH_3$ | $-CH_3$ | $-CH_3$ |
| (V)-42 | H | H | H | H |
| (V)-43 | H | H | H | H |
| (V)-44 | H | H | H | H |
| (V)-45 | H | H | H | H |
| (V)-46 | H | H | H | H |
| (V)-47 | H | H | H | H |
| (V)-48 | H | H | H | H |
| (V)-49 | H | $-CH_3$ | $-CH_3$ | $-CH_3$ |
| (V)-50 | $-CH_3$ | $-CH_3$ | $-CH_3$ | $-CH_3$ |
| (V)-51 | H | H | H | H |
| (V)-52 | H | 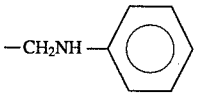 | H | H |
| (V)-53 | H | H | 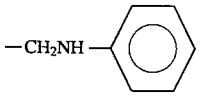 | H |
| (V)-54 | H | 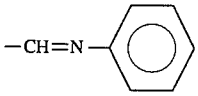 | H | H |
| (V)-55 | H | H | 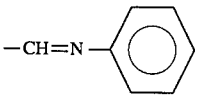 | H |
| (V)-56 | H | H | H | 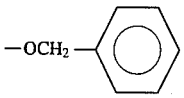 |
| (V)-57 | H | 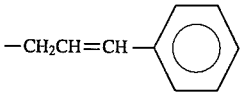 | H | H |
| (V)-58 | H | H | 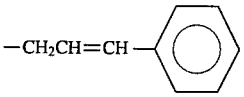 | H |

TABLE 40-continued

| | | | | |
|---|---|---|---|---|
| (V)-59 | H | H | H | H |
| (V)-60 | H | H | $-CH_3$ | H |
| (V)-61 | H | $-CH_3$ | $-CH_3$ | H |
| (V)-62 | H | $-CH_3$ | H | $-CH_3$ |
| (V)-63 | H | H | $-CH_3$ | $-CH_3$ |
| (V)-64 | H | $-CH_3$ | $-CH_3$ | $-CH_3$ |
| (V)-65 | H | $-CH_3$ | $-CH_3$ | $-CH_3$ |
| (V)-66 | H | $-CH_3$ | $-CH_3$ | $-CH_3$ |
| (V)-67 | H | $-CH_3$ | $-CH_3$ | $-CH_3$ |
| (V)-68 | H | $-CH_3$ | $-CH_3$ | $-CH_3$ |
| (V)-69 | H | $-CH_3$ | $-CH_3$ | $-CH_3$ |
| (V)-70 | H | $-CH_3$ | $-CH_3$ | $-CH_3$ |
| (V)-71 | H | $-CH_3$ | $-CH_3$ | $-CH_3$ |
| (V)-72 | H | $-CH_3$ | $-CH_3$ | $-CH_3$ |
| (V)-73 | H | $-CH_3$ | $-CH_3$ | $-CH_3$ |
| (V)-74 | H | H | H | H |
| (V)-75 | H | $-CH_3$ | $-CH_3$ | H |
| (V)-76 | H | $-CH_3$ | $-CH_3$ | $-CH_3$ |
| (V)-77 | H | H | $-C(CH_3)_2-CH_2-C(CH_3)_2-CH_2$ | H |
| (V)-78 | H | H | $-CH_3$ | $-CH_3$ |
| (V)-79 | H | H | $-CH_3$ | $-CH_3$ |
| (V)-80 | H | H | $-CH_3$ | $-CH_3$ |
| (V)-81 | H | $-CH_3$ | H | $-CH_3$ |
| (V)-82 | H | $-CH_3$ | H | $-CH_3$ |
| (V)-83 | H | $-CH_3$ | $-CH_3$ | H |
| (V)-84 | H | H | $-CH_3$ | $-CH_3$ |
| (V)-85 | H | $-CH_3$ | $-CH_3$ | $-CH_3$ |
| (V)-86 | H | $-CH_3$ | $-CH_3$ | $-CH_3$ |
| (V)-87 | H | H | H | H |
| (V)-88 | H | H | H | H |
| (V)-89 | H | $-CH_3$ | $-CH_3$ | $-CH_3$ |
| (V)-90 | H | H | $-C_4H_9(t)$ | H |
| (V)-91 | H | H | $-C_4H_9(t)$ | H |
| (V)-92 | H | H | $-C_4H_9(t)$ | H |
| (V)-93 | H | H | $-C_4H_9(t)$ | H |
| (V)-94 | H | H | $-C_4H_9(t)$ | H |
| (V)-95 | H | $-CH_3$ | $-C_4H_9(t)$ | H |
| (V)-96 | H | H | H | H |
| (V)-97 | H | $-CH_3$ | $-CH_3$ | $-CH_3$ |
| (V)-98 | H | $-CH_3$ | $-CH_3$ | $-CH_3$ |
| (V)-99 | H | $-CH_3$ | $-CH_3$ | $-CH_3$ |
| (V)-100 | H | $-CH_3$ | $-CH_3$ | $-CH_3$ |
| (V)-101 | H | $-CH_3$ | $-CH_3$ | $-CH_3$ |
| (V)-102 | H | $-CH_3$ | $-CH_3$ | $-CH_3$ |
| (V)-103 | 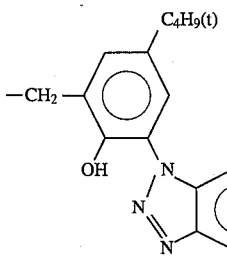 | H | $-CH_3$ | $-CH_3$ |
| (V)-104 | | | | |
| (V)-105 | H | $-C_4H_9(t)$ | $-C_4H_9(t)$ | H |
| (V)-106 | H | 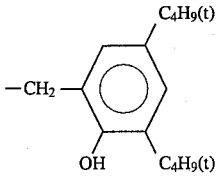 | $-CH_3$ | $-CH_3$ |
| (V)-107 | $-CH_3$ | H | H | H |
| (V)-108 | H | $-CH_3$ | $-CH_2Cl$ | $-CH_3$ |
| (V)-109 | H | H | $-OCH_3$ | H |
| (V)-110 | H | H | $-S-C_{18}H_{37}(n)$ | H |

TABLE 40-continued

| | | | | |
|---|---|---|---|---|
| (V)-111 | H | H | $-\underset{\underset{CH_3}{\vert}}{\overset{\overset{CH_3}{\vert}}{C}}-CH_2-\underset{\underset{CH_3}{\vert}}{\overset{\overset{CH_3}{\vert}}{C}}-CH_3$ | H |
| (V)-112 | H | H | H | $-CH_3$ |
| (V)-113 | H | H | H | $-CH_3$ |
| (V)-114 | H | 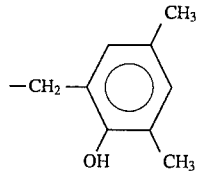 | $-CH_3$ | $-CH_3$ |
| (V)-115 | H | 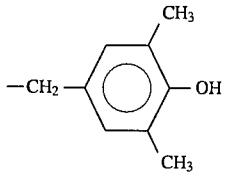 | $-CH_3$ | $-CH_3$ |
| (V)-116 | H | 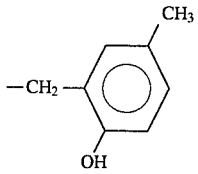 | $-CH_3$ | $-CH_3$ |
| (V)-117 | H | 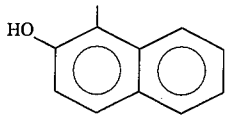 | $-CH_3$ | $-CH_3$ |
| (V)-118 | H | H | $-OCH_3$ | H |
| (V)-119 | H | H | H | H |
| (V)-120 | H | $-\underset{\underset{CH_3}{\vert}}{CH}-CH_3$ | $-\underset{\underset{CH_3}{\vert}}{CH}-CH_3$ | H |
| (V)-121 | H | H | $-OCH_3$ | H |
| (V)-122 | H | $-CH_3$ | $-CH_3$ | $-CH_3$ |
| (V)-123 | $-OCH_3$ | H | H | $-CH_3$ |
| (V)-124 | H | H | $-S-C_8H_{17}(n)$ | H |
| (V)-125 | $-CH_3$ | H | $-CH_3$ | H |
| (V)-126 | H | $-CH_3$ | $-CH_3$ | $-CH_3$ |
| (V)-127 | H | $-CH_3$ | $-CH_3$ | $-CH_3$ |
| (V)-128 | H | $-CH_3$ | $-CH_3$ | $-CH_3$ |
| (V)-129 | H | $-CH_3$ | $-CH_3$ | $-CH_3$ |
| (V)-130 | H | $-CH_3$ | $-CH_3$ | $-CH_3$ |
| (V)-131 | H | H | H | $-CH_3$ |
| (V)-132 | H | H | $-\underset{\underset{CH_3}{\vert}}{CH}-CH_3$ | H |
| (V)-133 | H | $-CH_3$ | H | H |
| (V)-134 | H | H | $-C_8H_{17}(n)$ | H |
| (V)-135 | H | $-CH_3$ | $-CH_3$ | $-CH_3$ |
| (V)-136 | H | $-OCH_3$ | $-OCH_3$ | H |
| (V)-137 | H | $-C_4H_9(t)$ | H | H |
| (V)-138 | H | H | $-C_4H_9(t)$ | H |
| (V)-139 | H | H | $-C_4H_9(t)$ | H |
| (V)-140 | H | $-C_4H_9(t)$ | $-CH_3$ | H |
| (V)-141 | $-CH_3$ | H | $-C_4H_9(t)$ | H |
| (V)-142 | H | $-CH_3$ | $-CH_3$ | $-CH_3$ |
| (V)-143 | H | $-CH_3$ | $-CH_3$ | $-CH_3$ |
| (V)-144 | H | $-CH_3$ | $-CH_3$ | $-CH_3$ |
| (V)-145 | H | $-CH_2OC_2H_5$ | $-CH_3$ | $-CH_3$ |
| (V)-146 | H | $-CH_3$ | $-CH_3$ | $-CH_3$ |

TABLE 40-continued
| | | | | |
|---|---|---|---|---|
| (V)-147 | H | H | $-OCH_3$ | H |
| (V)-148 | H | H | $-OCH_3$ | H |
| (V)-149 | H | H | H | H |
| (V)-150 | H | H | H | H |
| (V)-151 | H | $-CH_2N(CH_3)_2$ | $-CH_2N(CH_3)_2$ | $-CH_3$ |
| (V)-152 | H | $-CH_2Cl$ | $-CH_3$ | $-CH_3$ |
| (V)-153 | H | $-CH_3$ | $-CH_3$ | $-CH_3$ |
| (V)-154 | H | $-C_2H_5$ | $-C_2H_5$ | $-CH_3$ |
| (V)-155 | H | $-CH_3$ | $-OCH_3$ | $-OCH_3$ |
| (V)-156 | H | $-CH_3$ | $-OCH_3$ | $-OCH_3$ |
| (V)-157 | H | $-CH_3$ | H | $-C(CH_3)_2-CH_3$ |
| (V)-158 | H | $-CH_3$ | H | $-C(CH_3)_2-CH_3$ |
| (V)-159 | H | H | 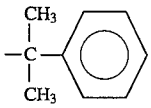 | H |
| (V)-160 | H | H | $-C_4H_9(n)$ | H |
| (V)-161 | H | H | H | $-C_4H_9(n)$ |
| (V)-162 | H | H | 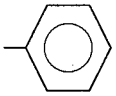 | H |
| (V)-163 | H | $-OCH_3$ | $-OCH_3$ | H |
| (V)-164 | H | 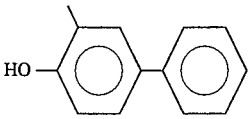 | $-CH_3$ | $-CH_3$ |
| (V)-165 | H | 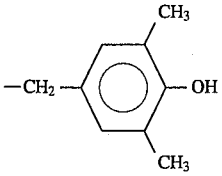 | $-CH_3$ | $-CH_3$ |
| (V)-166 | H | 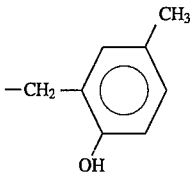 | $-CH_3$ | $-CH_3$ |
| (V)-167 | H | 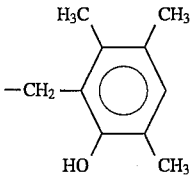 | $-CH_3$ | $-CH_3$ |
| (V)-168 | H | 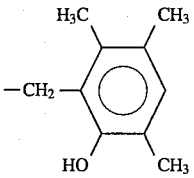 | $-CH_3$ | $-CH_3$ |
| (V)-169 | $-CH_3$ | $-CH_2OCH_3$ | $-CH_3$ | $-CH_3$ |
| (V)-170 | H | $-CH_2OCH_3$ | $-CH_3$ | $-CH_3$ |
| (V)-171 | H | H | H | H |

TABLE 40-continued

| | | | | |
|---|---|---|---|---|
| (V)-172 | H | H | H | H |
| (V)-173 | H | H | $-CH_3$ | $-CH_3$ |
| (V)-174 | H | H | H | H |
| (V)-175 | H | $-CH_3$ | $-CH_3$ | $-CH_3$ |
| (V)-176 | H | $-CH_3$ | $-CH_3$ | $-CH_3$ |
| (V)-177 | H | $-CH_3$ | $-CH_3$ | $-CH_3$ |
| (V)-178 | H | $-CH_3$ | H | H |
| (V)-179 | H | H | $-CH_3$ | H |
| (V)-180 | H | $-CH_3$ | 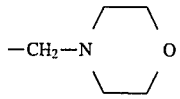 | $-CH_3$ |
| (V)-181 | H | 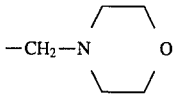 | $-CH_3$ | $-CH_3$ |
| (V)-182 | H | 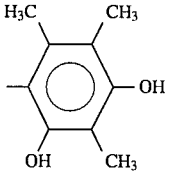 | $-CH_3$ | $-CH_3$ |
| (V)-183 | H | $-CH_2N(CH_3)_2$ | H | $-CH_3$ |
| (V)-184 | H | $-CH_2N(CH_3)_2$ | $-CH_3$ | $-CH_3$ |
| (V)-185 | H | $-CH_3$ | $-CH_2N(CH_3)_2$ | $-CH_3$ |
| (V)-186 | H | H | $-C_4H_9(t)$ | H |
| (V)-187 | H | $-CH_3$ | H | $-C_4H_9(t)$ |
| (V)-188 | H | $-CH_3$ | $-OCH_3$ | $-OCH_3$ |
| (V)-189 | H | $-CH_3$ | H | $-C(CH_3)_2$ |
| (V)-190 | H | $-CH_3$ | $-OCH_3$ | $-CH_3$ |
| (V)-191 | H | H | H | H |
| (V)-192 | H | H | H | H |
| (V)-193 | H | H | H | H |
| (V)-194 | $-CH_3$ | $-CH_2OC_2H_5$ | $-CH_3$ | $-CH_3$ |
| (V)-195 | H | $-C_2H_5$ | H | H |
| (V)-196 | H | 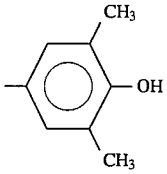 | $-CH_3$ | $-CH_3$ |
| (V)-197 | H | $-CH_3$ | $-CH_3$ | $-C_2H_5$ |
| (V)-198 | H | $-CH_3$ | $-CH_3$ | $-CH_3$ |
| (V)-199 | H | $-CH_3$ | $-CH_3$ | $-CH_3$ |
| (V)-200 | H | H | H | H |
| (V)-201 | H | H | H | H |
| (V)-202 | H | H | H | H |
| (V)-203 | H | $-CH_3$ | $-CH_3$ | $-CH_3$ |
| (V)-204 | H | H | H | H |
| (V)-205 | H | $-CH_3$ | $-CH_3$ | $-CH_3$ |
| (V)-206 | H | $-CH_3$ | $-CH_3$ | $-CH_3$ |
| (V)-207 | H | $-CH_3$ | $-CH_3$ | $-CH_3$ |
| (V)-208 | H | H | H | H |
| (V)-209 | H | $-CH_3$ | $-CH_3$ | $-CH_3$ |

TABLE 41

| Compound No. | $R^1$ | $R^2$ | $R^3$ | $R^4$ | $R^5$ | $R^6$ | $R^7$ |
|---|---|---|---|---|---|---|---|
| (VI)-1 | $-OCH_3$ | $-CH_3$ | 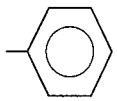 | H | $-OCH_3$ | $-CH_3$ | H |
| (VI)-2 | $-CH(OCH_3)_2$ | $-CH_3$ | 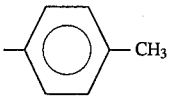 | H | $-CH_3$ | $-CH_3$ | $-CH_3$ |
| (VI)-3 | $-CH(OCH_3)_2$ | H | H | H | $-CH_3$ | $-CH_3$ | $-CH_3$ |
| (VI)-4 | $-CH_3$ | $-CH_3$ | H | H | H | H | H |
| (VI)-5 | $-\left(CH_2CH_2CH=\underset{\underset{CH_3}{\vert}}{C}\right)_2-CH_3$ | $-CH_3$ | H | H | H | H | H |
| (VI)-6 | $-\left(CH_2CH_2CH=\underset{\underset{CH_3}{\vert}}{C}\right)_3-CH_3$ | $-CH_3$ | H | H | H | $-CH_3$ | H |
| (VI)-7 | $-CH_3$ | $-CH_3$ | H | H | H | $-OCH_3$ | H |
| (VI)-8 | $-CH_3$ | $-CH_3$ | H | H | $-CH_2OCH_3$ | $-CH_3$ | $-CH_3$ |
| (VI)-9 | $-CH_2CH_2CH=\underset{\underset{CH_3}{\vert}}{C}-CH_3$ | $-CH_3$ | H | H | H | H | H |
| (VI)-10 | $-CH_3$ | $-CH_3$ | H | H | $-CH_3$ | $-CH_3$ | $-CH_3$ |
| (VI)-11 | H | H | 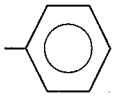 | H | H | H | H |
| (VI)-12 | $-\left(CH_2CH_2CH_2\underset{\underset{CH_3}{\vert}}{CH}\right)_3-CH_3$ | $-CH_3$ | H | H | $-CH_3$ | $-CH_3$ | $-CH_3$ |
| (VI)-13 | H | H | H | H | $-CH_3$ | $-CH_3$ | $-CH_3$ |
| (VI)-14 | H | H | H | 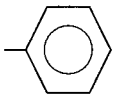 | H | $-OCH_3$ | $-OCH_3$ |
| (VI)-15 | 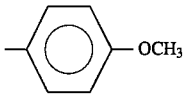 | H | H | H | H | $-OCH_3$ | H |
| (VI)-16 | $-CH_3$ | $-CH_3$ | H | H | $-OCH_3$ | H | $-CH_3$ |
| (VI)-17 | 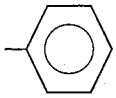 | H | H | H | H | $-OCH_3$ | H |
| (VI)-18 | H | H | H | 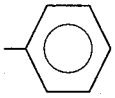 | H | $-OCH_3$ | H |
| (VI)-19 | $-CH_2CH_2CH=\underset{\underset{CH_3}{\vert}}{C}-CH_3$ | $-CH_3$ | H | H | $-CH_3$ | $-CH_3$ | $-CH_3$ |
| (VI)-20 | $-\left(CH_2CH_2CH=\underset{\underset{CH_3}{\vert}}{C}\right)_3-CH_3$ | $-CH_3$ | H | H | $-CH_3$ | $-CH_3$ | $-CH_3$ |
| (VI)-21 | $-CH_3$ | $-CH_3$ | H | H | H | H | $-CH_3$ |

TABLE 41-continued

| Compound No. | $R^1$ | $R^2$ | $R^3$ | $R^4$ | $R^5$ | $R^6$ | $R^7$ |
|---|---|---|---|---|---|---|---|
| (VI)-22 | $-(CH_2CH_2CH=C(CH_3))_3-CH_3$ | $-CH_3$ | H | H | $-CH_3$ | H | $-CH_3$ |
| (VI)-23 | $-(CH_2CH_2CH=C(CH_3))_3-CH_3$ | $-CH_3$ | H | H | $-CH_3$ | $-OCH_3$ | $-OCH_3$ |
| (VI)-24 | $-(CH_2CH_2CH_2CH(CH_3))_3-CH_3$ | $-CH_3$ | H | H | $-CH_3$ | $-OCH_3$ | $-OCH_3$ |
| (VI)-25 | H | H | H | 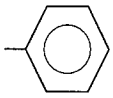 | H | $-OCH_3$ | $-OCH_3$ |
| (VI)-26 | $-(CH_2CH_2CH_2CH(CH_3))_3-CH_3$ | $-CH_3$ | H | H | $-CH_3$ | H | $-CH(CH_3)-CH_3$ |
| (VI)-27 | 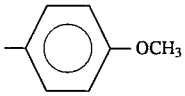 | $-OC_2H_5$ | $-OCH_3$ | H | H | H | H |
| (VI)-28 | 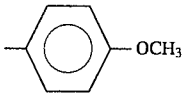 | $-OCH_3$ | $-OC_2H_5$ | H | H | H | H |
| (VI)-29 | $-(CH_2CH_2CH=C(CH_3))_3-CH_3$ | $-CH_3$ | H | H | H | H | $-CH_3$ |
| (VI)-30 | 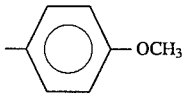 | H | $-CH(CH_3)-CH_3$ | H | H | H | H |
| (VI)-31 | $-CH_3$ | H | H | H | $-CH_3$ | $-CH_3$ | $-CH_3$ |
| (VI)-32 | $-CH_2CH_2CH=C(CH_3)-CH_3$ | $-CH_3$ | H | H | $-CH_3$ | H | $-CH_3$ |
| (VI)-33 | $-CH_2CH_2CH=C(CH_3)-CH_3$ | $-CH_3$ | H | H | H | $-CH_3$ | $-CH_3$ |
| (VI)-34 | $-CH_3$ | $-CH_3$ | H | H | H | $-C_4H_9(t)$ | H |
| (VI)-35 | 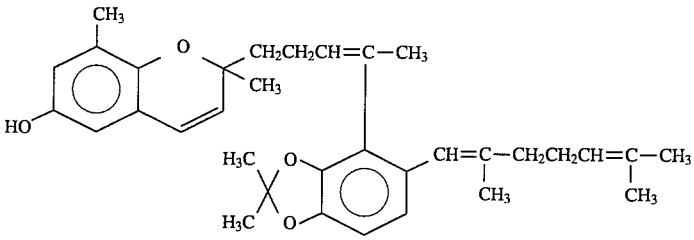 | | | | | | |

TABLE 41-continued
| Compound No. | $R^1$ | $R^2$ | $R^3$ | $R^4$ | $R^5$ | $R^6$ | $R^7$ |
|---|---|---|---|---|---|---|---|
| (VI)-36 | | 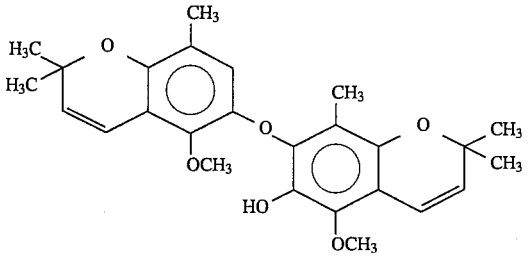 | | | | | |
| (VI)-37 | | 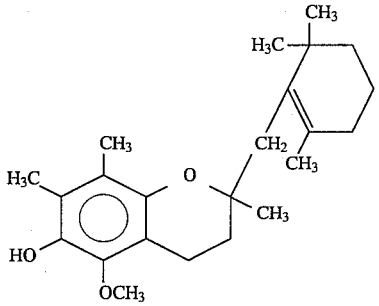 | | | | | |

TABLE 42
| Compound No. | $R^1$ | $R^2$ | $R^3$ | $R^4$ | $R^5$ | $R^6$ | $R^7$ |
|---|---|---|---|---|---|---|---|
| (VII)-1 | =NH | | 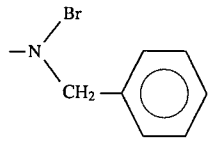 | $-CH_3$ | H | H | H |
| (VII)-2 | H | H | H | H | H | 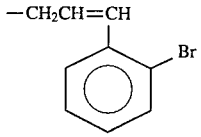 | H |
| (VII)-3 | H | H | H | H | H | 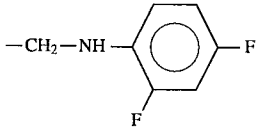 | H |
| (VII)-4 | H | H | H | H | H | H | H |
| (VII)-5 | $-CH_3$ | $-CH_3$ | H | H | H | H | H |
| (VII)-6 | 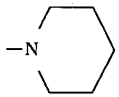 | H | $-CH_3$ | $-CH_3$ | H | H | H |
| (VII)-7 | 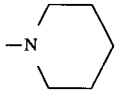 | H | $-CH_3$ | $-CH_3$ | H | 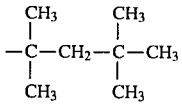 | H |
| (VII)-8 | H | H | H | H | H | 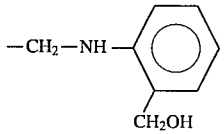 | H |

TABLE 42-continued
| Compound No. | $R^1$ | $R^2$ | $R^3$ | $R^4$ | $R^5$ | $R^6$ | $R^7$ |
|---|---|---|---|---|---|---|---|
| (VII)-9 | H | H | H | H | H | 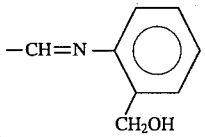 | H |
| (VII)-10 | H | H | H | H | H | 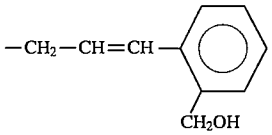 | H |
| (VII)-11 | 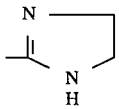 | H | H | H | H | H | H |
| (VII)-12 | =NH | | 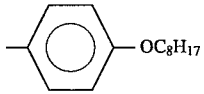 | H | $-CH_3$ | $-CH_3$ | $-CH_3$ |
| (VII)-13 | $-CH_3$ | $-CH_3$ | H | H | $-CH_3$ | $-CH_3$ | $-CH_3$ |
| (VII)-14 | H | H | 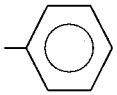 | H | H | H | H |
| (VII)-15 | H | H | H | H | H | 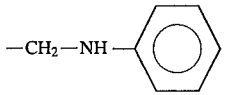 | H |
| (VII)-16 | H | H | H | H | H | 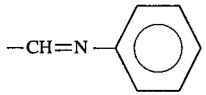 | H |
| (VII)-17 | H | H | H | H | H | 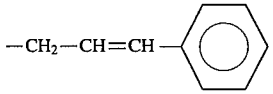 | H |
| (VII)-18 | $-CH_3$ | $-CH_3$ | H | H | H | $-CH_3$ | $-CH_3$ |

TABLE 42-continued

| Compound No. | $R^1$ | $R^2$ | $R^3$ | $R^4$ | $R^5$ | $R^6$ | $R^7$ |
|---|---|---|---|---|---|---|---|
| (VII)-19 | $-CH_3$ | H | H | H | $-CH_3$ | $-CH_3$ | $-CH_3$ |
| (VII)-20 | $-(CH_2CH_2CH_2C(CH_3))_3-CH_3$ | $-CH_3$ | H | H | $-CH_3$ | $-CH_3$ | $-CH_3$ |
| (VII)-21 | H | H | H | H | $-CH_3$ | $-CH_3$ | $-CH_3$ |
| (VII)-22 | $=NH$ | | $-CH_3$ | 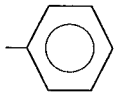 | H | $-C_3H_7(n)$ | H |
| (VII)-23 | $-OC_2H_5$ | $-OC_2H_5$ | $-Br$ | H | H | $-CH_3$ | $-CH_3$ |
| (VII)-24 | 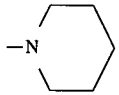 | H | $-C_4H_9(n)$ | $-C_2H_5$ | H | $-C_4H_9(n)$ | H |
| (VII)-25 | 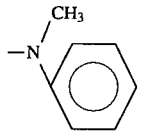 | H | $-C_4H_9(n)$ | $-C_2H_5$ | H | $-C(CH_3)_2-CH_2-C(CH_3)_2-CH_3$ | H |
| (VII)-26 | 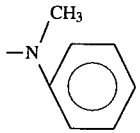 | H | $-C_4H_9(n)$ | $-C_4H_9(n)$ | H | $-C_4H_9(n)$ | H |
| (VII)-27 | $-OC_2H_5$ | $-OC_2H_5$ | H | H | H | H | H |
| (VII)-28 | $-OC_2H_5$ | $-OC_2H_5$ | H | H | H | $-CH_3$ | $-CH_3$ |
| (VII)-29 | $-CH_3$ | H | H | H | $-CH_3$ | H | H |
| (VII)-30 | $-CH_3$ | H | H | H | H | $-CH_3$ | H |
| (VII)-31 | H | H | $-CH_3$ | $-CH_3$ | H | H | H |
| (VII)-32 | 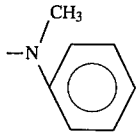 | H | $-CH_3$ | $-CH_3$ | H | $-C(CH_3)_2-CH_2-C(CH_3)_2-CH_3$ | H |

TABLE 42-continued
| Compound No. | $R^1$ | $R^2$ | $R^3$ | $R^4$ | $R^5$ | $R^6$ | $R^7$ |
|---|---|---|---|---|---|---|---|
| (VII)-33 | 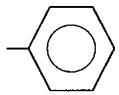 | H | $-CH_3$ | H | H | $-OCH_3$ | H |
| (VII)-34 | H | H | H | H | H | $-CH_3$ | H |
| (VII)-35 | 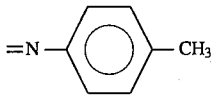 | | 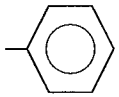 | 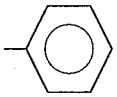 | H | H | H |
| (VII)-36 | $-CH_3$ | $-CH_3$ | H | H | H | H | $-C_4H_9$ |
| (VII)-37 | 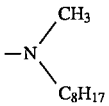 | H | $-CH_3$ | $-CH_3$ | H | $-C_4H_9(t)$ | H |
| (VII)-38 | 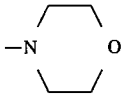 | H | $-CH_3$ | $-CH_3$ | H | $-C_4H_9(t)$ | H |
| (VII)-39 | $-OC_8H_{17}$ | H | $-CH_3$ | $-CH_3$ | H | $-C_4H_9(t)$ | H |
| (VII)-40 | 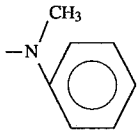 | H | $-CH_3$ | $-CH_3$ | $-OC_2H_5$ | H | $-C_4H_9(t)$ |
| (VII)-41 | $-OC_2H_5$ | H | $-CH_3$ | $-CH_3$ | H | H | H |
| (VII)-42 | 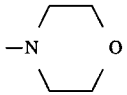 | 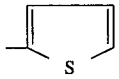 | $-C_2H_5$ | H | H | H | H |
| (VII)-43 | 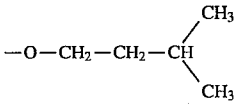 | H | $-CH_3$ | $-CH_3$ | H | H | H |

TABLE 42-continued

| Compound No. | $R^1$ | $R^2$ | $R^3$ | $R^4$ | $R^5$ | $R^6$ | $R^7$ |
|---|---|---|---|---|---|---|---|
| (VII)-44 | $-O-\overset{H}{\underset{CH_3}{C}}-CH_3$ | H | $-CH_3$ | $-CH_3$ | H | H | H |
| (VII)-45 | $-O-\underset{CH}{CH}-CH_2-CH_2-CH_3$ ($CH_3$, $CH_3$) | H | $-CH_3$ | $-CH_3$ | H | H | H |
| (VII)-46 | 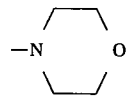 | H | $-CH_3$ | $-CH_3$ | H | $-CH(CH_3)C_8H_{17}$ | H |
| (VII)-47 | $-O-CH(CH_3)-CH(CH_3)-CH_3$ ($CH_3$, $CH_3$) | H | $-CH_3$ | $-CH_3$ | H | H | H |
| (VII)-48 | 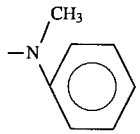 | H | $-CH_3$ | $-CH_3$ | H | H | H |
| (VII)-49 | 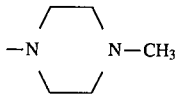 | H | $-CH_3$ | $-CH_3$ | H | H | H |
| (VII)-50 | $-O-CH_2-CH(CH_3)-CH_3$ | H | $-CH_3$ | $-CH_3$ | H | H | H |
| (VII)-51 | 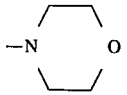 | H | $-CH_3$ | $-CH_3$ | H | H | H |
| (VII)-52 | $-O-CH=CH-CH_3$ | H | $-CH_3$ | $-CH_3$ | H | H | H |
| (VII)-53 | $-O-CH_2CH_2CH_3$ | H | $-CH_3$ | $-CH_3$ | H | H | H |

TABLE 42-continued
| Compound No. | $R^1$ | $R^2$ | $R^3$ | $R^4$ | $R^5$ | $R^6$ | $R^7$ |
|---|---|---|---|---|---|---|---|
| (VII)-54 | 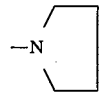 | H | $-CH_3$ | $-CH_3$ | H | H | H |
| (VII)-55 | 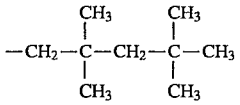 | H | $-CH_3$ | $-CH_3$ | H | H | H |
| (VII)-56 | 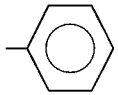 | 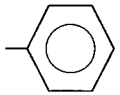 | H | H | H | H | H |
| (VII)-57 | 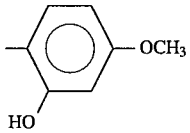 | H | $-CH_3$ | H | H | $-OCH_3$ | H |
| (VII)-58 | $-OCH_3$ | H | $-CH_3$ | $-CH_3$ | H | H | H |
| (VII)-59 | 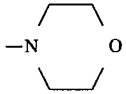 | H | $-CH_3$ | $-CH_3$ | H | $-OCH_3$ | H |
| (VII)-60 | $-O-CH(OCH_3)-CH_3$ | H | $-CH_3$ | $-CH_3$ | H | H | H |
| (VII)-61 | $-CH_3$ | H | 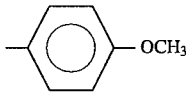 | H | H | $-OCH_3$ | H |
| (VII)-62 | 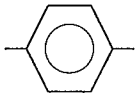 | H | H | H | H | H | H |
| (VII)-63 | 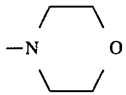 | H | $-CH_3$ | $-CH_3$ | H | $-CH_3$ | $-CH_3$ |

TABLE 42-continued
| Compound No. | $R^1$ | $R^2$ | $R^3$ | $R^4$ | $R^5$ | $R^6$ | $R^7$ |
|---|---|---|---|---|---|---|---|
| (VII)-64 | 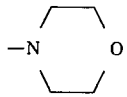 | H | $-CH_3$ | $-CH_3$ | H | $-CH_3$ | H |
| (VII)-65 | 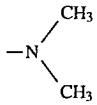 | H | $-CH_3$ | $-CH_3$ | H | H | H |
| (VII)-66 | $-CH_3$ | $-CH_3$ | 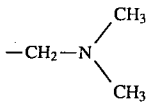 | H | H | H | H |
| (VII)-67 | 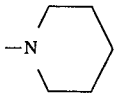 | H | $-CH_3$ | $-CH_3$ | H | $-C_4H_9(t)$ | H |
| (VII)-68 | 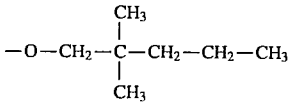 | H | $-CH_3$ | $-CH_3$ | H | H | H |
| (VII)-69 | 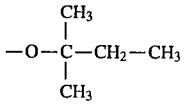 | H | $-CH_3$ | $-CH_3$ | H | H | H |
| (VII)-70 | $-OC_2H_5$ | $-CH_3$ | $-CH_3$ | H | H | H | H |
| (VII)-71 | $-OC_2H_5$ | H | $-CH_3$ | $-CH_3$ | H | $-CH_3$ | $-CH_3$ |
| (VII)-72 | 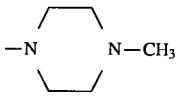 | H | $-CH_3$ | H | H | H | H |
| (VII)-73 | 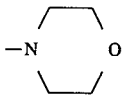 | H | $-CH_3$ | H | H | H | H |

TABLE 42-continued

| Compound No. | $R^1$ | $R^2$ | $R^3$ | $R^4$ | $R^5$ | $R^6$ | $R^7$ |
|---|---|---|---|---|---|---|---|
| (VII)-74 | 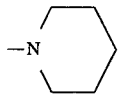 | H | $-CH_3$ | H | H | H | H |
| (VII)-75 | 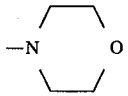 | H | | H | H | H | H |
| (VII)-76 | $-OCH_2CH=CH_2$ | H | $-CH_3$ | $-CH_3$ | H | H | H |
| (VII)-77 | 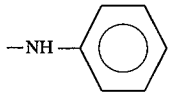 | H | $-CH_3$ | $-CH_3$ | $-CH_3$ | $-OC_4H_9(t)$ | H |
| (VII)-78 | $-OC_4H_9(n)$ | H | $-CH_3$ | $-CH_3$ | H | H | H |
| (VII)-79 | $-CH_3$ | $-CH_3$ | H | H | H | $-OC_4H_9(t)$ | H |
| (VII)-80 | $-CH_3$ | $-CH_3$ | H | H | H | H | $-C_4H_9$ |
| (VII)-81 | 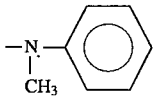 | H | $-CH_3$ | $-CH_3$ | H | $-OC_4H_9(t)$ | H |
| (VII)-82 | 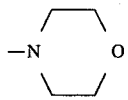 | H | $-CH_3$ | $-CH_3$ | H | $-OC_4H_9(t)$ | H |
| (VII)-83 | 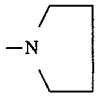 | H | $-CH_3$ | $-CH_3$ | H | $-OC_4H_9(t)$ | H |
| (VII)-84 | $-OC_2H_5$ | H | $-CH_3$ | $-CH_3$ | H | $-OC_4H_9(t)$ | H |
| (VII)-85 | $-OC_2H_5$ | H | $-CH_3$ | $-CH_3$ | H | H | $-C_4H_9$ |
| (VII)-86 | $-N(CH_3)_2$ | H | $-CH_3$ | $-CH_3$ | H | H | H |
| (VII)-87 | 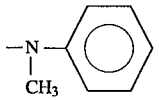 | H | $-CH_3$ | $-CH_3$ | H | $-C(CH_3)_2-CH_2-C(CH_3)_3$ | H |

TABLE 42-continued

| Compound No. | $R^1$ | $R^2$ | $R^3$ | $R^4$ | $R^5$ | $R^6$ | $R^7$ |
|---|---|---|---|---|---|---|---|
| (VII)-88 | 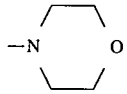 | H | $-CH_3$ | $-CH_3$ | H | 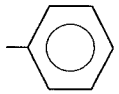 | H |
| (VII)-89 | 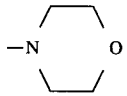 | H | $-CH_3$ | $-CH_3$ | H | H | 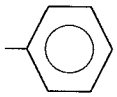 |
| (VII)-90 | 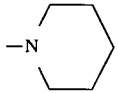 | H | $-CH_3$ | $-CH_3$ | H | H | H |
| (VII)-91 | $-OC_3H_7$(iso) | H | $-CH_3$ | $-CH_3$ | H | H | H |
| (VII)-92 | 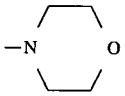 | H | $-CH_3$ | $-CH_3$ | H | $-C_3H_7$(iso) | H |
| (VII)-93 | 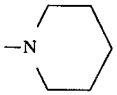 | H | $-OC_3H_7$(iso) | H | H | H | H |
| (VII)-94 | $-C(CH_3)(OCH_3)-CH_3$ | H | H | H | H | $-CH_3$ | $-CH_3$ |
| (VII)-95 | 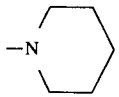 | H | $-CH_3$ | H | H | H | 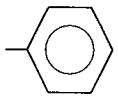 |
| (VII)-96 | $-CH_3$ | $-CH_3$ | H | H | $-CH_3$ | H | $-CH_3$ |
| (VII)-97 | H | H | $-CH_3$ | $-CH_3$ | H | $-CH_3$ | $-CH_3$ |
| (VII)-98 | $-N(CH_3)_2$ | H | $-CH_3$ | $-CH_3$ | H | H | H |
| (VII)-99 | $-OC_2H_5$ | H | $-CH_3$ | $-CH_3$ | H | $-CH_3$ | $-CH_3$ |
| (VII)-100 | $-OC_2H_5$ | H | $-CH_3$ | $-CH_3$ | H | $-CH_3$ | H |
| (VII)-101 | $-OC_2H_5$ | H | $-CH_3$ | $-CH_3$ | H | H | $-CH_3$ |
| (VII)-102 | $-CH_3$ | H | H | H | H | H | H |
| (VII)-103 | H | H | H | H | H | $-CH_3$ | H |
| (VII)-104 | $-CH_3$ | $-CH_3$ | $-CH_3$ | H | H | H | H |
| (VII)-105 | $-CH_3$ | H | H | H | $-CH_3$ | H | $-CH_3$ |

TABLE 42-continued

| Compound No. | $R^1$ | $R^2$ | $R^3$ | $R^4$ | $R^5$ | $R^6$ | $R^7$ |
|---|---|---|---|---|---|---|---|
| (VII)-106 | $-C_2H_5$ | H | H | H | $-CH_3$ | $-CH_3$ | $-CH_3$ |
| (VII)-107 | $-CH_3$ | H | $-CH_3$ | H | $-CH_3$ | $-CH_3$ | $-CH_3$ |
| (VII)-108 | $-CH_3$ | H | $-C_2H_5$ | H | H | H | H |
| (VII)-109 | $-CH(CH_3)(CH_2)_9-CH_3$ | H | H | H | $-CH_3$ | $-CH_3$ | $-CH_3$ |
| (VII)-110 | $\leftarrow CH_2 \rightarrow_9 CH_3$ | H | $-CH_3$ | H | H | H | H |
| (VII)-111 | $-CH_3$ | $-CH_3$ | $-CH_3$ | H | H | $-C_3H_7$(n) | H |
| (VII)-112 | $-C_3H_7$ | H | H | H | $-CH_3$ | $-CH_3$ | $-CH_3$ |
| (VII)-113 | $-CH(CH_3)_2$ | H | H | H | $-CH_3$ | $-CH_3$ | $-CH_3$ |
| (VII)-114 | $\leftarrow CH_2 \rightarrow_{13} CH_3$ | H | $-CH_3$ | H | H | H | H |
| (VII)-115 | $\leftarrow CH_2 \rightarrow_{15} CH_3$ | H | $-CH_3$ | H | H | H | H |
| (VII)-116 | $\leftarrow CH_2 \rightarrow_{16} CH_3$ | H | H | H | $-CH_3$ | $-CH_3$ | $-CH_3$ |
| (VII)-117 | H | H | $-CH_3$ | H | H | $-CH_3$ | H |
| (VII)-118 | 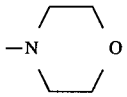 | H | $-CH_3$ | H | H | H | H |
| (VII)-119 | $\leftarrow CH_2CH_2CH_2-CH(CH_3) \rightarrow_2 CH_3$ | $-CH_3$ | H | H | $-CH_3$ | $-CH_3$ | $-CH_3$ |
| (VII)-120 | 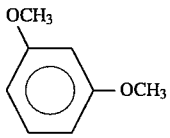 | H | H | H | H | $-OCH_3$ | H |

TABLE 42-continued
| Compound No. | $R^1$ | $R^2$ | $R^3$ | $R^4$ | $R^5$ | $R^6$ | $R^7$ |
|---|---|---|---|---|---|---|---|
| (VII)-121 | $-CH(CH_3)-(CH_2)_5-CH(CH_3)-CH_3$ | $-CH_3$ | H | H | $-CH_3$ | $-CH_3$ | $-CH_3$ |
| (VII)-122 | 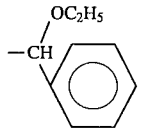 | H | H | H | H | H | H |
| (VII)-123 | 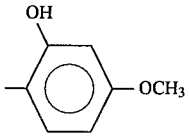 | H | H | H | H | H | H |
| (VII)-124 | H | H | $-CH_3$ | H | $-OCH_3$ | H | H |
| (VII)-125 | 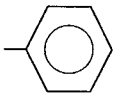 | H | $-CH_3$ | H | H | H | H |
| (VII)-126 | 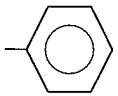 | H | H | H | $-CH_3$ | $-CH_3$ | $-CH_3$ |
| (VII)-127 | $-CH_3$ | $-CH_3$ | 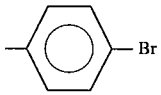 | H | $-CH_3$ | $-CH_3$ | $-CH_3$ |
| (VII)-128 | 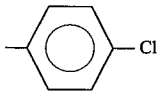 | $-CH_3$ | H | H | H | $-OCH_3$ | H |
| (VII)-129 | $-CH_3$ | $-CH_3$ | 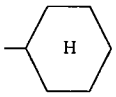 | H | $-CH_3$ | $-CH_3$ | $-CH_3$ |

TABLE 42-continued
| Compound No. | $R^1$ | $R^2$ | $R^3$ | $R^4$ | $R^5$ | $R^6$ | $R^7$ |
|---|---|---|---|---|---|---|---|
| (VII)-130 | $-CH_3$ | $-CH_3$ | 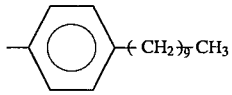 | H | $-CH_3$ | $-CH_3$ | $-CH_3$ |
| (VII)-131 | $-CH_3$ | $-CH_3$ | 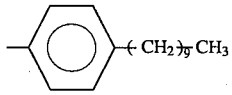 | H | $-CH_3$ | $-CH_3$ | $-CH_3$ |
| (VII)-132 | 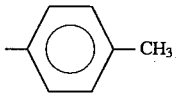 | H | $-CH_3$ | H | $-CH_3$ | $-OCH_3$ | H |
| (VII)-133 | 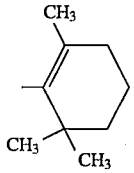 | H | H | H | $-CH_3$ | $-OCH_3$ | H |
| (VII)-134 | $-CH_3$ | $-CH_3$ | 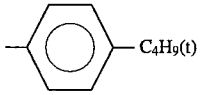 | H | $-CH_3$ | $-CH_3$ | $-CH_3$ |
| (VII)-135 | $-CH_3$ | $-CH_3$ | 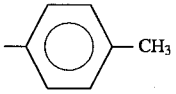 | H | $-CH_3$ | $-CH_3$ | $-CH_3$ |
| (VII)-136 | $-CH_3$ | $-CH_3$ | 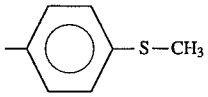 | H | $-CH_3$ | $-CH_3$ | $-CH_3$ |
| (VII)-137 | $-CH_3$ | $-CH_3$ | 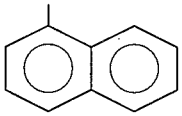 | H | H | H | H |

TABLE 42-continued
| Compound No. | $R^1$ | $R^2$ | $R^3$ | $R^4$ | $R^5$ | $R^6$ | $R^7$ |
|---|---|---|---|---|---|---|---|
| (VII)-138 | $-CH_3$ | $-CH_3$ | 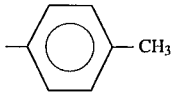 | H | $-CH_3$ | $-CH_3$ | $-CH_3$ |
| (VII)-139 | $-CH_3$ | $-CH_3$ | 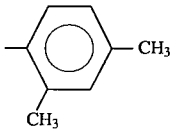 | H | $-CH_3$ | $-CH_3$ | $-CH_3$ |
| (VII)-140 | $-CH_3$ | $-CH_3$ | 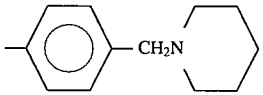 | H | $-CH_3$ | $-CH_3$ | $-CH_3$ |
| (VII)-141 | 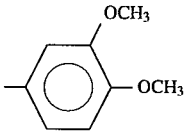 | H | $-CH_3$ | H | H | 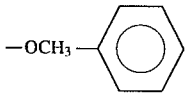 | H |
| (VII)-142 | $-CH_3$ | $-CH_3$ | 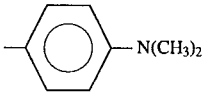 | H | $-CH_3$ | $-CH_3$ | $-CH_3$ |
| (VII)-143 | $-(CH_2)_5-CH(CH_3)-CH_3$ | $-CH_3$ | H | H | $-CH_3$ | $-CH_3$ | $-CH_3$ |
| (VII)-144 | $-(CH(CH_3)-CH_2CH_2CH_2)_2-CH(CH_3)-CH_2(CH_3)$ | $-CH_3$ | H | H | $-CH_3$ | $-CH_3$ | $-CH_3$ |
| (VII)-145 | $-(CH(CH_3)-CH_2CH_2CH_2)_5-CH(CH_3)-CH_2(CH_3)$ | $-CH_3$ | H | H | $-CH_3$ | $-CH_3$ | $-CH_3$ |
| (VII)-146 | 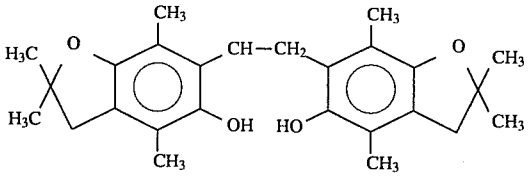 | | | | | | |

TABLE 42-continued
| Compound No. | $R^1$ | $R^2$ | $R^3$ | $R^4$ | $R^5$ | $R^6$ | $R^7$ |
|---|---|---|---|---|---|---|---|
| (VII)-147 | | | 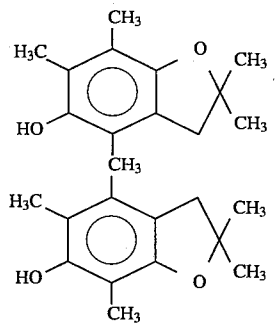 | | | | |

TABLE 43
| Compound No. | $R^1$ | $R^2$ | $R^3$ | $R^4$ | $R^5$ |
|---|---|---|---|---|---|
| (VIII)-1 | 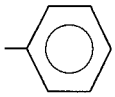 | H | $-Br$ | $-CH_2-N(CH_3)_2$ | H |
| (VIII)-2 | 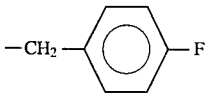 | $-CH_3$ | $-C_3H_7(n)$ | H | $-Cl$ |
| (VIII)-3 | H | H | H | H | H |
| (VIII)-4 | 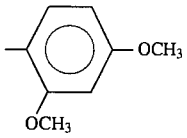 | H | H | $-OCH_3$ | H |
| (VIII)-5 | H | H | H | $-CH_3$ | $-CH_3$ |
| (VIII)-6 | 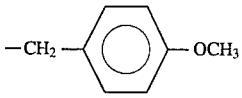 | H | $-CH_3$ | $-CH_3$ | H |
| (VIII)-7 | $-C_2H_5$ | H | $-CH_3$ | $-CH_3$ | $-CH_3$ |
| (VIII)-8 | 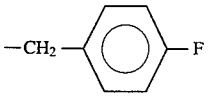 | $-CH_3$ | $-C_3H_7(n)$ | H | H |
| (VIII)-9 | $-C_6H_{13}(n)$ | H | H | H | H |
| (VIII)-10 | 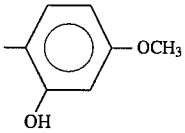 | H | H | $-OCH_3$ | H |
| (VIII)-11 | 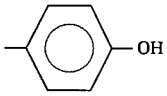 | H | H | H | H |
| (VIII)-12 | 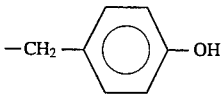 | $-CH_3$ | H | H | H |
| (VIII)-13 | 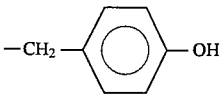 | $-CH_3$ | $-C_3H_7(n)$ | H | H |
| (VIII)-14 | $-CH_3$ | 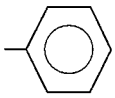 | H | $-OCH_3$ | H |
| (VIII)-15 | 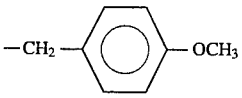 | $-CH_3$ | H | H | H |
| (VIII)-16 | 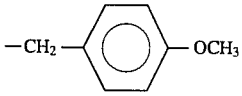 | $-CH_3$ | $-C_3H_7(n)$ | H | H |
| (VIII)-17 | H | $-CH_3$ | H | H | H |

TABLE 43-continued
| Compound No. | $R^1$ | $R^2$ | $R^3$ | $R^4$ | $R^5$ |
|---|---|---|---|---|---|
| (VIII)-18 | $-CH(CH_3)_2$ | H | H | H | H |
| (VIII)-19 | H | $-CH_3$ | $-CH_2-CH=CH_2$ | H | H |
| (VIII)-20 | H | $-CH_3$ | $-C_3H_7(n)$ | H | H |
| (VIII)-21 | $-CH_3$ | $-CH_3$ | $-CH_3$ | $-CH_3$ | $-CH_3$ |
| (VIII)-22 | H | 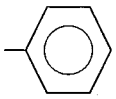 | H | H | H |
| (VIII)-23 | $-CH_3$ | H | $-CH_3$ | $-CH_3$ | $-CH_3$ |
| (VIII)-24 | 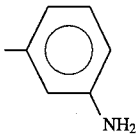 | $-CH_3$ | H | H | H |
| (VIII)-25 | 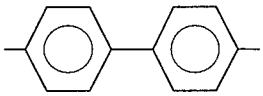 | $-CH_3$ | H | H | H |
| (VIII)-26 | $-Br$ | 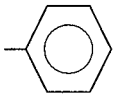 | $-CH_2-N(CH_3)_2$ | H | H |
| (VIII)-27 | 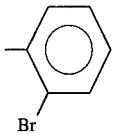 | $-CH_3$ | H | H | H |
| (VIII)-28 | 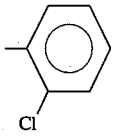 | $-C_4H_9(n)$ | H | H | H |
| (VIII)-29 | 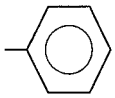 | $-C_4H_9(n)$ | H | H | H |
| (VIII)-30 | 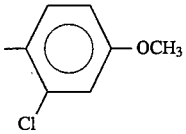 | $-C_2H_5$ | H | H | H |
| (VIII)-31 | $-CH_3$ | $-CH_3$ | H | H | H |
| (VIII)-32 | 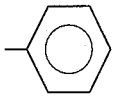 | H | $-CH_2-N(CH_3)_2$ | H | H |
| (VIII)-33 | H | 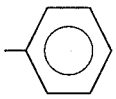 | $-CH_2-N(CH_3)_2$ | H | H |

TABLE 43-continued
| Compound No. | $R^1$ | $R^2$ | $R^3$ | $R^4$ | $R^5$ |
|---|---|---|---|---|---|
| (VIII)-34 | 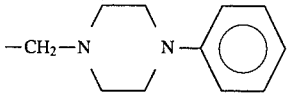 | 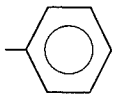 | $-CH_2-N(CH_3)_2$ | H | H |
| (VIII)-35 | 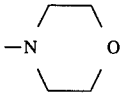 | 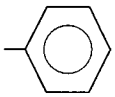 | H | 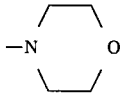 | H |
| (VIII)-36 | 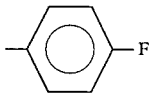 | $-C_2H_5$ | H | H | H |
| (VIII)-37 | $-C_2H_5$ | 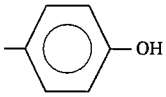 | H | H | H |
| (VIII)-38 | $-C_2H_5$ | 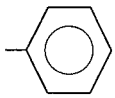 | H | H | H |
| (VIII)-39 | 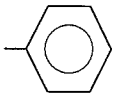 | $-C_2H_5$ | H | H | H |
| (VIII)-40 | 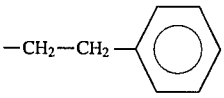 | $-C_2H_5$ | H | H | H |
| (VIII)-41 | 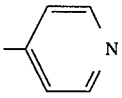 | $-C_2H_5$ | H | H | H |
| (VIII)-42 | 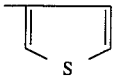 | $-C_2H_5$ | H | H | H |
| (VIII)-43 | 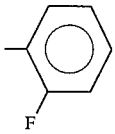 | $-CH_3$ | H | H | H |
| (VIII)-44 | 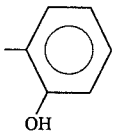 | H | H | H | H |
| (VIII)-45 | $-CH_3$ | 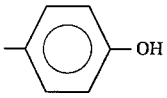 | H | H | H |
| (VIII)-46 | 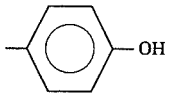 | $-C_3H_7(n)$ | H | H | H |
| (VIII)-47 | 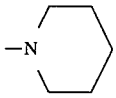 | 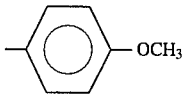 | H | $-OCH_3$ | H |

TABLE 43-continued
| Compound No. | $R^1$ | $R^2$ | $R^3$ | $R^4$ | $R^5$ |
|---|---|---|---|---|---|
| (VIII)-48 | 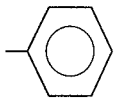 | $-CH_3$ | H | $-OCH_3$ | H |
| (VIII)-49 | 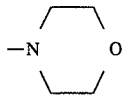 | 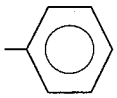 | H | $-OCH_3$ | H |
| (VIII)-50 | 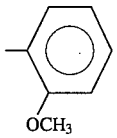 | H | H | H | H |
| (VIII)-51 | 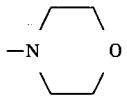 | 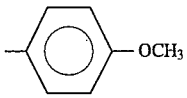 | H | 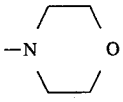 | H |
| (VIII)-52 | 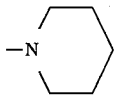 | 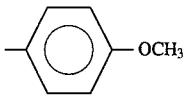 | H | 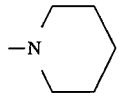 | H |
| (VIII)-53 | 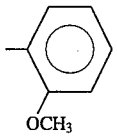 | $-CH_3$ | H | H | H |
| (VIII)-54 | 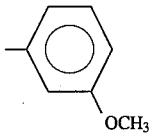 | $-CH_3$ | H | H | H |
| (VIII)-55 | 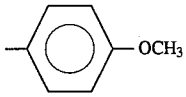 | $-C_3H_7$ | H | H | H |
| (VIII)-56 | $-CH_3$ | H | H | H | H |
| (VIII)-57 | 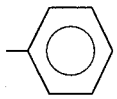 | 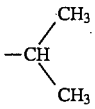 | H | H | H |
| (VIII)-58 | 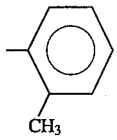 | $-CH_3$ | H | H | H |
| (VIII)-59 | 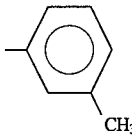 | $-CH_3$ | H | H | H |
| (VIII)-60 | 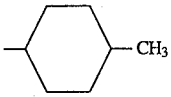 | $-CH_3$ | H | H | H |

TABLE 43-continued
| Compound No. | $R^1$ | $R^2$ | $R^3$ | $R^4$ | $R^5$ |
|---|---|---|---|---|---|
| (VIII)-61 | $-CH_3$ | 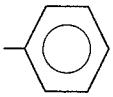 | H | H | H |
| (VIII)-62 | 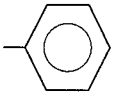 | $-CH_3$ | H | H | H |
| (VIII)-63 | $-CH_2-CH_2-$ 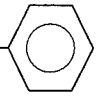 | $-CH_3$ | H | H | H |
| (VIII)-64 | $-CH_3$ | 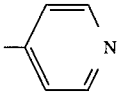 | H | H | H |
| (VIII)-65 | 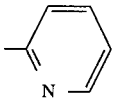 | $-CH_3$ | H | H | H |
| (VIII)-66 | 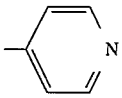 | $-CH_3$ | H | H | H |
| (VIII)-67 | 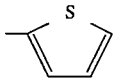 | $-CH_3$ | H | H | H |
| (VIII)-68 | $-CH=CH-CH_2-CH_2-CH_2-CH_3$ | H | H | H | H |
| (VIII)-69 | 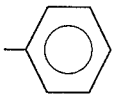 | H | H | H | H |
| (VIII)-70 | 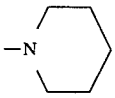 | 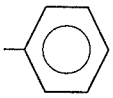 | H | 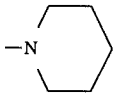 | H |
| (VIII)-71 | 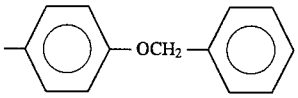 | $-C_3H_7(n)$ | H | H | H |
| (VIII)-72 | $-C_3H_7(n)$ | $-CH_2-$ 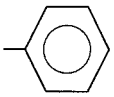 | H | H | H |
| (VIII)-73 | $-CH_2-S-$ 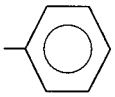 | 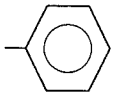 | H | H | H |
| (VIII)-74 | 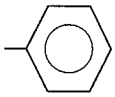 | $-C_3H_7(n)$ | H | H | H |
| (VIII)-75 | $-C_3H_7(n)$ | 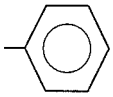 | H | H | H |

TABLE 43-continued

| Compound No. | $R^1$ | $R^2$ | $R^3$ | $R^4$ | $R^5$ |
|---|---|---|---|---|---|
| (VIII)-76 | 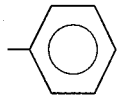 | $-C_{14}H_{29}(n)$ | H | H | H |
| (VIII)-77 | 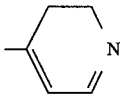 | $-C_3H_7(n)$ | H | H | H |
| (VIII)-78 | H | $-CH_2CH_2NH_2(n)$ | H | H | H |
| (VIII)-79 | 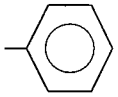 | 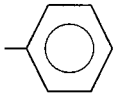 | $-CH_2-N(CH_3)_2$ | H | H |
| (VIII)-80 | H | $-CH_3$ | H | $-CH_3$ | H |
| (VIII)-81 | 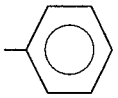 | 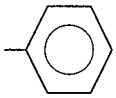 | H | H | H |
| (VIII)-82 | 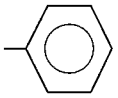 | 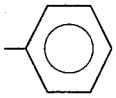 | 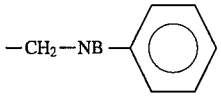 | H | H |
| (VIII)-83 | 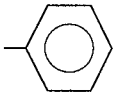 | 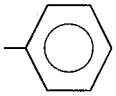 | 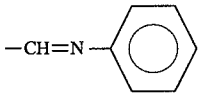 | H | H |
| (VIII)-84 | 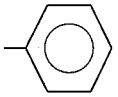 | 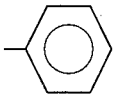 | 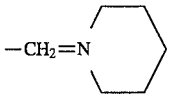 | H | H |
| (VIII)-85 | $-C_2H_5$ | H | H | H | H |
| (VIII)-86 | $-CH_3$ | $-CH_3$ | H | $-C_2H_5$ | H |
| (VIII)-87 | $-\underset{\underset{CH_3}{\vert}}{C}=CH_2$ | H | H | H | H |
| (VIII)-88 | 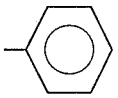 | 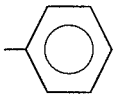 | 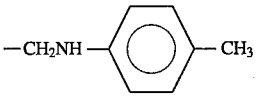 | H | H |
| (VIII)-89 | 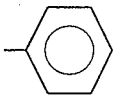 | 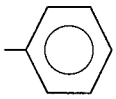 | 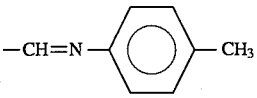 | H | H |
| (VIII)-90 | 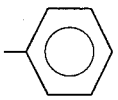 | 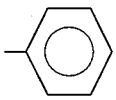 | 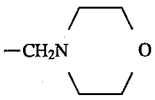 | H | H |
| (VIII)-91 | $-CH_3$ | H | H | $-CH_3$ | H |
| (VIII)-92 | 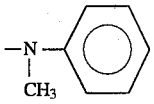 | $-C_4H_9(Sn)$ | H | H | H |
| (VIII)-93 | $-C_2H_5$ | $-CH_3$ | H | H | H |
| (VIII)-94 | $-C_3H_7(n)$ | $-C_2H_5$ | H | H | H |
| (VIII)-95 | $-C_5H_{11}(n)$ | $-CH_3$ | H | H | H |

TABLE 43-continued
| Compound No. | $R^1$ | $R^2$ | $R^3$ | $R^4$ | $R^5$ |
|---|---|---|---|---|---|
| (VIII)-96 | 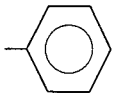 | | $-CH_3$ | $-CH_3$ | $-CH_3$ |
| (VIII)-97 | H | $-CH_3$ | $-OCH_3$ | H | H |
| (VIII)-98 | 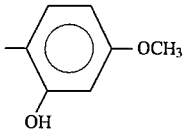 | H | H | H | H |
| (VIII)-99 | 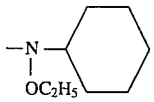 | H | $-CH_3$ | $-CH_3$ | H |
| (VIII)-100 | 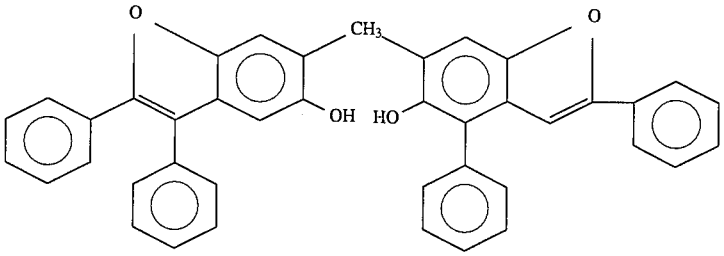 | | | H | H |
TABLE 44
(IX)-1
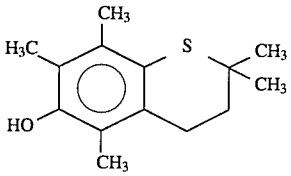
(IX)-2
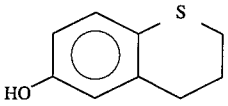
(IX)-3
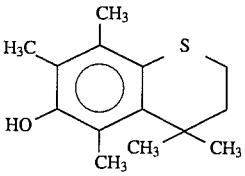
(IX)-4
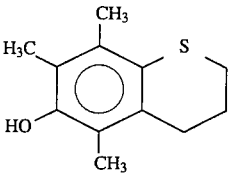
TABLE 44-continued
(IX)-5
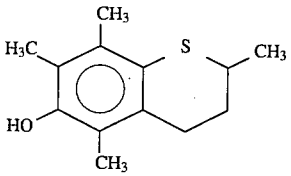
(IX)-6
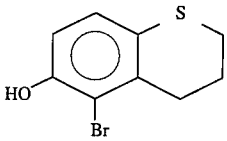
(IX)-7
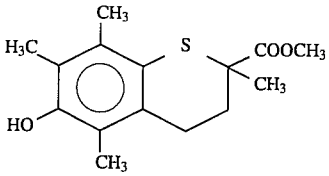
(IX)-8
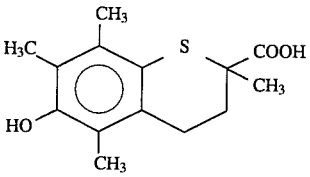

TABLE 44-continued
(IX)-9
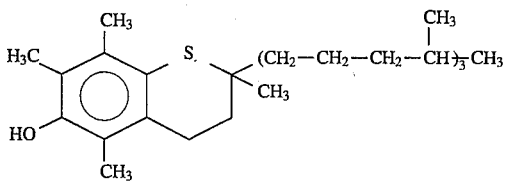
(IX)-10
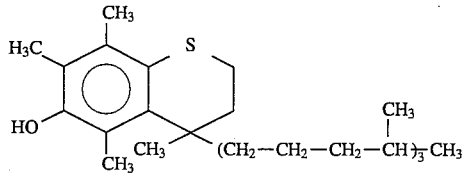
TABLE 45
(X)-1
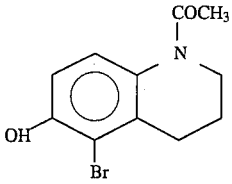
(X)-2
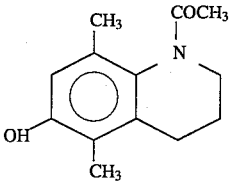
(X)-3
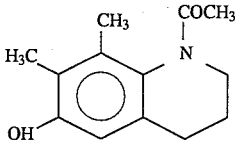
(X)-4
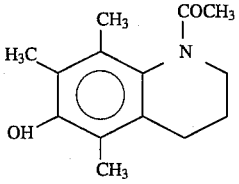
(X)-5
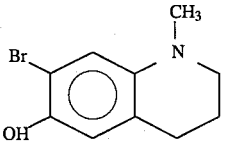
(X)-6
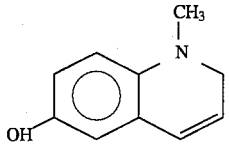
(X)-7
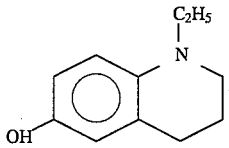
TABLE 45-continued
(X)-8
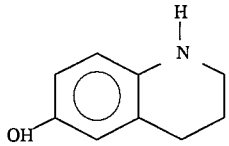
(X)-9
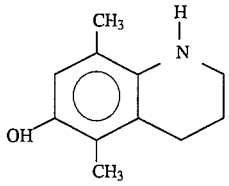
(X)-10
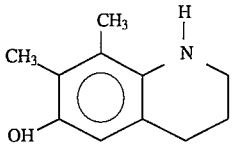
(X)-11
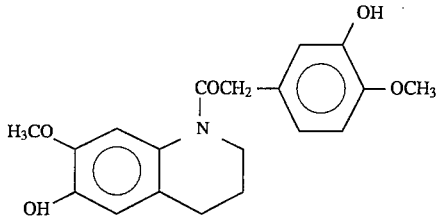
(X)-12
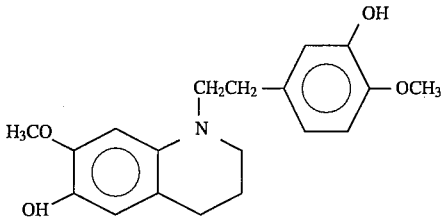
(X)-13
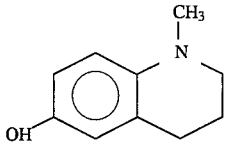
(X)-14
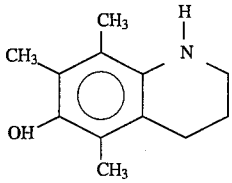
(X)-15
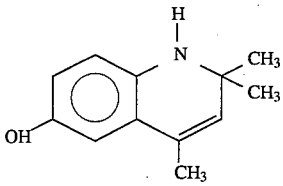

TABLE 45-continued
(X)-16
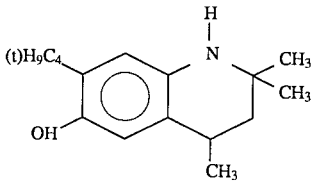
(X)-17
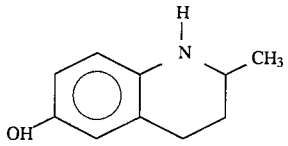
(X)-18
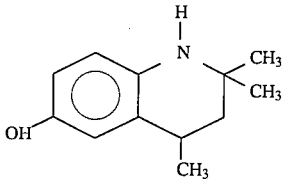
(X)-19
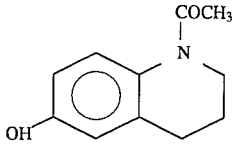
(X)-20
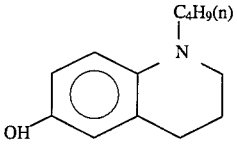
(X)-21
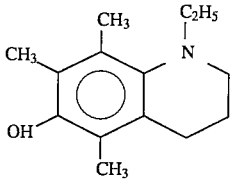
(X)-22
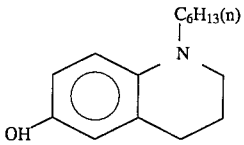
(X)-23
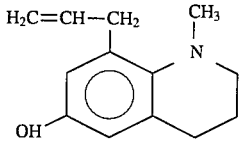
TABLE 45-continued
(X)-24
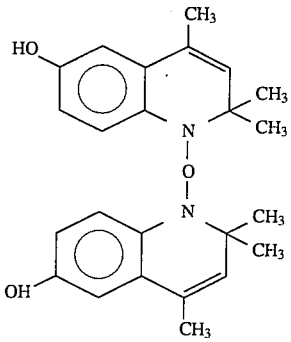
(X)-25
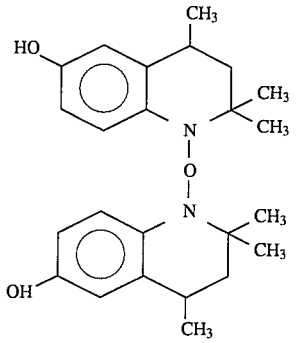
(X)-26
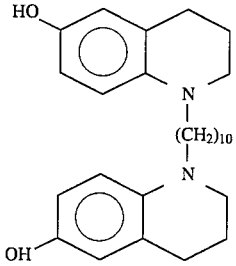
(X)-27
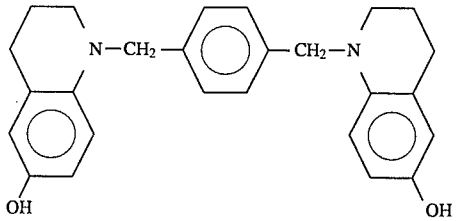
TABLE 46
(XI)-1
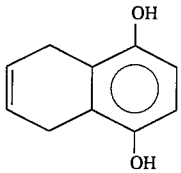
(XI)-2
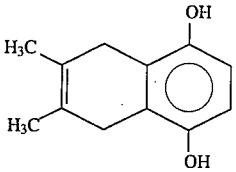

TABLE 46-continued
(XI)-3
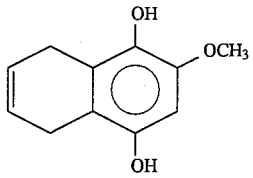
(XI)-4
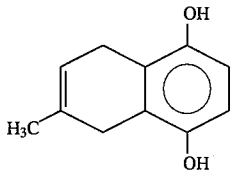
(XI)-5
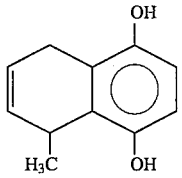
(XI)-6
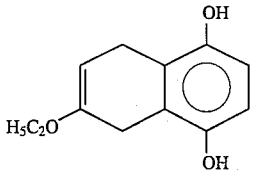
(XI)-7
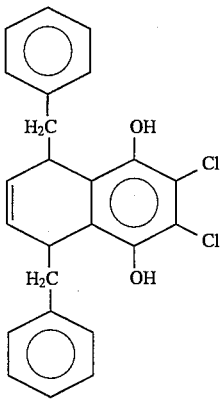
(XI)-8
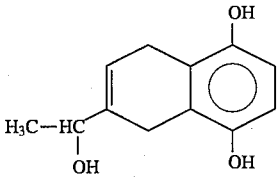
(XI)-9
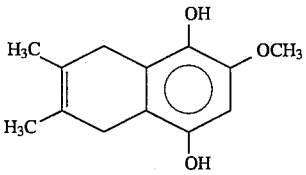
TABLE 46-continued
(XI)-10
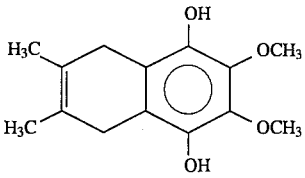
(XI)-11
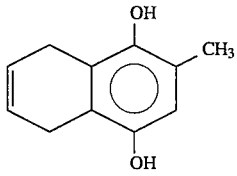
(XI)-12
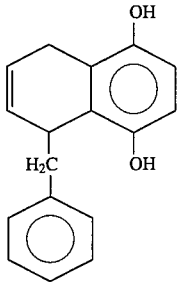
(XI)-13
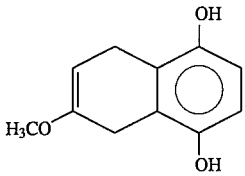
(XI)-14
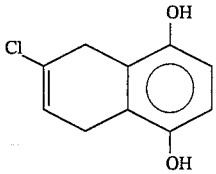
(XI)-15
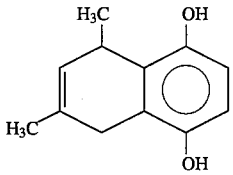
(XI)-16
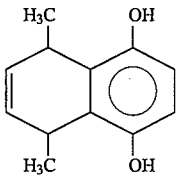
(XI)-17
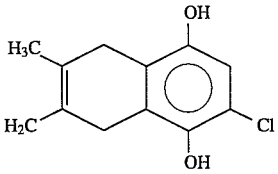

TABLE 46-continued
(XI)-18
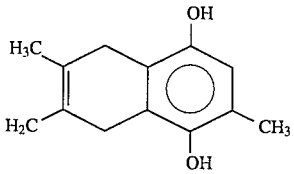
(XI)-19
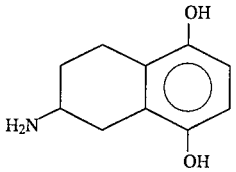
(XI)-20
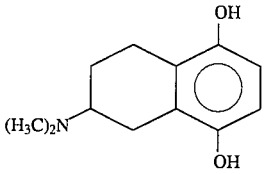
(XI)-21
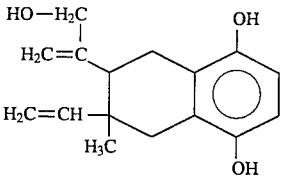
(XI)-22
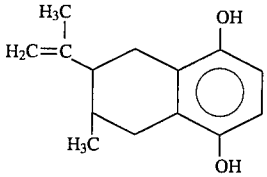
(XI)-23
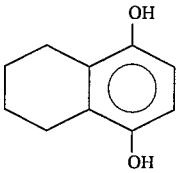
(XI)-24
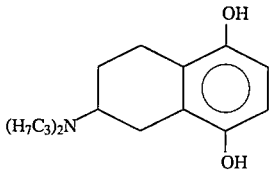
(XI)-25
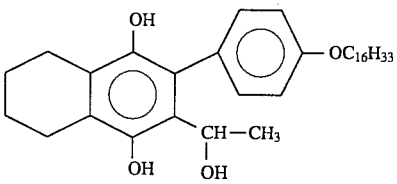
TABLE 46-continued
(XI)-26
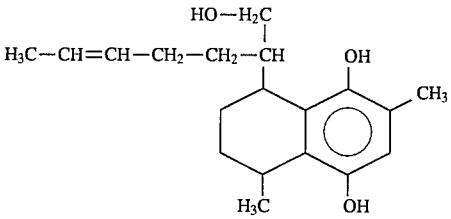
(XI)-27
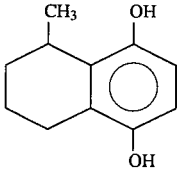
(XI)-28
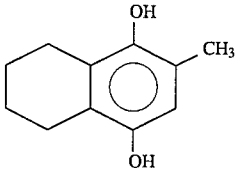
(XI)-29
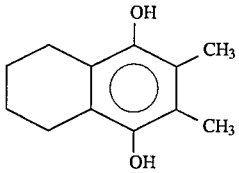
TABLE 47
(XII)-1
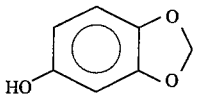
(XII)-2
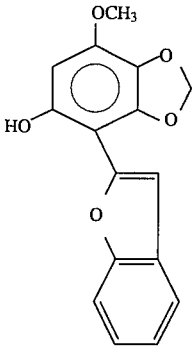
(XII)-3
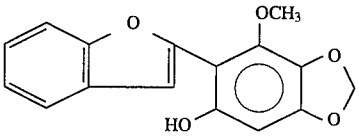
(XII)-4
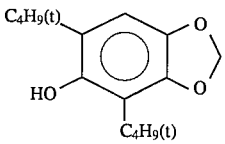

TABLE 47-continued
(XII)-5
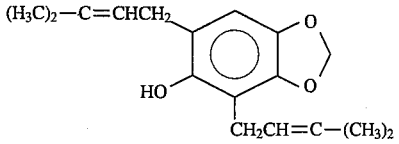
(XII)-6
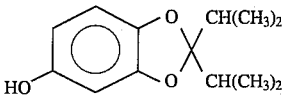
(XII)-7
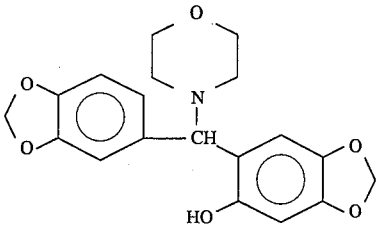
(XII)-8
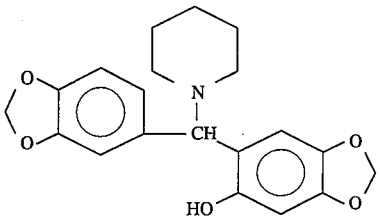
(XII)-9
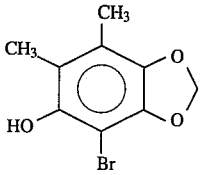
(XII)-10
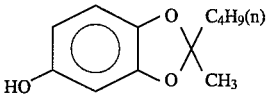
(XII)-11
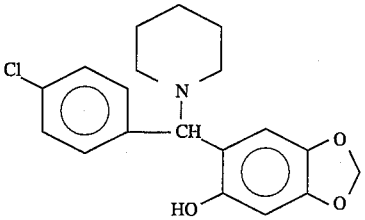
(XII)-12
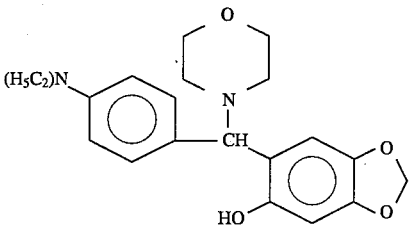
TABLE 47-continued
(XII)-13
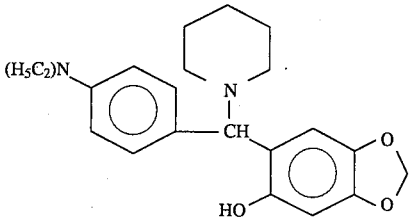
(XII)-14
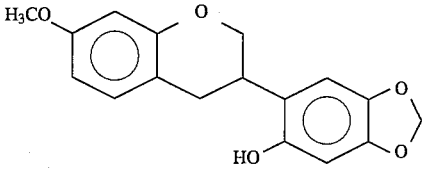
(XII)-15
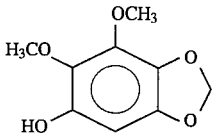
(XII)-16
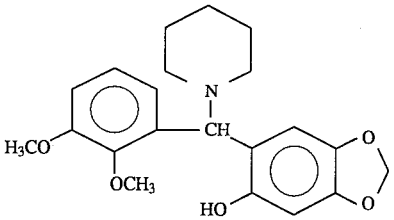
(XII)-17
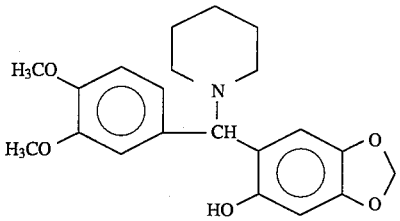
(XXI)-18
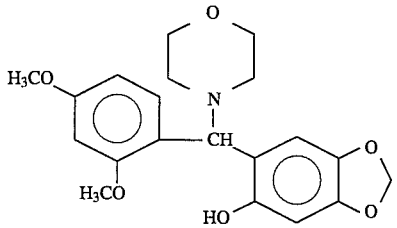
(XII)-19
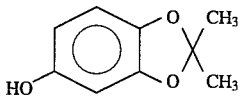
(XII)-20
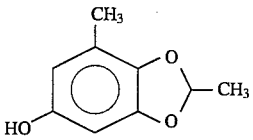

TABLE 47-continued
(XII)-21
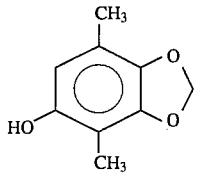
(XII)-22
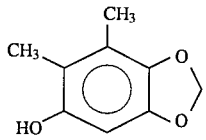
(XII)-23
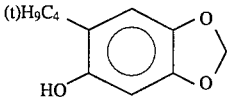
(XII)-24
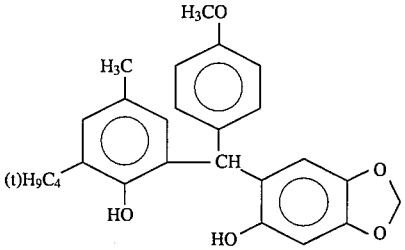
(XII)-25
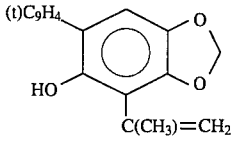
(XII)-26
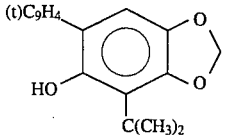
(XII)-27
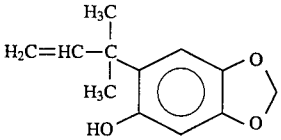
(XII)-28
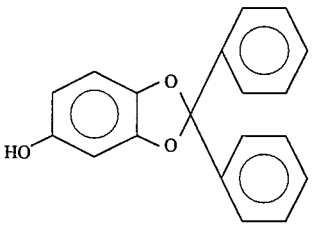
(XII)-29
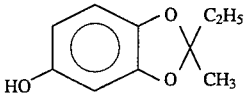
(XII)-30
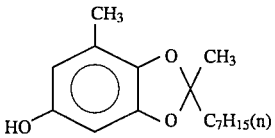
TABLE 47-continued
(XII)-31
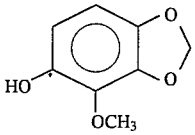
(XII)-32
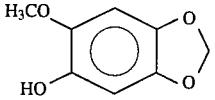
(XII)-33
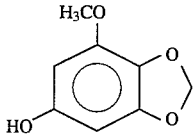
(XII)-34
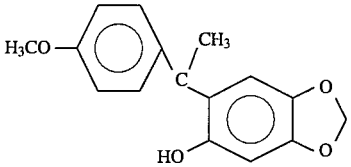
(XII)-35
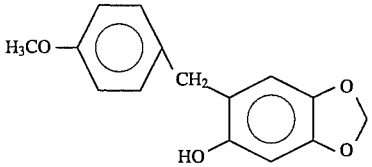
(XII)-36
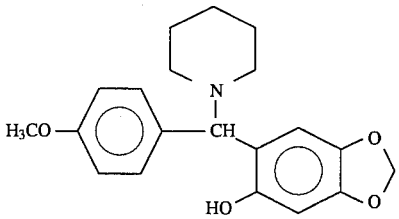
(XII)-37
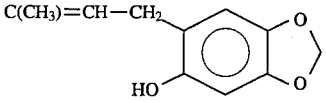
(XII)-38
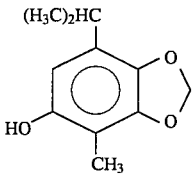
(XII)-39
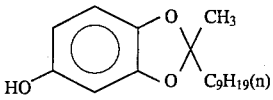
(XII)-40
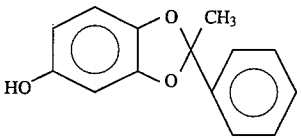

TABLE 47-continued
(XII)-41
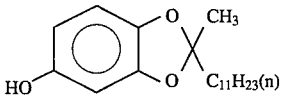
(XII)-42
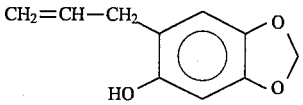
(XII)-43
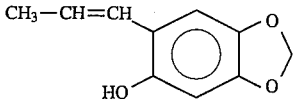
(XII)-44
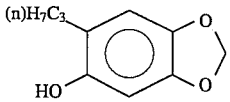
(XII)-45
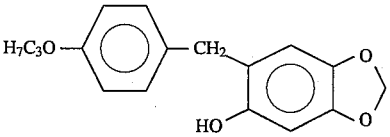
(XII)-46
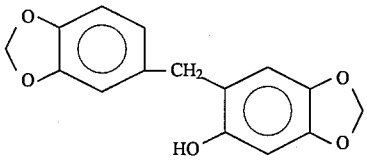
(XII)-47
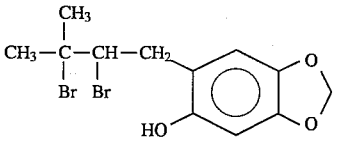
(XII)-48
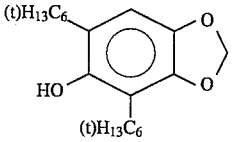
(XII)-49
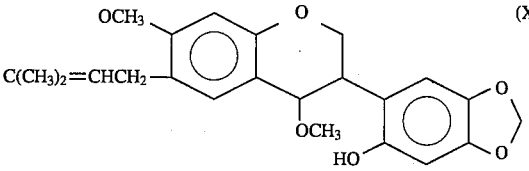
(XII)-50
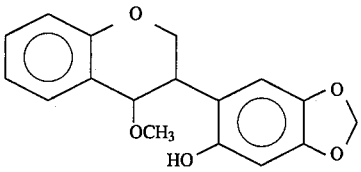
(XII)-51
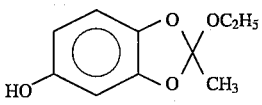
TABLE 47-continued
(XII)-52
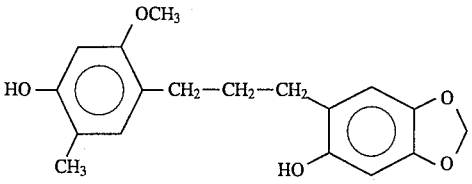
(XII)-53
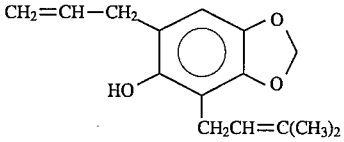
(XII)-54
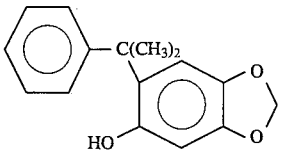
(XII)-55
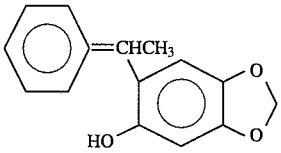
(XII)-56
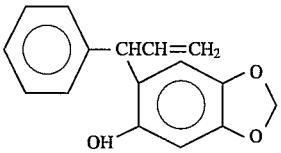
(XII)-57
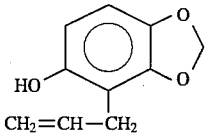
(XII)-58
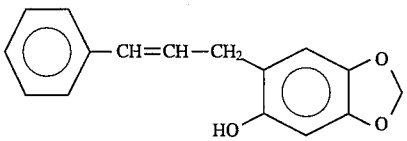
(XII)-59
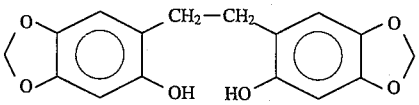
(XII)-60
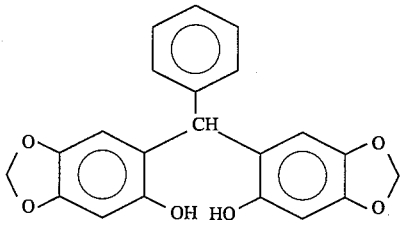
(XII)-61
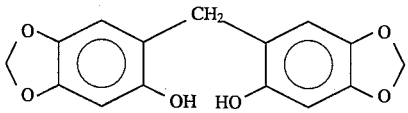

Figure 2:
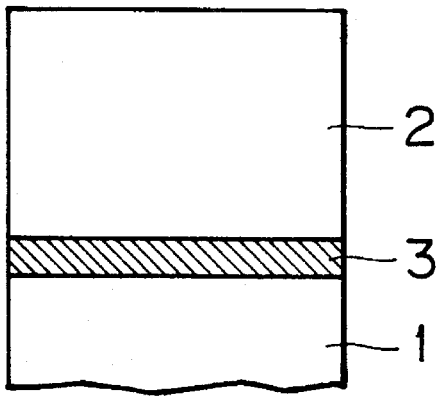
FIG. 2 is a schematic cross-sectional view of a second embodiment of an electrophotographic photoconductor according to the present invention, in which an undercoat layer is provided between an electroconductive support and an photoconductive layer.
Figure 3:
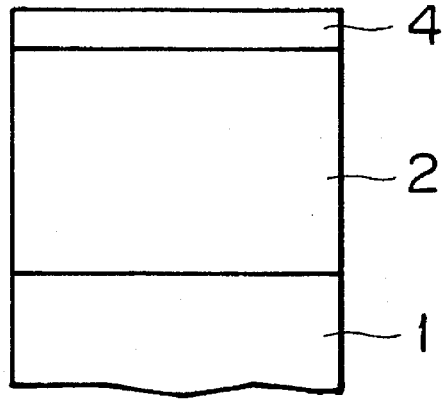
FIG. 3 is a schematic cross-sectional view of a third embodiment of an electrophotographic photoconductor according to the present invention, in which a protective layer is provided on a photoconductive layer.
Figure 4:
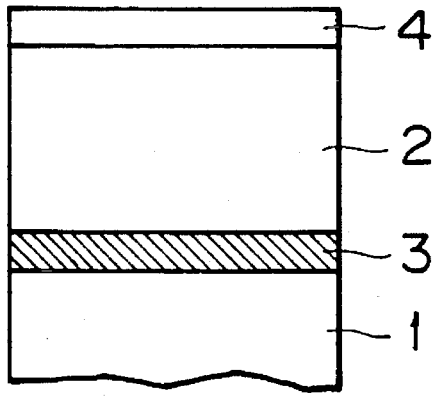
FIG. 4 is a schematic cross-sectional view of a fourth embodiment of an electrophotographic photoconductor according to the present invention, in which an undercoat layer is provided between an electroconductive support and a photoconductive layer, and a protective layer is provided on the photoconductive layer.

FIGS. 1 to 4 are schematic cross-sectional views which show the embodiments of the electrophotographic photoconductor according to the present invention. Reference numeral 1 indicate an electroconductive support; and reference numeral 2, a single-layered photoconductive layer. Any embodiment is adoptable as long as the single-layered photoconductive layer 2 is formed on the electroconductive support 1. For instance, an undercoat layer 3 may be interposed between the electroconductive support 1 and the single-layered photoconductive layer 2 to improve the adhesion properties and the electric charge blocking characteristics, as shown in FIG. 2. In addition, a protective layer 4 may be formed on the single-layered photoconductive layer 2 to increase the mechanical durability such as the wear resistance of the photoconductor, as shown in FIG. 3. As shown in FIG. 4, both an undercoat layer 3 and a protective layer 4 may be provided.

For the electroconductive support for use in the photoconductor of the present invention, metals such as aluminum, brass, stainless steel and nickel, and alloys thereof can be employed. In addition, a thin film of electroconductive materials such as aluminum, silver, gold, nickel, indium oxide, and tin oxide may be formed on an electrically insulating support made of a material such as polyethylene terephthalate, polypropylene, nylon, glass and paper. Further, electroconductive particles such as carbon black, indium oxide and tin oxide may be dispersed in an appropriate resin, and the thus obtained resin may be provided on the above-mentioned electrically insulating support, and a sheet of may be treated to be electroconductive for the support. The shape of the electroconductive support is not limited, and a sheet-, drum- or belt-shaped support may be employed as occasion demands.

Any conventional binder resins can be employed in the single-layered photoconductive layer for use in the present invention. In particular, polymers with high electrically insulating properties and film-forming properties are preferable. For example, thermoplastic resins and thermosetting resins such as polystyrene, styrene—acrylonitrile copolymer, styrene—butadiene copolymer, styrene—maleic anhydride copolymer, polyester, polyvinyl chloride, vinyl chloride—vinyl acetate copolymer, polyvinyl acetate, polyvinylidene chloride, polyarylate resin, polycarbonate (bisphenol A and bisphenol Z), cellulose acetate resin, ethyl cellulose resin, polyvinyl butyral, polyvinyl formal, polyvinyltoluene, poly-N-vinylcarbazole, acrylic resin, silicone resin, epoxy resin, melamine resin, urethane resin, phenolic resin, and alkyd resin can be employed.

To prepare the electrophotographic photoconductor of the present invention, the previously mentioned disazo pigment and trisazo pigment are mixed and simultaneously pulverized. In this case, ketones, esters, alcohols, cyclic ethers and cyclic ketones may be used as the dispersing solvents. Of these solvents, cyclic ethers and cyclic ketones are preferable, and tetrahydrofuran and cyclohexanone are in particular preferably employed as the dispersing solvents from the viewpoint of the sensitizing effect of the azo pigments. Then, the charge transporting material and the binder resin are added to the above prepared mixture of azo pigments, and the thus obtained mixture is coated on the electroconductive support by dip coating, spray coating or bead coating. Thus, an electrophotographic photoconductor according to the present invention is prepared.

It is preferable that the amount of the simultaneously pulverized mixture of the above-mentioned azo pigments be in a range of 0.01 to 10 parts by weight to 10 parts by weight of the binder resin. When the mixture of the azo pigments is contained in such an amount, the residual potential can be decreased, and the decrease of the charging characteristics and mechanical strength can be prevented.

When the charge transporting material for use in the photoconductor of the present invention is an organic positive hole transporting material, it is preferable that the amount of the charge transporting material be in a range of 1 to 15 parts by weight to 10 parts by weight of the binder resin. When the charge transporting material is contained in the photoconductive layer in the above-mentioned amount, the photosensitivity can be increased and the decrease of the charging characteristics and the mechanical strength can be prevented.

When the charge transporting material comprises an organic positive hole transporting material and an organic acceptor compound, the amount of the organic acceptor compound is preferably in a range of 1 to 15 parts by weight to 10 parts by weight of the binder resin to prevent the deterioration of the charging characteristics during the repeated operations, and the deterioration of the photosensitivity and the mechanical strength.

The thickness of the single-layered photoconductive layer is preferably in the range of 5 to 100 μm, more preferably in the range of 10 to 50 μm when the increase of mechanical strength and decrease of the residual potential are taken into consideration.

Other features of this invention will become apparent in the course of the following description of exemplary embodiments, which are given for illustration of the invention and are not intended to be limiting thereof.

EXAMPLE I-1

An unsymmetrical disazo pigment of formula (1) in which $R^1$ and $R^2$ are hydrogen was prepared using the couplers No. 17 and No. 24 shown in TABLE 1. A trisazo pigment of formula (2) in which $R^3$ is hydrogen was prepared using the coupler No. 70 shown in TABLE 2.

Five parts by weight of the disazo pigment and 5 parts by weight of the trisazo pigment were dispersed in a ball mill together with 70 parts by weight of methyl ethyl ketone for 5 days, and simultaneously pulverized.

The above prepared mixture was added to a solution consisting of 100 parts by weight of Z type polycarbonate with a molecular weight of 60,000, 300 parts by weight of tetrahydrofuran, 80 parts by weight of 4-diethylaminobenzaldehyde-1-benzyl-1-phenylhydrazone serving as the charge transporting material, and 0.1 parts by weight of a commercially available silicone oil (Trademark "KF-50", made by Shin-Etsu Chemical Co., Ltd.). Thus, a coating liquid for a photoconductive layer was obtained.

The thus obtained photoconductive layer coating liquid was coated on an aluminum plate (Trademark "A1080", made by Sumitomo Light Metal Industries, Ltd.) with a thickness of 0.2 mm by blade coating, dried at 150° C. for 20 minutes, so that a photoconductive layer with a thickness of 20 μm was formed on the electroconductive support.

Thus, an electrophotographic photoconductor No. I-1 according to the present invention was obtained.

The oxidation potential of the charge transporting material for use in Example I-1 was 0.50 V (vs SCE).

EXAMPLE I-2

The procedure for preparation of the electrophotographic photoconductor No. I-1 in Example I-1 was repeated except that the unsymmetrical disazo pigment for use in the photoconductive layer coating liquid in Example I-1 was replaced by a disazo pigment of formula (1) ($R^1$=$R^2$=hydrogen) which was prepared using the coupler No. 30 shown in TABLE 1.

Thus, an electrophotographic photoconductor No. I-2 according to the present invention was obtained.

EXAMPLE I-3

The procedure for preparation of the electrophotographic photoconductor No. I-1 in Example I-1 was repeated except that the trisazo pigment for use in the photoconductive layer coating liquid in Example I-1 was replaced by a trisazo pigment of formula (2) ($R^3$=hydrogen) which was prepared using the coupler No. 214 shown in TABLE 13.

Thus, an electrophotographic photoconductor No. I-3 according to the present invention was obtained.

EXAMPLE I-4

The procedure for preparation of the electrophotographic photoconductor No. I-1 in Example I-1 was repeated except that the unsymmetrical disazo pigment for use in the photoconductive layer coating liquid in Example I-1 was replaced by a symmetrical disazo pigment of formula (1) ($R^2$=$R^2$=hydrogen) which was prepared using the coupler No. 17 shown in TABLE 1.

Thus, an electrophotographic photoconductor No. I-4 according to the present invention was obtained.

EXAMPLE I-5

The procedure for preparation of the electrophotographic photoconductor No. I-1 in Example I-1 was repeated except that the trisazo pigment for use in the photoconductive layer coating liquid in Example I-1 was replaced by a trisazo pigment of formula (2) ($R^3$=hydrogen) which was prepared using the coupler No. 3 shown in TABLE 1.

Thus, an electrophotographic photoconductor No. I-5 according to the present invention was obtained.

EXAMPLE I-6

The procedure for preparation of the electrophotographic photoconductor No. I-1 in Example I-1 was repeated except that the amount of the unsymmetrical disazo pigment and that of the trisazo pigment for use in the photoconductive layer coating liquid in Example I-1 were separately changed to 0.04 parts by weight.

Thus, an electrophotographic photoconductor No. I-6 according to the present invention was obtained.

EXAMPLE I-7

The procedure for preparation of the electrophotographic photoconductor No. I-1 in Example I-1 was repeated except that the amount of the unsymmetrical disazo pigment and that of the trisazo pigment for use in the photoconductive layer coating liquid in Example I-1 were separately changed to 0.05 parts by weight.

Thus, an electrophotographic photoconductor No. I-7 according to the present invention was obtained.

EXAMPLE I-8

The procedure for preparation of the electrophotographic photoconductor No. I-1 in Example I-1 was repeated except that the amount of the unsymmetrical disazo pigment and that of the trisazo pigment for use in the photoconductive layer coating liquid in Example I-1 were separately changed to 50 parts by weight.

Thus, an electrophotographic photoconductor No. I-8 according to the present invention was obtained.

EXAMPLE I-9

The procedure for preparation of the electrophotographic photoconductor No. I-1 in Example I-1 was repeated except that the amount of the unsymmetrical disazo pigment and that of the trisazo pigment for use in the photoconductive layer coating liquid in Example I-1 were separately changed to 75 parts by weight.

Thus, an electrophotographic photoconductor No. I-9 according to the present invention was obtained.

EXAMPLE I-10

The procedure for preparation of the electrophotographic photoconductor No. I-1 in Example I-1 was repeated except that the amount of the charge transporting material for use in the photoconductive layer coating liquid in Example I-1 was changed to 5 parts by weight.

Thus, an electrophotographic photoconductor No. I-10 according to the present invention was obtained.

EXAMPLE I-11

The procedure for preparation of the electrophotographic photoconductor No. I-1 in Example I-1 was repeated except that the amount of the charge transporting material for use in the photoconductive layer coating liquid in Example I-1 was changed to 10 parts by weight.

Thus, an electrophotographic photoconductor No. I-11 according to the present invention was obtained.

EXAMPLE I-12

The procedure for preparation of the electrophotographic photoconductor No. I-1 in Example I-1 was repeated except that the amount of the charge transporting material for use in the photoconductive layer coating liquid in Example I-1 was changed to 150 parts by weight.

Thus, an electrophotographic photoconductor No. I-12 according to the present invention was obtained.

EXAMPLE I-13

The procedure for preparation of the electrophotographic photoconductor No. I-1 in Example I-1 was repeated except that the amount of the charge transporting material for use in the photoconductive layer coating liquid in Example I-1 was changed to 200 parts by weight.

Thus, an electrophotographic photoconductor No. I-13 according to the present invention was obtained.

EXAMPLE I-14

The procedure for preparation of the electrophotographic photoconductor No. I-1 in Example I-1 was repeated except that methyl ethyl ketone used in dispersing the azo pigments in Example I-1 was replaced by 1,4-dioxane.

Thus, an electrophotographic photoconductor No. I-14 according to the present invention was obtained.

EXAMPLE I-15

The procedure for preparation of the electrophotographic photoconductor No. I-1 in Example I-1 was repeated except that methyl ethyl ketone used in dispersing the azo pigments in Example I-1 was replaced by isophorone.

Thus, an electrophotographic photoconductor No. I-15 according to the present invention was obtained.

EXAMPLE I-16

The procedure for preparation of the electrophotographic photoconductor No. I-1 in Example I-1 was repeated except that methyl ethyl ketone used in dispersing the azo pigments in Example I-1 was replaced by tetrahydrofuran.

Thus, an electrophotographic photoconductor No. I-16 according to the present invention was obtained.

EXAMPLE I-17

The procedure for preparation of the electrophotographic photoconductor No. I-1 in Example I-1 was repeated except that methyl ethyl ketone used in dispersing the azo pigments in Example I-1 was replaced by cyclohexanone.

Thus, an electrophotographic photoconductor No. I-17 according to the present invention was obtained.

COMPARATIVE EXAMPLE I-1

An unsymmetrical disazo pigment of formula (1) in which $R^1$ and $R^2$ are hydrogen was prepared using the couplers No. 17 and No. 24 shown in TABLE 1.

Ten parts by weight of the disazo pigment were dispersed in a ball mill together with 70 parts by weight of methyl ethyl ketone for 5 days.

The above prepared dispersion of the disazo pigment was added to a solution consisting of 100 parts by weight of Z type polycarbonate with a molecular weight of 60,000, 300 parts by weight of tetrahydrofuran, 80 parts by weight of 4-diethylaminobenzaldehyde-1-benzyl-1-phenylhydrazone serving as the charge transporting material, and 0.1 parts by weight of a commercially available silicone oil (Trademark "KF-50", made by Shin-Etsu Chemical Co., Ltd.). Thus, a coating liquid for a photoconductive layer was obtained.

The thus obtained photoconductive layer coating liquid was coated on an aluminum plate (Trademark "A1080", made by Sumitomo Light Metal Industries, Ltd.) with a thickness of 0.2 mm by blade coating, dried at 150° C. for 20 minutes, so that a photoconductive layer with a thickness of 20 μm was formed on the electroconductive support.

Thus, a comparative electrophotographic photoconductor No. I-1 was obtained.

COMPARATIVE EXAMPLE I-2

A trisazo pigment of formula (2) in which $R^3$ is hydrogen was prepared using the coupler No. 70 shown in TABLE 2.

Ten parts by weight of the trisazo pigment were dispersed in a ball mill together with 70 parts by weight of methyl ethyl ketone for 5 days.

The above prepared dispersion of the trisazo pigment was added to a solution consisting of 100 parts by weight of Z type polycarbonate with a molecular weight of 60,000, 300 parts by weight of tetrahydrofuran, 80 parts by weight of 4-diethylaminobenzaldehyde-1-benzyl-1-phenylhydrazone serving as the charge transporting material, and 0.1 parts by weight of a commercially available silicone oil (Trademark "KF-50", made by Shin-Etsu Chemical Co., Ltd.). Thus, a coating liquid for a photoconductive layer was obtained.

The thus obtained photoconductive layer coating liquid was coated on an aluminum plate (Trademark "A1080", made by Sumitomo Light Metal Industries, Ltd.) with a thickness of 0.2 mm by blade coating, dried at 150° C. for 20 minutes, so that a photoconductive layer with a thickness of 20 μm was formed on the electroconductive support.

Thus, a comparative electrophotographic photoconductor No. I-2 was obtained.

COMPARATIVE EXAMPLE I-3

An unsymmetrical disazo pigment of formula (1) in which $R^1$ and $R^2$ are hydrogen was prepared using the couplers No. 17 and No. 24 shown in TABLE 1. A trisazo pigment of formula (2) in which $R^3$ is hydrogen was prepared using the coupler No. 70 shown in TABLE 2.

Five parts by weight of the disazo pigment and 5 parts by weight of the trisazo pigment were separately dispersed in a ball mill with 35 parts by weight of methyl ethyl ketone for 5 days. Then, the dispersion of the disazo pigment and the dispersion of the trisazo pigment were mixed.

The above prepared mixture was added to a solution consisting of 100 parts by weight of Z type polycarbonate with a molecular weight of 60,000, 300 parts by weight of tetrahydrofuran, 80 parts by weight of 4-diethylaminobenzaldehyde-1-benzyl-1-phenylhydrazone serving as the charge transporting material, and 0.1 parts by weight of a commercially available silicone oil (Trademark "KF-50", made by Shin-Etsu Chemical Co., Ltd.). Thus, a coating liquid for a photoconductive layer was obtained.

The thus obtained photoconductive layer coating liquid was coated on an aluminum plate (Trademark "A1080", made by Sumitomo Light Metal Industries, Ltd.) with a thickness of 0.2 mm by blade coating, dried at 150° C. for 20 minutes, so that a photoconductive layer with a thickness of 20 μm was formed on the electroconductive support.

Thus, a comparative electrophotographic photoconductor No. I-3 was obtained.

The dynamic electrostatic properties of each of the electrophotographic photoconductors No. I-1 to No. I-17 according to the present invention and the comparative electrophotographic photoconductors No. I-1 to No. I-3 were measured by using a commercially available test apparatus (Trademark "EPA-8100", made by Kawaguchi Electro Works Co., Ltd.) under the circumstances of 25° C. and 50% RH.

More specifically, each photoconductor was charged positively in the dark under application of +6 kV for 10 seconds. Then, each photoconductor was allowed to stand in the dark for 20 seconds without applying any charge thereto. After that, the photoconductor was illuminated by white light of a halogen lamp in such a manner that the illuminance on the illuminated surface of the photoconductor was 10 lux. Similarly, the photoconductor was illuminated by a 780 nm-monochromatic light in such a manner that the illuminance on the illuminated surface of the photoconductor was 10 $\mu W/cm^2$ after charging and dark decay.

The charging potential was expressed by a surface potential $V_2$ (V), which was obtained two seconds after the initiation of charging; the photosensitivity was expressed by an exposure $E_{1/2}$ (lux·sec) required to reduce the surface potential obtained just before the exposure by the application of the white light to ½ the surface potential, and an exposure $E_{1/2}$ ($\mu J/cm^2$) required to reduce the surface potential obtained just before the exposure by the application of the monochromatic light to ½ the surface potential; and the residual potential was expressed by a surface potential $V_{30}$ (V) separately obtained after the exposure for 30 seconds by use of the white light and the monochromatic light.

The results are shown in TABLE 48.

TABLE 48

| | Disazo Coupler No. | Trisazo Coupler No. | Azo Pigments/ Binder Resin Ratio | Charge Trans-porting Material | Charge Trans-porting Material/ Binder Resin Ratio | $V_2$ V | $E_{1/2}$ (white) lux · sec | $V_{30}$ (white) V | $E_{1/2}$ (mono-chomatic) μJ/cm$^2$ | $V_{30}$ (mono-chromatic) V | Solvent for dispersing pigments |
|---|---|---|---|---|---|---|---|---|---|---|---|
| Ex. I-1 | 17, 24 | 70 | 1/10 | * | 8/10 | 620 | 0.80 | 35 | 0.35 | 30 | Methyl ethyl ketone |
| Ex. I-2 | 30 | 70 | 1/10 | * | 8/10 | 680 | 0.93 | 30 | 0.40 | 30 | Methyl ethyl ketone |
| Ex. I-3 | 17, 24 | 214 | 1/10 | * | 8/10 | 620 | 1.02 | 30 | 0.40 | 30 | Methyl ethyl ketone |
| Ex. I-4 | 17 | 70 | 1/10 | * | 8/10 | 610 | 0.91 | 35 | 0.41 | 40 | Methyl ethyl ketone |
| Ex. I-5 | 17, 24 | 3 | 1/10 | * | 8/10 | 650 | 1.31 | 50 | 0.78 | 120 | Methyl ethyl ketone |
| Ex. I-6 | 17, 24 | 70 | 0.008/10 | * | 8/10 | 660 | 0.85 | 70 | 0.40 | 80 | Methyl ethyl ketone |
| Ex. I-7 | 17, 24 | 70 | 0.01/10 | * | 8/10 | 630 | 0.81 | 50 | 0.37 | 40 | Methyl ethyl ketone |
| Ex. I-8 | 17, 24 | 70 | 10/10 | * | 8/10 | 630 | 0.81 | 10 | 0.36 | 15 | Methyl ethyl ketone |
| Ex. I-9 | 17, 24 | 70 | 15/10 | * | 8/10 | 500 | 0.83 | 5 | 0.35 | 5 | Methyl ethyl ketone |
| Ex. I-10 | 17, 24 | 70 | 1/10 | * | 0.5/10 | 680 | 0.90 | 40 | 0.41 | 35 | Methyl ethyl ketone |
| Ex. I-11 | 17, 24 | 70 | 1/10 | * | 1/10 | 620 | 0.83 | 35 | 0.35 | 30 | Methyl ethyl ketone |
| Ex. I-12 | 17, 24 | 70 | 1/10 | * | 15/10 | 620 | 0.80 | 35 | 0.35 | 30 | Methyl ethyl ketone |
| Ex. I-13 | 17, 24 | 70 | 1/10 | * | 20/10 | 510 | 0.80 | 30 | 0.31 | 30 | Methyl ethyl ketone |
| Ex. I-14 | 17, 24 | 70 | 1/10 | * | 8/10 | 530 | 0.70 | 30 | 0.32 | 35 | Dioxane |
| Ex. I-15 | 17, 24 | 70 | 1/10 | * | 8/10 | 620 | 0.75 | 30 | 0.32 | 35 | Isophorone |
| Ex. I-16 | 17, 24 | 70 | 1/10 | * | 8/10 | 620 | 0.52 | 30 | 0.28 | 30 | Tetrahydro-furan |
| Ex. 1-17 | 17, 24 | 70 | 1/10 | * | 8/10 | 610 | 0.50 | 30 | 0.28 | 30 | Cyclohexanone |
| Comp. Ex. I-1 | 17, 24 | — | 1/10 | * | 8/10 | 610 | 1.10 | 35 | 3.00 | 40 | Methyl ethyl ketone |
| Comp. Ex. I-2 | — | 70 | 1/10 | * | 8/10 | 650 | 0.80 | 35 | No sensitivity | — | Methyl ethyl ketone |
| Comp. Ex. I-3 | 17, 24 | 70 | 1/10 | * | 8/10 | 620 | 1.50 | 40 | 1.32 | 40 | Methyl ethyl ketone |

*4-diethylaminobenzaldehyde-1-benzyl-1-phenylhydrazone

EXAMPLES I-18 TO I-38

The procedure for preparation of the electrophotographic photoconductor No. I-1 in Example I-1 was repeated except that the charge transporting material, 4-diethylaminobenzaldehyde-1-benzyl-1-phenylhydrazone, used in the photoconductive layer coating liquid in Example I-1 was replaced by the respective charge transporting materials as shown in TABLE 49.

Thus, electrophotographic photoconductors No. I-18 to No. I-38 according to the present invention were obtained.

The oxidation potential of each charge transporting material is also shown in TABLE 49.

TABLE 49

| | Charge Transporting Material | Oxidation Potential [V (vs SCE)] |
|---|---|---|
| Ex. I-18 | 9-ethylcarbazole-3-aldehyde-1-methyl-1-phenylhydrazone | 0.74 |
| Ex. I-19 | 9-ethylcarbazole-3-aldehyde-1-benzyl-1-phenylhydrazone | 0.81 |
| Ex. I-20 | 2-methoxynaphthalene-1-aldehyde-1-benzyl-1-phenylhydrazone | 0.79 |
| Ex. I-21 | 2,2'-dimethyl-4,4'-bis(diethylamino)-triphenylmethane | 0.66 |
| Ex. I-22 | 9-(4-diethylaminostyryl)anthracene | 0.52 |
| Ex. I-23 | 3-(4-ethoxystyryl)-9-ethylcarbazole | 0.76 |
| Ex. I-24 | 4-diphenylaminostilbene | 0.89 |
| Ex. I-25 | 4'-diphenylamino-α-phenylstilbene | 0.86 |
| Ex. I-26 | 4'-bis(4-methylphenyl)amino-α-phenyl-stilbene | 0.76 |
| Ex. I-27 | 4'-(4-methoxy)diphenylamino-α-phenyl-stilbene | 0.74 |
| Ex. I-28 | N,N'-diphenyl-N,N'-bis(3-methyl-phenyl)-[1,1'-biphenyl]-4,4'-diamine | 0.73 |
| Ex. I-29 | 4'-methoxy-N,N'-bis(4-methylphenyl)-[1,1'-biphenyl]-4-amine | 0.76 |
| Ex. I-30 | N,N'-bis(4-methylphenyl)-[1,1'-biphenyl]-4-amine | 0.81 |
| Ex. I-31 | 1-di(p-tolylamino)pyrene | 0.81 |
| Ex. I-32 | 1,4-bis[4-di(p-tolyl)aminostyryl]-benzene | 0.89 |
| Ex. I-33 | 4,4',4"-trimethoxytriphenylamine | 0.52 |

TABLE 49-continued

| | Charge Transporting Material | Oxidation Potential [V (vs SCE)] |
|---|---|---|
| Ex. I-34 | 4-methoxytriphenylamine | 0.77 |
| Ex. I-35 | 4,4'-dimethyltriphenylamine | 0.84 |
| Ex. I-36 | N-ethyl-3,6-tetrabenzylaminocarbazole | 0.31 |
| Ex. I-37 | 1-phenyl-3-(4-diethylaminostyryl)-5-(4-diethylaminophenyl)pyrazoline | 0.47 |
| Ex. I-38 | 1,3-diphenyl-5-(4-dimethylamino-phenyl)pyrazoline | 0.67 |

The dynamic electrostatic properties of each of the electrophotographic photoconductors No. I-1 and Nos. I-18 to I-38 according to the present invention were measured by using a commercially available test apparatus (Trademark "EPA-8100", made by Kawaguchi Electro Works Co., Ltd.) under the circumstances of 25° C. and 50% RH.

More specifically, each photoconductor was charged positively in the dark under application of +6 kV for 10 seconds. Then, each photoconductor was allowed to stand in the dark for 20 seconds without applying any charge thereto. After that, the photoconductor was illuminated by white light of a halogen lamp in such a manner that the illuminance on the illuminated surface of the photoconductor was 10 lux.

The charging potential was expressed by a saturated surface potential Vm (V), which was obtained in the charging time of ten seconds; and the photosensitivity was expressed by an exposure $E_{1/2}$ (lux·sec) required to reduce the surface potential obtained just before the exposure to ½ the surface potential. The results are shown in TABLE 50.

Figure 5:
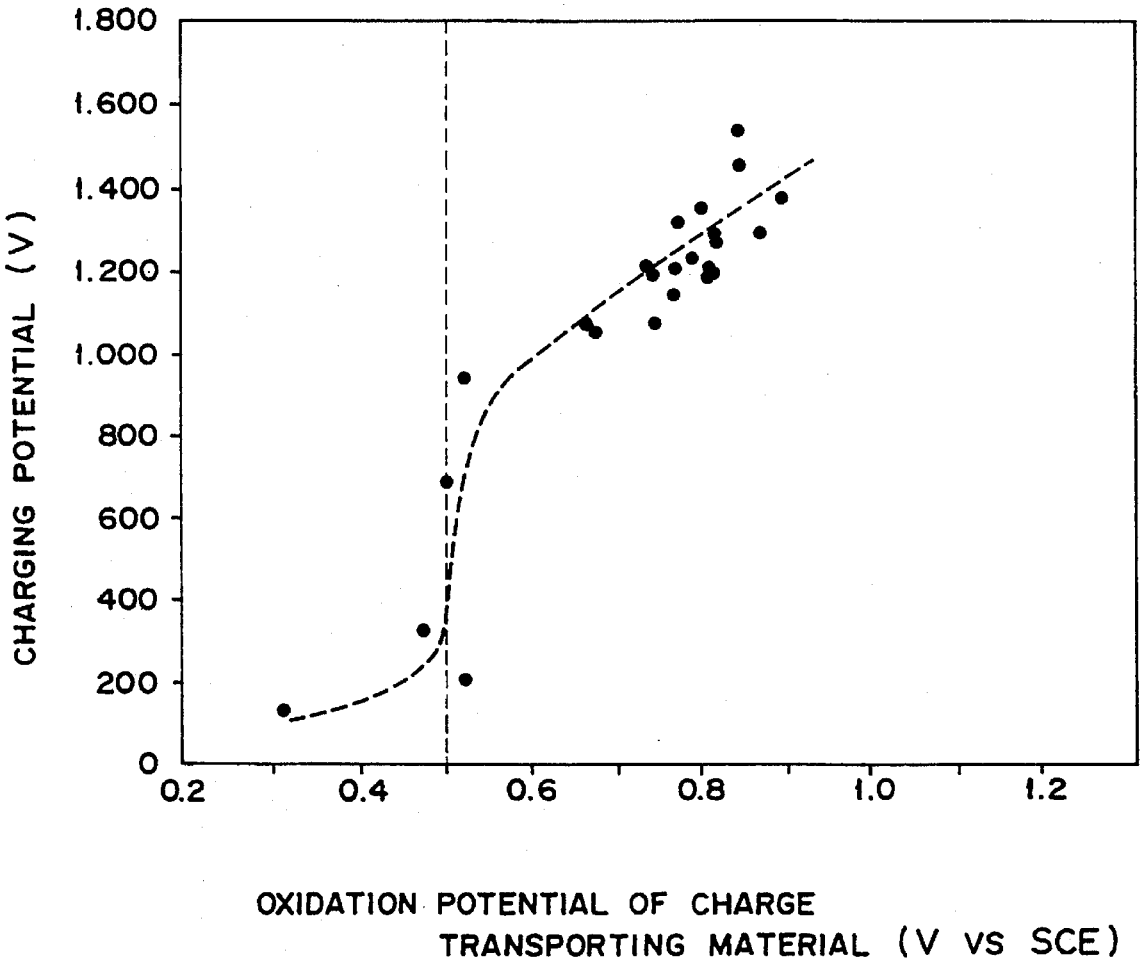
FIG. 5 is a graph which shows the relationship between the oxidation potential of a charge transporting material to be employed and the charging potential of the obtained photoconductor.

Further, the saturated surface potential Vm (V) was plotted as a function of the oxidation potential of the charge transporting material as shown in FIG. 5.

TABLE 50

| | Vm (V) | $E_{1/2}$ (lux · sec) |
|---|---|---|
| Example I-1 | 700 | 0.80 |
| Example I-18 | 1070 | 0.83 |
| Example I-19 | 1290 | 0.75 |
| Example I-20 | 1400 | 1.02 |
| Example I-21 | 1080 | 0.88 |
| Example I-22 | 950 | 0.89 |
| Example I-23 | 1330 | 1.10 |
| Example I-24 | 1380 | 0.70 |
| Example I-25 | 1300 | 0.72 |
| Example I-26 | 1210 | 0.66 |
| Example I-27 | 1190 | 0.64 |
| Example I-28 | 1210 | 0.55 |
| Example I-29 | 1150 | 0.73 |
| Example I-30 | 1270 | 0.75 |
| Example I-31 | 1200 | 0.67 |
| Example I-32 | 1530 | 0.73 |
| Example I-33 | 300 | 1.48 |
| Example I-34 | 1320 | 1.38 |
| Example I-35 | 1450 | 4.00 |
| Example I-36 | 130 | 1.30 |
| Example I-37 | 330 | 1.20 |
| Example I-38 | 1350 | 1.46 |

To evaluate the stability of the electrostatic properties of the photoconductor, using the electrophotographic photoconductors No. I-1, No. I-20 and No. I-28 according to the present invention, the saturated surface potential Vm (V) and the exposure $E_{1/2}$ (lux·sec) were measured in the same manner as described above after fatigue of making of 5,000 copies.

The results are shown in TABLE 51.

TABLE 51

| | Vm (V) after fatigue | $E_{1/2}$ (lux · sec) after fatigue |
|---|---|---|
| Example I-1 | 480 | 1.01 |
| Example I-20 | 1150 | 0.98 |
| Example I-28 | 840 | 0.49 |

As is apparent from the above results, the charging characteristics of the photoconductor are excellent when the oxidation potential of the charge transporting material for use in the photoconductor is +0.5 V (vs SCE) or more.

In addition, the electrophotographic photoconductors Nos. I-18 to I-32 employing the charge transporting materials of formulas (14), (15), (17), (19), (22), (23), (24), (28), (29), (30) and (31) show excellent charging characteristics and advantageous photosensitivity.

Furthermore, the charging stability of the electrophotographic photoconductor No. I-21 according to the present invention employing the charge transporting material of formula (17) is excellent even after the repeated operations.

COMPARATIVE EXAMPLE I-4

An unsymmetrical disazo pigment of formula (1) in which $R^1$ and $R^2$ are hydrogen was prepared using the couplers No. 17 and No. 24 shown in TABLE 1. A trisazo pigment of formula (2) in which $R^3$ is hydrogen was prepared using the coupler No. 70 shown in TABLE 2.

Five parts by weight of the disazo pigment and 5 parts by weight of the trisazo pigment were dispersed in a ball mill together with 70 parts by weight of cyclohexanone for 5 days, and further diluted with 420 parts by weight of cyclohexanone. Thus, a coating liquid for a charge generation layer was obtained.

The thus obtained charge generation layer coating liquid was coated on an aluminum plate (Trademark "A1080", made by Sumitomo Light Metal Industries, Ltd.) with a thickness of 0.2 mm by blade coating, dried at 100° C. for 10 minutes, so that a charge generation layer with a thickness of 0.3 μm was formed on the electroconductive support.

A mixture of 100 parts by weight of Z type polycarbonate with a molecular weight of 60,000, 80 parts by weight of 4-diethylaminobenzaldehyde-1-benzyl-1-phenylhydrazone serving as the charge transporting material, and 0.1 parts by weight of a commercially available silicone oil (Trademark "KF-50", made by Shin-Etsu Chemical Co., Ltd.) was dissolved in 300 parts by weight of dichloromethane. Thus, a coating liquid for a charge transport layer was obtained.

The above obtained charge transport layer coating liquid was coated on the charge generation layer by blade coating, and dried at 150° C. for 20 minutes, so that a charge transport layer with a thickness of 20 μm was formed on the charge generation layer.

Thus, a comparative electrophotographic photoconductor No. I-4 of laminated type was obtained.

The spectral sensitivities of the comparative photoconductor No. I-4 of laminated type and the electrophotographic photoconductor No. I-17 according to the present invention were measured by the following method: The comparative photoconductor No. I-4 and the photoconductor No. I-17 according to the present invention were respectively charged to −600 V and +600 V. The monochromatic light was taken out of the lights ranging from 900 to 400 nm by 20 nm using a commercially available monochromator, made by Nikon Corporation, and applied to each photoconductor. The exposure to reduce the surface potential just before the exposure to ½ the surface potential was measured as changing the wavelength of the monochromatic light used for the exposure, and the spectral sensitivities ($V \cdot cm^2/\mu J$) were calculated from the exposures. The results are shown in FIG. 6.

Figure 6:
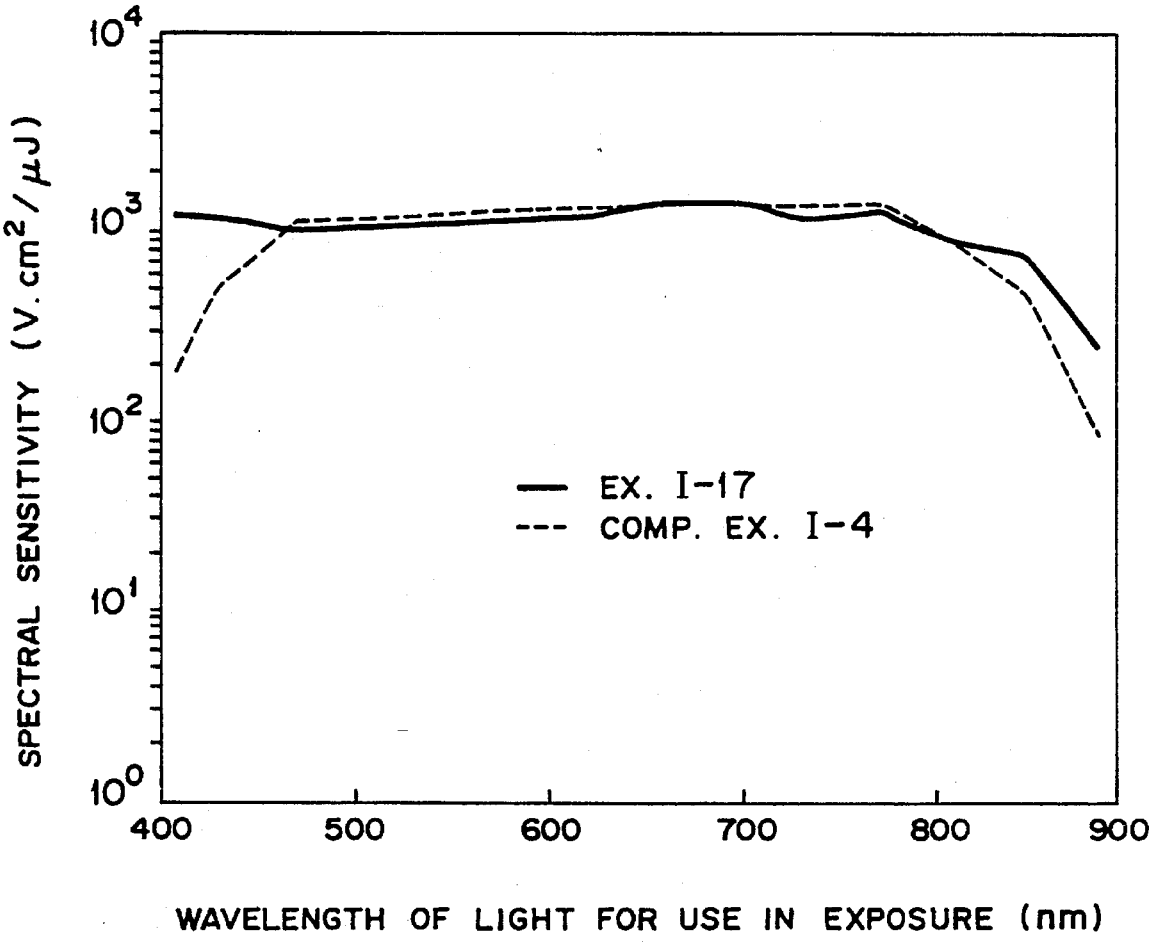
FIG. 6 is a graph which shows the spectral sensitivities of a comparative photoconductor and a photoconductor according to the present invention.

As is apparent from the graph in FIG. 6, the spectral sensitivity of the electrophotographic photoconductor No. I-17 according to the present invention is remarkably stable in a broad wave range from the light of a high wavelength extending to the light of a low wavelength, as compared with the comparative laminated electrophotographic photoconductor No. I-4.

EXAMPLE II-1

An unsymmetrical disazo pigment of formula (1) in which $R^1$ and $R^2$ are hydrogen was prepared using the couplers No. 17 and No. 24 shown in TABLE 1. A trisazo pigment of formula (2) in which $R^3$ is hydrogen was prepared using the coupler No. 70 shown in TABLE 2.

Five parts by weight of the disazo pigment and 5 parts by weight of the trisazo pigment were dispersed in a ball mill together with 70 parts by weight of tetrahydrofuran for 5 days, and simultaneously pulverized.

The above prepared mixture was added to a solution consisting of 100 parts by weight of Z type polycarbonate with a molecular weight of 60,000, 300 parts by weight of tetrahydrofuran, 50 parts by weight a stilbene compound serving as the organic positive hole transporting material of the following formula (a);

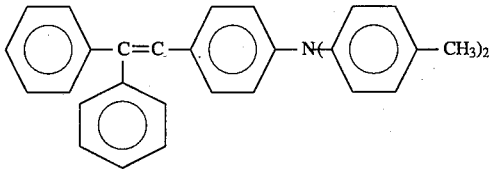

(a)

20 parts by weight of an organic acceptor compound of the following formula (b);

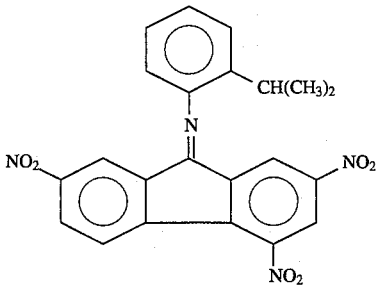

(b)

and 0.1 parts by weight of a commercially available silicone oil (Trademark "KF-50", made by Shin-Etsu Chemical Co., Ltd.). Thus, a coating liquid for a photoconductive layer was obtained.

The thus obtained photoconductive layer coating liquid was coated on an aluminum plate (Trademark "A1080", made by Sumitomo Light Metal Industries, Ltd.) with a thickness of 0.2 mm by blade coating, dried at 150° C. for 20 minutes, so that a photoconductive layer with a thickness of 20 μm was formed on the electroconductive support.

Thus, an electrophotographic photoconductor No. II-1 according to the present invention was obtained.

EXAMPLE II-2

The procedure for preparation of the electrophotographic photoconductor No. II-1 in Example II-1 was repeated except that the unsymmetrical disazo pigment for use in the photoconductive layer coating liquid in Example II-1 was replaced by a disazo pigment of formula (1) ($R^1$=$R^2$=hydrogen) which was prepared using the coupler No. 30 shown in TABLE 1.

Thus, an electrophotographic photoconductor No. II-2 according to the present invention was obtained.

EXAMPLE II-3

The procedure for preparation of the electrophotographic photoconductor No. II-1 in Example II-1 was repeated except that the trisazo pigment for use in the photoconductive layer coating liquid in Example II-1 was replaced by a trisazo pigment of formula (2) ($R^3$=hydrogen) which was prepared using the coupler No. 214 shown in TABLE 13.

Thus, an electrophotographic photoconductor No. II-3 according to the present invention was obtained.

EXAMPLE II-4

The procedure for preparation of the electrophotographic photoconductor No. II-1 in Example II-1 was repeated except that the unsymmetrical disazo pigment for use in the photoconductive layer coating liquid in Example II-1 was replaced by a symmetrical disazo pigment of formula (1) ($R^1$=$R^2$=hydrogen) which was prepared using the coupler No. 17 shown in TABLE 1.

Thus, an electrophotographic photoconductor No. II-4 according to the present invention was obtained.

EXAMPLE II-5

The procedure for preparation of the electrophotographic photoconductor No. II-1 in Example II-1 was repeated except that the trisazo pigment for use in the photoconductive layer coating liquid in Example II-1 was replaced by a trisazo pigment of formula (2) ($R^3$=hydrogen) which was prepared using the coupler No. 3 shown in TABLE 1.

Thus, an electrophotographic photoconductor No. II-5 according to the present invention was obtained.

EXAMPLE II-6

The procedure for preparation of the electrophotographic photoconductor No. II-1 in Example II-1 was repeated except that the amount of the unsymmetrical disazo pigment and that of the trisazo pigment for use in the photoconductive layer coating liquid in Example II-1 were separately changed to 0.04 parts by weight.

Thus, an electrophotographic photoconductor No. II-6 according to the present invention was obtained.

EXAMPLE II-7

The procedure for preparation of the electrophotographic photoconductor No. II-1 in Example II-1 was repeated except that the amount of the unsymmetrical disazo pigment and that of the trisazo pigment for use in the photoconductive layer coating liquid in Example II-1 were separately changed to 0.05 parts by weight.

Thus, an electrophotographic photoconductor No. II-7 according to the present invention was obtained.

EXAMPLE II-8

The procedure for preparation of the electrophotographic photoconductor No. II-1 in Example II-1 was repeated except that the amount of the unsymmetrical disazo pigment and that of the trisazo pigment for use in the photoconductive layer coating liquid in Example II-1 were separately changed to 50 parts by weight.

Thus, an electrophotographic photoconductor No. II-8 according to the present invention was obtained.

EXAMPLE II-9

The procedure for preparation of the electrophotographic photoconductor No. II-1 in Example II-1 was repeated except that the amount of the unsymmetrical disazo pigment and that of the trisazo pigment for use in the photoconductive layer coating liquid in Example II-1 were separately changed to 75 parts by weight.

Thus, an electrophotographic photoconductor No. II-9 according to the present invention was obtained.

EXAMPLE II-10

The procedure for preparation of the electrophotographic photoconductor No. II-1 in Example II-1 was repeated except that the amount of the organic acceptor compound for use in the photoconductive layer coating liquid in Example II-1 was changed to 5 parts by weight.

Thus, an electrophotographic photoconductor No. II-10 according to the present invention was obtained.

EXAMPLE II-11

The procedure for preparation of the electrophotographic photoconductor No. II-1 in Example II-1 was repeated except that the amount of the organic acceptor compound for use in the photoconductive layer coating liquid in Example II-1 was changed to 10 parts by weight.

Thus, an electrophotographic photoconductor No. II-11 according to the present invention was obtained.

EXAMPLE II-12

The procedure for preparation of the electrophotographic photoconductor No. II-1 in Example II-1 was repeated except that the amount of the organic acceptor compound for use in the photoconductive layer coating liquid in Example II-1 was changed to 150 parts by weight.

Thus, an electrophotographic photoconductor No. II-12 according to the present invention was obtained.

EXAMPLE II-13

The procedure for preparation of the electrophotographic photoconductor No. II-1 in Example II-1 was repeated except that the amount of the organic acceptor compound for use in the photoconductive layer coating liquid in Example II-1 was changed to 200 parts by weight.

Thus, an electrophotographic photoconductor No. II-13 according to the present invention was obtained.

EXAMPLES II-14 TO II-27

The procedure for preparation of the electrophotographic photoconductor No. II-1 in Example II-1 was repeated except that the organic acceptor compound for use in the photoconductive layer coating liquid in Example II-1 was replaced by the respective organic acceptor compounds as shown in TABLE 52.

Thus, electrophotographic photoconductors Nos. II-14 to II-27 according to the present invention were obtained.

The dynamic electrostatic properties of each of the electrophotographic photoconductors No. II-1 to No. II-27 according to the present invention were measured by using a commercially available test apparatus (Trademark "EPA-8100", made by Kawaguchi Electro Works Co., Ltd.) under the circumstances of 25° C. and 50% RH.

More specifically, each photoconductor was charged positively in the dark under application of +6 kV for 10 seconds. Then, each photoconductor was allowed to stand in the dark for 20 seconds without applying any charge thereto. After that, the photoconductor was illuminated by a 780 nm-monochromatic light in such a manner that the illuminated surface of the photoconductor was 10 $\mu W/cm^2$.

The surface potential $V_s$ (V) which was obtained ten seconds after the initiation of charging; the surface potential $V_o$ (V) which was obtained after the dark decay; and the exposure $E_{1/2}$ ($\mu J/cm^2$) required to reduce the surface potential $V_o$ to ½ the surface potential $V_o$ were measured. In addition, to evaluate the charging characteristics after the repeated electrophotographic processes, the surface potentials $V_s$ and $V_o$, and the exposure $E_{1/2}$ were measured after making of 5,000 copies.

The results are shown in TABLE 52.

TABLE 52

| | Disazo Coupler No. | Trisazo Coupler No. | Azo Pigments/ Binder Resin Ratio | Acceptor Compound/ Binder Resin Ratio | Acceptor Compound No. | Initial Stage | | | After making 5000 copies | | |
|---|---|---|---|---|---|---|---|---|---|---|---|
| | | | | | | $V_s$ (V) | $V_0$ (V) | $E_{1/2}$ ($\mu J/cm^2$) | $V_s$ (V) | $V_0$ (V) | $E_{1/2}$ ($\mu J/cm^2$) |
| Ex. II-1 | 17, 24 | 70 | 1/10 | 2/10 | (b) | 1530 | 1150 | 0.52 | 1510 | 1110 | 0.54 |
| Ex. II-2 | 30 | 70 | 1/10 | 2/10 | (b) | 1510 | 1120 | 0.60 | 1500 | 1080 | 0.60 |
| Ex. II-3 | 17, 24 | 214 | 1/10 | 2/10 | (b) | 1480 | 1090 | 0.55 | 1450 | 1080 | 0.56 |
| Ex. II-4 | 17 | 70 | 1/10 | 2/10 | (b) | 1500 | 1140 | 0.68 | 1480 | 1110 | 0.69 |
| Ex. II-5 | 17, 24 | 3 | 1/10 | 2/10 | (b) | 1610 | 1220 | 0.63 | 1590 | 1190 | 0.63 |
| Ex. II-6 | 17, 24 | 70 | 0.008/10 | 2/10 | (b) | 1780 | 1330 | 0.85 | 1760 | 1280 | 0.87 |
| Ex. II-7 | 17, 24 | 70 | 0.01/10 | 2/10 | (b) | 1750 | 1270 | 0.71 | 1710 | 1230 | 0.71 |
| Ex. II-8 | 17, 24 | 70 | 10/10 | 2/10 | (b) | 1300 | 1020 | 0.48 | 1280 | 990 | 0.48 |
| Ex. II-9 | 17, 24 | 70 | 15/10 | 2/10 | (b) | 1140 | 830 | 0.45 | 1130 | 810 | 0.45 |
| Ex. II-10 | 17, 24 | 70 | 1/10 | 0.5/10 | (b) | 1520 | 1130 | 0.43 | 1300 | 980 | 0.52 |
| Ex. II-11 | 17, 24 | 70 | 1/10 | 1/10 | (b) | 1490 | 1080 | 0 .47 | 1470 | 1020 | 0.51 |
| Ex. II-12 | 17, 24 | 70 | 1/10 | 15/10 | (b) | 1380 | 1050 | 0.80 | 1380 | 1040 | 0.80 |
| Ex. II-13 | 17, 24 | 70 | 1/10 | 20/10 | (b) | 1310 | 990 | 1.25 | 1300 | 990 | 1.23 |

TABLE 52-continued

| | Disazo Coupler No. | Trisazo Coupler No. | Azo Pigments/ Binder Resin Ratio | Acceptor Compound/ Binder Resin Ratio | Acceptor Compound No. | Initial Stage $V_s$ (V) | Initial Stage $V_0$ (V) | Initial Stage $E_{1/2}$ (μJ/cm²) | After making 5000 copies $V_s$ (V) | After making 5000 copies $V_0$ (V) | After making 5000 copies $E_{1/2}$ (μJ/cm²) |
|---|---|---|---|---|---|---|---|---|---|---|---|
| Ex. II-14 | 17, 24 | 70 | 1/10 | 2/10 | (1)-18 (TABLE 17) | 1550 | 1160 | 0.65 | 1510 | 1120 | 0.60 |
| Ex. II-15 | 17, 24 | 70 | 1/10 | 2/10 | (2)-74 (TABLE 18) | 1490 | 1100 | 0.56 | 1440 | 1080 | 0.55 |
| Ex. II-16 | 17, 24 | 70 | 1/10 | 2/10 | (3)-152 (TABLE 19) | 1350 | 1070 | 0.53 | 1330 | 1070 | 0.53 |
| Ex. II-17 | 17, 24 | 70 | 1/10 | 2/10 | (4)-1 (TABLE 20) | 1510 | 1170 | 0.66 | 1470 | 1090 | 0.68 |
| Ex. II-18 | 17, 24 | 70 | 1/10 | 2110 | (5)-22 (TABLE 21) | 1330 | 1010 | 0.57 | 1310 | 990 | 0.62 |
| Ex. II-19 | 17, 24 | 70 | 1/10 | 2/10 | (6)-5 (TABLE 22) | 1450 | 1220 | 0.71 | 1410 | 1180 | 0.73 |
| Ex. II-20 | 17, 24 | 70 | 1/10 | 2/10 | (7)-10 (TABLE 23) | 1530 | 1190 | 0.63 | 1520 | 1170 | 0.69 |
| Ex. II-21 | 17, 24 | 70 | 1/10 | 2/10 | (8)-83 (TABLE 24) | 1490 | 1280 | 0.66 | 1420 | 1250 | 0.59 |
| Ex. II-22 | 17, 24 | 70 | 1/10 | 2/10 | (9)-102 (TABLE 25) | 1590 | 1230 | 0.51 | 1550 | 1200 | 0.62 |
| Ex. II-23 | 17, 24 | 70 | 1/10 | 2/10 | (10)-6 (TABLE 26) | 1680 | 1390 | 0.70 | 1650 | 1370 | 0.76 |
| Ex. II-24 | 17, 24 | 70 | 1/10 | 2/10 | (11)-2 (TABLE 27) | 1620 | 1400 | 0.62 | 1580 | 1330 | 0.66 |
| Ex. II-25 | 17, 24 | 70 | 1/10 | 2/10 | (12)-5 (TABLE 28) | 1610 | 1330 | 0.58 | 1580 | 1290 | 0.64 |
| Ex. II-26 | 17, 24 | 70 | 1/10 | 2/10 | (13)-13 (TABLE 29) | 1630 | 1370 | 0.61 | 1590 | 1360 | 0.73 |
| Ex. II-27 | 17, 24 | 70 | 1/10 | 2/10 | (14)-27 (TABLE 30) | 1510 | 1200 | 0.54 | 1480 | 1150 | 0.63 |

As previously explained, the electrophotographic photoconductors according to the present invention exhibit high photosensitivity in a broad wave range from the visible region extending to the near infrared region, and excellent charging stability when the single-layered photoconductive layer comprises a simultaneously pulverized mixture comprising the disazo pigment of formula (1) and the trisazo pigment of formula (2), the organic positive hole transporting material, the organic acceptor compound, and the binder resin.

EXAMPLE III-1

An unsymmetrical disazo pigment of formula (1) in which $R^1$ and $R^2$ are hydrogen was prepared using the couplers No. 17 and No. 24 shown in TABLE 1. A trisazo pigment of formula (2) in which $R^3$ is hydrogen was prepared using the coupler No. 70 shown in TABLE 2.

Five parts by weight of the disazo pigment and 5 parts by weight of the trisazo pigment were dispersed in a ball mill together with 70 parts by weight of tetrahydrofuran for 5 days, and simultaneously pulverized.

The above prepared mixture was added to a solution consisting of 100 parts by weight of Z type polycarbonate with a molecular weight of 60,000, 300 parts by weight of tetrahydrofuran, 50 parts by weight a stilbene compound serving as an organic positive hole transporting material of the following formula (a);

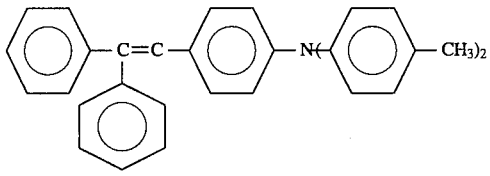

(a)

20 parts by weight of an organic acceptor compound No. B-2 in TABLE 32, and 0.1 parts by weight of a commercially available silicone oil (Trademark "KF-50", made by Shin-Etsu Chemical Co., Ltd.). Thus, a coating liquid for a photoconductive layer was obtained.

The thus obtained photoconductive layer coating liquid was coated on an aluminum plate (Trademark "A1080", made by Sumitomo Light Metal Industries, Ltd.) with a thickness of 0.2 mm by blade coating, dried at 150° C. for 20 minutes, so that a photoconductive layer with a thickness of 20 μm was formed on the electroconductive support.

Thus, an electrophotographic photoconductor No. III-1 according to the present invention was obtained.

EXAMPLE III-2

The procedure for preparation of the electrophotographic photoconductor No. III-1 in Example III-1 was repeated except that the unsymmetrical disazo pigment for use in the photoconductive layer coating liquid in Example III-1 was replaced by a disazo pigment of formula (1) ($R^1$=$R^2$= hydrogen) which was prepared using the coupler No. 30 shown in TABLE 1.

Thus, an electrophotographic photoconductor No. III-2 according to the present invention was obtained.

EXAMPLE III-3

The procedure for preparation of the electrophotographic photoconductor No. III-1 in Example III-1 was repeated except that the trisazo pigment for use in the photoconductive layer coating liquid in Example III-1 was replaced by a trisazo pigment of formula (2) ($R^3$=hydrogen) which was prepared using the coupler No. 214 shown in TABLE 13.

Thus, an electrophotographic photoconductor No. III-3 according to the present invention was obtained.

EXAMPLE III-4

The procedure for preparation of the electrophotographic photoconductor No. III-1 in Example III-1 was repeated except that the unsymmetrical disazo pigment for use in the photoconductive layer coating liquid in Example III-1 was replaced by a disazo pigment of formula (1) ($R^1$=$R^2$=hydrogen) which was prepared using the coupler No. 17 shown in TABLE 1.

Thus, an electrophotographic photoconductor No. III-4 according to the present invention was obtained.

EXAMPLE III-5

The procedure for preparation of the electrophotographic photoconductor No. III-1 in Example III-1 was repeated except that the trisazo pigment for use in the photoconductive layer coating liquid in Example III-1 was replaced by a trisazo pigment of formula (2) ($R^3$=hydrogen) which was prepared using the coupler No. 3 shown in TABLE 1.

Thus, an electrophotographic photoconductor No. III-5 according to the present invention was obtained.

EXAMPLE III-6

The procedure for preparation of the electrophotographic photoconductor No. III-1 in Example III-1 was repeated except that the amount of the unsymmetrical disazo pigment and that of the trisazo pigment for use in the photoconductive layer coating liquid in Example III-1 were separately changed to 0.04 parts by weight.

Thus, an electrophotographic photoconductor No. III-6 according to the present invention was obtained.

EXAMPLE III-7

The procedure for preparation of the electrophotographic photoconductor No. III-1 in Example III-1 was repeated except that the amount of the unsymmetrical disazo pigment and that of the trisazo pigment for use in the photoconductive layer coating liquid in Example III-1 were separately changed to 0.05 parts by weight.

Thus, an electrophotographic photoconductor No. III-7 according to the present invention was obtained.

EXAMPLE III-8

The procedure for preparation of the electrophotographic photoconductor No. III-1 in Example III-1 was repeated except that the amount of the unsymmetrical disazo pigment and that of the trisazo pigment for use in the photoconductive layer coating liquid in Example III-1 were separately changed to 50 parts by weight.

Thus, an electrophotographic photoconductor No. III-8 according to the present invention was obtained.

EXAMPLE III-9

The procedure for preparation of the electrophotographic photoconductor No. III-1 in Example III-1 was repeated except that the amount of the unsymmetrical disazo pigment and that of the trisazo pigment for use in the photoconductive layer coating liquid in Example III-1 were separately changed to 75 parts by weight.

Thus, an electrophotographic photoconductor No. III-9 according to the present invention was obtained.

EXAMPLE III-10

The procedure for preparation of the electrophotographic photoconductor No. III-1 in Example III-1 was repeated except that the amount of the organic acceptor compound for use in the photoconductive layer coating liquid in Example III-1 was changed to 5 parts by weight.

Thus, an electrophotographic photoconductor No. III-10 according to the present invention was obtained.

EXAMPLE III-11

The procedure for preparation of the electrophotographic photoconductor No. III-1 in Example III-1 was repeated except that the amount of the organic acceptor compound for use in the photoconductive layer coating liquid in Example III-1 was changed to 10 parts by weight.

Thus, an electrophotographic photoconductor No. III-11 according to the present invention was obtained.

EXAMPLE III-12

The procedure for preparation of the electrophotographic photoconductor No. III-1 in Example III-1 was repeated except that the amount of the organic acceptor compound for use in the photoconductive layer coating liquid in Example III-1 was changed to 150 parts by weight.

Thus, an electrophotographic photoconductor No. III-12 according to the present invention was obtained.

EXAMPLE III-13

The procedure for preparation of the electrophotographic photoconductor No. III-1 in Example III-1 was repeated except that the amount of the organic acceptor compound for use in the photoconductive layer coating liquid in Example III-1 was changed to 200 parts by weight. Thus, an electrophotographic photoconductor No. III-13 according to the present invention was obtained.

EXAMPLES III-14 TO III-16

The procedure for preparation of the electrophotographic photoconductor No. III-1 in Example III-1 was repeated except that the organic acceptor compound for use in the photoconductive layer coating liquid in Example III-1 was replaced by the respective organic acceptor compounds as shown in TABLE 53.

Thus, electrophotographic photoconductors Nos. III-14 to III-16 according to the present invention were obtained.

TABLE 53

| | Organic Acceptor Compound |
|---|---|
| Example III-14 | Compound No. A-3 |
| Example III-15 | Compound No. B-29 |
| Example III-16 | Compound No. CIII-11 |

The dynamic electrostatic properties of each of the electrophotographic photoconductors No. III-1 to No. III-16 according to the present invention were measured by using a commercially available test apparatus (Trademark "EPA-8100", made by Kawaguchi Electro Works Co., Ltd.) under the circumstances of 25° C. and 50% RH.

More specifically, each photoconductor was charged positively in the dark under application of +6 kV for 10 seconds. Then, each photoconductor was allowed to stand in the dark for 20 seconds without applying any charge thereto. After that, the photoconductor was illuminated by a 780 nm-monochromatic light in such a manner that the illuminance on the illuminated surface of the photoconductor was 10 $\mu W/cm^2$.

The surface potential $V_s$ (V) which was obtained ten seconds after the initiation of charging; the surface potential $V_o$ (V) which was obtained after the dark decay; and the exposure $E_{1/2}$ ($\mu J/cm^2$) required to reduce the surface potential $V_o$ to ½ the surface potential $V_o$ were measured. In addition, to evaluate the charging characteristics after the repeated electrophotographic processes, the surface potentials $V_s$ and $V_o$, and the exposure $E_{1/2}$ were measured after making of 5,000 copies.

The results are shown in TABLE 54.

TABLE 54

| | Disazo Coupler No. | Trisazo Coupler No. | Azo Pigments/ Binder Resin Ratio | Acceptor Compound/ Binder Resin Ratio | Acceptor Compound No. | Initial Stage $V_s$ (V) | Initial Stage $V_0$ (V) | Initial Stage $E_{1/2}$ ($\mu J/cm^2$) | After making 5000 copies $V_s$ (V) | After making 5000 copies $V_0$ (V) | After making 5000 copies $E_{1/2}$ ($\mu J/cm^2$) |
|---|---|---|---|---|---|---|---|---|---|---|---|
| Ex. III-1 | 17, 24 | 70 | 1/10 | 2/10 | B-2 | 1690 | 1300 | 0.59 | 1660 | 1260 | 0.60 |
| Ex. III-2 | 30 | 70 | 1/10 | 2/10 | B-2 | 1620 | 1280 | 0.62 | 1600 | 1240 | 0.64 |
| Ex. III-3 | 17, 24 | 214 | 1/10 | 2/10 | B-2 | 1520 | 1110 | 0.57 | 1490 | 1120 | 0.58 |
| Ex. III-4 | 17 | 70 | 1/10 | 2/10 | B-2 | 1580 | 1190 | 0.68 | 1520 | 1170 | 0.71 |
| Ex. III-5 | 17, 24 | 3 | 1/10 | 2/10 | B-2 | 1730 | 1290 | 0.65 | 1670 | 1210 | 0.68 |
| Ex. III-6 | 17, 24 | 70 | 0.008/10 | 2/10 | B-2 | 1810 | 1360 | 0.88 | 1790 | 1330 | 0.90 |
| Ex. III-7 | 17, 24 | 70 | 0.01/10 | 2/10 | B-2 | 1770 | 1340 | 0.75 | 1720 | 1290 | 0.75 |
| Ex. III-8 | 17, 24 | 70 | 10/10 | 2/10 | B-2 | 1320 | 1050 | 0.49 | 1290 | 1010 | 0.51 |
| Ex. III-9 | 17, 24 | 70 | 15/10 | 2/10 | B-2 | 1180 | 850 | 0.44 | 1150 | 820 | 0.46 |
| Ex. III-10 | 17, 24 | 70 | 1/10 | 0.5/10 | B-2 | 1580 | 1190 | 0.43 | 1340 | 1160 | 0.47 |
| Ex. III-11 | 17, 24 | 70 | 1/10 | 1/10 | B-2 | 1540 | 1210 | 0.50 | 1520 | 1180 | 0.54 |
| Ex. III-12 | 17, 24 | 70 | 1/10 | 15/10 | B-2 | 1420 | 1090 | 0.82 | 1410 | 1040 | 0.82 |
| Ex. III-13 | 17, 24 | 70 | 1/10 | 20/10 | B-2 | 1380 | 1030 | 1.31 | 1320 | 990 | 1.30 |
| Ex. III-14 | 17, 24 | 70 | 1/10 | 2/10 | A-3 | 1520 | 1180 | 0.60 | 1480 | 1090 | 0.64 |
| Ex. III-15 | 17, 24 | 70 | 1/10 | 2/10 | B-23 | 1680 | 1340 | 0.65 | 1620 | 1290 | 0.71 |
| Ex. III-16 | 17, 24 | 70 | 1/10 | 2/10 | CIII-11 | 1490 | 1160 | 0.54 | 1430 | 1110 | 0.55 |

As previously explained, the electrophotographic photoconductors according to the present invention exhibit high photosensitivity in a broad wave range from the visible region extending to the near infrared region, and excellent charging stability when the single-layered photoconductive layer comprises a simultaneously pulverized mixture comprising the disazo pigment of formula (1) and the trisazo pigment of formula (2), the organic positive hole transporting material, the specified organic acceptor compound, and the binder resin.

EXAMPLE IV-1

An unsymmetrical disazo pigment of formula (1) in which $R^1$ and $R^2$ are hydrogen was prepared using the couplers No. 17 and No. 24 shown in TABLE 1. A trisazo pigment of formula (2) in which $R^1$ is hydrogen was prepared using the coupler No. 70 shown in TABLE 2.

Five parts by weight of the disazo pigment and 5 parts by weight of the trisazo pigment were dispersed in a ball mill together with 70 parts by weight of tetrahydrofuran for 5 days, and simultaneously pulverized.

The above prepared mixture was added to a solution consisting of 100 parts by weight of Z type polycarbonate with a molecular weight of 60,000, 300 parts by weight of tetrahydrofuran, 50 parts by weight a stilbene compound serving as the organic positive hole transporting material of the following formula (a);

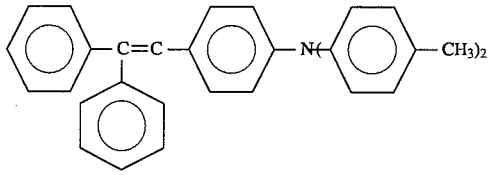

(a)

20 parts by weight of an organic acceptor compound the following formula (c) with a reduction potential of −0.47 v (vs SCE);

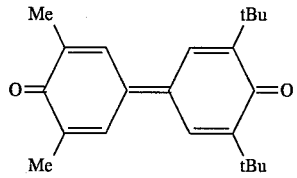

(c)

and 0.1 parts by weight of a commercially available silicone oil (Trademark "KF-50", made by Shin-Etsu Chemical Co., Ltd.). Thus, a coating liquid for a photoconductive layer was obtained.

The thus obtained photoconductive layer coating liquid was coated on an aluminum plate (Trademark "A1080", made by Sumitomo Light Metal Industries, Ltd.) with a thickness of 0.2 mm by blade coating, dried at 150° C. for 20 minutes, so that a photoconductive layer with a thickness of 20 μm was formed on the electroconductive support.

Thus, an electrophotographic photoconductor No. IV-1 according to the present invention was obtained.

EXAMPLE IV-2

The procedure for preparation of the electrophotographic photoconductor No. IV-1 in Example IV-1 was repeated except that the unsymmetrical disazo pigment for use in the photoconductive layer coating liquid in Example IV-1 was replaced by a disazo pigment of formula (1) ($R^1$=$R^2$=hydrogen) which was prepared using the coupler No. 30 shown in TABLE 1.

Thus, an electrophotographic photoconductor No. IV-2 according to the present invention was obtained.

EXAMPLE IV-3

The procedure for preparation of the electrophotographic photoconductor No. IV-1 in Example IV-1 was repeated except that the trisazo pigment for use in the photoconductive layer coating liquid in Example IV-1 was replaced by a trisazo pigment of formula (2) ($R^3$=hydrogen) which was prepared using the coupler No. 214 shown in TABLE 13.

Thus, an electrophotographic photoconductor No. IV-3 according to the present invention was obtained.

EXAMPLE IV-4

The procedure for preparation of the electrophotographic photoconductor No. IV-1 in Example IV-1 was repeated except that the unsymmetrical disazo pigment for use in the photoconductive layer coating liquid in Example IV-1 was replaced by a symmetrical disazo pigment of formula (1) ($R^1$=$R^2$=hydrogen) which was prepared using the coupler No. 17 shown in TABLE 1.

Thus, an electrophotographic photoconductor No. IV-4 according to the present invention was obtained.

EXAMPLE IV-5

The procedure for preparation of the electrophotographic photoconductor No. IV-1 in Example IV-1 was repeated except that the trisazo pigment for use in the photoconductive layer coating liquid in Example IV-1 was replaced by a trisazo pigment of formula (2) ($R^3$=hydrogen) which was prepared using the coupler No. 3 shown in TABLE 1.

Thus, an electrophotographic photoconductor No. IV-5 according to the present invention was obtained.

EXAMPLE IV-6

The procedure for preparation of the electrophotographic photoconductor No. IV-1 in Example IV-1 was repeated except that the amount of the unsymmetrical disazo pigment and that of the trisazo pigment for use in the photoconductive layer coating liquid in Example IV-1 were separately changed to 0.04 parts by weight.

Thus, an electrophotographic photoconductor No. IV-6 according to the present invention was obtained.

EXAMPLE IV-7

The procedure for preparation of the electrophotographic photoconductor No. IV-1 in Example IV-1 was repeated except that the amount of the unsymmetrical disazo pigment and that of the trisazo pigment for use in the photoconductive layer coating liquid in Example IV-1 were separately changed to 0.05 parts by weight.

Thus, an electrophotographic photoconductor No. IV-7 according to the present invention was obtained.

EXAMPLE IV-8

The procedure for preparation of the electrophotographic photoconductor No. IV-1 in Example IV-1 was repeated except that the amount of the unsymmetrical disazo pigment and that of the trisazo pigment for use in the photoconductive layer coating liquid in Example IV-1 were separately changed to 50 parts by weight.

Thus, an electrophotographic photoconductor No. IV-8 according to the present invention was obtained.

EXAMPLE IV-9

The procedure for preparation of the electrophotographic photoconductor No. IV-1 in Example IV-1 was repeated except that the amount of the unsymmetrical disazo pigment and that of the trisazo pigment for use in the photoconductive layer coating liquid in Example IV-1 were separately changed to 75 parts by weight.

Thus, an electrophotographic photoconductor No. IV-9 according to the present invention was obtained.

EXAMPLE IV-10

The procedure for preparation of the electrophotographic photoconductor No. IV-1 in Example IV-1 was repeated except that the amount of the organic acceptor compound for use in the photoconductive layer coating liquid in Example IV-1 was changed to 5 parts by weight.

Thus, an electrophotographic photoconductor No. IV-10 according to the present invention was obtained.

EXAMPLE IV-11

The procedure for preparation of the electrophotographic photoconductor No. IV-1 in Example IV-1 was repeated except that the amount of the organic acceptor compound for use in the photoconductive layer coating liquid in Example IV-1 was changed to 10 parts by weight.

Thus, an electrophotographic photoconductor No. IV-11 according to the present invention was obtained.

EXAMPLE IV-12

The procedure for preparation of the electrophotographic photoconductor No. IV-1 in Example IV-1 was repeated except that the amount of the organic acceptor compound for use in the photoconductive layer coating liquid in Example IV-1 was changed to 150 parts by weight.

Thus, an electrophotographic photoconductor No. IV-12 according to the present invention was obtained.

EXAMPLE IV-13

The procedure for preparation of the electrophotographic photoconductor No. IV-1 in Example IV-1 was repeated except that the amount of the organic acceptor compound for use in the photoconductive layer coating liquid in Example IV-1 was changed to 200 parts by weight.

Thus, an electrophotographic photoconductor No. IV-13 according to the present invention was obtained.

EXAMPLES IV-14 TO IV-20

The procedure for preparation of the electrophotographic photoconductor No. IV-1 in Example IV-1 was repeated except that the organic acceptor compound for use in the photoconductive layer coating liquid in Example IV-1 was replaced by the respective organic acceptor compounds as shown in TABLE 55.

Thus, electrophotographic photoconductors Nos. IV-14 to IV-20 according to the present invention were obtained.

TABLE 55

| | Organic Acceptor Compound | Reduction Potential [(V (vs SCE)] |
|---|---|---|
| Ex. IV-14 | 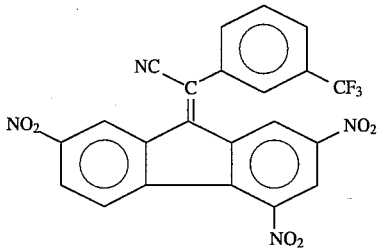 | −0.41 |
| Ex. IV-15 | 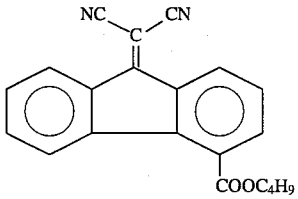 | −0.59 |
| Ex. IV-16 | 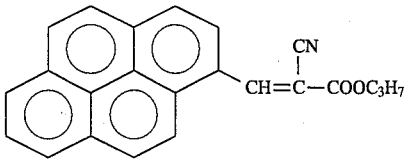 | −0.87 |
| Ex. IV-17 | 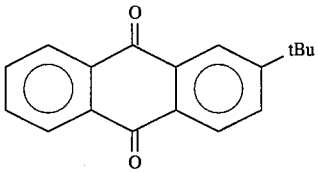 | −0.92 |
| Ex. IV-18 | 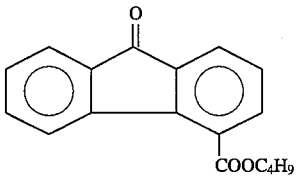 | −1.06 |
| Ex. IV-19 | 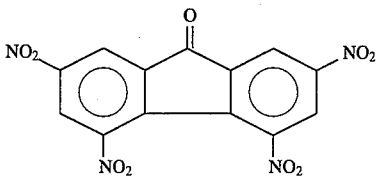 | −0.15 |
| Ex. IV-20 | 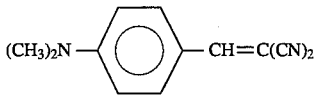 | −1.42 |

COMPARATIVE EXAMPLE IV-1

An unsymmetrical disazo pigment of formula (1) in which $R^1$ and $R^2$ are hydrogen was prepared using the couplers No. 17 and No. 24 shown in TABLE 1. A trisazo pigment of formula (2) in which $R^3$ is hydrogen was prepared using the coupler No. 70 shown in TABLE 2.

Five parts by weight of the disazo pigment and 5 parts by weight of the trisazo pigment were separately dispersed in a ball mill with 35 parts by weight of tetrahydrofuran for 5 days. Then, the dispersion of the disazo pigment and the dispersion of the trisazo pigment were mixed.

The above prepared mixture was added to a solution consisting of 100 parts by weight of Z type polycarbonate with a molecular weight of 60,000, 300 parts by weight of tetrahydrofuran, 80 parts by weight of the same organic positive hole transporting material as used in Example IV-1, 20 parts by weight of the same organic acceptor compound as used in Example IV-1, and 0.1 parts by weight of a commercially available silicone oil (Trademark "KF-50", made by Shin-Etsu Chemical Co., Ltd.). Thus, a coating liquid for a photoconductive layer was obtained.

The thus obtained photoconductive layer coating liquid was coated on an aluminum plate (Trademark "A1080", made by Sumitomo Light Metal Industries, Ltd.) with a thickness of 0.2 mm by blade coating, dried at 150° C. for 20 minutes, so that a photoconductive layer with a thickness of 20 μm was formed on the electroconductive support.

The dynamic electrostatic properties and the charging characteristics after the repeated electrophotographic processes of each of the electrophotographic photoconductors No. IV-1 to No. IV-20 according to the present invention and the comparative electrophotographic photoconductors No. IV-1 to No. IV-3 were measured in the same manner as in Example II-1.

The results are shown in TABLE 56.

TABLE 56

| | Disazo Coupler No. | Trisazo Coupler No. | Azo Pigments/ Binder Resin Ratio | Acceptor Compound/ Binder Resin Ratio | Initial Stage | | | After making 5000 copies | | |
|---|---|---|---|---|---|---|---|---|---|---|
| | | | | | $V_s$ (V) | $V_0$ (V) | $E_{1/2}$ (μJ/cm²) | $V_s$ (V) | $V_0$ (V) | $E_{1/2}$ (μJ/cm²) |
| Ex. IV-1 | 17, 24 | 70 | 1/10 | 2110 | 1510 | 1140 | 0.49 | 1490 | 1100 | 0.51 |
| Ex. IV-2 | 30 | 70 | 1/10 | 2/10 | 1470 | 1100 | 0.56 | 1450 | 1070 | 0.56 |
| Ex. IV-3 | 17, 24 | 214 | 1/10 | 2/10 | 1450 | 1080 | 0.53 | 1410 | 1060 | 0.54 |
| Ex. IV-4 | 17 | 70 | 1/10 | 2/10 | 1480 | 1120 | 0.65 | 1440 | 1090 | 0.67 |
| Ex. IV-5 | 17, 24 | 3 | 1/10 | 2/10 | 1580 | 1240 | 0.60 | 1550 | 1200 | 0.59 |
| Ex. IV-6 | 17, 24 | 70 | 0.008/10 | 2/10 | 1690 | 1300 | 0.80 | 1660 | 1240 | 0.82 |
| Ex. IV-7 | 17, 24 | 70 | 0.01/10 | 2/10 | 1660 | 1230 | 0.69 | 1650 | 1190 | 0.71 |
| Ex. IV-8 | 17, 24 | 70 | 10/10 | 2/10 | 1290 | 1000 | 0.45 | 1250 | 970 | 0.45 |
| Ex. IV-9 | 17, 24 | 70 | 15/10 | 2/10 | 1110 | 820 | 0.42 | 1090 | 800 | 0.42 |
| Ex. IV-10 | 17, 24 | 70 | 1/10 | 0.5/10 | 1490 | 1090 | 0.43 | 1020 | 830 | 0.40 |
| Ex. IV-11 | 17, 24 | 70 | 1/10 | 1/10 | 1460 | 1050 | 0.44 | 1450 | 1040 | 0.46 |
| Ex. IV-12 | 17, 24 | 70 | 1/10 | 15/10 | 1360 | 1020 | 0.76 | 1340 | 1000 | 0.75 |
| Ex. IV-13 | 17, 24 | 70 | 1/10 | 20/10 | 1280 | 970 | 1.22 | 1210 | 920 | 1.24 |
| Ex. IV-14 | 17, 24 | 70 | 1/10 | 2/10 | 1530 | 1250 | 0.55 | 1500 | 1210 | 0.56 |
| Ex. IV-15 | 17, 24 | 70 | 1/10 | 2/10 | 1460 | 1270 | 0.50 | 1460 | 1260 | 0.51 |
| Ex. IV-16 | 17, 24 | 70 | 1/10 | 2/10 | 1350 | 1100 | 0.66 | 1320 | 1070 | 0.68 |
| Ex. IV-17 | 17, 24 | 70 | 1/10 | 2/10 | 1620 | 1490 | 0.71 | 1620 | 1480 | 0.73 |
| Ex. IV-18 | 17, 24 | 70 | 1/10 | 2/10 | 1390 | 1100 | 0.64 | 1360 | 1070 | 0.65 |
| Comp. Ex. IV-1 | 17, 24 | 70 | 1/10 | 2/10 | 1400 | 1090 | 3.55 | 1350 | 1050 | 3.72 |
| Comp. Ex. IV-2 | 17, 24 | None | 1/10 | 2/10 | 1560 | 1330 | No sensitivity | 1550 | 1320 | No sensitivity |
| Comp. Ex. IV-3 | None | 70 | 1/10 | 2/10 | 1530 | 1370 | 2.29 | 1500 | 1330 | 2.60 |
| Ex. IV-19 | 17, 24 | 70 | 1/10 | 2/10 | 1490 | 1170 | 1.85 | 1460 | 1160 | 1.84 |
| Ex. IV-20 | 17, 24 | 70 | 1/10 | 2/10 | 1620 | 1390 | 3.14 | 820 | 510 | 3.95 |

Thus, a comparative electrophotographic photoconductor No. IV-1 was obtained.

COMPARATIVE EXAMPLE IV-2

The procedure for preparation of the electrophotographic photoconductor No. IV-1 in Example IV-1 was repeated except that the trisazo pigment of formula (2) prepared by use of the coupler No. 70 was not employed in the preparation of the photoconductive layer coating liquid.

Thus, a comparative electrophotographic photoconductor No. IV-2 was obtained.

COMPARATIVE EXAMPLE IV-3

The procedure for preparation of the electrophotographic photoconductor No. IV-1 in Example IV-1 was repeated except that the unsymmetrical disazo pigment of formula (1) prepared by use of the couplers Nos. 17 and 24 was not employed in the preparation of the photoconductive layer coating liquid.

Thus, a comparative electrophotographic photoconductor No. IV-3 was obtained.

As previously explained, the electrophotographic photoconductors according to the present invention exhibit high photosensitivity in a broad wave range from the visible region extending to the near infrared region, and excellent charging stability when the single-layered photoconductive layer comprises a simultaneously pulverized mixture comprising the disazo pigment of formula (1) and the trisazo pigment of formula (2), the organic positive hole transporting material, the organic acceptor compound having a reduction potential in a range of −0.2 to −1.2 V (vs SCE), and the binder resin.

EXAMPLE V-1

Five parts by weight of a disazo pigment of formula (d) and 5 parts by weight of a trisazo pigment of formula (e) were dispersed in a ball mill together with 70 parts by weight of methyl ethyl ketone for 5 days, and simultaneously pulverized.

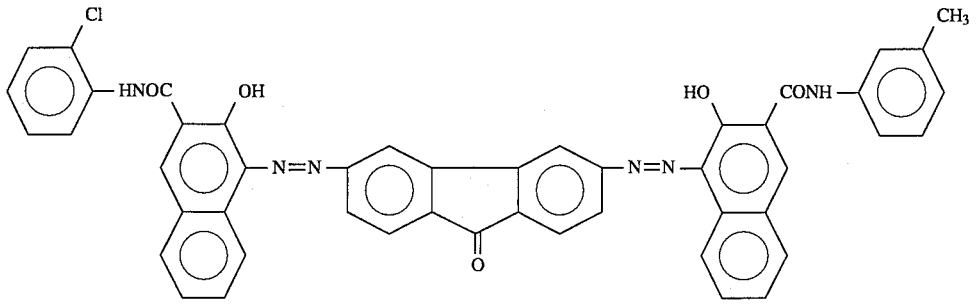

(d)

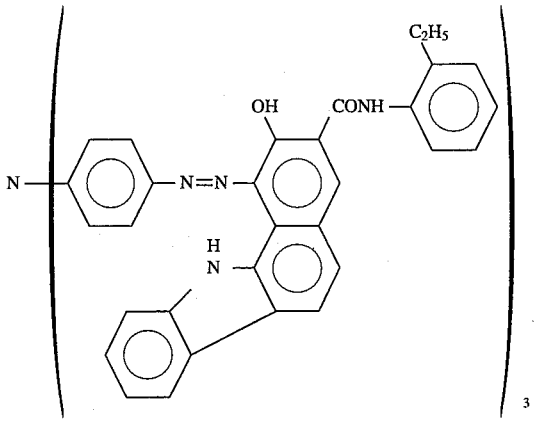

(e)

The above prepared mixture was added to a solution consisting of 100 parts by weight of Z type polycarbonate with a molecular weight of 60,000, 300 parts by weight of tetrahydrofuran, 80 parts by weight of 4-diethylaminobenzaldehyde-1-benzyl-1-phenylhydrazone serving as the charge transporting material, 5 parts by weight of a commercially available hindered amine compound (Trademark "Sanol LS-770", made by Sankyo Company, Limited) serving as the antioxidant, and 0.1 parts by weight of a commercially available silicone oil (Trademark "KF-50", made by Shin-Etsu Chemical Co., Ltd.). Thus, a coating liquid for a photoconductive layer was obtained.

The thus obtained photoconductive layer coating liquid was coated on an aluminum plate (Trademark "A1080", made by Sumitomo Light Metal Industries, Ltd.) with a thickness of 0.2 mm by blade coating, dried at 150° C. for 20 minutes, so that a photoconductive layer with a thickness of 20 μm was formed on the electroconductive support.

Thus, an electrophotographic photoconductor No. V-1 according to the present invention was obtained.

EXAMPLE V-2

The procedure for preparation of the electrophotographic photoconductor No. V-1 in Example V-1 was repeated except that the disazo pigment of formula (d) for use in the photoconductive layer coating liquid in Example V-1 was replaced by a disazo pigment of the following formula (f):

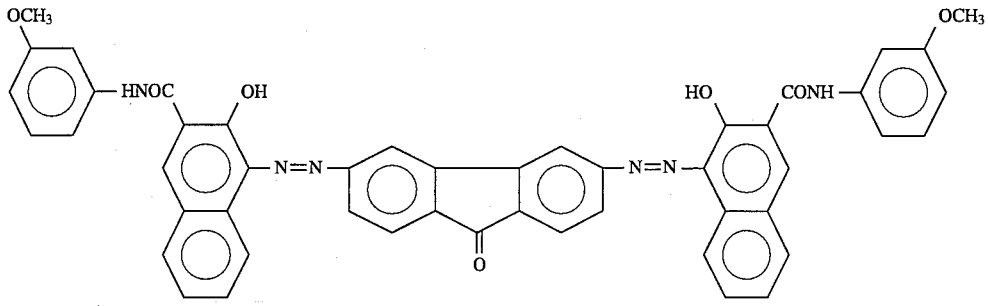

(f)

Thus, an electrophotographic photoconductor No. V-2 according to the present invention was obtained.

EXAMPLE V-3

The procedure for preparation of the electrophotographic photoconductor No. V-1 in Example V-1 was repeated except that the trisazo pigment of formula (e) for use in the photoconductive layer coating liquid in Example V-1 was replaced by a trisazo pigment of the following formula (g):

(g)

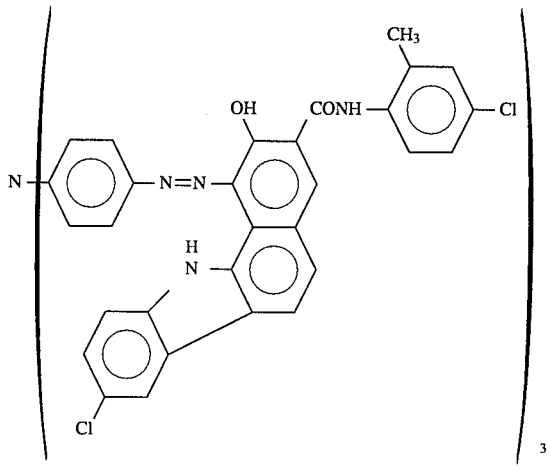

Thus, an electrophotographic photoconductor No. V-3 according to the present invention was obtained.

EXAMPLE V-4

The procedure for preparation of the electrophotographic photoconductor No. V-1 in Example V-1 was repeated except that the disazo pigment of formula (d) for use in the photoconductive layer coating liquid in Example V-1 was replaced by a disazo pigment of the following formula (h):

(h)

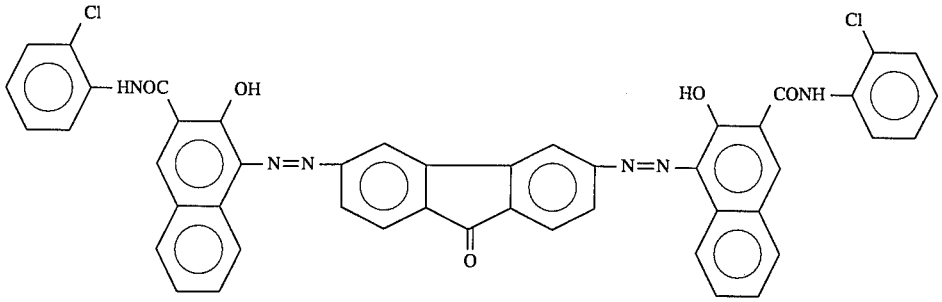

Thus, an electrophotographic photoconductor No. V-4 according to the present invention was obtained.

EXAMPLE V-5

The procedure for preparation of the electrophotographic photoconductor No. V-1 in Example V-1 was repeated except that the trisazo pigment of formula (e) for use in the photoconductive layer coating liquid in Example V-1 was replaced by a trisazo pigment of the following formula (i):

(i)

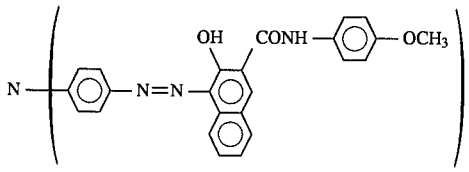

Thus, an electrophotographic photoconductor No. V-5 according to the present invention was obtained.

EXAMPLE V-6

The procedure for preparation of the electrophotographic photoconductor No. V-1 in Example V-1 was repeated except that the amount of the disazo pigment and that of the trisazo pigment for use in the photoconductive layer coating liquid in Example V-1 were separately changed to 0.04 parts by weight.

Thus, an electrophotographic photoconductor No. V-6 according to the present invention was obtained.

EXAMPLE V-7

The procedure for preparation of the electrophotographic photoconductor No. V-1 in Example V-1 was repeated except that the amount of the disazo pigment and that of the trisazo pigment for use in the photoconductive layer coating liquid in Example V-1 were separately changed to 0.05 parts by weight.

Thus, an electrophotographic photoconductor No. V-7 according to the present invention was obtained.

EXAMPLE V-8

The procedure for preparation of the electrophotographic photoconductor No. V-1 in Example V-1 was repeated except that the amount of the disazo pigment and that of the trisazo pigment for use in the photoconductive layer coating liquid in Example V-1 were separately changed to 50 parts by weight.

Thus, an electrophotographic photoconductor No. V-8 according to the present invention was obtained.

EXAMPLE V-9

The procedure for preparation of the electrophotographic photoconductor No. V-1 in Example V-1 was repeated except that the amount of the disazo pigment and that of the trisazo pigment for use in the photoconductive layer coating liquid in Example V-1 were separately changed to 75 parts by weight.

Thus, an electrophotographic photoconductor No. V-9 according to the present invention was obtained.

EXAMPLE V-10

The procedure for preparation of the electrophotographic photoconductor No. V-1 in Example V-1 was repeated except that the amount of the charge transporting material for use in the photoconductive layer coating liquid in Example V-1 was changed to 5 parts by weight.

Thus, an electrophotographic photoconductor No. V-10 according to the present invention was obtained.

EXAMPLE V-11

The procedure for preparation of the electrophotographic photoconductor No. V-1 in Example V-1 was repeated except that the amount of the charge transporting material for use in the photoconductive layer coating liquid in Example V-1 was changed to 10 parts by weight.

Thus, an electrophotographic photoconductor No. V-11 according to the present invention was obtained.

EXAMPLE V-12

The procedure for preparation of the electrophotographic photoconductor No. V-1 in Example V-1 was repeated except that the amount of the charge transporting material for use in the photoconductive layer coating liquid in Example V-1 was changed to 150 parts by weight.

Thus, an electrophotographic photoconductor No. V-12 according to the present invention was obtained.

EXAMPLE V-13

The procedure for preparation of the electrophotographic photoconductor No. V-1 in Example V-1 was repeated except that the amount of the charge transporting material for use in the photoconductive layer coating liquid in Example V-1 was changed to 200 parts by weight.

Thus, an electrophotographic photoconductor No. V-13 according to the present invention was obtained.

EXAMPLE V-14

The procedure for preparation of the electrophotographic photoconductor No. V-1 in Example V-1 was repeated except that methyl ethyl ketone used in dispersing the azo pigments in Example V-1 was replaced by 1,4-dioxane.

Thus, an electrophotographic photoconductor No. V-14 according to the present invention was obtained.

EXAMPLE V-15

The procedure for preparation of the electrophotographic photoconductor No. V-1 in Example V-1 was repeated except that methyl ethyl ketone used in dispersing the azo pigments in Example V-1 was replaced by isophorone.

Thus, an electrophotographic photoconductor No. V-15 according to the present invention was obtained.

EXAMPLE V-16

The procedure for preparation of the electrophotographic photoconductor No. V-1 in Example V-1 was repeated except that methyl ethyl ketone used in dispersing the azo pigments in Example V-1 was replaced by tetrahydrofuran.

Thus, an electrophotographic photoconductor No. V-16 according to the present invention was obtained.

EXAMPLE V-17

The procedure for preparation of the electrophotographic photoconductor No. V-1 in Example V-1 was repeated except that methyl ethyl ketone used in dispersing the azo pigments in Example V-1 was replaced by cyclohexanone.

Thus, an electrophotographic photoconductor No. V-17 according to the present invention was obtained.

The dynamic electrostatic properties of each of the electrophotographic photoconductors No. V-1 to No. V-17 according to the present invention were measured in the same manner as in Example I-1.

The results are shown in TABLE 57.

TABLE 57

| | Disazo Coupler No. | Trisazo Coupler No. | Azo Pigments/ Binder Resin Ratio | Charge Transporting Material/ Binder Resin Ratio | Solvent for dispersing pigments | $V_2$ V | $E_{1/2}$ (white) lux · sec | $V_{30}$ (mono-chromatic) V | $E_{1/2}$ (mono-chromatic) μJ/cm$^2$ | $V_{30}$ V |
|---|---|---|---|---|---|---|---|---|---|---|
| Ex. V-1 | Formula (d) | Formula (e) | 1/10 | 8/10 | MEK | 720 | 1.00 | 45 | 0.50 | 40 |
| Ex. V-2 | Formula (f) | Formula (e) | 1/10 | 8/10 | MEK | 740 | 1.12 | 40 | 0.60 | 40 |
| Ex. V-3 | Formula (d) | Formula (g) | 1/10 | 8/10 | MEK | 710 | 1.18 | 45 | 0.62 | 45 |
| Ex. V-4 | Formula (h) | Formula (e) | 1/10 | 8/10 | MEK | 690 | 1.08 | 45 | 0.65 | 45 |
| Ex. V-5 | Formula (d) | Formula (i) | 1/10 | 8/10 | MEK | 720 | 1.40 | 60 | 0.88 | 55 |
| Ex. V-6 | Formula (d) | Formula (e) | 0.008/10 | 8/10 | MEK | 770 | 1.15 | 85 | 0.62 | 75 |
| Ex. V-7 | Formula (d) | Formula (e) | 0.01/10 | 8/10 | MEK | 750 | 1.10 | 75 | 0.55 | 60 |
| Ex. V-8 | Formula (d) | Formula (e) | 10/10 | 8/10 | MEK | 690 | 0.97 | 25 | 0.47 | 30 |
| Ex. V-9 | Formula (d) | Formula (e) | 15/10 | 8/10 | MEK | 580 | 0.97 | 15 | 0.46 | 25 |
| Ex. V-10 | Formula (d) | Formula (e) | 1/10 | 0.5/10 | MEK | 760 | 1.12 | 50 | 0.62 | 50 |
| Ex. V-11 | Formula (d) | Formula (e) | 1/10 | 1/10 | MEK | 735 | 1.08 | 45 | 0.58 | 45 |
| Ex. V-12 | Formula (d) | Formula (e) | 1/10 | 15/10 | MEK | 700 | 0.98 | 40 | 0.48 | 35 |
| Ex. V-13 | Formula (d) | Formula (e) | 1/10 | 20/10 | MEK | 635 | 0.99 | 40 | 0.48 | 30 |
| Ex. V-14 | Formula (d) | Formula (e) | 1/10 | 8/10 | Dioxane | 650 | 0.95 | 40 | 0.47 | 40 |
| Ex. V-15 | Formula (d) | Formula (e) | 1/10 | 8/10 | Isophorone | 720 | 0.98 | 40 | 0.46 | 40 |
| Ex. V-16 | Formula (d) | Formula (e) | 1/10 | 8/10 | THF | 715 | 0.89 | 35 | 0.42 | 35 |
| Ex. V-17 | Formula (d) | Formula (e) | 1/10 | 8/10 | Anone | 700 | 0.87 | 35 | 0.40 | 30 |

MEK: Methyl Ethyl Ketone, THF: Tetrahydrofuran, Anone: Cyclohexanone

EXAMPLE V-18 TO V-38

The procedure for preparation of the electrophotographic photoconductor No. V-1 in Example V-1 was repeated except that the antioxidant used in the photoconductive layer coating liquid in Example V-1 was replaced by the respective antioxidants as shown in TABLE 58.

Thus, electrophotographic photoconductors No. V-18 to No. V-38 according to the present invention were obtained.

TABLE 58

| Example No. | Antioxidant |
|---|---|
| Ex. V-18 | 3,5-di-t-butyl-4-hydroxytoluene (made by Tokyo Kasei Kogyo Co., Ltd.) |

TABLE 58-continued

| Example No. | Antioxidant |
|---|---|
| Ex. V-19 | Trademark "SUMILIZER MDP-S", made by Sumitomo Chemical Co., Ltd. |
| Ex. V-20 | Trademark "SUMILIZER TPM", made by Sumitomo Chemical Co., Ltd. |
| Ex. V-21 | Trademark "SANOL LS-2626", made by Sankyo Company, Limited |
| Ex. V-22 | Trademark "MARK PEP-24", made by Asahi Denka Kogyo K.K. |
| Ex. V-23 | Trademark "IRGANOX-1330", made by CIBA-GEIGY, Ltd. |
| Ex. V-24 | Compound No. (I)-13 |
| Ex. V-25 | Compound No. (II)-2 |
| Ex. V-26 | Compound No. (III)-1 |
| Ex. V-27 | Compound No. (III)-20 |
| Ex. V-28 | Compound No. (V)-49 |
| Ex. V-29 | Compound No. (V)-72 |
| Ex. V-30 | Compound No. (VI)-6 |
| Ex. V-31 | Compound No. (VII)-18 |
| Ex. V-32 | Compound No. (VIII)-23 |
| Ex. V-33 | Compound No. (IX)-1 |
| Ex. V-34 | Compound No. (X)-6 |
| Ex. V-35 | Compound No. (X)-21 |
| Ex. V-36 | Compound No. (XI)-2 |
| Ex. V-37 | Compound No. (XI)-20 |
| Ex. V-38 | Compound No. (XII)-4 |

EXAMPLE V-39

The procedure for preparation of the electrophotographic photoconductor No. V-25 in Example V-25 was repeated except that the amount of the antioxidant (Compound No. II-2 in TABLE 37) used in the photoconductive layer coating liquid in Example V-25 was changed from 5 parts by weight to 0.05 parts by weight.

Thus, an electrophotographic photoconductor No. V-39 according to the present invention was obtained.

EXAMPLE V-40

The procedure for preparation of the electrophotographic photoconductor No. V-25 in Example V-25 was repeated except that the amount of the antioxidant (Compound No. II-2 in TABLE 37) used in the photoconductive layer coating liquid in Example V-25 was changed from 5 parts by weight to 0.1 parts by weight.

Thus, an electrophotographic photoconductor No. V-40 according to the present invention was obtained.

EXAMPLE V-41

The procedure for preparation of the electrophotographic photoconductor No. V-25 in Example V-25 was repeated except that the amount of the antioxidant (Compound No. II-2 in TABLE 37) used in the photoconductive layer coating liquid in Example V-25 was changed from 5 parts by weight to 20 parts by weight.

Thus, an electrophotographic photoconductor No. V-41 according to the present invention was obtained.

EXAMPLE V-42

The procedure for preparation of the electrophotographic photoconductor No. V-25 in Example V-25 was repeated except that the amount of the antioxidant (Compound No. II-2 in TABLE 37) used in the photoconductive layer coating liquid in Example V-25 was changed from 5 parts by weight to 30 parts by weight.

Thus, an electrophotographic photoconductor No. V-42 according to the present invention was obtained.

The dynamic electrostatic properties of each of the electrophotographic photoconductors No. V-1 and Nos. V-18 to V-42 according to the present invention were measured by using a commercially available test apparatus (Trademark "EPA-8100", made by Kawaguchi Electro Works Co., Ltd.) under the circumstances of 25° C. and 50% RH.

More specifically, each photoconductor was charged positively in the dark under application of +6 kV for 10 seconds. Then, each photoconductor was allowed to stand in the dark for 20 seconds without applying any charge thereto. After that, the photoconductor was illuminated by white light of a halogen lamp in such a manner that the illuminance on the illuminated surface of the photoconductor was 10 lux.

The charging potential was expressed by a saturated surface potential Vm (V), which was obtained in the charging time of ten seconds; the photosensitivity was expressed by an exposure $E_{1/2}$ (lux·sec) required to reduce the surface potential obtained just before the exposure to ½ the surface potential; and the residual potential was expressed by a surface potential $V_{30}$ (V) obtained 30 seconds after the exposure.

In addition, to evaluate the stability of the electrostatic properties of the photoconductor, the saturated surface potential Vm' (V), the exposure $E_{1/2}'$ (lux·sec), and the surface potential $V_{30'}$ were measured in the same manner as described above after fatigue of making of 5,000 copies.

The results are shown in TABLE 59.

TABLE 59

| | Before fatigue | | | After fatigue | | |
|---|---|---|---|---|---|---|
| | Vm (V) | $E_{1/2}$ (lux · sec) | V30' (V) | Vm' (V) | $E_{1/2}'$ (lux · sec) | V30' (V) |
| Ex. V-1 | 980 | 1.00 | 45 | 820 | 1.35 | 85 |
| Ex. V-18 | 720 | 0.82 | 35 | 550 | 0.98 | 40 |
| Ex. V-19 | 730 | 0.85 | 40 | 580 | 0.93 | 50 |
| Ex. V-20 | 725 | 0.80 | 45 | 585 | 0.92 | 50 |
| Ex. V-21 | 710 | 0.82 | 45 | 560 | 0.95 | 55 |
| Ex. V-22 | 700 | 0.81 | 35 | 545 | 0.97 | 40 |
| Ex. V-23 | 705 | 0.86 | 45 | 550 | 0.98 | 50 |
| Ex. V-24 | 950 | 0.81 | 40 | 850 | 0.83 | 55 |
| Ex. V-25 | 1050 | 0.82 | 40 | 970 | 0.84 | 60 |
| Ex. V-26 | 1010 | 0.81 | 40 | 950 | 0.84 | 55 |
| Ex. V-27 | 990 | 0.85 | 40 | 900 | 0.93 | 55 |
| Ex. V-28 | 920 | 0.83 | 45 | 830 | 0.87 | 65 |
| Ex. V-29 | 950 | 0.84 | 40 | 800 | 0.90 | 60 |
| Ex. V-30 | 940 | 0.82 | 40 | 830 | 0.87 | 55 |
| Ex. V-31 | 945 | 0.84 | 40 | 825 | 0.90 | 60 |
| Ex. V-32 | 960 | 0.83 | 40 | 850 | 0.90 | 55 |
| Ex. V-33 | 955 | 0.82 | 40 | 840 | 0.88 | 55 |
| Ex. V-34 | 940 | 0.85 | 40 | 810 | 0.90 | 55 |
| Ex. V-35 | 935 | 0.86 | 40 | 800 | 0.94 | 55 |
| Ex. V-36 | 955 | 0.88 | 45 | 815 | 0.97 | 65 |
| Ex. V-37 | 940 | 0.90 | 45 | 795 | 0.98 | 70 |
| Ex. V-38 | 1000 | 0.84 | 40 | 830 | 0.88 | 60 |
| Ex. V-39 | 920 | 0.80 | 35 | 590 | 0.92 | 40 |
| Ex. V-40 | 990 | 0.81 | 40 | 830 | 0.83 | 50 |
| Ex. V-41 | 1180 | 0.90 | 60 | 1120 | 1.25 | 80 |
| Ex. V-42 | 1250 | 1.02 | 85 | 1180 | 1.55 | 120 |

As is apparent from the results shown in TABLE 59, the charging characteristics of the photoconductor are remarkably improved when the single-layered photoconductive layer comprises an antioxidant. In particular, the charging characteristics are excellent and the photosensitivity and residual potential are advantageous in Examples V-24 to V-38 in which antioxidants of formulas (I) to (XII) are employed, and in Examples V-40 and V-41 in which the amount of the antioxidant contained in the photoconductive layer is preferable.

As previously explained, the electrophotographic photoconductors according to the present invention exhibit high photosensitivity in a broad wave range from the visible region extending to the near infrared region, and excellent charging stability when the single-layered photoconductive layer comprises a simultaneously pulverized mixture comprising the disazo pigment of formula (1) and the trisazo pigment of formula (2), the charge transporting material, the binder resin and the antioxidant. In this case, the decrease of image density and the toner deposition on the background can be prevented.

Japanese Patent Application 5-280543 filed on Oct. 14, 1993; Japanese Patent Application 5-354296 filed on Dec. 30, 1993; Japanese Patent Application 5-354295 filed on Dec. 30, 1993; Japanese Patent Application 5-341779 filed on Dec. 11, 1993; and Japanese Patent Application 6-193563 filed on Jul. 26, 1994 are hereby incorporated by reference.

What is claimed is:

1. An electrophotographic photoconductor comprising an electroconductive support and a single-layered photoconductive layer formed thereon, comprising:

(a) a charge transporting material, (b) a binder resin, and (c) a simultaneously pulverized mixture comprising at least one disazo pigment of formula (1) and at least one trisazo pigment of formula (2), which is obtained by simultaneously pulverizing said disazo pigment and said trisazo pigment:

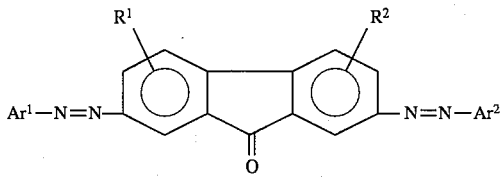

(1)

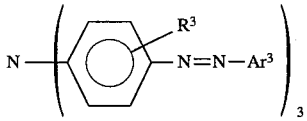

(2)

wherein $R^1$ and $R^2$ each is hydrogen, a halogen atom, trifluoromethyl group, nitro group or cyano group; $R^3$ is hydrogen, chlorine, fluorine, iodine, bromine, nitro group or cyano group; and $Ar^1$, $Ar^2$ and $Ar^3$ each is a coupler radical, which may be the same or different, and is selected from the group consisting of coupler radicals of formulas (3) to (10):

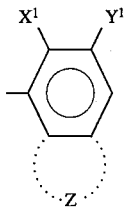

(3)

wherein $X^1$ is —OH, —$N(R^4)(R^5)$, or —$NHSO_2R^6$, in which $R^4$ and $R^5$ each is hydrogen, an acyl group or an alkyl group which may have a substituent, and $R^6$ is an aryl group which may have a substituent; $Y^1$ is hydrogen, a halogen atom, an alkyl group which may have a substituent, an alkoxyl group, a carboxyl group, a sulfone group, a benzimidazolyl group, a sulfamoyl group which may have a substituent, or —$CON(R^7)(Y^2)$, in which $R^7$ is hydrogen, an alkyl group which may have a substituent, or a phenyl group which may have a substituent, and $Y^2$ is a cyclic hydrocarbon group which may have a substituent, a heterocyclic group which may have a substituent, or —$N{=}C(R^8)(R^9)$, in which $R^8$ is a cyclic hydrocarbon group which may have a substituent, a heterocyclic group which may have a substituent, or a styryl group which may have a substituent, $R^9$ is hydrogen, an alkyl group which may have a substituent, or a phenyl group which may have a substituent, and $R^8$ and $R^9$ may form a ring in combination with a carbon atom to which $R^8$ and $R^9$ are bonded; and Z is a cyclic hydrocarbon group which may have a substituent, or a heterocyclic group which may have a substituent;

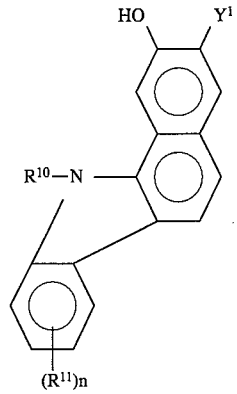

(4)

wherein n is an integer of 1 to 4; $R^{10}$ is hydrogen, an alkyl group which may have a substituent, or an aryl group which may have a substituent; $R^{11}$ is hydrogen, an alkyl group which may have a substituent, an alkoxyl group which may have a substituent, an alkylsulfonyl group which may have a substituent, an alkylmercapto group which may have a substituent, a halogen atom, an aryl group which may have a substituent, an acyl group which may have a substituent, cyano group, nitro group, or an amino group which may have a substituent, and when n is 2, 3 or 4, $R^{11}$ may be the same or different; and $Y^1$ is the same as defined in formula (3);

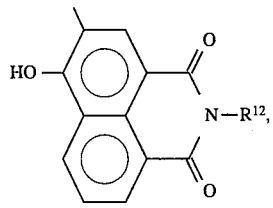

(5)

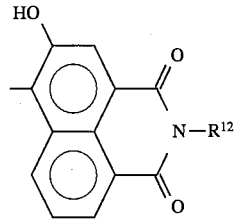

(6)

wherein $R^{12}$ in formulas (5) and (6) is a hydrocarbon group which may have a substituent;

(7)

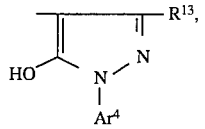

(8)

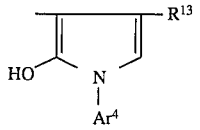

wherein $R^{13}$ in formulas (7) and (8) is an alkyl group, a carbamoyl group, a carboxyl group or an ester group thereof; and $Ar^4$ is an aromatic hydrocarbon group which may have a substituent;

(9)

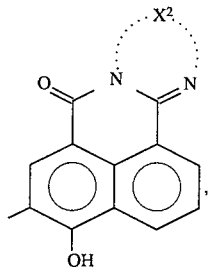

(10)

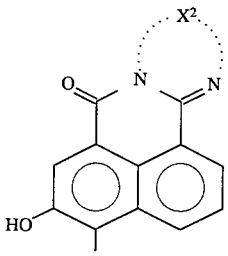

wherein $X^2$ in formulas (9) and (10) is a bivalent aromatic hydrocarbon group or a bivalent heterocyclic group.

2. The electrophotographic photoconductor as claimed in claim 1, wherein said trisazo pigment is a compound of formula (11):

(11)

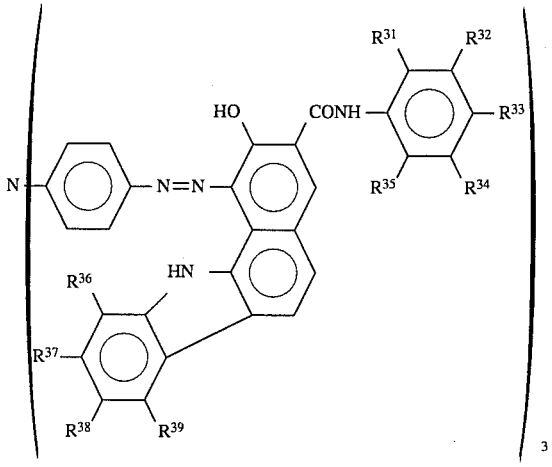

wherein $R^{31}$ to $R^{39}$ each is hydrogen, $—CH_3$, $—C_2H_5$, $—C_3H_7$, chlorine, fluorine, iodine, bromine, $CH_3—$, $C_2H_5O—$, $C_3H_7O—$, $—NO_2$, —CN, $—CF_3$ or —OH.

3. The electrophotographic photoconductor as claimed in claim 1, wherein said disazo pigment is selected from the group consisting of a compound of formula (12) and a compound of formula (13):

(12)

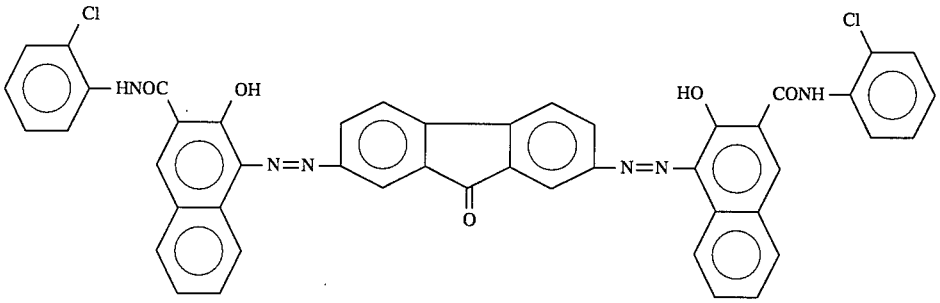

(13)

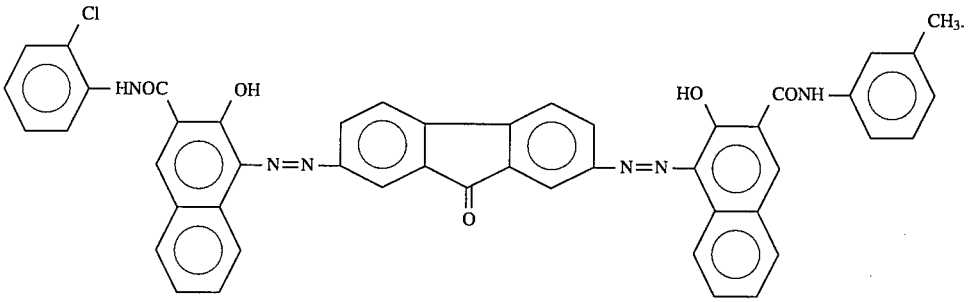

4. The electrophotographic photoconductor as claimed in claim 1, wherein the amount of said simultaneously pulverized mixture of said disazo pigment and said trisazo pigment is in a range of 0.01 to 10 parts by weight to 10 parts by weight of said binder resin.

5. The electrophotographic photoconductor as claimed in claim 1, wherein said charge transporting material is an organic positive hole transporting material and is contained in said single-layered photoconductive layer in an amount of 1 to 15 parts by weight to 10 parts by weight of said binder resin.

6. The electrophotographic photoconductor as claimed in claim 1, wherein said charge transporting material has an oxidation potential of +0.5 V (vs SCE) or more.

7. The electrophotographic photoconductor as claimed in claim 6, wherein said charge transporting material comprises at least one compound of formula (14) having an oxidation potential of +0.5 V (vs SCE) or more:

(14)

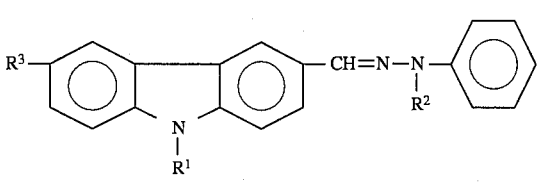

wherein $R^1$ is methyl group, ethyl group, 2-hydroxyethyl group or 2-chloroethyl group; $R^2$ is methyl group, ethyl group, benzyl group or phenyl group; and $R^3$ is hydrogen, chlorine, bromine, an alkyl group having 1 to 4 carbon atoms, an alkoxyl group having 1 to 4 carbon atoms, a dialkylamino group, or nitro group.

8. The electrophotographic photoconductor as claimed in claim 6, wherein said charge transporting material comprises at least one compound of formula (15) having an oxidation potential of +0.5 V (vs SCE) or more:

(15)

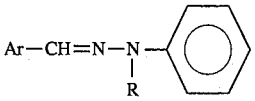

wherein

Ar is naphthalene ring, anthracene ring, styryl ring, each of which may have a substituent, pyridyl ring, furan ring, or thiophene ring; and R is an alkyl group or benzyl group.

9. The electrophotographic photoconductor as claimed in claim 6, wherein said charge transporting material comprises at least one compound of formula (17) having an oxidation potential of +0.5 V (vs SCE) or more:

(17)

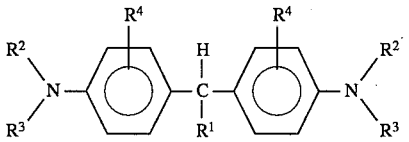

wherein $R^1$ is an alkyl group having 1 to 11 carbon atoms, a substituted or unsubstituted phenyl group, or a heterocyclic group; $R^2$ and $R^3$ may be the same or different and each is hydrogen, an alkyl group having 1 to 4 carbon atoms, a hydroxyalkyl group, a chloroalkyl group, or a substituted or unsubstituted aralkyl group, and $R^2$ and $R^3$ may form a nitrogen-containing heterocyclic ring in combination; and $R^4$ is hydrogen, an alkyl group having 1 to 4 carbon atoms, an alkoxyl group, or a halogen atom, and may be the same or different.

10. The electrophotographic photoconductor as claimed in claim 6, wherein said charge transporting material comprises at least one compound of formula (19) having an oxidation potential of +0.5 V (vs SCE) or more:

(19)

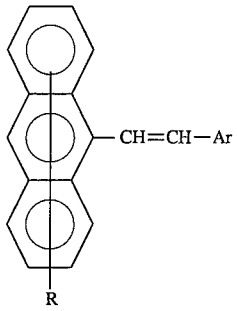

wherein

R is hydrogen or a halogen atom; Ar is phenyl group, naphthyl group, anthryl group or carbazolyl group, each of which may have a substituent.

11. The electrophotographic photoconductor as claimed in claim 6, wherein said charge transporting material comprises at least one compound of formula (22) having an oxidation potential of +0.5 V (vs SCE) or more:

(22)

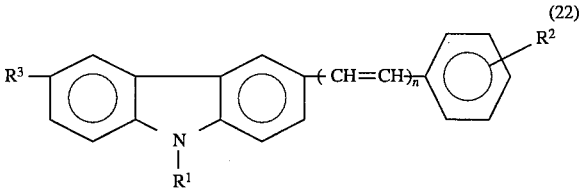

wherein $R^1$ is a lower alkyl group, a substituted or unsubstituted phenyl group, or benzyl group; $R^2$ and $R^3$ each is hydrogen, a lower alkyl group, a lower alkoxyl group, a halogen atom, nitro group, or an amino group which may have as a substituent a lower alkyl group or benzyl group; and n is an integer of 1 or 2.

12. The electrophotographic photoconductor as claimed in claim 6, wherein said charge transporting material comprises at least one compound of formula (23) having an oxidation potential of +0.5 V (vs SCE) or more:

(23)

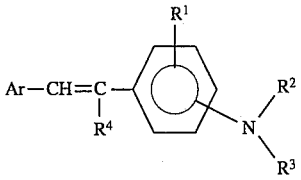

wherein $R^1$ is hydrogen, an alkyl group, an alkoxyl group or a halogen atom; $R^2$ and $R^3$ each is an alkyl group, a substituted or unsubstituted aralkyl group, or a substituted or unsubstituted aryl group; $R^4$ is hydrogen, a lower alkyl group, or a substituted or unsubstituted phenyl group; and Ar is a substituted or unsubstituted phenyl group or naphthyl group.

13. The electrophotographic photoconductor as claimed in claim 6, wherein said charge transporting material comprises at least one compound of formula (24) having an oxidation potential of +0.5 V (vs SCE) or more:

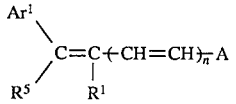

(24)

wherein n is an integer of 0 or 1; $R^1$ is hydrogen, an alkyl group or a substituted or unsubstituted phenyl group; $Ar^1$ is a substituted or unsubstituted aryl group; $R^5$ is a substituted or unsubstituted alkyl group, or a substituted or unsubstituted aryl group; and A is

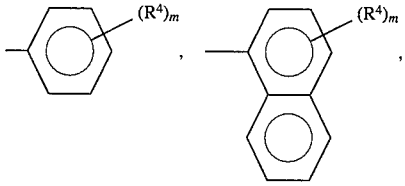

9-anthryl group or a substituted or unsubstituted N-alkylcarbazolyl group, in which $R^2$ is hydrogen, an alkyl group, an alkoxyl group, a halogen atom, or

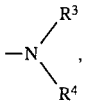

in which $R^3$ and $R^4$ each is an alkyl group, a substituted or unsubstituted aralkyl group, or a substituted or unsubstituted aryl group, and $R^3$ and $R^4$ may be the same or different and may form a ring in combination; m is an integer of 0 to 3; and when m is 2 or more, $R^2$ may be the same or different; and when n is 0, A and $R^1$ may form a ring in combination.

14. The electrophotographic photoconductor as claimed in claim 6, wherein said charge transporting material comprises at least one compound of formula (28) having an oxidation potential of +0.5 V (vs SCE) or more:

(28)

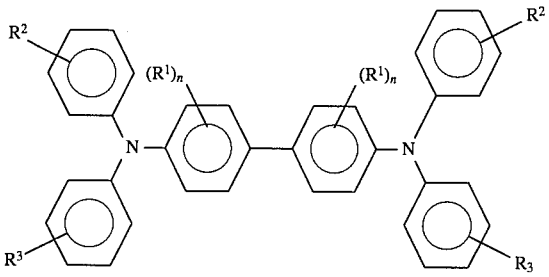

wherein $R^1$ is a lower alkyl group, a lower alkoxyl group, or a halogen atom; n is an integer of 0 to 4; and $R^2$ and $R^3$ may be the same or different, and each is hydrogen, a lower alkyl group, a lower alkoxyl group, or a halogen atom.

15. The electrophotographic photoconductor as claimed in claim 6, wherein said charge transporting material comprises at least one compound of formula (29) having an oxidation potential of +0.5 V (vs SCE) or more:

(29)

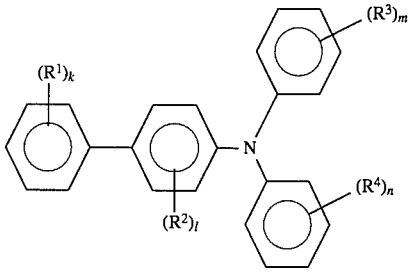

wherein $R^1$, $R^3$ and $R^4$ each is hydrogen, an amino group, a thioalkoxyl group, an aryloxy group, methylenedioxy group, a substituted or unsubstituted alkyl group, a halogen atom, or a substituted or unsubstituted aryl group; $R^2$ is hydrogen, an alkoxyl group, a substituted or unsubstituted alkyl group, or a halogen atom, provided that not all of $R^1$, $R^2$, $R^3$, and $R^4$ are hydrogen at the same time; k, l, m and n each is an integer of 1 to 4, and when each of k, l, m and n is 2, 3 or 4, $R^1$, $R^2$, $R^3$, and $R^4$ may be the same or different.

16. The electrophotographic photoconductor as claimed in claim 6, wherein said charge transporting material comprises at least one compound of formula (30) having an oxidation potential of +0.5 V (vs SCE) or more:

(30)

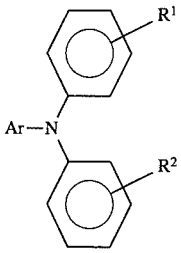

wherein

Ar is a condensed polycyclic hydrocarbon group having 18 or less carbon atoms; $R^1$ and $R^2$ may be the same or different, and each is hydrogen, a halogen atom, a substituted or unsubstituted alkyl group, an alkoxyl group, or a substituted or unsubstituted phenyl group.

17. The electrophotographic photoconductor as claimed in claim 6, wherein said charge transporting material comprises at least one compound of formula (31) having an oxidation potential of +0.5 V (vs SCE) or more:

$$A—CH=CH—Ar—CH=CH—A \quad (31)$$

wherein

Ar is a substituted or unsubstituted aromatic hydrocarbon group; and A is

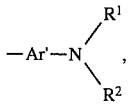

in which

Ar' is a substituted or unsubstituted aromatic hydrocarbon group; and $R^1$ and $R^2$ each is a substituted or unsubstituted alkyl group, or a substituted or unsubstituted aryl group.

18. The electrophotographic photoconductor as claimed in claim 1, wherein said simultaneously pulverized mixture is prepared by simultaneously mixing and pulverizing said disazo pigment and said trisazo pigment by use of at least one dispersing solvent selected from the group consisting of a cyclic ether and a cyclic ketone.

19. The electrophotographic photoconductor as claimed in claim 1, wherein said simultaneously pulverized mixture is prepared by simultaneously mixing and pulverizing said disazo pigment and said trisazo pigment by use of at least one dispersing solvent selected from the group consisting of tetrahydrofuran and cyclohexanone.

20. The electrophotographic photoconductor as claimed in claim 1, wherein said charge transporting material comprises an organic positive hole transporting material and an organic acceptor compound.

21. The electrophotographic photoconductor as claimed in claim 20, wherein the amount of said organic acceptor compound is in a range of 1 to 15 parts by weight to 10 parts by weight of said binder resin.

22. The electrophotographic photoconductor as claimed in claim 20, wherein said organic acceptor compound is a compound of formula (1):

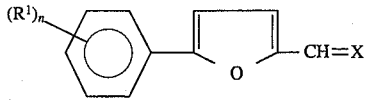

(1)

wherein $R^1$ is hydrogen, a halogen atom, a substituted or unsubstituted alkyl group, a substituted or unsubstituted phenyl group, an alkoxycarbonyl group, an N-alkylcarbamoyl group, cyano group or nitro group; n is an integer of 1 to 3; X is $$C(CN)_2,\ C(CN)(COOR^2),\ \text{or}\ C(COOR^3)_2,$$

in which $R^2$ and $R^3$ each is an alkyl group, and $R^3$ may be bonded to each other.

23. The electrophotographic photoconductor as claimed in claim 20, wherein said organic acceptor compound is a compound of formula (2):

$$Ar-CH=C(CN)-X \quad (2)$$

wherein

Ar is a substituted or unsubstituted aromatic group; and X is cyano group or an alkoxycarbonyl group.

24. The electrophotographic photoconductor as claimed in claim 20, wherein said organic acceptor compound is a compound of formula (3):

$$Ar-CH=C(COOR)_2 \quad (3)$$

wherein

Ar is a substituted or unsubstituted aromatic group; and R is an alkyl group, and R may be bonded to each other to form a ring.

25. The electrophotographic photoconductor as claimed in claim 20, wherein said organic acceptor compound is a compound of formula (4):

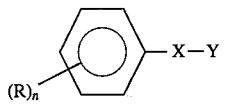

(4)

wherein

X is sulfur or selenium; Y is a substituted or unsubstituted alkyl group, an aryl group, or cyano group; R is a substituted or unsubstituted alkyl group, a substituted or unsubstituted aryl group, cyano group, nitro group, a halogen atom, or hydrogen; and n is an integer of 1 to 3.

26. The electrophotographic photoconductor as claimed in claim 20, wherein said organic acceptor compound is a compound of formula (5):

$$Ar-CH=CHNO_2 \quad (5)$$

wherein

Ar is a substituted or unsubstituted aromatic group.

27. The electrophotographic photoconductor as claimed in claim 20, wherein said organic acceptor compound is a compound of formula (6):

$$R^1-\underset{\underset{O}{\|}}{C}-CH=CH-R^2 \quad (6)$$

wherein $R^1$ and $R^2$ each is a substituted or unsubstituted phenyl group, a substituted or unsubstituted naphthyl group, or a heterocyclic aromatic group.

28. The electrophotographic photoconductor as claimed in claim 20, wherein said organic acceptor compound is a compound of formula (7):

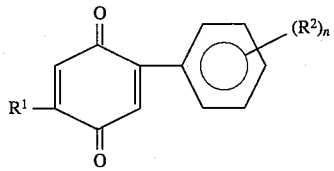

(7)

wherein $R^1$ is hydrogen, a halogen atom, an alkyl group, or a substituted or unsubstituted phenyl group; $R^2$ is hydrogen, a substituted or unsubstituted alkyl group, a substituted or unsubstituted phenyl group, a halogen atom, an alkoxycarbonyl group, an N-alkylcarbamoyl group, cyano group, or nitro group; and n is an integer of 1 to 3.

29. The electrophotographic photoconductor as claimed in claim 20, wherein said organic acceptor compound is a compound of formula (8):

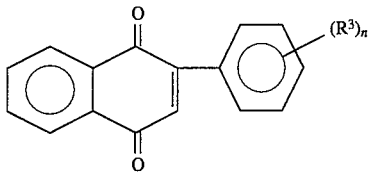

(8)

wherein $R^3$ is hydrogen, a substituted or unsubstituted alkyl group, a substituted or unsubstituted phenyl group, a halogen atom, an alkoxycarbonyl group, an N-alkylcarbamoyl group, cyano group, or nitro group; and n is an integer of 1 to 3.

30. The electrophotographic photoconductor as claimed in claim 20, wherein said organic acceptor compound is a compound of formula (9):

$$R^1-C(CN)=CH-R^2 \quad (9)$$

wherein $R^1$ and $R^2$ each is a substituted or unsubstituted phenyl group, a substituted or unsubstituted polycyclic aromatic group, or a substituted or unsubstituted heterocyclic group.

31. The electrophotographic photoconductor as claimed in claim 20, wherein said organic acceptor compound is a compound of formula (10):

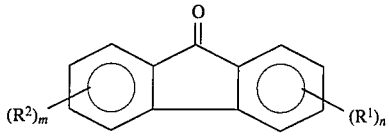

(10)

wherein $R^1$ and $R^2$ each is hydrogen, a halogen atom, a substituted or unsubstituted alkyl group, a substituted or unsubstituted aryl group, a substituted or unsubstituted heterocyclic group, an alkoxycarbonyl group, an aryloxycarbonyl group, an N-alkylcarbamoyl group, an alkylcarbonyl group, an arylcarbonyl group, cyano group, nitro group, an alkoxyl group, an aryloxy group, an amino group, or a vinyl group of

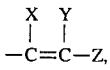

in which

X is hydrogen or an alkyl group, and at least one of Y or Z is a substituted or unsubstituted phenyl group and the other is hydrogen; and n and m each is an integer of 1 to 3.

32. The electrophotographic photoconductor as claimed in claim 20, wherein said organic acceptor compound is a compound of formula (11):

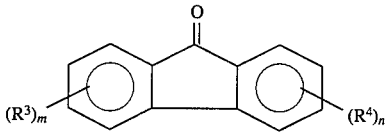

(11)

wherein $R^3$ and $R^4$ each is hydrogen, a halogen atom, a substituted or unsubstituted alkyl group, a substituted or unsubstituted aryl group, a substituted or unsubstituted heterocyclic group, an alkoxycarbonyl group, an aryloxycarbonyl group, an N-alkylcarbamoyl group, an alkylcarbonyl group, an arylcarbonyl group, cyano group, nitro group, an alkoxyl group, an aryloxy group, an amino group, or a vinyl group of

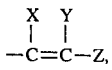

in which

X is hydrogen or an alkyl group, and at least one of Y or Z is a substituted or unsubstituted phenyl group and the other is hydrogen; and n and m each is an integer of 1 to 3.

33. The electrophotographic photoconductor as claimed in claim 20, wherein said organic acceptor compound is a compound of formula (12):

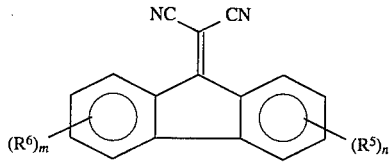

(12)

wherein $R^5$ and $R^6$ each is hydrogen, a halogen atom, a substituted or unsubstituted alkyl group, a substituted or unsubstituted aryl group, a substituted or unsubstituted heterocyclic group, an alkoxycarbonyl group, an aryloxycarbonyl group, an N-alkylcarbamoyl group, an alkylcarbonyl group, an arylcarbonyl group, cyano group, nitro group, an alkoxyl group, an aryloxy group, an amino group, or a vinyl group of

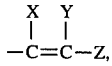

in which

X is hydrogen or an alkyl group, and at least one of Y or Z is a substituted or unsubstituted phenyl group and the other is hydrogen; and n and m each is an integer of 1 to 3.

34. The electrophotographic photoconductor as claimed in claim 20, wherein said organic acceptor compound is a compound of formula (13):

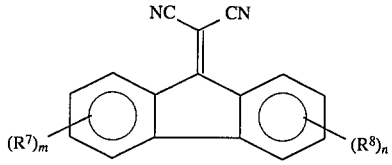

(13)

wherein $R^7$ and $R^8$ each is hydrogen, a halogen atom, a substituted or unsubstituted alkyl group, a substituted or unsubstituted aryl group, a substituted or unsubstituted heterocyclic group, an alkoxycarbonyl group, an aryloxycarbonyl group, an N-alkylcarbamoyl group, an alkylcarbonyl group, an arylcarbonyl group, cyano group, nitro group, an alkoxyl group, an aryloxy group, an amino group, or a vinyl group of

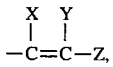

in which

X is hydrogen or an alkyl group, and at least one of Y or Z is a substituted or unsubstituted phenyl group and the other is hydrogen; and n and m each is an integer of 1 to 3.

35. The electrophotographic photoconductor as claimed in claim 20, wherein said organic acceptor compound is a compound of formula (14):

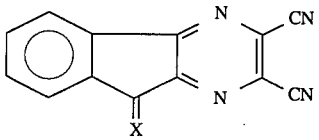

(14)

wherein

X is O or N—R, in which R is a substituted or unsubstituted phenyl group, or a substituted or unsubstituted naphthyl group.

36. The electrophotographic photoconductor as claimed in claim 20, wherein said organic acceptor compound is a compound of formula (A):

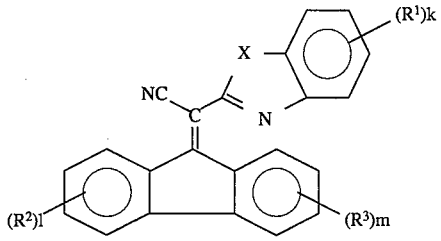

(A)

wherein $R^1$, $R^2$, and $R^3$ each is hydrogen, a substituted or unsubstituted alkyl group, an alkoxyl group, a substituted or unsubstituted alkoxycarbonyl group, a substituted or unsubstituted acyl group, a substituted or unsubstituted sulfonyl group, a substituted or unsubstituted sulfonamide group, a substituted or unsubstituted carbamoyl group, a halogen atom, cyano group, or nitro group, and $R^1$ may form a ring in combination with other atoms; k, l and m each is an integer of 1 to 4; and X is oxygen, sulfur or selenium.

37. The electrophotographic photoconductor as claimed in claim 20, wherein said organic acceptor compound is a compound of formula (B):

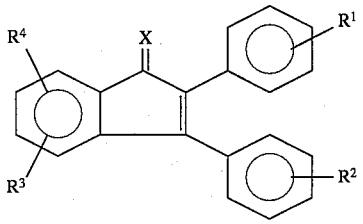

(B)

wherein $R^1$, $R^2$, $R^3$ and $R^4$ may be the same or different, and each is hydrogen, a halogen atom, a substituted or unsubstituted alkyl group, cyano group, or nitro group; and X is

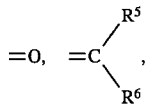

in which $R^5$ and $R^6$ may be the same or different and each is hydrogen, a halogen atom, cyano group, a substituted or unsubstituted aromatic group, or —$COOR^7$ in which $R^7$ is a substituted or unsubstituted alkyl group, or a substituted or unsubstituted aromatic group; or N—$R^8$ in which $R^8$ is a substituted or unsubstituted alkyl group, a substituted or unsubstituted aromatic group, or cyano group.

38. The electrophotographic photoconductor as claimed in claim 20, wherein said organic acceptor compound is a compound of formula (C):

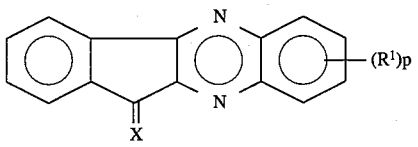

(C)

wherein $R^1$ may be the same or different, and is a halogen atom, nitro group, or a substituted or unsubstituted alkyl group; X is =O, N—$R^2$, in which $R^2$ is a substituted or unsubstituted phenyl group, or a substituted or unsubstituted naphthyl group, or

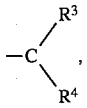

in which $R^3$ and $R^4$ may be the same or different and each is hydrogen, cyano group, a substituted or unsubstituted alkoxycarbonyl group, a substituted or unsubstituted phenoxycarbonyl group, a substituted or unsubstituted phenyl group, or a substituted or unsubstituted naphthyl group; and p is an integer of 0 to 4, provided that when X is oxygen, p is an integer of 1 to 4.

39. The electrophotographic photoconductor as claimed in claim 20, wherein said organic acceptor compound has a reduction potential in a range of −0.2 to −1.2 V (vs SCE).

40. The electrophotographic photoconductor as claimed in claim 1, wherein said photoconductive layer further comprises an antioxidant.

41. The electrophotographic photoconductor as claimed in claim 40, wherein said antioxidant is contained in said photoconductive layer in an amount of 0.01 to 2 parts by weight to 10 parts by weight of said binder resin.

42. The electrophotographic photoconductor as claimed in claim 40, said antioxidant comprises a compound of formula (I):

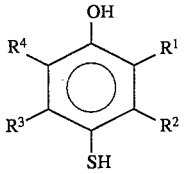

(I)

wherein $R^1$, $R^2$, $R^3$ and $R^4$ each is hydrogen, a halogen atom, hydroxyl group, a substituted or unsubstituted alkyl group, a substituted or unsubstituted alkenyl group, a substituted or unsubstituted aryl group, a substituted or unsubstituted cycloalkyl group, a substituted or unsubstituted alkoxyl group, a substituted or unsubstituted aryloxy group, a substituted or unsubstituted alkylthio group, a substituted or unsubstituted arylthio group, a substituted amino group, imino group, a heterocyclic group, a sulfoxide group, a sulfonyl group, an acyl group, or an azo group.

43. The electrophotographic photoconductor as claimed in claim 40, said antioxidant comprises a compound of formula (II):

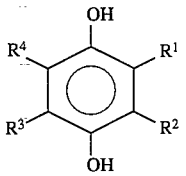

(II)

wherein $R^1$, $R^2$, $R^3$ and $R^4$ each is hydrogen, a halogen atom, a substituted or unsubstituted alkyl group, a substituted or unsubstituted alkenyl group, a substituted or unsubstituted cycloalkyl group, a substituted or unsubstituted alkoxyl group, a substituted or unsubstituted aryloxy group, an alkylthio group, an arylthio group, an alkylamino group, an arylamino group, an acyl group, an alkylacylamino group, an arylacylamino group, an alkylcarbamoyl group, an arylcarbamoyl group, an alkylsulfonamide group, an arylsulfonamide group, an alkylsulfamoyl group, an arylsulfamoyl group, an alkylsulfonyl group, an arylsulfonyl group, an alkyloxycarbonyl group, an aryloxycarbonyl group, an alkylacyloxy group, an arylacyloxy group, a silyl group, or a heterocyclic group, provided that at least one of $R^1$, $R^2$, $R^3$ or $R^4$ is a group having 4 or more carbon atoms.

44. The electrophotographic photoconductor as claimed in claim 40, said antioxidant comprises a compound of formula (III):

(III)

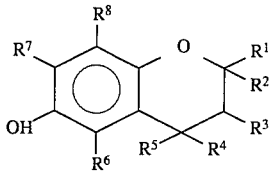

wherein $R^1$ to $R^8$ each is hydrogen, a hydroxyl group, a halogen atom, a substituted or unsubstituted alkyl group, a substituted or unsubstituted alkenyl group, a substituted or unsubstituted aryl group, a substituted or unsubstituted cycloalkyl group, a substituted or unsubstituted alkoxyl group, a substituted or unsubstituted aryloxy group, a substituted or unsubstituted amino group, a substituted or unsubstituted imino group, a substituted or unsubstituted heterocyclic group, a substituted or unsubstituted alkylthio group, a substituted or unsubstituted arylthio group, a substituted or unsubstituted acyl group, a substituted or unsubstituted sulfonyl group, a substituted or unsubstituted phosphonyl group, or a substituted or unsubstituted carbamoyl group.

45. The electrophotographic photoconductor as claimed in claim 40, said antioxidant comprises a compound of formula (IV):

(IV)

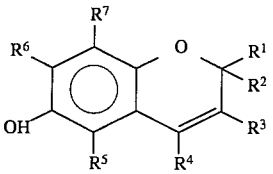

wherein $R^1$ to $R^7$ each is hydrogen, a hydroxyl group, a halogen atom, a substituted or unsubstituted alkyl group, a substituted or unsubstituted alkenyl group, a substituted or unsubstituted aryl group, a substituted or unsubstituted cycloalkyl group, a substituted or unsubstituted alkoxyl group, a substituted or unsubstituted aryloxy group, a substituted or unsubstituted amino group, a substituted or unsubstituted imino group, a substituted or unsubstituted heterocyclic group, a substituted or unsubstituted alkylthio group, a substituted or unsubstituted arylthio group, a substituted or unsubstituted acyl group, a substituted or unsubstituted sulfonyl group, a substituted or unsubstituted phosphonyl group, or a substituted or unsubstituted carbamoyl group.

46. The electrophotographic photoconductor as claimed in claim 40, said antioxidant comprises a compound of formula (V):

(V)

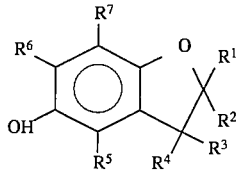

wherein $R^1$ to $R^7$ each is hydrogen, a hydroxyl group, a halogen atom, a substituted or unsubstituted alkyl group, a substituted or unsubstituted alkenyl group, a substituted or unsubstituted aryl group, a substituted or unsubstituted cycloalkyl group, a substituted or unsubstituted alkoxyl group, a substituted or unsubstituted aryloxy group, a substituted or unsubstituted amino group, a substituted or unsubstituted imino group, a substituted or unsubstituted heterocyclic group, a substituted or unsubstituted alkylthio group, a substituted or unsubstituted arylthio group, a substituted or unsubstituted acyl group, a substituted or unsubstituted sulfonyl group, a substituted or unsubstituted phosphonyl group, or a substituted or unsubstituted carbamoyl group.

47. The electrophotographic photoconductor as claimed in claim 40, said antioxidant comprises a compound of formula (VI):

(VI)

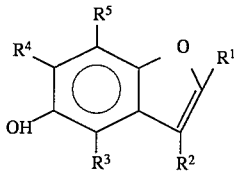

wherein $R^1$ to $R^6$ each is hydrogen, a hydroxyl group, a halogen atom, a substituted or unsubstituted alkyl group, a substituted or unsubstituted alkenyl group, a substituted or unsubstituted aryl group, a substituted or unsubstituted cycloalkyl group, a substituted or unsubstituted alkoxyl group, a substituted or unsubstituted aryloxy group, a substituted or unsubstituted amino group, a substituted or unsubstituted imino group, a substituted or unsubstituted heterocyclic group, a substituted or unsubstituted alkylthio group, a substituted or unsubstituted arylthio group, a substituted or unsubstituted acyl group, a substituted or unsubstituted sulfonyl group, a substituted or unsubstituted phosphonyl group, or a substituted or unsubstituted carbamoyl group.

48. The electrophotographic photoconductor as claimed in claim 40, said antioxidant comprises a compound of formula (VII):

(VII)

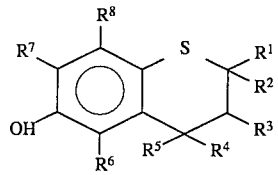

wherein $R^1$ to $R^8$ each is hydrogen, a hydroxyl group, a halogen atom, a substituted or unsubstituted alkyl group, a substituted or unsubstituted alkenyl group, a substituted or unsubstituted aryl group, a substituted or unsubstituted cycloalkyl group, a substituted or unsubstituted alkoxyl group, a substituted or unsubstituted aryloxy group, a substituted or unsubstituted amino group, a substituted or unsubstituted imino group, a substituted or unsubstituted heterocyclic group, a substituted or unsubstituted alkylthio group, a substituted or unsubstituted arylthio group, a substituted or unsubstituted acyl group, a substituted or unsubstituted sulfonyl group, a substituted or unsubstituted phosphonyl group, or a substituted or unsubstituted carbamoyl group.

49. The electrophotographic photoconductor as claimed in claim 40, said antioxidant comprises at least one of a compound of formula (VIII) or a compound of formula (IX):

(VIII)

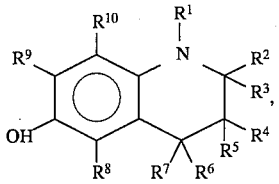

(IX)

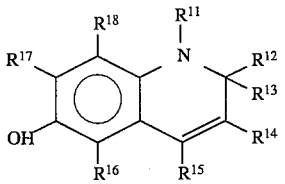

wherein $R^1$ to $R^{10}$ and $R^{11}$ to $R^{18}$ each is hydrogen, a halogen atom, a hydroxyl group, a substituted or unsubstituted alkyl group, a substituted or unsubstituted alkenyl group, a substituted or unsubstituted aryl group, a substituted or unsubstituted cycloalkyl group, a substituted or unsubstituted alkoxyl group, a substituted or unsubstituted aryloxy group, a substituted amino group, an imino group, a heterocyclic group, a substituted or unsubstituted alkylthio group, a substituted or unsubstituted arylthio group, a sulfoxide group, a sulfonyl group, an acyl group, or an azo group.

50. The electrophotographic photoconductor as claimed in claim 40, said antioxidant comprises at least one of a compound of formula (X) or a compound of formula (XI):

(X)

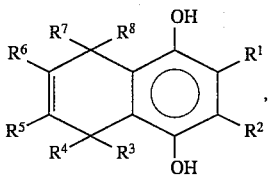

(XI)

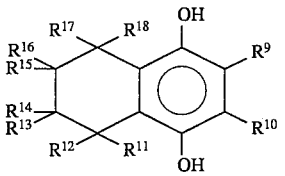

wherein $R^1$ to $R^8$ and $R^9$ to $R^{18}$ each is hydrogen, a halogen atom, a hydroxyl group, a substituted or unsubstituted alkyl group, a substituted or unsubstituted alkenyl group, a substituted or unsubstituted aryl group, a substituted or unsubstituted cycloalkyl group, a substituted or unsubstituted alkoxyl group, a substituted or unsubstituted aryloxy group, a substituted amino group, an imino group, a heterocyclic group, a substituted or unsubstituted alkylthio group, a substituted or unsubstituted arylthio group, a sulfoxide group, a sulfonyl group, an acyl group, or an azo group.

51. The electrophotographic photoconductor as claimed in claim 40, said antioxidant comprises a compound of formula (XII):

(XII)

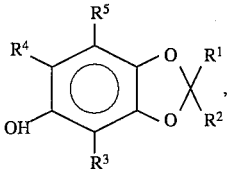

wherein $R^1$ to $R^5$ each is hydrogen, a halogen atom, a hydroxyl group, a substituted or unsubstituted alkyl group, a substituted or unsubstituted alkenyl group, a substituted or unsubstituted aryl group, a substituted or unsubstituted cycloalkyl group, a substituted or unsubstituted alkoxyl group, a substituted or unsubstituted aryloxy group, a substituted amino group, an imino group, a heterocyclic group, a substituted or unsubstituted alkylthio group, a substituted or unsubstituted arylthio group, a sulfoxide group, a sulfonyl group, an acyl group, or an azo group.

52. The electrophotographic photoconductor as claimed in claim 1, wherein said at least one disazo pigment of the formula (1) and said at least one trisazo pigment of the formula (2) are used in a ratio of:

$$\frac{\text{(disazo pigment)}}{\text{(disazo pigment)} + \text{(trisazo pigment)}} = 0.01 \text{ to } 0.99.$$

53. The electrophotographic photoconductor as claimed in claim 52, wherein said ratio is:

$$\frac{\text{(disazo pigment)}}{\text{(disazo pigment)} + \text{(trisazo pigment)}} = 0.1 \text{ to } 0.9.$$

54. The electrophotographic photoconductor as claimed in claim 1, wherein said single-layered photoconductive layer has a thickness of from 5 to 100 μm.

55. The electrophotographic photoconductor as claimed in claim 54, wherein said single-layered photosensitive layer has a thickness of from 10 to 50 μm.

* * * * *